US010863872B2

(12) United States Patent
Borke

(10) Patent No.: US 10,863,872 B2
(45) **Date of Patent: *Dec. 15, 2020**

(54) HANDS-FREE FLOWABLE MATERIAL DISPENSERS AND RELATED METHODS

(71) Applicant: GPCP IP HOLDINGS LLC, Atlanta, GA (US)

(72) Inventor: Brian S. Borke, Appleton, WI (US)

(73) Assignee: GPCP Holdings LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/580,315

(22) Filed: Sep. 24, 2019

(65) Prior Publication Data

US 2020/0015639 A1 Jan. 16, 2020

Related U.S. Application Data

(63) Continuation of application No. 15/640,153, filed on Jun. 30, 2017, now Pat. No. 10,420,444, which is a (Continued)

(51) Int. Cl.
*A47K 10/36* (2006.01)
*A47K 5/12* (2006.01)

(52) U.S. Cl.
CPC ..... *A47K 10/3618* (2013.01); *A47K 5/1207* (2013.01); *A47K 10/3625* (2013.01); *A47K 5/1217* (2013.01); *A47K 2010/3668* (2013.01)

(58) Field of Classification Search
CPC ..... A47K 10/3618; A47K 10/3625; A47K 2010/3668; A47K 5/1207; A47K 5/1217
See application file for complete search history.

(56) References Cited

U.S. PATENT DOCUMENTS 2,266,958 A 12/1941 Corbin
2,278,029 A 3/1942 Walsh et al.
(Continued)

FOREIGN PATENT DOCUMENTS

EP 0383617 A1 8/1990
JP 2004313442 A 11/2004
(Continued)

OTHER PUBLICATIONS

International Search Report and Written Opinion of the International Searching Authority for International Patent Application No. PCT/US2016/068385, dated Apr. 13, 2017.
(Continued)

*Primary Examiner* — David P Angwin
*Assistant Examiner* — Bob Zadeh
(74) *Attorney, Agent, or Firm* — Eversheds Sutherland (US) LLP

(57) ABSTRACT

A flowable material dispenser for dispensing flowable material from a container having a pump may include a housing, an actuator, a motor, and a drive assembly. The actuator may be disposed within the housing and configured to translate relative to the housing between a first position and a second position during a dispense cycle. The actuator may be configured to move the pump between an extended configuration and a compressed configuration to dispense the flowable material as the actuator translates between the first position and the second position during the dispense cycle. The drive assembly may be coupled to the actuator and the motor and configured to translate the actuator between the first position and the second position at a varying rate of translation during the dispense cycle. The varying rate of translation may vary relative to a rate of rotation of the motor and follow a non-sinusoidal waveform.

21 Claims, 47 Drawing Sheets

Related U.S. Application Data continuation-in-part of application No. 15/389,208, filed on Dec. 22, 2016, now Pat. No. 10,617,266.

(60) Provisional application No. 62/272,881, filed on Dec. 30, 2015.

(56) References Cited

U.S. PATENT DOCUMENTS

| | | | | |
|---|---|---|---|---|
| 3,575,328 | A | 4/1971 | Jaspersen | |
| 4,712,461 | A | 12/1987 | Rasmussen | |
| 5,119,973 | A | 6/1992 | Miller et al. | |
| 5,255,822 | A * | 10/1993 | Mease | A47K 5/1202 222/113 |
| 5,507,413 | A | 4/1996 | Chen | |
| 6,036,056 | A | 3/2000 | Lee et al. | |
| 6,209,752 | B1 | 4/2001 | Mitchell et al. | |
| 6,267,460 | B1 | 7/2001 | Gaide et al. | |
| 6,390,329 | B1 * | 5/2002 | Maddox | A47K 5/1202 222/207 |
| 6,412,679 | B2 | 7/2002 | Formon et al. | |
| 6,419,136 | B2 | 7/2002 | Formon et al. | |
| 6,568,561 | B2 | 5/2003 | Studer et al. | |
| 6,742,689 | B2 | 6/2004 | Formon et al. | |
| 6,745,927 | B2 | 6/2004 | Formon et al. | |
| 6,766,977 | B2 | 7/2004 | Denen et al. | |
| 6,830,210 | B2 | 12/2004 | Formon et al. | |
| 6,929,150 | B2 | 8/2005 | Muderlak et al. | |
| 7,237,744 | B2 | 7/2007 | Morris et al. | |
| 7,341,170 | B2 | 3/2008 | Boone | |
| 7,347,134 | B2 | 3/2008 | Lewis et al. | |
| 7,611,030 | B2 | 11/2009 | Reynolds et al. | |
| 7,681,765 | B2 | 3/2010 | Muderlak | |
| 7,845,593 | B2 | 12/2010 | Formon et al. | |
| 7,887,005 | B2 | 2/2011 | Troutman et al. | |
| 8,079,540 | B2 | 12/2011 | Troutman et al. | |
| 8,079,541 | B2 | 12/2011 | Troutman et al. | |
| 8,079,542 | B2 | 12/2011 | Troutman et al. | |
| 8,079,543 | B2 | 12/2011 | Troutman et al. | |
| 8,083,170 | B2 | 12/2011 | Troutman et al. | |
| 8,321,075 | B2 | 7/2012 | Troutman et al. | |
| 8,321,076 | B2 | 7/2012 | Troutman et al. | |
| 8,240,594 | B2 | 8/2012 | Troutman et al. | |
| 8,261,941 | B2 * | 9/2012 | Woo | A47K 5/1215 222/52 |
| 8,261,942 | B2 * | 9/2012 | Chen | G01F 11/029 222/63 |
| 8,261,950 | B2 * | 9/2012 | Cittadino | B05B 11/3047 222/321.7 |
| 8,336,803 | B2 | 12/2012 | Troutman et al. | |
| 8,469,244 | B2 | 6/2013 | Helf et al. | |
| 8,561,933 | B2 | 10/2013 | Troutman et al. | |
| 8,632,030 | B2 | 1/2014 | Troutman et al. | |
| 8,943,939 | B2 | 2/2015 | Sahlberg | |
| 9,282,855 | B2 | 3/2016 | Troutman et al. | |
| 9,457,951 | B2 * | 10/2016 | Carpenter | B65D 83/267 |
| 9,480,370 | B2 | 11/2016 | Troutman et al. | |
| 2003/0006246 | A1 * | 1/2003 | Studer | A47K 5/1209 222/52 |
| 2005/0013708 | A1 | 1/2005 | Peeler et al. | |
| 2006/0076366 | A1 | 4/2006 | Furner et al. | |
| 2007/0000941 | A1 | 1/2007 | Hadden et al. | |
| 2007/0119873 | A1 | 5/2007 | Boll et al. | |
| 2009/0101671 | A1 * | 4/2009 | Cittadino | A47K 5/1202 222/23 |
| 2009/0266842 | A1 * | 10/2009 | Snodgrass | A47K 5/1217 222/52 |
| 2010/0006597 | A1 | 1/2010 | Reynolds et al. | |
| 2010/0089939 | A1 | 8/2010 | Morris et al. | |
| 2010/0288788 | A1 * | 11/2010 | Ophardt | A47K 5/1207 222/1 |
| 2011/0017778 | A1 * | 1/2011 | Kadiks | A47K 5/1217 222/190 |
| 2012/0223625 | A1 * | 9/2012 | Klemm | H02K 11/30 310/68 R |
| 2012/0241470 | A1 | 9/2012 | Snodgrass et al. | |
| 2013/0264355 | A1 | 10/2013 | Jodoin | |
| 2014/0124531 | A1 | 5/2014 | Muderlak et al. | |
| 2014/0209631 | A1 * | 7/2014 | Lin | A47K 5/1217 222/52 |
| 2015/0157176 | A1 | 6/2015 | Muderlak et al. | |
| 2015/0238053 | A1 | 8/2015 | Yang et al. | |
| 2015/0359391 | A1 | 12/2015 | Ophardt et al. | |
| 2016/0052007 | A1 | 2/2016 | Fuller | |
| 2016/0287035 | A1 | 10/2016 | Troutman et al. | |
| 2017/0055787 | A1 * | 3/2017 | Borke | A47K 10/424 |
| 2017/0112332 | A1 * | 4/2017 | Ciavarella | F04B 17/03 |
| 2017/0136479 | A1 | 5/2017 | Ophardt et al. | |
| 2017/0296004 | A1 | 10/2017 | Borke | |
| 2018/0325330 | A1 | 11/2018 | Gottschalk | |
| 2018/0325331 | A1 | 11/2018 | Gottschalk | |

FOREIGN PATENT DOCUMENTS

| | | | |
|---|---|---|---|
| WO | 90/12530 | A1 | 11/1990 |
| WO | 2013/019392 | A1 | 2/2013 |

OTHER PUBLICATIONS

International Search Report and Written Opinion of the International Searching Authority for International Application No. PCT/US2018/037811, dated Mar. 22, 2019.

* cited by examiner

HANDS-FREE FLOWABLE MATERIAL DISPENSERS AND RELATED METHODS

CROSS-REFERENCE TO RELATED APPLICATIONS

This application is a continuation of U.S. application Ser. No. 15/640,153, filed Jun. 30, 2017, which is a continuation-in-part of U.S. application Ser. No. 15/389,208, filed Dec. 22, 2016, which claims the benefit of U.S. Provisional Application No. 62/272,881, filed Dec. 30, 2015, all of which are incorporated herein by reference.

FIELD OF THE DISCLOSURE

The present disclosure relates generally to product dispensers and more particularly to hands-free sheet product dispensers and related methods for dispensing individual sheets from a roll of sheet product as well as hands-free flowable material dispensers and related methods for dispensing flowable material from a container.

BACKGROUND OF THE DISCLOSURE

Various types of sheet product dispensers are known in the art, including dispensers configured to dispense individual sheets from a roll of sheet product disposed therein. Such dispensers may be mechanical in nature, requiring a user to manually impart a driving force to either the dispenser or the sheet product in order to carry out a dispense cycle. Alternatively, such dispensers may be automated in nature, including electronic dispensing mechanisms and control systems configured to carry out a dispense cycle without requiring a user to impart any driving force to the dispenser or the sheet product.

Certain dispensers, which may be mechanical or automated, may be referred to as "hands-free" dispensers, meaning that a user may obtain an individual sheet of sheet product from the dispenser without having to touch the dispenser itself. Such hands-free dispensers may be configured to dispense individual sheets from a roll of non-perforated sheet product. Alternatively, such hands-free dispensers may be configured to dispense individual sheets from a roll of perforated sheet product.

According to one configuration, a mechanical hands-free dispenser may be configured to present a "tail" portion (i.e., an exposed end portion) of a roll of non-perforated sheet product disposed within a housing of the dispenser. Specifically, the dispenser may be configured to present the tail portion extending from a dispenser outlet defined in the housing. The dispenser may include a mechanical cutting mechanism, such as a spring-loaded drum and a cutting knife, disposed within the housing and configured to perforate the sheet product during a dispense cycle. In use of the dispenser, a user may grasp and pull the tail portion to impart a driving force sufficient to advance the sheet product further out of the dispenser outlet and to actuate the mechanical cutting mechanism to perforate the sheet product, thereby defining an individual sheet to be separated by the user along a perforation line. In this manner, a length of the individual sheet obtained may be equal to a sum of a length of the tail portion (a "tail length") and a length over which the user pulls the tail portion (a "pull length"). Upon separation of the individual sheet, a new tail portion remains extending from the dispenser outlet for use in a subsequent dispense cycle. Although this configuration may provide adequate dispensing of sheet product in many applications, the dispenser may present certain drawbacks in other applications, including: a high pull force required to advance the sheet product and to actuate the mechanical cutting mechanism, a high paper strength required to withstand the required pull force, a large housing required to accommodate the mechanical cutting mechanism disposed therein, a limited range of variation of a ratio of the tail length to the pull length, a limited amount of energy that may be generated by the driving force imparted by the user during a dispense cycle, and challenges in reliably perforating the sheet product and presenting a tail portion, particularly in view of the limited amount of energy generated.

According to another configuration, an automated hands-free dispenser may be configured to present a tail portion of a roll of non-perforated sheet product disposed within a housing of the dispenser. Specifically, the dispenser may be configured to present the tail portion extending from a dispenser outlet defined in the housing, and the dispenser may include a tear bar positioned about the dispenser outlet. The dispenser also may include an electronic dispensing mechanism disposed within the housing and configured to guide the sheet product from the roll to the dispenser outlet during a dispense cycle. In use of the dispenser, a user may grasp and pull the tail portion against the tear bar to separate an individual sheet of sheet product from the roll. In this manner, a length of the individual sheet obtained may be equal to a length of the tail portion (a "tail length"). Upon separation of the individual sheet, the electronic dispensing mechanism may be activated to carry out a dispense cycle to advance the roll of sheet product and present a new tail portion extending from the dispenser outlet. Although this configuration may provide adequate dispensing of sheet product in many applications, the dispenser may present certain drawbacks in other applications, including: a high paper strength required to withstand the required dispensing forces generated by the electronic dispensing mechanism, a large housing required to accommodate the electronic dispensing mechanism disposed therein, a complexity of the electronic dispensing mechanism and associated control system, and challenges in reliably separating an individual sheet via the tear bar and presenting a tail portion.

According to another configuration, a mechanical hands-free dispenser may be configured to present a tail portion of a roll of perforated sheet product disposed within a housing of the dispenser. Specifically, the dispenser may be configured to present the tail portion extending from a dispenser outlet defined in the housing such that a leading perforation line (i.e., a perforation line closest to the tail portion and defining a leading individual sheet) is disposed within the housing. The dispenser may include a mechanical dispensing mechanism, such as one or more rollers, disposed within the housing and configured to guide the sheet product from the roll to the dispenser outlet during a dispense cycle. In use of the dispenser, a user may grasp and pull the tail portion to impart a driving force sufficient to advance the sheet product through the mechanical dispensing mechanism and further out of the dispenser outlet. The user continues to pull the tail portion until the leading perforation line is disposed outside of the housing, at which point tension applied along the perforation line, due to friction between a next individual sheet and the mechanical dispensing mechanism, is sufficient to separate the leading individual sheet. In this manner, a length of the individual sheet obtained may be equal to a sum of a length of the tail portion (a "tail length") and a length over which the user pulls the tail portion (a "pull length"). Upon separation of the leading individual sheet, a new tail portion remains extending from the dispenser outlet for use in a subsequent dispense cycle. Although this configuration may provide adequate dispensing of sheet product in many applications, the dispenser may present certain drawbacks in other applications, including: a high pull force required to advance the sheet product through the mechanical dispensing mechanism, a high paper strength required to withstand the required pull force, a limited range of variation of a ratio of the tail length to the pull length, a limited amount of energy that may be generated by the driving force imparted by the user during a dispense cycle, and challenges in reliably separating the leading individual sheet with the leading perforation line disposed outside of the housing and presenting a tail portion, particularly in view of the limited amount of energy generated.

Various types of flowable material dispensers are known in the art, including dispensers configured to dispense flowable material from a container having a reservoir and a pump. Such dispensers may be automated in nature, including electronic dispensing mechanisms and control systems configured to carry out a dispense cycle without requiring a user to impart any driving force to the dispenser. According to certain configurations, an automated flowable material dispenser may have an electronic dispensing mechanism that includes an actuator for engaging and actuating a pump of a container during a dispense cycle. The actuator may be moved by a drive assembly that is driven by a motor of the dispenser. In certain configurations, a required torque exerted by the motor to drive the drive assembly may vary widely during the dispense cycle, and a peak required torque may be relatively high compared to an average required torque over the dispense cycle. As a result, the dispenser may require a relatively large motor in order to produce the peak required torque, which may affect the size and cost of the dispenser. Further, operating the motor may draw a relatively high peak current, which may affect wear on batteries used to power the motor and limit the usefulness of the batteries at lower voltages.

There is thus a desire for improved hands-free sheet product dispensers and related methods for dispensing individual sheets from a roll of sheet product, as well as improved hands-free flowable material dispensers for dispensing flowable material from a container having a pump, to address one or more of the potential drawbacks discussed above.

SUMMARY OF THE DISCLOSURE

In one aspect, the present disclosure provides a flowable material dispenser for dispensing flowable material from a container having a reservoir and a pump. The flowable material dispenser may include a housing, an actuator, a motor, and a drive assembly. The housing may be configured to receive the container therein. The actuator may be disposed within the housing and configured to translate relative to the housing between a first position and a second position during a dispense cycle. The actuator may be configured to move the pump between an extended configuration and a compressed configuration to dispense the flowable material as the actuator translates between the first position and the second position during the dispense cycle. The motor may be disposed within the housing. The drive assembly may be coupled to the actuator and the motor. The drive assembly may be configured to translate the actuator between the first position and the second position at a varying rate of translation during the dispense cycle. The varying rate of translation may vary relative to a rate of rotation of the motor and follow a non-sinusoidal waveform.

In another aspect, the present disclosure provides a method of dispensing flowable material from a container using a flowable material dispenser. The method may include the step of providing the flowable material dispenser including a housing, an actuator, a motor, and a drive assembly. The actuator may be disposed within the housing and configured to translate relative to the housing between a first position and a second position. The motor may be disposed within the housing. The drive assembly may be coupled to the actuator and the motor. The method also may include the step of receiving the container within the housing. The container may include a reservoir containing the flowable material therein, and a pump attached to the reservoir and configured to move between an extended configuration and a compressed configuration. The method also may include the step of translating the actuator between the first position and the second position during a dispense cycle such that the actuator moves the pump between the extended configuration and the compressed configuration to dispense the flowable material. The drive assembly may translate the actuator between the first position and the second position at a varying rate of translation during the dispense cycle. The varying rate of translation may vary relative to a rate of rotation of the motor and follow a non-sinusoidal waveform.

In still another aspect, the present disclosure provides a flowable material dispensing system for dispensing flowable material. The flowable material dispensing system may include a container and a flowable material dispenser. The container may include a reservoir containing the flowable material therein, and a pump attached to the reservoir and configured to move between an extended configuration and a compressed configuration. The flowable material dispenser may include a housing, an actuator, a motor, and a drive assembly. The housing may receive the container therein. The actuator may be disposed within the housing and configured to translate relative to the housing between a first position and a second position during a dispense cycle. The actuator may be configured to move the pump between the extended configuration and the compressed configuration to dispense the flowable material as the actuator translates between the first position and the second position during the dispense cycle. The motor may be disposed within the housing. The drive assembly may be coupled to the actuator and the motor. The drive assembly may be configured to translate the actuator between the first position and the second position at a varying rate of translation during the dispense cycle. The varying rate of translation may vary relative to a rate of rotation of the motor and follow a non-sinusoidal waveform.

These and other aspects and improvements of the present disclosure will become apparent to one of ordinary skill in the art upon review of the following detailed description when taken in conjunction with the several drawings and the appended claims.

BRIEF DESCRIPTION OF THE DRAWINGS

The detailed description is set forth with reference to the accompanying drawings illustrating example embodiments of the disclosure, in which the use of the same reference numerals indicates similar or identical items. Certain embodiments may include elements and/or components other than those illustrated in the drawings, and some elements and/or components may not be present in certain embodiments.

FIG. 11 is a perspective view of the example mechanical hands-free sheet product dispenser of FIG. 10.

DETAILED DESCRIPTION

Figure 1:
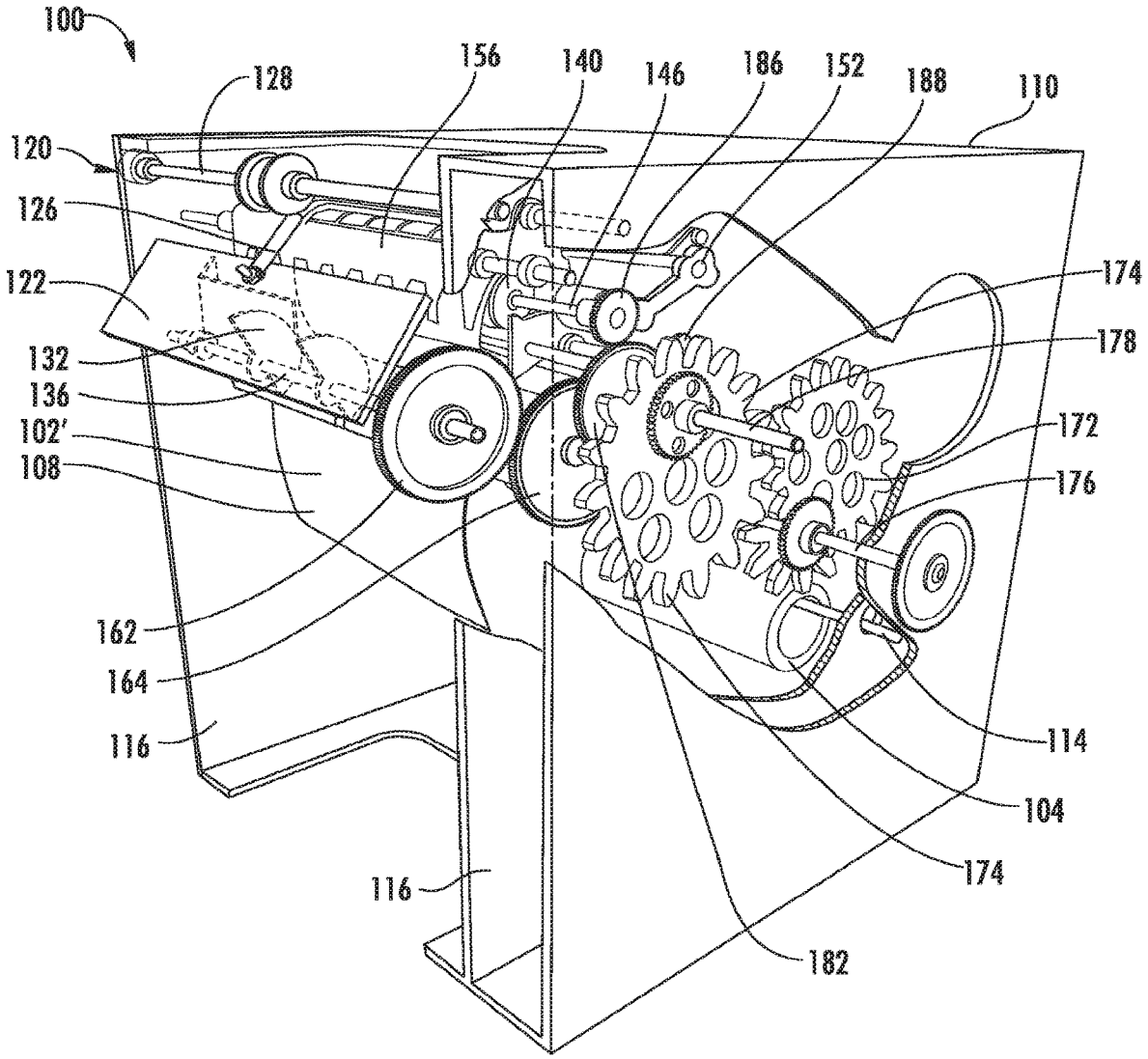
FIG. 1 is a perspective view of an example mechanical hands-free sheet product dispenser in accordance with one or more embodiments of the disclosure.

The present disclosure includes example embodiments of hands-free sheet product dispensers and related methods for dispensing individual sheets from a roll of sheet product to address one or more of the potential drawbacks discussed above. Reference is made herein to the accompanying drawings illustrating the example embodiments of the disclosure, in which the use of the same reference numerals indicates similar or identical items. Throughout the disclosure, depending on the context, singular and plural terminology may be used interchangeably.

As used herein, the term "sheet products" is inclusive of natural and/or synthetic cloth or paper sheets. Sheet products may include both woven and non-woven articles. There are a wide variety of non-woven processes for forming sheet products, which can be either wetlaid or drylaid. Examples of non-woven processes include, but are not limited to, hydroentangled (sometimes called "spunlace"), double recreped (DRC), airlaid, spunbond, carded, paper towel, and melt-blown processes. Further, sheet products may contain fibrous cellulosic materials that may be derived from natural sources, such as wood pulp fibers, as well as other fibrous material characterized by having hydroxyl groups. Examples of sheet products include, but are not limited to, wipers, napkins, tissues, towels, or other fibrous, film, polymer, or filamentary products.

As used herein, the term "non-circular gears" (NCGs) is inclusive of any gear that does not have a circular shape and thus does not have a constant gear ratio. Examples of non-circular gears include, but are not limited to, gears having an elliptical, square, rectangular, triangular, trapezoidal, or other regular or irregular shape that is non-circular. According to its shape and corresponding varying gear ratio, a non-circular gear may be used to vary a rate at which a mating gear or other component is driven throughout a rotation of the non-circular gear. Further, according to its shape and corresponding varying gear ratio, a non-circular gear may be used to vary a torque generated by the non-circular gear throughout a rotation thereof.

As used herein, the term "flowable material" refers to any material, such as a liquid, gel, or foam material, that is able to move or be moved along in a flow. Examples of flowable materials include, but are not limited to, soap, sanitizer, cleanser, air freshener, shampoo, body wash, lotion, or other skincare or personal hygiene products, condiments or other foodservice products, or cleaning products, whether in the form of a liquid, gel, foam, or combinations thereof. In some embodiments, the flowable material may be stored in one form, such as a liquid, and dispensed in the same form. In some embodiments, the flowable material may be stored in one form, such as a liquid, and dispensed in another form, such as a foam.

FIG. 1 shows a perspective view of an example mechanical hands-free sheet product dispenser 100 in accordance with one or more embodiments of the disclosure. FIGS. 2A-2E show side views of a portion of the dispenser 100 in different states during a dispense cycle. The dispenser 100 may be configured to dispense individual sheets 102 from a roll 104 of perforated sheet product. The roll 104 of perforated sheet product may be formed in a conventional manner, whereby the individual sheets 102 are at least partially defined by perforation lines 106 or other predefined lines of weakness extending between adjacent sheets 102. In this manner, the perforation lines 106 may be configured to facilitate separation of the sheets 102 from one another during use of the dispenser 100.

As is described in detail herein below, the dispenser 100 may be configured to present a tail portion 108 (i.e., an exposed end portion) of the roll 104 to be grasped and pulled by a user during a dispense cycle. Specifically, as is shown, the tail portion 108 may be a leading end portion of a leading individual sheet 102' to be dispensed during a dispense cycle. A leading perforation line 106' (i.e. the perforation line closest to the tail portion 108 and at least partially defining the leading individual sheet 102') may extend between the leading individual sheet 102' and a next individual sheet 102". It will be understood that the terms "leading" and "next" are used herein for the purpose of describing relevant portions of the roll 104 of sheet product prior to and during a given dispense cycle, and that these terms are adjusted when describing relevant portions prior to and during a subsequent dispense cycle. In this manner, upon completion of a first dispense cycle for dispensing the leading individual sheet 102', the next individual sheet 102" for the first dispense cycle becomes the leading individual sheet 102' for a second dispense cycle.

As is shown, the dispenser 100 may include a housing 110, and the roll 104 of perforated sheet product may be disposed within the housing 110 for dispensing the individual sheets 102 therefrom. The roll 104 may be rotatably supported within the housing 110 by a roll support, such as a roll shaft 114 attached to opposing side walls 116 of the housing 110. In some embodiments, the housing 110 may include a dispenser outlet (not shown) defined in a wall thereof, such as a front wall or a bottom wall of the housing. The dispenser 100 may be configured to present the tail portion 108 extending from the dispenser outlet and out of the housing 110 to be grasped and pulled by a user.

The dispenser 100 also may include a mechanical dispensing mechanism 120 disposed within the housing 110 and configured to guide and advance the sheet product from the roll 104 during a dispense cycle. The mechanical dispensing mechanism 120 may include a carriage 122 configured to move with respect to the housing 110 during a dispense cycle. As is described in detail below, the carriage 122 may be configured to move downward with respect to the housing 110 during a portion of the dispense cycle and to move upward with respect to the housing 110 during another portion of the dispense cycle. In some embodiments, the carriage 122 may be pivotally attached to the housing 110 and configured to pivot downward and upward with respect to the housing 110. For example, a rear end of the carriage 122 may be pivotally attached to the side walls 116 of the housing 110 via a pair of link arms 124. The mechanical dispensing mechanism 120 also may include a return spring 126 fixedly attached to a front end of the carriage 122 and configured to bias the carriage 122 to move upward with respect to the housing 110. As is shown, the return spring 126 may be attached to the housing 110 by a spring support, such as a spring shaft 128 attached to the side walls 116 of the housing 110.

The mechanical dispensing mechanism 120 further may include a number of rollers configured to guide and advance the sheet product from the roll 104 during a dispense cycle as a user grasps and pulls the tail portion 108 to impart a driving force thereto. Specifically, the number of rollers may include first and second crescent rollers 132, 134 attached to the carriage 122 and configured to receive the sheet product therebetween. The crescent rollers 132, 134 may be configured to engage and grip the sheet product during a portion of the dispense cycle and to disengage the sheet product during another portion of the dispense cycle. As is shown, the crescent rollers 132, 134 may be respectively positioned about and coupled to first and second crescent roller axles 136, 138 supported by the carriage 122 and allowing the crescent rollers 132, 134 to rotate with respect to the carriage 122. The number of rollers also may include first and second drive rollers 140, 142 and a pinch roller 144 attached to the housing 110 and configured to receive the sheet product therebetween. The drive rollers 140, 142 and the pinch roller 144 may be configured to engage and grip the sheet product during a portion of the dispense cycle and to engage but release grip of the sheet product during another portion of the dispense cycle. As is shown, the drive rollers 140, 142 may be respectively positioned about and coupled to first and second drive roller axles 146, 148 supported by the side walls 116 of the housing 110 and allowing the drive rollers 140, 142 to rotate with respect to the housing 110. The pinch roller 144 similarly may be positioned about and coupled to a pinch roller axle 150 supported by the housing 110 via a pinch roller arm 152 and allowing the pinch roller 144 to rotate with respect to the housing 110. As is shown, the mechanical dispensing mechanism 120 also may include a sheet product guide 156 disposed above the first drive roller 140 and configured to guide the sheet product downward toward the crescent rollers 132, 134.

The mechanical dispensing mechanism 120 further may include a number of gears configured to drive the drive rollers 140, 142 at a varying rate during a dispense cycle, as is described in detail below. Specifically, the number of gears may include first and second crescent roller gears 162, 164 respectively positioned about and coupled to the crescent roller axles 136, 138 supported by the carriage 122 and allowing the crescent roller gears 162, 164 to rotate with respect to the carriage 122. As is shown, the crescent roller gears 162, 164 may be circular gears that engage one another throughout the dispense cycle. The number of gears also may include a first transfer gear 166 positioned about and coupled to a first transfer gear axle 168 supported by the carriage 122 and allowing the first transfer gear 166 to rotate with respect to the carriage 122. As is shown, the first transfer gear 166 may be a circular gear that engages the second crescent roller gear 164 throughout the dispense cycle.

The number of gears also may include first and second non-circular gears 172, 174 respectively positioned about and coupled to first and second non-circular gear axles 176, 178 supported by the housing 110 and allowing the non-circular gears 172, 174 to rotate with respect to the housing 110. As is shown, the non-circular gears 172, 174 may be elliptical gears that engage one another throughout the dispense cycle. The number of gears also may include a second transfer gear 180 positioned about and coupled to the first non-circular gear axle 176 supported by the housing 110 and allowing the second transfer gear 180 to rotate with respect to the housing 110. As is shown, the second transfer gear 180 may be a circular gear that engages the first transfer gear 166 throughout the dispense cycle. The number of gears also may include a third transfer gear 182 positioned about and coupled to the second non-circular gear axle 178 supported by the housing 110 and allowing the third transfer gear 182 to rotate with respect to the housing 110. As is shown, the third transfer gear 182 may be a circular gear.

The number of gears also may include first and second drive roller gears 186, 188 respectively positioned about and coupled to the drive roller axles 146, 148 supported by the housing 110 and allowing the drive roller gears 186, 188 to rotate with respect to the housing 110. As is shown, the drive roller gears 186, 188 may be circular gears that each engage the third transfer gear 182 throughout the dispense cycle. Ultimately, the number of gears may be configured to interact with one another to drive the drive rollers 140, 142 at a varying rate throughout a dispense cycle as a user grasps and pulls the tail portion 108 to impart a driving force to the sheet product.

Figure 2A:
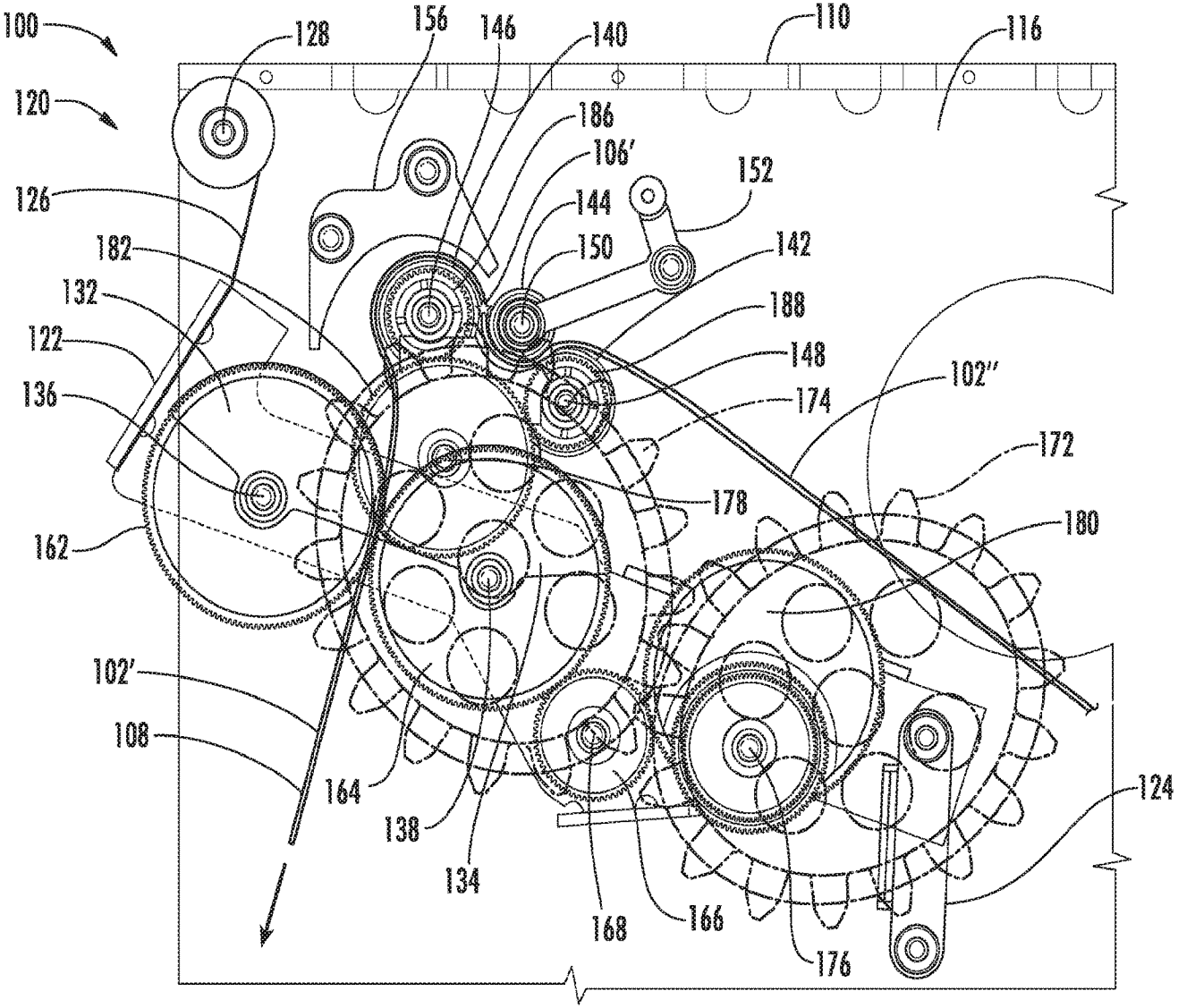
FIG. 2A is a side view of a portion of the example mechanical hands-free sheet product dispenser of FIG. 1, showing a mechanical dispensing mechanism in a first state during a dispense cycle.

FIGS. 2A-2E show side views of the mechanical dispensing mechanism 120 in a number of different states during a dispense cycle as may be carried out using the dispenser 100. FIG. 2A shows the mechanical dispensing mechanism 120 in a first state of the dispense cycle, in which the tail portion 108 (the leading end portion of the leading sheet 102') is presented and available to be grasped and pulled by a user. In the first state, the carriage 122 is maintained in an upward position by the return spring 126, which is in a retracted position. The crescent rollers 132, 134 are engaging and gripping a portion of the leading sheet 102' received therebetween, while the first drive roller 140 is engaging and gripping another portion of the leading sheet 102' disposed thereover. As is shown, in the first state, the leading perforation line 106' is disposed along the rear side of the first drive roller 140 approximately between the first drive roller 140 and the pinch roller 144, such that the second drive roller 142 and the pinch roller 144 are engaging and gripping a portion of the next sheet 102".

The user pulls the tail portion 108 downward to impart a driving force to the sheet product to carry out the dispense cycle. As the user initially pulls the tail portion 108 downward, the crescent rollers 132, 134 continue to grip a portion of the leading sheet 102' received therebetween, which causes the crescent rollers 132, 134 to rotate (clockwise and counter-clockwise, respectively, in the side views shown) along with the crescent roller axles 136, 138 and also causes the carriage 122 to move downward with respect to the housing 110. The downward movement of the carriage 122 causes the return spring 126 to extend downward and store energy. The rotation of the crescent roller axles 136, 138 causes the crescent roller gears 162, 164 to rotate (clockwise and counter-clockwise, respectively), which causes the first transfer gear 166 to rotate (clockwise). The rotation of the first transfer gear 166 causes the second transfer gear 180 to rotate (counter-clockwise) along with the first non-circular gear axle 176, which causes the first non-circular gear 172 to rotate (counter-clockwise). The rotation of the first non-circular gear 172 causes the second non-circular gear 174 to rotate (clockwise) along with the second non-circular gear axle 178, which causes the third transfer gear 182 to rotate (clockwise). The rotation of the third transfer gear 182 causes the drive roller gears 186, 188 to rotate (both counter-clockwise) along with the drive roller axles 146, 148, which causes the drive rollers 140, 142 to rotate (both counter-clockwise). In this manner, initial pulling of the tail portion 108 downward causes the crescent rollers 132, 134 to rotate (clockwise and counter-clockwise, respectively), which ultimately causes the drive rollers 140, 142 to rotate (both counter-clockwise) in a dispensing direction of the leading sheet 102'.

As discussed above, by their nature, the non-circular gears 172, 174 have a varying gear ratio, which is dependent upon the orientation of the non-circular gears 172, 174 throughout a rotation thereof. Accordingly, an output of the non-circular gears 172, 174 to the drive rollers 140, 142 (via the second non-circular gear axle 178, the third transfer gear 182, the drive roller gears 186, 188, and the drive roller axles 146, 148) varies throughout the dispense cycle, and thus the non-circular gears 172, 174 drive the drive rollers 140, 142 at a varying rate throughout the dispense cycle. In the first state of the dispense cycle, the non-circular gears 172, 174 are in an orientation in which the output to the drive rollers 140, 142 is very slow compared to the input from the initial pulling of the tail portion 108 and the downward movement of the carriage 122. Accordingly, as the user initially pulls the tail portion 108, the contact surfaces of the drive rollers 140, 142 rotate at a slower rate than the tail portion 108 is pulled. In the first state, the crescent rollers 132, 134 grip the leading individual sheet 102', and the second drive roller 142 and the pinch roller 144 grip the next individual sheet 102". Because the second drive roller 142 is rotating at a slower rate than the crescent rollers 132, 134 advance, there is tension in the portions of the leading individual sheet 102' and the next individual sheet 102" between the crescent rollers 132, 134 and the second drive roller 142. This tension causes the first drive roller 140 to grip the leading individual sheet 102'. In the first state, the crescent rollers 132, 134 grip the sheet product harder than the first drive roller 140, the second drive roller 142, and the pinch roller 144 grip the sheet product, and thus the sheet product skids between the second drive roller 142 and the pinch roller 144 and over the first drive roller 140 (i.e. the first drive roller 140, the second drive roller 142, and the pinch roller 144 release grip of the sheet product) as the user initially pulls the tail portion 108. Because the leading perforation line 106' is disposed along the rear side of the first drive roller 140, the leading perforation line 106' generally is not exposed to the full tension generated in the leading sheet 102' as the user pulls the tail portion 108 and the crescent rollers 132, 134 grip the leading sheet 102'.

Figure 2B:
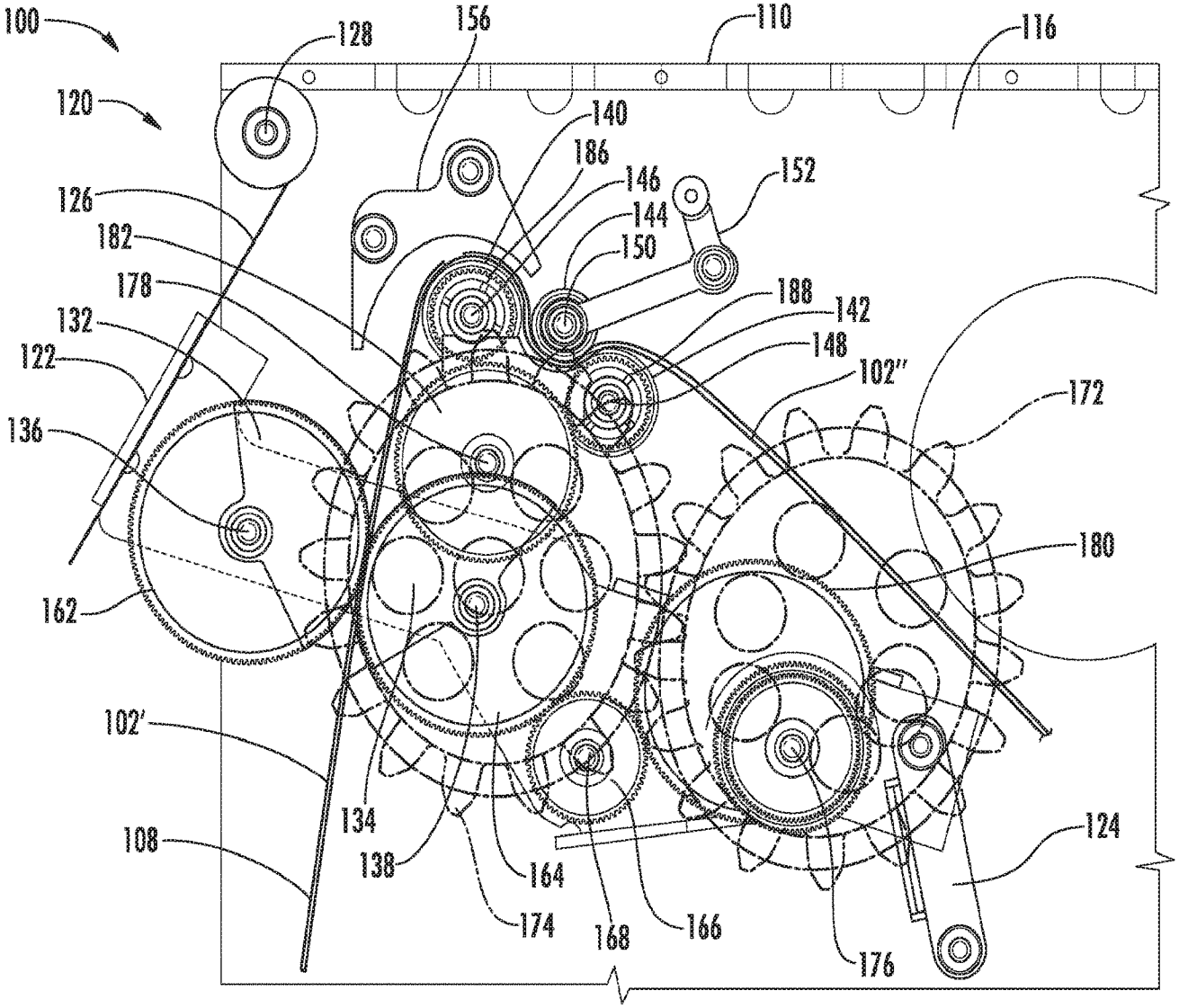
FIG. 2B is a side view of a portion of the example mechanical hands-free sheet product dispenser of FIG. 1, showing the mechanical dispensing mechanism in a second state during the dispense cycle.

FIG. 2B shows the mechanical dispensing mechanism 120 in a second state of the dispense cycle, following initial pulling of the tail portion 108 and skidding of the sheet product until the leading perforation line 106' advances over the top of the first drive roller 140. Because the leading perforation line 106' is disposed far enough along the front side of the first drive roller 140, the leading perforation line 106' is exposed to most of the tension generated in the leading sheet 102' as the user continues to pull the tail portion 108 and the crescent rollers 132, 134 continue to grip the leading sheet 102'. Ultimately, the leading perforation line 106' is exposed to enough tension to separate the leading sheet 102' from the next sheet 102" along the leading perforation line 106', as is shown. Upon separation of the leading sheet 102', the next sheet 102" no longer skids between the second drive roller 142 and the pinch roller 144 as the user continues to pull the tail portion 108. Instead, the second drive roller 142 and the pinch roller 144 grip and advance the next sheet 102" relatively slowly, according to the rotation of the second drive roller gear 188 as determined by the gear ratio of the non-circular gears 172, 174. Meanwhile, the crescent rollers 132, 134 continue to grip the leading sheet 102' and rotate, the carriage 122 continues to move downward, and the return spring 126 continues to extend downward and store more energy. The rotation of the crescent rollers 132, 134 causes the various gears of the mechanical dispensing mechanism 120 to continue to rotate as described above.

Figure 2C:
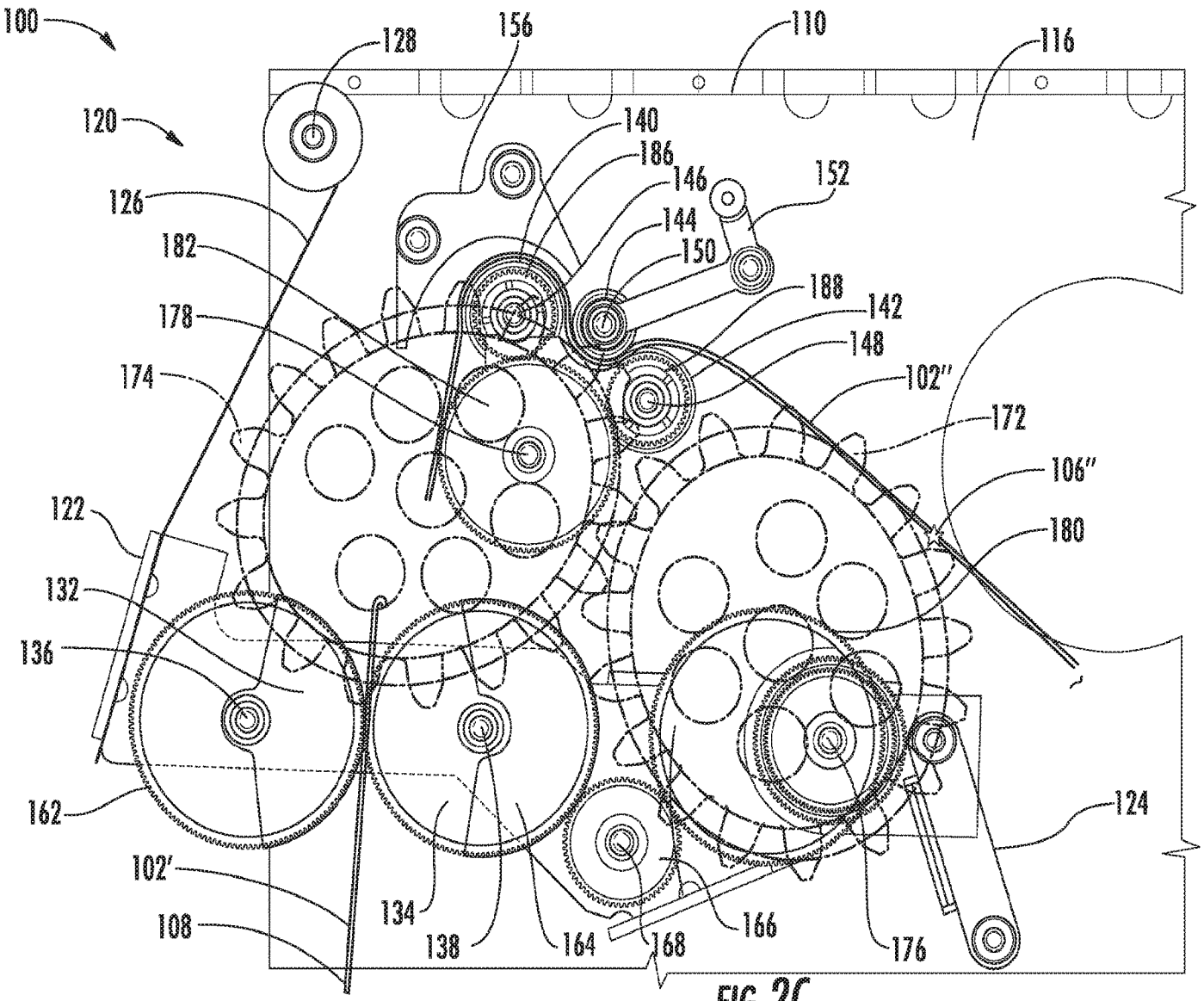
FIG. 2C is a side view of a portion of the example mechanical hands-free sheet product dispenser of FIG. 1, showing the mechanical dispensing mechanism in a third state during the dispense cycle.

FIG. 2C shows the mechanical dispensing mechanism 120 in a third state of the dispense cycle, following continued pulling of the tail portion 108 downward by the user. The crescent rollers 132, 134 continue to grip the leading sheet 102' and rotate, the carriage 122 continues to move downward, and the return spring 126 continues to extend downward and store more energy. The rotation of the crescent rollers 132, 134 causes the various gears of the mechanical dispensing mechanism 120 to continue to rotate as described above. In the third state of the dispense cycle, the non-circular gears 172, 174 are in an orientation in which the output to the drive rollers 140, 142 is very fast compared to the input from the pulling of the tail portion 108 and the downward movement of the carriage 122. Accordingly, as the user continues to pull the tail portion 108, the contact surfaces of the drive rollers 140, 142 rotate and advance the next sheet 102" at a faster rate than the tail portion 108 is pulled. As the next sheet 102" is advanced, the next perforation line 106" approaches but does not yet contact the second drive roller 142.

Figure 2D:
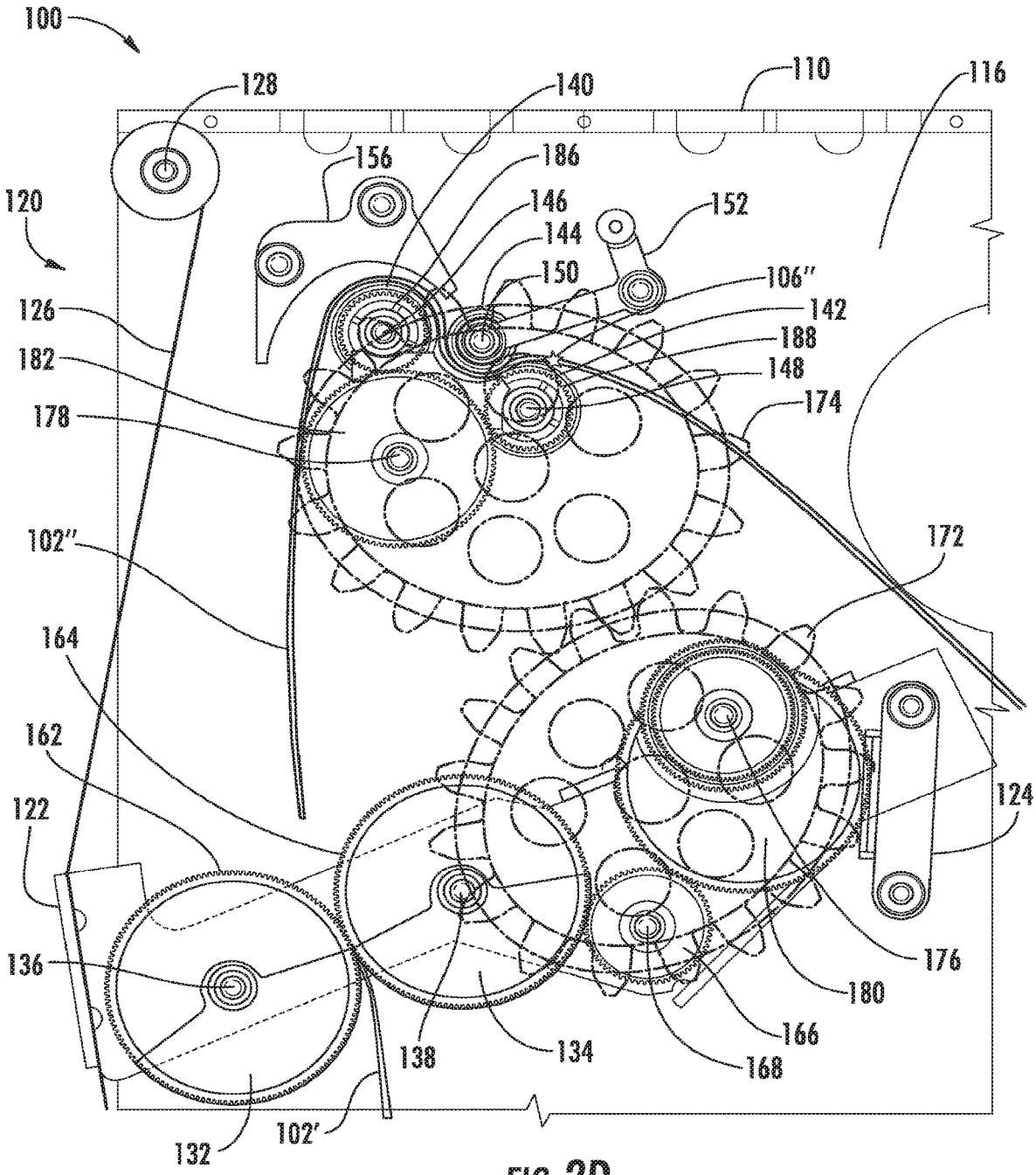
FIG. 2D is a side view of a portion of the example mechanical hands-free sheet product dispenser of FIG. 1, showing the mechanical dispensing mechanism in a fourth state during the dispense cycle.

FIG. 2D shows the mechanical dispensing mechanism 120 in a fourth state of the dispense cycle, following continued pulling of the tail portion 108 downward by the user. In the fourth state, the crescent rollers 132, 134 disengage and release grip of the leading sheet 102', allowing the user to take the leading sheet 102'. Meanwhile, the return spring 126 begins to pull the carriage 122 upward with respect to the housing 110 as the return spring 126 retracts and releases the energy stored during downward movement of the carriage 122. The upward movement of the carriage 122 causes the various gears of the mechanical dispensing mechanism 120 to continue to rotate as described above. Accordingly, the drive rollers 140, 142 continue to rotate and advance the next sheet 102" as the carriage 122 continues to move upward. In the fourth state of the dispense cycle, the next perforation line 106" contacts the second drive roller 142, as is shown.

Figure 2E:
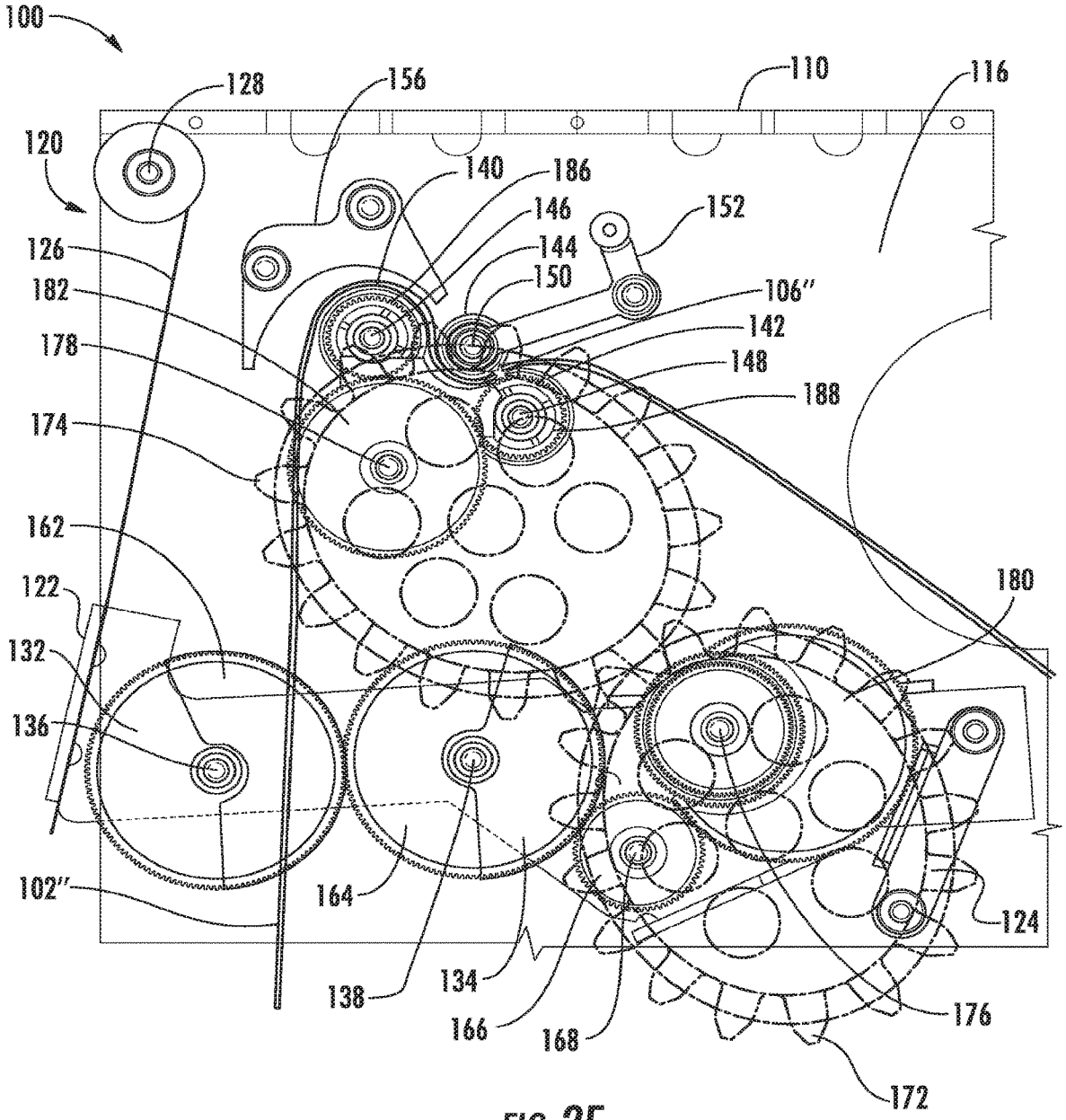
FIG. 2E is a side view of a portion of the example mechanical hands-free sheet product dispenser of FIG. 1, showing the mechanical dispensing mechanism in a fifth state during the dispense cycle.

FIG. 2E shows the mechanical dispensing mechanism 120 in a fifth state of the dispense cycle, following continued upward movement of the carriage 122 as the return spring 126 continues to retract and release the stored energy. In the fifth state, the crescent rollers 132, 134 are in an open orientation, and a leading end portion of the next sheet 102" extends freely through a gap defined between the crescent rollers 132, 134, as is shown. In this manner, the crescent rollers 132, 134 do not engage or grip the next sheet 102". The continued upward movement of the carriage 122 causes the various gears of the mechanical dispensing mechanism 120 to continue to rotate as described above. In the fifth state of the dispense cycle, the non-circular gears 172, 174 are in an orientation in which the output to the drive rollers 140, 142 is very slow compared to the input from the upward movement of the carriage 122. Accordingly, as the return spring 126 continues to pull the carriage 122 upward, the contact surfaces of the drive rollers 140, 142 rotate and advance the next sheet 102" at a slower rate than the carriage 122 is pulled. In this manner, the energy stored in the return spring 126 is used almost entirely to move the carriage 122 upward and reveal the leading end portion of the next sheet 102" that is already extended. Notably, the return spring 126 has a very high mechanical advantage to overcome any resistance that that the roll 104 may present while unwinding. In the fifth state of the dispense cycle, the next perforation line 106" is disposed approximately between the second drive roller 142 and the pinch roller 144, as is shown. Following continued upward movement of the carriage 122 as the return spring 126 continues to retract and release the stored energy, the mechanical dispensing mechanism 120 returns to the first state, as is shown in FIG. 2A, and is ready to begin a subsequent dispense cycle.

The dispenser 100 may be configured to mechanically synchronize a dispense cycle with the perforation lines 106 of the roll 104 of sheet product. Specifically, the mechanical dispensing mechanism 120 may be configured to mechanically synchronize a dispense cycle with a leading perforation line 106' (a next perforation line 106" of a previous dispense cycle) that advanced too far during the previous dispense cycle (i.e., a leading perforation line 106' that is advanced further than the leading perforation line 106' shown in FIG. 2A). The mechanical dispensing mechanism 120 also may be configured to mechanically synchronize a dispense cycle with a leading perforation line 106' (a next perforation line 106" of a previous dispense cycle) that did not advance far enough during the previous dispense cycle (i.e., a leading perforation line 106' that is not advanced as far as the leading perforation line 106' shown in FIG. 2A).

Mechanical synchronization may occur between the first state and the second state of the dispense cycle. As described above, when a user initially pulls the tail portion 108, the crescent rollers 132, 134 grip the sheet product while the sheet product skids over the first drive roller 140. In this manner, the sheet product moves at a higher speed when skidding over the first drive roller 140 and moves at a lower speed when being driven by the drive rollers 140, 142. If, for some reason, a leading perforation line 106' advanced too far during a previous dispense cycle, when a user pulls the tail portion 108 to initiate a new dispense cycle, the sheet product would not skid at the higher speed over the first drive roller 140 for very long (if at all) before the leading perforation line 106' would be exposed to enough tension to separate the leading sheet 102' from the next sheet 102", after which the next sheet 102" would be driven by the drive rollers 140, 142 at the lower speed. Accordingly, the next sheet 102" would spend a shorter amount of time at the higher speed and would travel a shorter distance than during a typical dispense cycle, thereby compensating for having been advanced too far during a previous dispense cycle. If, for some reason, a leading perforation line 106' did not advance far enough during a previous dispense cycle, when a user pulls the tail portion 108 to initiate a new dispense cycle, the sheet product would skid at the higher speed over the first drive roller 140 for longer before the leading perforation line 106' would be exposed to enough tension to separate the leading sheet 102' from the next sheet 102", after which the next sheet 102" would be driven by the drive rollers 140, 142 at the lower speed. Accordingly, the next sheet 102" would spend a longer amount of time at the higher speed and would travel a longer distance than during a typical dispense cycle, thereby compensating for not having advanced far enough during a previous dispense cycle. In this manner, the mechanical dispensing mechanism 120, and thus the overall dispenser 100, may compensate and synchronize a dispense cycle with the perforation lines 106 of the roll 104 of sheet product.

The dispenser 100 may be configured to dispense individual sheets 102 having a predetermined sheet length (i.e., the roll 104 has a predetermined distance between adjacent perforation lines 106), which may depend on the type of sheet product dispensed. For example, the dispenser 100 may be configured to dispense individual sheets 102 of paper towels having a predetermined sheet length of 8.5 inches. Based on the configuration and operation of the mechanical dispensing mechanism 120, specifically the movement of the carriage 122 and the skidding of the sheet product during a dispense cycle, the sheet length may be less than a sum of a length of the tail portion 108 (a "tail length") and a length over which a user pulls the tail portion (a "pull length") during the dispense cycle. For example, the dispenser 100 may be configured to dispense individual sheets 102 having a sheet length of 8.5 inches, wherein the tail length is 4.25 inches and the pull length is 7.25 inches. In contrast, as described above, known mechanical hands-free dispensers generally are configured to dispense individual sheets having a sheet length that is equal to a sum of the tail length and the pull length. For example, known mechanical hands-free dispensers configured to dispense individual sheets having a sheet length of 8.5 inches and to present a tail portion having a tail length of 4.25 inches would require a pull length of 4.25 inches. Ultimately, as compared to known dispensers, the dispenser 100 may allow a lower pull force (i.e., a driving force imparted by a user) required for a given sheet length and tail length, due to the greater pull length required. Additionally, as compared to known dispensers, the dispenser 100 may allow a lower paper strength required for a given sheet length and tail length, due to the lower pull force allowed. Further, as compared to known dispensers, the dispenser 100 may generate a greater amount of energy from a given pull force, due to the greater pull length required, which may provide greater reliability in presenting a tail portion.

The dispenser 100 also may be configured to mechanically "lockout" (i.e., prevent dispensing of) a roll 104 of sheet product including individual sheets 102 having a sheet length outside of a predetermined range. For example, the dispenser 100 may be configured to mechanically lockout a roll 104 of sheet product including individual sheets 102 having a sheet length outside of a predetermined range of 8.25 to 8.75 inches. As described above, proper operation of the mechanical dispensing mechanism 120 requires the perforation lines 106 to be disposed generally at certain positions relative to the various rollers and gears at certain portions of a dispense cycle. Attempting to dispense a roll 104 of sheet product including individual sheets 102 having a sheet length outside of a predetermined range would cause the perforation lines 106 to be disposed at incorrect positions relative to the various rollers and gears at certain portions of a dispense cycle. As also described above, the mechanical dispensing mechanism 120 is configured to provide a certain degree of skidding of the sheet product over the first drive roller 140 during an initial portion of a dispense cycle. Specifically, the mechanical dispensing mechanism 120 is configured such that a length of rotation of the contact surface of the first drive roller 140 (a "rotation length") during the dispense cycle is less than the individual sheet length, which causes the skidding of the sheet product to occur and enables the mechanical synchronization of the dispense cycle with the perforation lines 106. Accordingly, the dispenser 100 may be configured to dispense individual sheets 102 having a sheet length of 8.5 inches, wherein the rotation length of the contact surface of the first drive roller 140 is 8.0 inches. It will be understood that the dimensions of the dispenser 100, particularly the mechanical dispensing mechanism 120, and the individual sheets 102 may be selected depending upon the type of sheet product to be dispensed.

Figure 3:
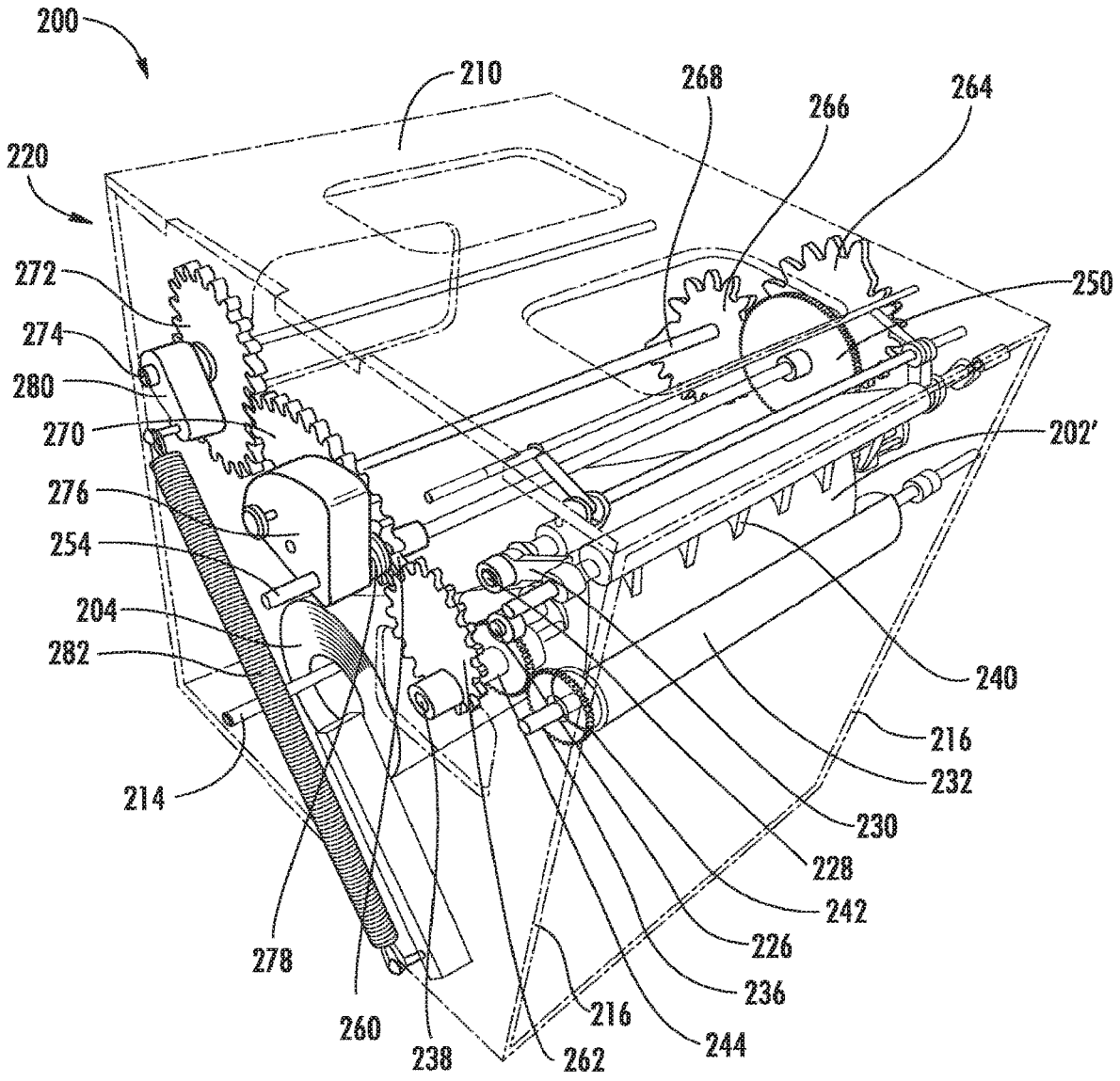
FIG. 3 is a perspective view of an example mechanical hands-free sheet product dispenser in accordance with one or more embodiments of the disclosure.
Figure 4:
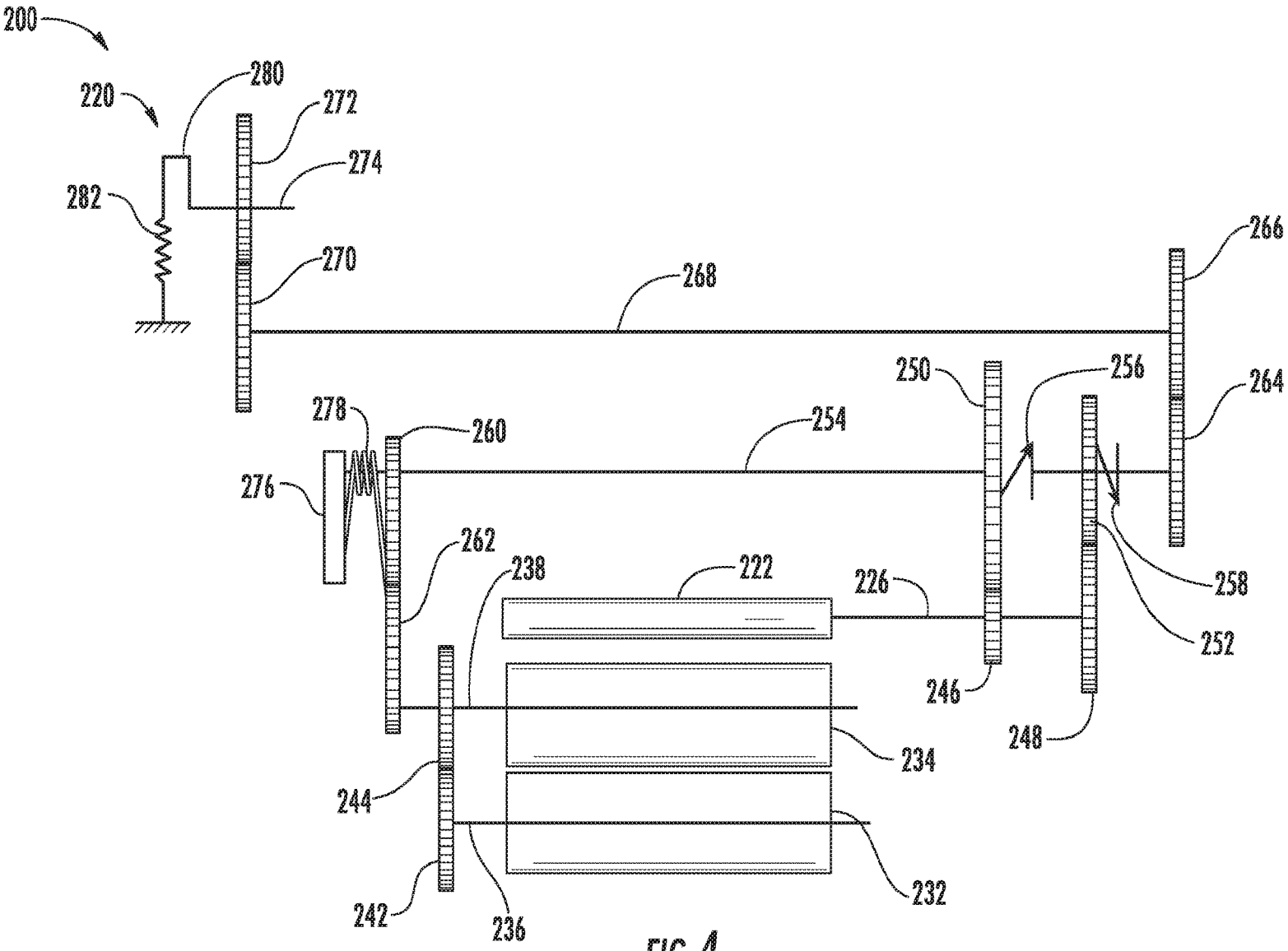
FIG. 4 is a schematic diagram of a portion of the example mechanical hands-free sheet product dispenser of FIG. 3, showing a mechanical dispensing mechanism.
Figure 5A:
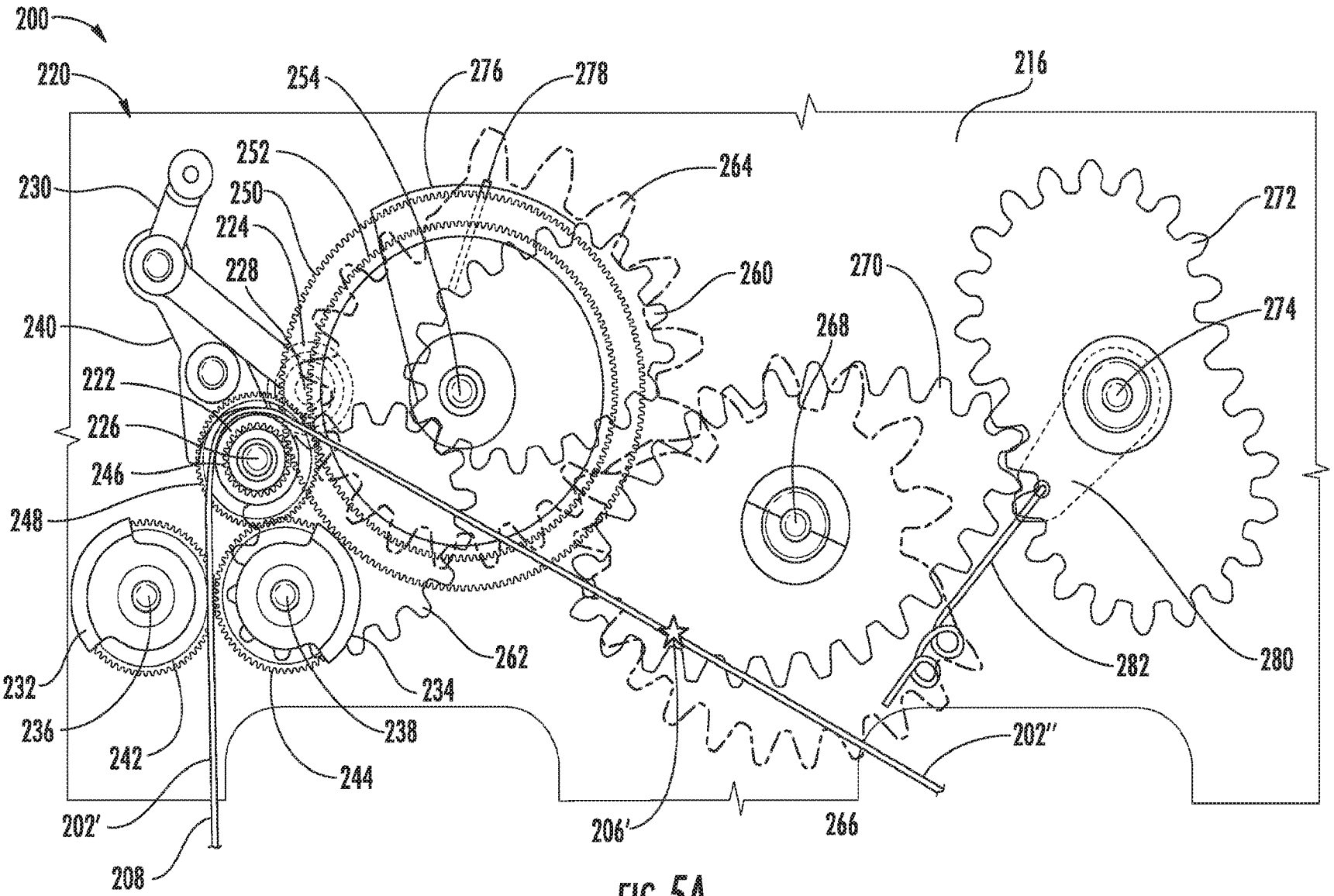
FIG. 5A is a side view of a portion of the example mechanical hands-free sheet product dispenser of FIG. 3, showing a mechanical dispensing mechanism in a first state during a dispense cycle.
Figure 5B:
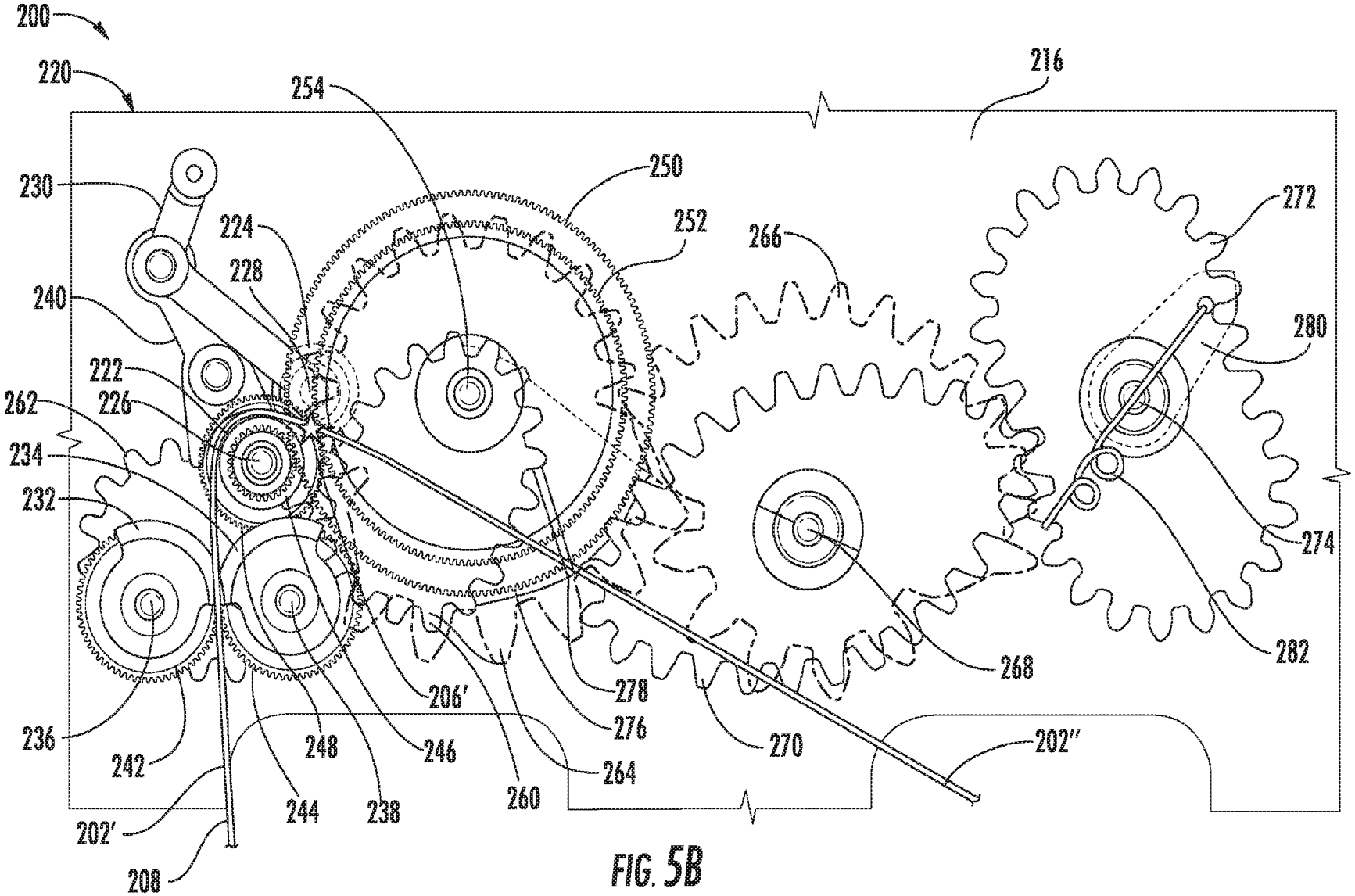
FIG. 5B is a side view of a portion of the example mechanical hands-free sheet product dispenser of FIG. 3, showing the mechanical dispensing mechanism in a second state during the dispense cycle.
Figure 5C:
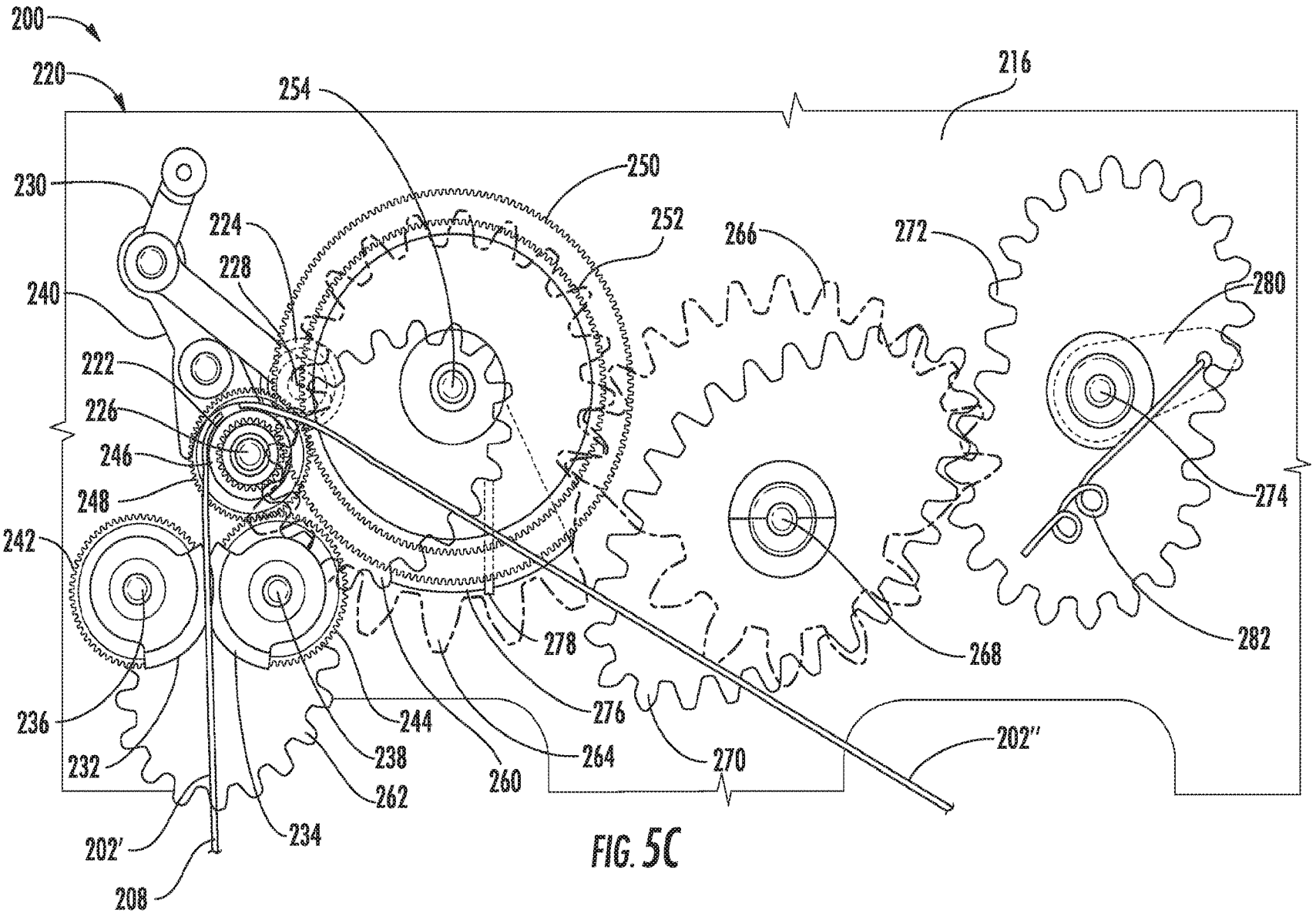
FIG. 5C is a side view of a portion of the example mechanical hands-free sheet product dispenser of FIG. 3, showing the mechanical dispensing mechanism in a third state during the dispense cycle.

FIG. 3 shows a perspective view of an example mechanical hands-free sheet product dispenser 200 in accordance with one or more embodiments of the disclosure. FIG. 4 shows a schematic diagram of a portion of the dispenser 200. FIGS. 5A-5C show side views of a portion of the dispenser 200 in different states during a dispense cycle. The dispenser 200 may be configured to dispense individual sheets 202 from a roll 204 of perforated sheet product. The roll 204 of perforated sheet product may be formed in a conventional manner, whereby the individual sheets 202 are at least partially defined by perforation lines 206 or other predefined lines of weakness extending between adjacent sheets 202. In this manner, the perforation lines 206 may be configured to facilitate separation of the sheets 202 from one another during use of the dispenser 200.

As is described in detail herein below, the dispenser 200 may be configured to present a tail portion 208 (i.e., an exposed end portion) of the roll 204 to be grasped and pulled by a user during a dispense cycle. Specifically, as is shown, the tail portion 208 may be a leading end portion of a leading individual sheet 202' to be dispensed during a dispense cycle. A leading perforation line 206' (i.e. the perforation line closest to the tail portion 208 and at least partially defining the leading individual sheet 202') may extend between the leading individual sheet 202' and a next individual sheet 202". It will be understood that the terms "leading" and "next" are used herein for the purpose of describing relevant portions of the roll 204 of sheet product prior to and during a given dispense cycle, and that these terms are adjusted when describing relevant portions prior to and during a subsequent dispense cycle. In this manner, upon completion of a first dispense cycle for dispensing the leading individual sheet 202', the next individual sheet 202" for the first dispense cycle becomes the leading individual sheet 202' for a second dispense cycle.

As is shown, the dispenser 200 may include a housing 210, and the roll 204 of perforated sheet product may be disposed within the housing 210 for dispensing the individual sheets 202 therefrom. The roll 204 may be rotatably supported within the housing 210 by a roll support, such as a roll shaft 214 attached to opposing side walls 216 of the housing 210. In some embodiments, the housing 210 may include a dispenser outlet (not shown) defined in a wall thereof, such as a front wall or a bottom wall of the housing. The dispenser 200 may be configured to present the tail portion 208 extending from the dispenser outlet and out of the housing 210 to be grasped and pulled by a user.

The dispenser 200 also may include a mechanical dispensing mechanism 220 disposed within the housing 210 and configured to guide and advance the sheet product from the roll 204 during a dispense cycle. The mechanical dispensing mechanism 220 may include a number of rollers configured to guide and advance the sheet product from the roll 204 during a dispense cycle as a user grasps and pulls the tail portion 208 to impart a driving force thereto. Specifically, the number of rollers may include a drive roller 222 and a pinch roller 224 attached to the housing 210 and configured to receive the sheet product therebetween. The drive roller 222 and the pinch roller 224 may be configured to engage and grip the sheet product throughout the dispense cycle. As is shown, the drive roller 222 may be positioned about and coupled to a drive roller axle 226 supported by the side walls 216 of the housing 210 and allowing the drive roller 222 to rotate with respect to the housing 210. The pinch roller 224 similarly may be positioned about and coupled to a pinch roller axle 228 supported by the housing 210 via a pinch roller arm 230 and allowing the pinch roller 224 to rotate with respect to the housing 210. The number of rollers also may include first and second crescent rollers 232, 234 attached to the housing 210 and configured to receive the sheet product therebetween. The crescent rollers 232, 234 may be configured to engage and grip the sheet product during a portion of the dispense cycle and to disengage and release grip of the sheet product during another portion of the dispense cycle. As is shown, the crescent rollers 232, 234 may be respectively positioned about and coupled to first and second crescent roller axles 236, 238 supported by the housing 210 and allowing the crescent rollers 232, 234 to rotate with respect to the housing 210. The mechanical dispensing mechanism 220 also may include a sheet product guide 240 disposed above the drive roller 222 and configured to guide the sheet product downward toward the crescent rollers 232, 234, as is shown.

The mechanical dispensing mechanism 220 also may include a number of gears configured to drive the crescent rollers 232, 234 at a varying rate throughout a dispense cycle, as is described in detail below. Specifically, the number of gears may include first and second crescent roller gears 242, 244 respectively positioned about and coupled to the crescent roller axles 236, 238 supported by the housing 210 and allowing the crescent roller gears 242, 244 to rotate with respect to the housing 210. As is shown, the crescent roller gears 242, 244 may be circular gears that engage one another throughout the dispense cycle. The number of gears also may include first and second drive roller gears 246, 248 each positioned about and coupled to the drive roller axle 226 supported by the housing 210 and allowing the drive roller gears 246, 248 to rotate with respect to the housing 210. As is shown, the drive roller gears 246, 248 may be circular gears.

The number of gears also may include first and second transfer gears 250, 252 each positioned about and coupled to a preloader axle 254 supported by the housing 210 and allowing the first and second transfer gears 250, 252 to rotate with respect to the housing 210. The first and second transfer gears 250, 252 may be respectively coupled to the preloader axle 254 via first and second one-way bearings 256, 258. The first one-way bearing 256 may allow the first transfer gear 250 to lock to the preloader axle 254 during a portion of the dispense cycle and to override the preloader axle 254 during another portion of the dispense cycle, and the second one-way bearing 258 may allow the second transfer gear 252 to lock to the preloader axle 254 during a portion of the dispense cycle and to override the preloader axle 254 during another portion of the dispense cycle, as is described in detail below. The first one-way bearing 256 may have an orientation that is opposite an orientation of the second one-way bearing 258, such the first transfer gear 250 locks to the preloader axle 254 while the second transfer gear 252 overrides the preloader axle 254, and the first transfer gear 250 overrides the preloader axle 254 while the second transfer gear 252 locks to the preloader axle 254. As is shown, the first transfer gear 250 may be a circular gear that engages the first drive roller gear 246 throughout the dispense cycle, and the second transfer gear 252 may be a circular gear that engages the second drive roller gear 248 throughout the dispense cycle.

The number of gears also may include a first non-circular gear 260 positioned about and free to rotate with respect to (i.e., not coupled to) the preloader axle 254 supported by the housing 210. As is shown, the first non-circular gear 260 may have a generally elliptical shape. The number of gears also may include a second non-circular gear 262 positioned about and coupled to the second crescent roller axle 238 supported by the housing 210 and allowing the second non-circular gear 262 to rotate with respect to the housing 210. As is shown, the second non-circular gear 262 may have a generally elliptical shape and may engage the first non-circular gear 260 throughout the dispense cycle. The number of gears also may include a third non-circular gear 264 positioned about and coupled to the preloader axle 254 supported by the housing 210 and allowing the third non-circular gear 264 to rotate with respect to the housing 210. As is shown, the third non-circular gear 264 may have a multiple segments, each with a constant pitch radius, including discontinuous step changes in pitch radii between segments. The number of gears also may include a fourth non-circular gear 266 positioned about and coupled to a transfer axle 268 supported by the housing 210 and allowing the fourth non-circular gear 266 to rotate with respect to the housing 210. As is shown, the fourth non-circular gear 266 may have a multiple segments, each with a constant pitch radius, including discontinuous step changes in pitch radii between segments, and may engage the third non-circular gear 264 throughout the dispense cycle. The number of gears also may include a fifth non-circular gear 270 positioned about and coupled to the transfer axle 268 supported by the housing 210 and allowing the fifth non-circular gear 270 to rotate with respect to the housing 210. As is shown, the fifth non-circular gear 270 may have a shape that has a continuously changing pitch radius and that is customized to deliver a desired dispensing performance. The number of gears also may include a sixth non-circular gear 272 positioned about and coupled to a tail spring axle 274 supported by the housing 210 and allowing the sixth non-circular gear 272 to rotate with respect to the housing 210. As is shown, the sixth non-circular gear 272 may have a shape that has a continuously changing pitch radius and that is customized to deliver a desired dispensing performance, and may engage the fifth non-circular gear 270 throughout the dispense cycle.

The mechanical dispensing mechanism 220 also may include a crescent preloader 276 positioned about and coupled to the preloader axle 254 supported by the housing 210 and allowing the crescent preloader 276 to rotate with respect to the housing 210. As is shown, the crescent preloader 276 also may be attached to the first non-circular gear 260 via a crescent preloader spring 278, such as a torsional spring, positioned therebetween. As is described in detail below, the crescent preloader spring 278 may be configured to compress and store energy as the crescent preloader 276 and the first non-circular gear 260 rotate with respect to one another during a portion of the dispense cycle, and to expand and release the stored energy as the crescent preloader 276 and the first non-circular gear 260 rotate with respect to one another during another portion of the dispense cycle.

The mechanical dispensing mechanism 220 also may include a tail spring arm 280 positioned about and coupled to the tail spring axle 274 supported by the housing 210 and allowing the tail spring arm 280 to rotate with respect to the housing 210. As is shown, the tail spring arm 280 also may be attached to the housing 210 via a tail spring 282, such as a coil spring, positioned therebetween. As is described in detail below, the tail spring 282 may be configured to extend and store energy as the tail spring arm 280 rotates with respect to the housing 210 during a portion of the dispense cycle, and to retract and release the stored energy as the tail spring arm 280 rotates with respect to the housing 210 during another portion of the dispense cycle.

FIGS. 5A-5C show side views of the mechanical dispensing mechanism 220 in a number of different states during a dispense cycle as may be carried out using the dispenser 200. FIG. 5A shows the mechanical dispensing mechanism 220 in a first state of the dispense cycle, in which the tail portion 208 (the leading end portion of the leading sheet 202') is presented and available to be grasped and pulled by a user. In the first state, the drive roller 222 and the pinch roller 224 are engaging and gripping a portion of the leading sheet 202' received therebetween, while the crescent rollers 232, 234 are in an open orientation allowing the leading sheet 202' to extend freely through a gap defined between the crescent rollers 232, 234. As is shown, the leading perforation line 206' is disposed a distance upstream of the drive roller 222 and the pinch roller 224. In the first state, the crescent preloader 276 may hold the crescent preloader spring 278 in a slightly compressed and loaded condition against the first non-circular gear 260, such that the crescent preloader spring 278 stores a small amount of energy. The tail spring arm 280 may hold the tail spring 282 in a slightly extended and loaded condition, such that the tail spring 282 stores a small amount of energy. In the first state, the tail spring 282 is held at a "bottom-dead-center" orientation, and thus the tail spring 282 has its shortest length of the dispense cycle.

The user pulls the tail portion 208 downward to impart a driving force to the sheet product to carry out the dispense cycle. As the user initially pulls the tail portion 208 downward, the drive roller 222 and the pinch roller 224 continue to grip a portion of the leading sheet 202' received therebetween, which causes the drive roller 222 to rotate (counter-clockwise in the side views shown) along with the drive roller axle 226. The rotation of the drive roller axle 226 causes the first and second drive roller gears 246, 248 to rotate (both counter-clockwise), which causes first and second transfer gears 250, 252 to rotate (both clockwise). The gear ratio of the first drive roller gear 246 and the first transfer gear 250 and the gear ratio of the second drive roller gear 248 and the second transfer gear 252 are configured such that the first transfer gear 250 rotates at a slower rate than the second transfer gear 252. Due to the orientation of the first and second one-way bearings 256, 258 and the slower speed of the first transfer gear 250, the first transfer gear 250 locks to and thus rotates the preloader axle 254 (clockwise), while the second transfer gear 252 overrides the preloader axle 254. In other words, when only the drive roller 222 is inputting force into the mechanical dispensing mechanism 220 (due to the driving force imparted by the user) yet the dispensing mechanism 220 would tend to remain stationary due to friction, the first one-way bearing 256 is configured to lock the first transfer gear 250 to the preloader axle 254 and rotate the preloader axle 254 at the slow speed, while the second one-way bearing 258 is configured to cause the second transfer gear 252 to override the preloader axle 254 at the faster speed. The rotation of the preloader axle 254 causes the crescent preloader 276 and the third non-circular gear 264 to rotate (both clockwise). The rotation of the crescent preloader 276 causes the first non-circular gear 260 to rotate (clockwise) via the force stored in the crescent preloader spring 278. The rotation of the first non-circular gear 260 causes the second non-circular gear 262 to rotate (counter-clockwise) along with the second crescent roller axle 238, which causes the second crescent roller gear 244 and the second crescent roller 234 to rotate (both counter-clockwise). The rotation of the second crescent roller gear 244 causes the first crescent roller gear 242 to rotate (clockwise) along with the first crescent roller axle 236, which causes the first crescent roller 232 to rotate (clockwise). The rotation of the third non-circular gear 264 causes the fourth non-circular gear 266 to rotate (counter-clockwise) along with the transfer axle 268, which causes the fifth non-circular gear 270 to rotate (counter-clockwise). The rotation of the fifth non-circular gear 270 causes the sixth non-circular gear 272 to rotate (clockwise) along with the tail spring axle 274, which causes the tail spring arm 280 to rotate (clockwise). The rotation of the tail spring arm 280 causes the tail spring 282 to extend upward and store energy. In this manner, initial pulling of the tail portion 208 downward by the user causes the drive roller 222 to rotate (counter-clockwise), which ultimately causes the crescent rollers 232, 234 to rotate (clockwise and counter-clockwise, respectively) and the tail spring 282 to extend and store energy.

As discussed above, by their nature, the first and second non-circular gears 260, 262 have a varying gear ratio, which is dependent upon the orientation of the non-circular gears 260, 262 throughout a rotation thereof. Accordingly, an output of the first and second non-circular gears 260, 262 to the crescent rollers 232, 234 (via the crescent roller axles 236, 238 and the crescent roller gears 242, 244) varies throughout the dispense cycle, and thus the non-circular gears 260, 262 drive the crescent rollers 232, 234 at a varying rate throughout the dispense cycle. In the first state of the dispense cycle, the first and second non-circular gears 260, 262 are in an orientation in which the output to the crescent rollers 232, 234 is very slow compared to the input from the initial pulling of the tail portion 208. Accordingly, as the user initially pulls the tail portion 208, the crescent rollers 232, 234 rotate at a slower rate than the tail portion 208 is pulled and the drive roller 222 is rotating.

FIG. 5B shows the mechanical dispensing mechanism 220 in a second state of the dispense cycle, following continued pulling of the tail portion 208 until the tail spring 282 reaches a "top-dead-center" orientation. Accordingly, the tail spring 282 has its longest length of the dispense cycle and stores the greatest amount of energy. In the second state, the crescent rollers 232, 234 engage and grip a portion of the leading sheet 202', while the drive roller 222 engages and grips another portion of the leading sheet 202', as is shown. In the second state, the first and second non-circular gears 260, 262 are in an orientation in which the output of the non-circular gears 260, 262 would be very fast, such that the crescent rollers 232, 234 would rotate at a rate faster than the tail portion 208 is pulled and the drive roller 222 is rotating. However, because the crescent rollers 232, 234 and the drive roller 222 are simultaneously gripping the leading sheet 202', and because there is tension in the leading sheet 202' between the crescent rollers 232, 234 and the drive roller 222, the crescent rollers 232, 234 are constrained to rotate at the same rate as the drive roller 222 as the user continues to pull the tail portion 208. The slower actual rate of rotation of the crescent rollers 232, 234 causes the crescent preloader spring 278 to compress and store more energy as the crescent preloader 276 rotates faster than the first non-circular gear 260, which is limited in speed by the crescent rollers 232, 234 as described above. Because the drive roller 222 is still inputting force into the mechanical dispensing mechanism 220 (due to the continued driving force imparted by the user), the first transfer gear 250 remains locked to and thus continues to rotate the preloader axle 254 according to the slow gear ratio of the first drive roller gear 246 and the first transfer gear 250, while the second transfer gear 252 continues to override the preloader axle 254. In the second state, the leading perforation line 206' is disposed along the rear side of the drive roller 222, and thus the leading perforation line 206' generally is not exposed to the full tension generated in the leading sheet 202' between the crescent rollers 232, 234 and the drive roller 222. As the user continues to pull the tail portion 208, the various gears continue to rotate as described above and the tail spring 282 moves beyond the top-dead-center orientation and begins to retract and release the stored energy, which reduces the driving force required from the user. Further, as the user continues to pull the tail portion 208, the tension generated in the leading sheet 202' between the crescent rollers 232, 234 and the drive roller 222 increases as the crescent preloader spring 278 continues to compress and store more energy. Further, as the user continues to pull the tail portion 208, the leading perforation line 206' is exposed to increasing tension as it rotates along the drive roller 222 and closer to the crescent rollers 232, 234.

FIG. 5C shows the mechanical dispensing mechanism 220 in a third state of the dispense cycle, following continued pulling of the tail portion 208 until the leading perforation line 206' advances over the top of the drive roller 222. In the third state, the drive roller 222 and the pinch roller 224 engage and grip a portion of the next sheet 202" received therebetween, while the crescent rollers 232, 234 engage and grip a portion of the leading sheet 202'. Because the leading perforation line 206' is disposed far enough along the front side of the drive roller 222, the leading perforation line 206' is exposed to the tension generated in the leading sheet 202' between the crescent rollers 232, 234 and the drive roller 222. Ultimately, as the user continues to pull the tail portion 208, the leading perforation line 206' is exposed to enough tension to separate the leading sheet 202' from the next sheet 202" along the leading perforation line 206', as is shown. Upon separation of the leading sheet 202', the crescent rollers 232, 234 are no longer constrained to rotate at the same rate as the drive roller 222. Accordingly, the crescent preloader spring 278 expands and releases the stored energy, which causes the first and second non-circular gears 260, 262 to continue to rotate (clockwise and counter-clockwise, respectively), which ultimately causes the crescent rollers 232, 234 to continue to rotate (clockwise and counter-clockwise, respectively) and advance the leading sheet 202'.

Further, upon separation of the leading sheet 202', the drive roller 222 is no longer inputting force into the mechanical dispensing mechanism 220. However, the tail spring 282 is beyond the top-dead-center orientation and continues to release the stored energy by rotating the tail spring arm 280 (clockwise) along with the tail spring axle 274, which causes the sixth non-circular gear 272 to continue to rotate (clockwise). The tail spring 282 continues to release the stored energy until it reaches the bottom-dead-center orientation. The rotation of the sixth non-circular gear 272 causes the fifth non-circular gear 270 to continue to rotate (counter-clockwise) along with the transfer axle 268, which causes the fourth non-circular gear 266 to continue to rotate (counter-clockwise). The rotation of the fourth non-circular gear 266 causes the third non-circular gear 264 to continue to rotate (clockwise) along with the preloader axle 254. In the third state of the dispense cycle, due to the orientation of the first and second one-way bearings 256, 258, the second transfer gear 252 locks to and thus rotates (clockwise) with the preloader axle 254, while first transfer gear 250 overrides the preloader axle 254. In other words, when the tail spring 282 is releasing the stored energy and thus driving the mechanical dispensing mechanism 220, the second one-way bearing 258 is configured to lock the second transfer gear 252 to the preloader axle 254, and the first one-way bearing 256 is configured to cause the first transfer gear 250 to override the preloader axle 254. The rotation of the second transfer gear 252 causes the second drive roller gear 248 to continue to rotate (counter-clockwise) along with the drive roller axle 226, which causes the drive roller 222 to continue to rotate (counter-clockwise) and advance the next sheet 202". In this manner, upon separation of the leading sheet 202', the release of the stored energy by the crescent preloader spring 278 ultimately causes the crescent rollers 232, 234 to continue to rotate and advance the leading sheet 202', and the release of the stored energy by the tail spring 282 ultimately causes the drive roller 222 to continue to rotate and advance the next sheet 202". The crescent rollers 232, 234 continue to rotate into an open orientation in which the crescent rollers 232, 234 disengage and release grip of the leading sheet 202', allowing the user to take the leading sheet 202'. Meanwhile, the drive roller 222 continues to rotate and advance the next sheet 202", as the mechanical dispensing mechanism 220 returns to the first state, as is shown in FIG. 5A, and is ready to begin a subsequent dispense cycle.

The dispenser 200 may be configured to mechanically synchronize a dispense cycle with the perforation lines 206 of the roll 204 of sheet product. Specifically, the mechanical dispensing mechanism 220 may be configured to mechanically synchronize a dispense cycle with a leading perforation line 206' (a next perforation line 206" of a previous dispense cycle) that advanced too far during the previous dispense cycle (i.e., a leading perforation line 206' that is advanced further than the leading perforation line 206' shown in FIG. 5A). The mechanical dispensing mechanism 220 also may be configured to mechanically synchronize a dispense cycle with a leading perforation line 206' (a next perforation line 206" of a previous dispense cycle) that did not advance far enough during the previous dispense cycle (i.e. a leading perforation line 206' that is not advanced as far as the leading perforation line 206' shown in FIG. 5A).

Mechanical synchronization may occur between the second state and the third state of the dispense cycle. As described above, in the second state (before separation of the leading sheet 202'), as the drive roller 222 is inputting force into the mechanical dispensing mechanism 220 (due to the continued driving force imparted by the user prior to separation of the leading sheet 202'), the first transfer gear 250 is locked to and thus rotates the preloader axle 254 along with the third non-circular gear 264 according to the lower output of the first drive roller gear 246 and the first transfer gear 250. In this manner, before separation of the leading sheet 202', the first drive roller gear 246 and the first transfer gear 250 cause the third non-circular gear 264 to rotate at a relatively low speed. In the third state (after separation of the leading sheet 202'), as the tail spring 282 drives the mechanical dispensing mechanism 220 (due to the release of the stored energy by the tail spring 282), the second transfer gear 252 is locked to and thus rotates with the preloader axle 254 being rotated by the third non-circular gear 264, and the second drive roller gear 248 rotates the drive roller axle 226 and the drive roller 222 according to the different output of the second transfer gear 252 and the second drive roller gear 248. In this manner, after separation of the leading sheet 202', the second drive roller gear 248 and the second transfer gear 252 allow the third non-circular gear 264 to rotate at a relatively high speed. It may be appreciated that, in the illustrated embodiment, the third non-circular gear 264 nominally rotates once per dispense cycle. As described above, the drive roller 222 rotates relatively quickly compared to the third non-circular gear 264 during the first state and the second state. The drive roller 222 rotates less quickly compared to the third non-circular gear 264 during the third state.

If, for some reason, a leading perforation line 206' advanced too far during a previous dispense cycle, during a new dispense cycle, the second state would end sooner (the sheet product would be pulled over the drive roller 222 for a decreased period of time as compared to a typical dispense cycle) because the leading perforation line 206' would be exposed sooner to enough tension to separate the leading sheet 202' from the next sheet 202". Accordingly, the third state would begin sooner, and the drive roller 222 would spend an increased portion of time (as compared to a typical dispense cycle) rotating less quickly, allowing the mechanical dispensing mechanism 220 to catch up to the next perforation line 206". If, for some reason, a leading perforation line 206' did not advance far enough during a previous dispense cycle, during a new dispense cycle, the second state would last a longer duration (the sheet product would be pulled over the drive roller 222 for an increased period of time as compared to a typical dispense cycle) because the leading perforation line 206' would be exposed later to enough tension to separate the leading sheet 202' from the next sheet 202". Accordingly, the third state would begin later, and the drive roller 222 would spend an increased portion of time (as compared to a typical dispense cycle) rotating more quickly, allowing the next perforation line 206" to catch up to the mechanical dispensing mechanism 220. In this manner, the mechanical dispensing mechanism 220, and thus the overall dispenser 200, may compensate and synchronize a dispense cycle with the perforation lines 206 of the roll 204 of sheet product.

The dispenser 200 may be configured to dispense individual sheets 202 having a predetermined sheet length (i.e., the roll 204 has a predetermined distance between adjacent perforation lines 206), which may depend on the type of sheet product dispensed. For example, the dispenser 200 may be configured to dispense individual sheets 202 of paper towels having a predetermined sheet length of 8.5 inches. Based on the configuration and operation of the mechanical dispensing mechanism 220, the sheet length may be equal to a sum of a length of the tail portion 208 (a "tail length") and a length over which a user pulls the tail portion 208 (a "pull length") during the dispense cycle. For example, the dispenser 200 may be configured to dispense individual sheets 202 having a sheet length of 8.5 inches, wherein the tail length is 4.25 inches and the pull length is 4.25 inches.

The dispenser 200 also may be configured to mechanically "lockout" (i.e., prevent dispensing of) a roll 204 of sheet product including individual sheets 202 having a sheet length outside of a predetermined range. For example, the dispenser 200 may be configured to mechanically lockout a roll 204 of sheet product including individual sheets 202 having a sheet length outside of a predetermined range of 7.85 to 9.15 inches. As described above, proper operation of the mechanical dispensing mechanism 220 requires the perforation lines 206 to be disposed generally at certain positions relative to the various rollers and gears at certain portions of a dispense cycle. Attempting to dispense a roll 204 of sheet product including individual sheets 202 having a sheet length outside of a predetermined range would cause the perforation lines 206 to be disposed at incorrect positions relative to the various rollers and gears at certain portions of a dispense cycle. It will be understood that the dimensions of the dispenser 200, particularly the mechanical dispensing mechanism 220, and the individual sheets 202 may be selected depending upon the type of sheet product to be dispensed.

The mechanical dispensing mechanism 220 of dispenser 200 may provide significant advantages over mechanical dispensing mechanisms of known hands-free sheet product dispensers. In particular, the various non-circular gears of the mechanical dispensing mechanism 220 may provide significant advantages over conventional circular gears used in known mechanical dispensing mechanisms.

As described above, the first and second non-circular gears 260, 262 may be configured to drive the crescent rollers 232, 234 at a varying speed throughout a dispense cycle. Specifically, the first and second non-circular gears 260, 262 may be configured to drive the crescent rollers 232, 234 at a higher speed while the crescent rollers 232, 234 are engaging and gripping the sheet product, and to drive the crescent rollers 232, 234 at a lower speed while the crescent rollers 232, 234 are not engaging the sheet product. The portions of the first and second non-circular gears 260, 262 that mesh while the crescent rollers 232, 234 are engaging and gripping the sheet product may have a constant pitch radius. In this manner, the first and second non-circular gears 260, 262 may maintain a constant gear ratio while the crescent rollers 232, 234 are engaging and gripping the sheet product, such that a known tension is maintained in the sheet product as the leading sheet 202' separates from the next sheet 202" along the leading perforation line 206'.

It would be possible to drive the crescent rollers 232, 234 of the dispenser 200 with conventional circular gears (instead of the first and second non-circular gears 260, 262), such that the crescent rollers 232, 234 would rotate at a constant speed throughout a dispense cycle. However, the crescent rollers 232, 234 would require a much larger radius in order to rotate fast enough while gripping to generate enough tension in the sheet product to separate the leading sheet 202' from the next sheet 202" along the leading perforation line 206'. The larger crescent rollers 232, 234 would require a larger housing 210 to contain the mechanical dispensing mechanism 220. Further, the larger crescent rollers 232, 234 would require a higher pull force (i.e., a driving force imparted by a user) for a given sheet length, as the larger crescent rollers 232, 234 would require a shorter pull length and a longer tail length in order for the tail portion 108 to extend far enough beyond the crescent rollers 232, 234 to be grasped and pulled by a user. Ultimately, as compared to conventional circular gears, the first and second non-circular gears 260, 262 may allow a smaller housing 210 to be used, a lower pull force required for a given sheet length, and a longer pull length required for a given sheet length.

As described above, the fifth and sixth non-circular gears 270, 272 may be configured to drive the tail spring arm 280 to cause the tail spring 282 to extend and store energy during a first portion of the dispense cycle, and to be driven by the tail spring arm 280 as the tail spring 282 retracts and releases the stored energy during a second portion of the dispense cycle. In this manner, a portion of the pull force required to carry out the dispense cycle is used to extend the tail spring 282 throughout the first portion of the dispense cycle. As is shown, the fifth and sixth non-circular gears 270, 272 may have varying radius relationships with respect to one another throughout the dispense cycle. Specifically, in the first state (FIG. 5A), the fifth non-circular gear 270 may have a larger pitch radius than the sixth non-circular gear 272, while the tail spring 282 is held at the bottom-dead-center orientation. Accordingly, as the user pulls the tail portion 208 and the fifth and sixth non-circular gears 270, 272 rotate as described above, the sixth non-circular gear 272 rotates at a higher rate than the fifth non-circular gear 270, which causes the tail spring arm 280 to rotate at the higher rate and more quickly be positioned to extend the tail spring 282 to store energy. Following continued pulling of the tail portion 208 and rotation of the fifth non-circular gear 270 about ninety degrees, the sixth non-circular gear 272 may also have rotated about ninety degrees, positioning the tail spring arm 280 with the greatest moment art with the tail spring 282. In this position, the sixth non-circular gear 272 have a larger pitch radius than the fifth non-circular gear 270, while the tail spring 282 exerts the maximum torque against the sixth non-circular gear 272. Accordingly, the fifth and sixth non-circular gears 270, 272 may reduce the pull force required at this point of the dispense cycle.

Figure 6:
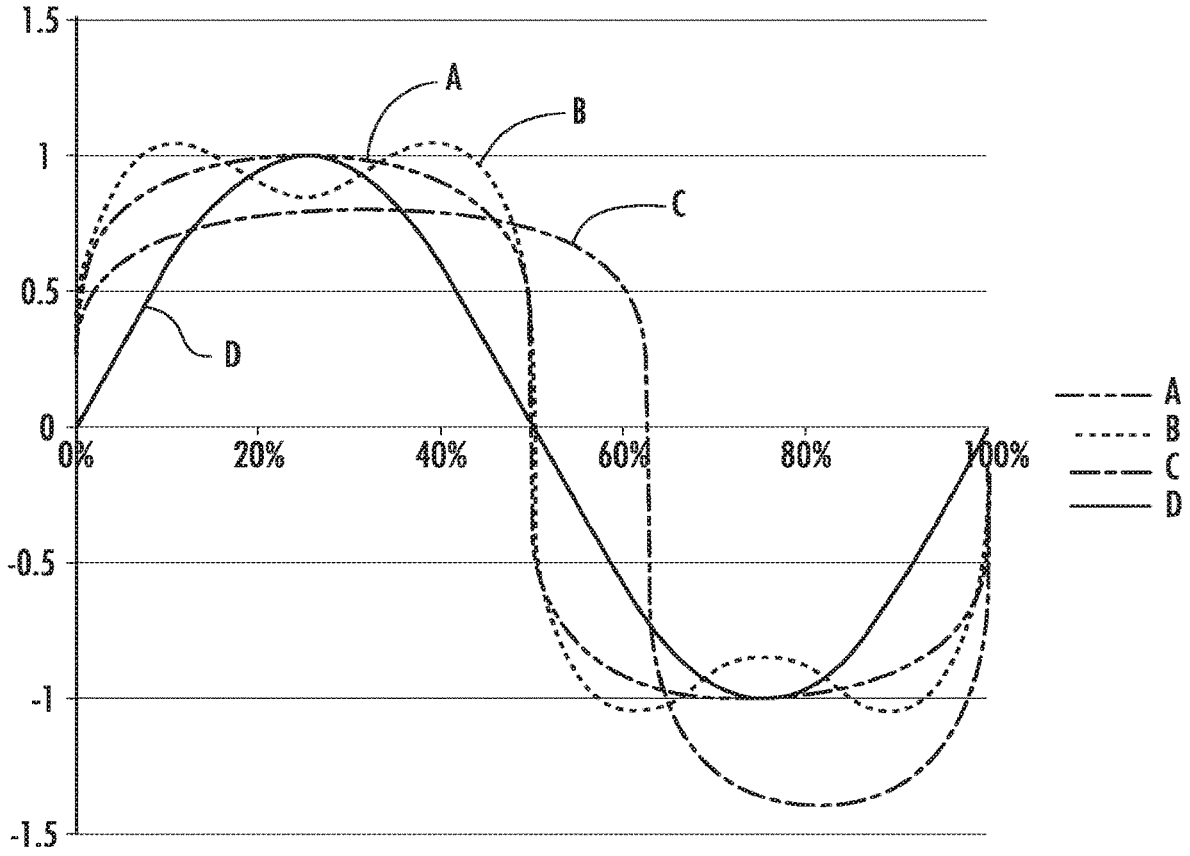
FIG. 6 is a graph of a force required to extend a tail spring as a function of a percentage of completion of a dispense cycle as may be carried out using the example mechanical hands-free sheet product dispenser of FIG. 3.

FIG. 6 shows a graph of a force required to pull the tail portion 208 in order to extend the tail spring 282 as a function of a percentage of completion of a dispense cycle of the dispenser 200, including force curves A, B, C according to different embodiments of the dispenser 200. For comparison, the graph also shows a force curve D for a conventional tail spring of a known mechanical hands-free dispenser including a rotating drum, as described above. A user pulls sheet product from the dispenser throughout a dispense cycle, which causes the drum to rotate and the tail spring to extend and then retract. As is shown by the force curve D, the force required to extend the tail spring increases and decreases in a generally sinusoidal pattern. In this manner, for a first half of the dispense cycle, the force required to extend the tail spring gradually increases, reaches a peak, and then gradually decreases to zero. For a second half of the dispense cycle, the force gradually increases negatively (i.e., the spring retracts and causes the drum to rotate), reaches a peak, and then gradually decreases negatively to zero. The area under the positive portion of the force curve D represents the energy input to the tail spring by rotating the drum, and the area under the negative portion of the force curve D (equal to the area under the positive portion) represents the energy output from the tail spring to rotate the drum.

It would be possible to drive the tail spring 282 of the dispenser 200 with conventional circular gears (instead of the fifth and sixth non-circular gears 270, 272), which would result in a force curve similar to the force curve D. However, the constant radius relationship of the conventional circular gears would determine the energy input and output for a given peak force, and the constant radius relationship of the conventional circular gears also would determine the peak force for a given energy input and output. In contrast, the varying radius relationships of the fifth and sixth non-circular gears 270, 272 may be configured to independently determine the peak force and the energy input and output. As is shown, the force curves A, B, C each have a positive portion corresponding to the portion of the dispense cycle during which the fifth and sixth non-circular gears 270, 272 drive the tail spring arm 280 to cause the tail spring 282 to extend and store energy. The force curves A, B, C also each have a negative portion corresponding to the portion of the dispense cycle during which the tail spring arm 280 drives the fifth and sixth non-circular gears 270, 272 as the tail spring 282 retracts and releases the stored energy. According to different embodiments, the fifth and sixth non-circular gears 270, 272 may have radius relationships that affect the peak force required to extend the tail spring 282 and the energy input required to extend the tail spring 282 (and thus also the energy output from the tail spring 282). For example, as compared to conventional circular gears, the fifth and sixth non-circular gears 270, 272 may be configured to provide a greater energy input and output for a given peak force required to extend the tail spring 282, as shown by force curves A and B. Alternatively, as compared to conventional circular gears, the fifth and sixth non-circular gears 270, 272 may be configured to provide a lower peak force required to extend the tail spring 282 for a given energy input and output. Further, as compared to conventional circular gears, the fifth and sixth non-circular gears 270, 272 may be configured to provide a lower peak force required to extend the tail spring 282 and a greater energy input and output. Ultimately, because the peak force required to extend the tail spring 282 is provided by the user pulling the tail portion 208, the fifth and sixth non-circular gears 270, 272 may be configured to allow a lower overall pull force required for a given sheet length, which may allow a lower paper strength of the sheet product and also may improve user perception of the dispenser 200.

As described above, the third and fourth non-circular gears 264, 266 may be configured to be driven by the preloader axle 254 during a first portion of the dispense cycle (before separation of the leading sheet 202'), and to drive the preloader axle 254 during a second portion of the dispense cycle (after separation of the leading sheet 202') to ultimately cause the drive roller 222 to advance a tail portion 208 for a subsequent dispense cycle. As is shown, the third and fourth non-circular gears 264, 266 each may have discontinuous pitch radii defined by a larger section and a smaller section thereof, the larger section having a larger, constant pitch radius and the smaller section having a smaller, constant pitch radius. In this manner, the third and fourth non-circular gears 264, 266 may be configured to provide two different rate relationships, depending on the orientation of the third and fourth non-circular gears 264, 266. Specifically, the third non-circular gear 264 may have the larger pitch radius during the first portion of the dispense cycle, such that the fourth non-circular gear 266 rotates at a higher rate than the third non-circular gear 264. Accordingly, during the first portion of the dispense cycle, the transfer axle 268 may rotate at a higher rate than the preloader axle 254. Further, the fourth non-circular gear 266 may have the larger pitch radius during the second portion of the dispense cycle, such that the third non-circular gear 264 rotates at a higher rate than the fourth non-circular gear 266. Accordingly, during the second portion of the dispense cycle, the preloader axle 254 may rotate at a higher rate than the transfer axle 268. The rate relationship of the third and fourth non-circular gears 264, 266 during the first portion of the dispense cycle may be configured such that the user is allowed to pull the tail portion 208 over a predetermined pull length. The rate relationship of the third and fourth non-circular gears 264, 266 during the second portion of the dispense cycle may be configured such that the drive roller 222 advances the next tail portion 208 having a predetermined tail length. For example, the dispenser 200 may be configured to dispense individual sheets 202 having a sheet length of 8.5 inches, and the rate relationships of the third and fourth non-circular gears 264, 266 may be configured such that, in conjunction with the above-described behavior of the drive roller gears 246, 248, the transfer gears 250, 250, the one-way bearings 256, 258, the first non-circular gear 260, and the second non-circular gear 262, the user is allowed to pull the tail portion 208 over a pull length of 4.9 inches, and such that the drive roller 222 advances the next tail portion 208 having a tail length of 3.6 inches.

It will be understood that the rate relationships of the third and fourth non-circular gears 264, 266 may be selected depending upon the sheet length, pull length, and tail length desired. A longer sheet length may allow for a pull length that is greater than a tail length. For example, the dispenser 200 may be configured to dispense individual sheets 202 having a sheet length of 11.0 inches, and the rate relationships of the third and fourth non-circular gears 264, 266 may be configured such that the user is allowed to pull the tail portion 208 over a pull length of 7.0 inches, and such that the drive roller 222 advances the next tail portion 208 having a tail length of 4.0 inches. According to this example, the fifth and sixth non-circular gears 270, 272 may be configured to produce the force curve C, which provides a lower peak force required to extend the tail spring 282 and a greater spring force available to advance the next tail portion 208 for greater dispenser reliability. The force curve C also provides a flatter, smoother shape than a sine wave for greater energy input and output to advance the next tail portion 208 as well as improved user perception.

Ultimately, as compared to known dispensers, the dispenser 200 may allow a lower pull force (i.e., a driving force imparted by a user) required for a given sheet length and tail length. Additionally, as compared to known dispensers, the dispenser 200 may allow a lower paper strength required for a given sheet length and tail length, due to the lower pull force allowed. Further, as compared to known dispensers, the dispenser 200 may generate a greater amount of energy from a given pull force, which may provide greater reliability in presenting a tail portion.

Figure 7:
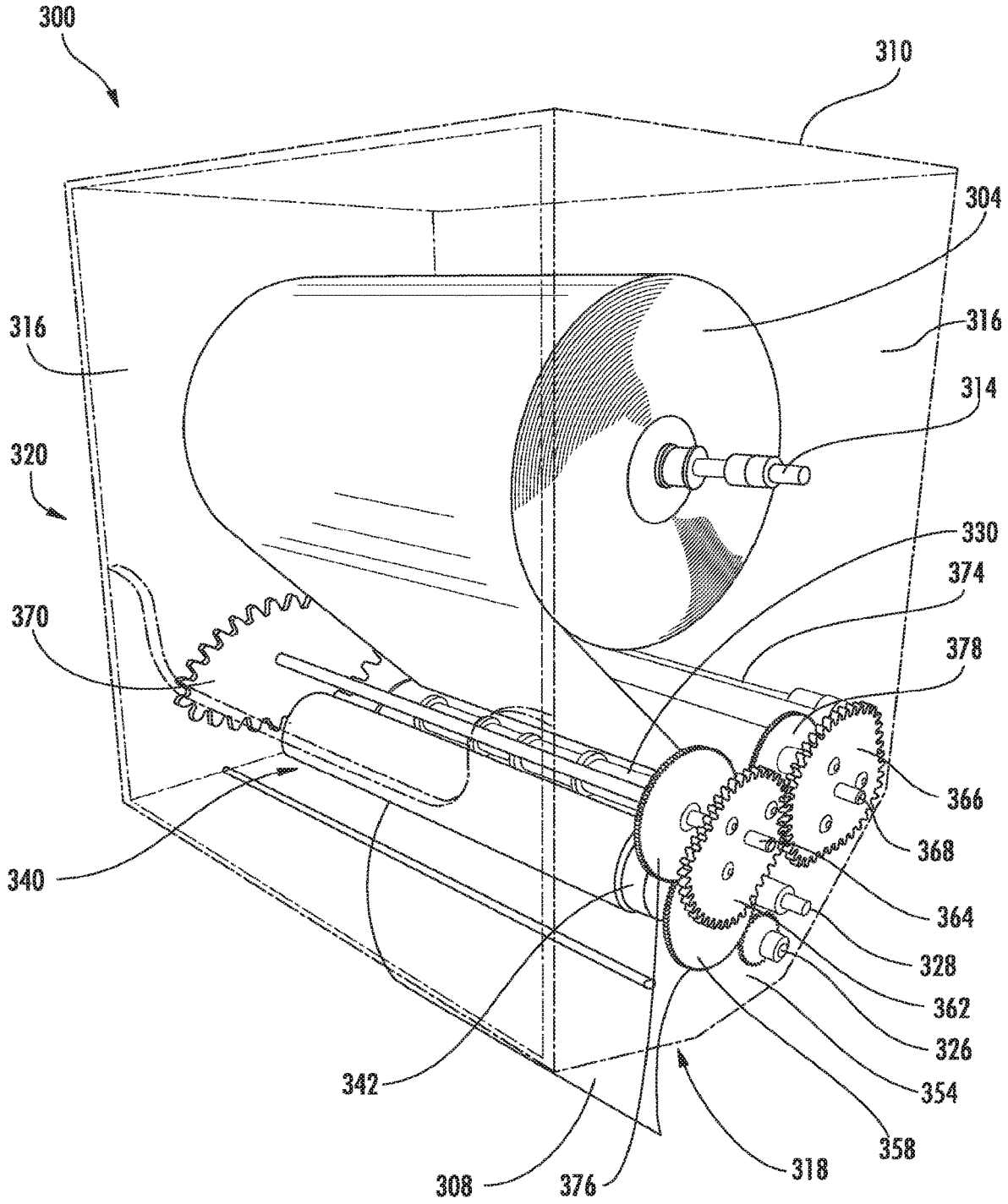
FIG. 7 is a perspective view of an example mechanical hands-free sheet product dispenser in accordance with one or more embodiments of the disclosure.
Figure 8:
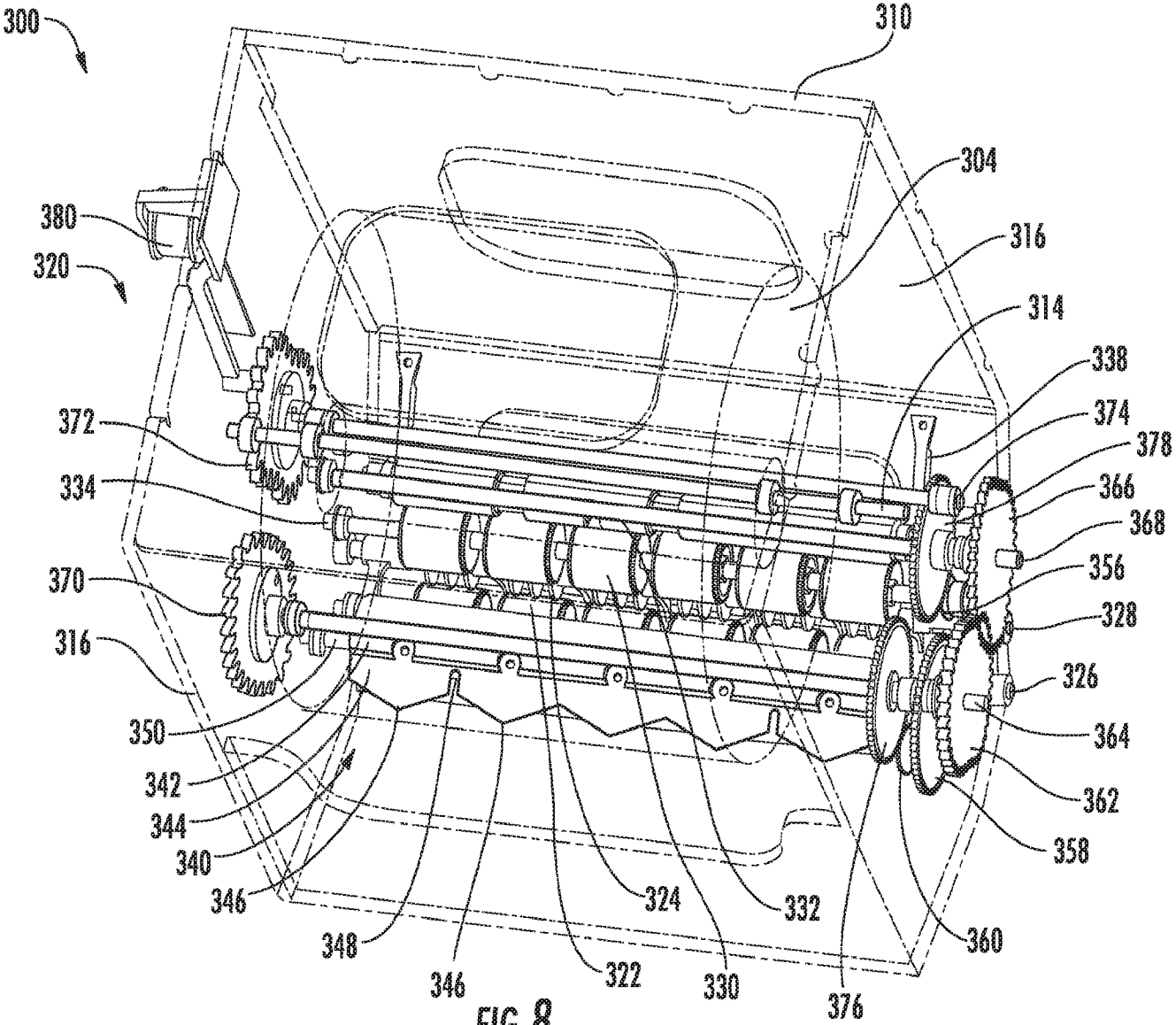
FIG. 8 is a perspective view of the example mechanical hands-free sheet product dispenser of FIG. 7.

FIGS. 7 and 8 show perspective views of an example mechanical hands-free sheet product dispenser 300 in accordance with one or more embodiments of the disclosure. FIGS. 9A-9F show side views of a portion of the dispenser 300 in different states during a dispense cycle. The dispenser 300 may be configured to dispense individual sheets 302 from a roll 304 of non-perforated sheet product. The roll 304 of non-perforated sheet product may be formed in a conventional manner. As is described in detail herein below, the dispenser 300 may be configured to present a tail portion 308 (i.e., an exposed end portion) of the roll 304 to be grasped and pulled by a user during a dispense cycle. Specifically, as is shown, the tail portion 308 may be a leading end portion of the roll 304 to be dispensed during a dispense cycle.

As is shown, the dispenser 300 may include a housing 310, and the roll 304 of non-perforated sheet product may be disposed within the housing 310 for dispensing the individual sheets 302 therefrom. The roll 304 may be rotatably supported within the housing 310 by a roll support, such as a roll shaft 314 attached to opposing side walls 316 of the housing 310. In some embodiments, the housing 310 may include a dispenser outlet 318 defined in a wall thereof, such as a front wall or a bottom wall of the housing. The dispenser 300 may be configured to present the tail portion 308 extending from the dispenser outlet 318 and out of the housing 310 to be grasped and pulled by a user.

The dispenser 300 also may include a mechanical dispensing mechanism 320 disposed within the housing 310 and configured to guide and advance the sheet product from the roll 304 during a dispense cycle. The mechanical dispensing mechanism 320 may include a number of rollers configured to guide and advance the sheet product from the roll 304 during a dispense cycle as a user grasps and pulls the tail portion 308 to impart a driving force thereto. Specifically, the number of rollers may include a first drive roller 322 and a first pinch roller 324 attached to the housing 310 and configured to receive the sheet product therebetween. The first drive roller 322 and the first pinch roller 324 may be configured to engage and grip the sheet product throughout the dispense cycle. As is shown, the first drive roller 322 may be positioned about and coupled to a first drive roller axle 326 supported by the side walls 316 of the housing 310 and allowing the first drive roller 322 to rotate with respect to the housing 310. The first pinch roller 324 similarly may be positioned about and coupled to a first pinch roller axle 328 supported by the housing 310 and allowing the first pinch roller 324 to rotate with respect to the housing 310. The number of rollers also may include a second drive roller 330 and a second pinch roller 332 attached to the housing 310 and configured to receive the sheet product therebetween. The second drive roller 330 and the second pinch roller 332 may be configured to engage and grip the sheet product throughout the dispense cycle. As is shown, the second drive roller 330 may be positioned about and coupled to a second drive roller axle 334 supported by the side walls 316 of the housing 310 and allowing the second drive roller 330 to rotate with respect to the housing 310. The second pinch roller 332 similarly may be positioned about and coupled to a second pinch roller axle 336 supported by the housing 310 via a second pinch roller arm 338 and allowing the second pinch roller 332 to rotate with respect to the housing 310.

The mechanical dispensing mechanism 320 also may include a cutting mechanism 340 configured to guide and cut the sheet product during a dispense cycle to define an individual sheet 302 to be dispensed to a user. The cutting mechanism 340 may include a drum 342 and a cutting knife 344. As is shown, the cutting knife 344 may be coupled to the drum 342 and may include a plurality of teeth 346 extending outward from the drum 342. The teeth 346 may be configured to penetrate and cut the sheet product during a portion of the dispense cycle to at least partially define the individual sheet 302 to be dispensed to the user. The cutting knife 344 also may include one or more notches 348 defined between one or more adjacent pairs of the teeth 346. The notches 348 may be configured to allow the individual sheet 302 to remain partially connected to a remainder of the roll 304 of sheet product after the teeth 346 penetrate and cut the sheet product. In other words, the cutting knife 344 may be configured to cut the sheet product to partially define the individual sheet 302, while allowing the individual sheet 302 to remain connected to the remainder of the roll 304 via small strips of sheet product corresponding to the notches 348. As is shown, the drum 342 may be positioned about and coupled to a drum axle 350 supported by the side walls 316 of the housing 310 and allowing the drum 342 to rotate with respect to the housing 310.

The mechanical dispensing mechanism 320 also may include a number of gears configured to drive the second drive roller 330 at a varying rate throughout a dispense cycle, as is described in detail below. Specifically, the number of gears may include a first drive roller gear 354 positioned about and coupled to the first drive roller axle 326 supported by the housing 310 and allowing the first drive roller gear 354 to rotate with respect to the housing 310. As is shown, the first drive roller gear 354 may be a circular gear. The number of gears also may include a second drive roller gear 356 positioned about and coupled to the second drive roller axle 334 supported by the housing 310 and allowing the second drive roller gear 356 to rotate with respect to the housing 310. As is shown, the second drive roller gear 356 may be a circular gear. The number of gears also may include first and second drum gears 358, 360 each positioned about and coupled to the drum axle 350 supported by the housing 310 and allowing the first and second drum gears 358, 360 to rotate with respect to the housing 310. As is shown, the first and second drum gears 358, 360 may be circular gears, and the first drum gear 358 may engage the first drive roller gear 354 throughout the dispense cycle.

The number of gears also may include a first non-circular gear 362 positioned about and coupled to a first non-circular gear axle 364 supported by the housing 310 and allowing the first non-circular gear 362 to rotate with respect to the housing 310. As is shown, the first non-circular gear 362 may have a customized shape including segments with constant pitch radius and other segments with smooth and continuously changing pitch radii. The number of gears also may include a second non-circular gear 366 positioned about and coupled to a second non-circular gear axle 368 supported by the housing 310 and allowing the second non-circular gear 366 to rotate with respect to the housing 310. As is shown, the second non-circular gear 366 may have a customized shape that complements the shape of the first non-circular gear 362 and may engage the first non-circular gear 362 throughout the dispense cycle. The number of gears also may include a third non-circular gear 370 positioned about and coupled to the first non-circular gear axle 364 supported by the housing 310 and allowing the third non-circular gear 370 to rotate with respect to the housing 310. As is shown, the third non-circular gear 370 may have a shape that has a continually changing pitch radius that is customized to deliver a desired dispenser performance. The number of gears also may include a fourth non-circular gear 372 positioned about and coupled to a fourth non-circular gear axle 374 supported by the housing 310 and allowing the fourth non-circular gear 372 to rotate with respect to the housing 310. As is shown, the fourth non-circular gear 372 may have a shape that complements the shape of the third non-circular gear 370 and may engage the third non-circular gear 370 throughout the dispense cycle.

The number of gears also may include a first transfer gear 376 positioned about and coupled to the first non-circular gear axle 364 supported by the housing 310 and allowing the first transfer gear 376 to rotate with respect to the housing 310. As is shown, the first transfer gear 376 may be a circular gear that engages the second drum gear 360 throughout the dispense cycle. The number of gears also may include a second transfer gear 378 positioned about and coupled to the second non-circular gear axle 368 supported by the housing 310 and allowing the second transfer gear 378 to rotate with respect to the housing 310. As is shown, the second transfer gear 378 may be a circular gear that engages the second drive roller gear 356 throughout the dispense cycle.

The mechanical dispensing mechanism 320 also may include a tail spring 380, such as a coil spring, coupled to the fourth non-circular gear 372 and the housing 310, as is shown. As is described in detail below, the tail spring 380 may be configured to extend and store energy as the fourth non-circular gear 372 rotates with respect to the housing 310 during a portion of the dispense cycle, and to retract and release the stored energy as the fourth non-circular gear 372 rotates with respect to the housing 310 during another portion of the dispense cycle.

Figure 9A:
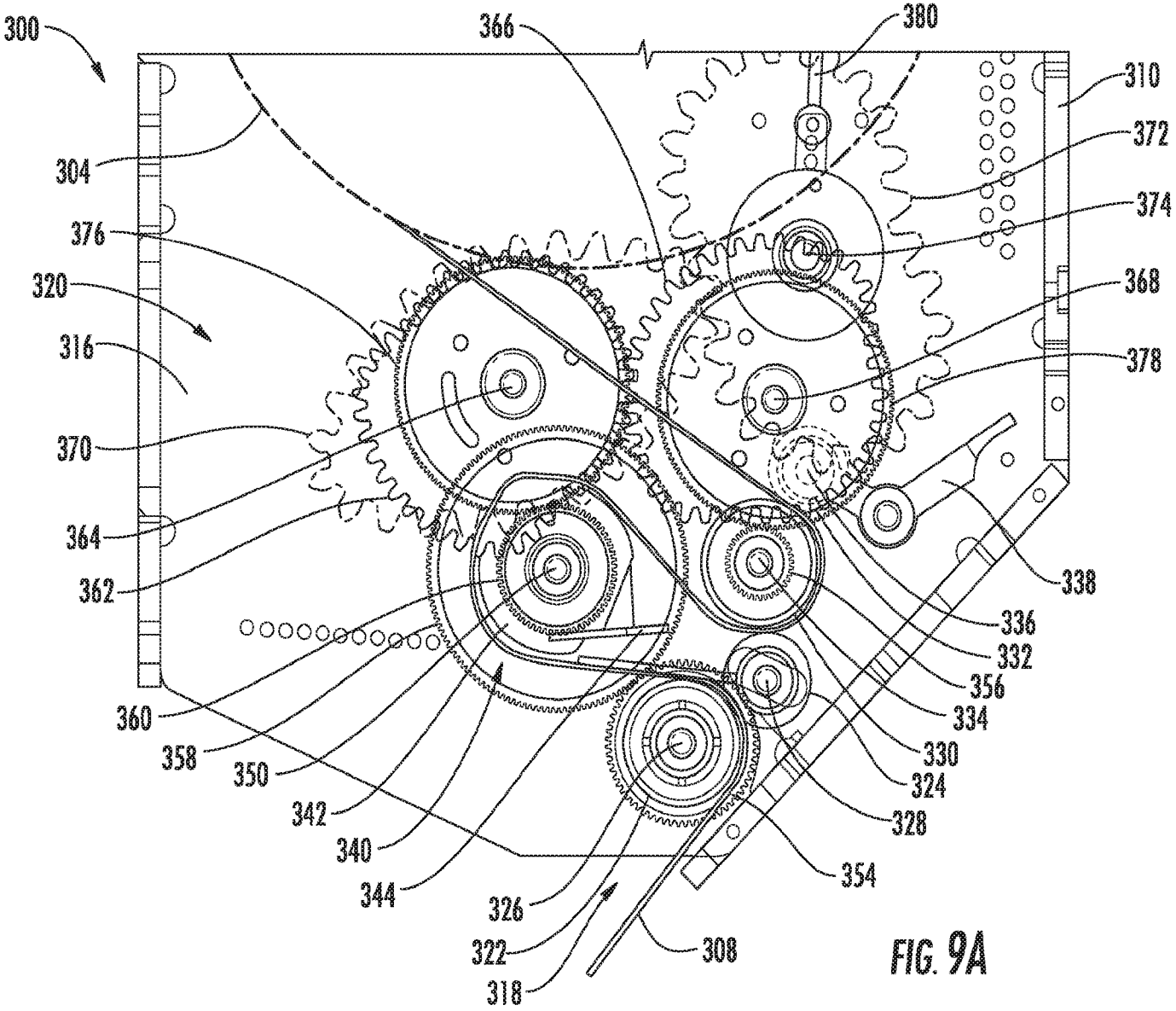
FIG. 9A is a side view of a portion of the example mechanical hands-free sheet product dispenser of FIG. 7, showing a mechanical dispensing mechanism in a first state during a dispense cycle.

FIGS. 9A-9F show side views of the mechanical dispensing mechanism 320 in a number of different states during a dispense cycle as may be carried out using the dispenser 300. FIG. 9A shows the mechanical dispensing mechanism 320 in a first state of the dispense cycle, in which the tail portion 308 (the exposed end portion of the roll 304) is presented and available to be grasped and pulled by a user. In the first state, the first drive roller 322 and the first pinch roller 324 are engaging and gripping a portion of the sheet product received therebetween, while the second drive roller 330 and the second pinch roller 332 are engaging and gripping another portion of the sheet product therebetween. Meanwhile, the drum 342 is loosely engaging yet another portion of the sheet product disposed thereover, and the cutting knife 344 is oriented such that it does not engage the sheet product. In other words, the portion of the sheet product disposed over drum 342 has some slack, as is shown. In the first state, the tail spring 380 is retracted and has its shortest length of the dispense cycle.

The user pulls the tail portion 308 downward to impart a driving force to the sheet product to carry out the dispense cycle. As the user initially pulls the tail portion 308 downward, the first drive roller 322 and the first pinch roller 324 continue to grip a portion of the sheet product received therebetween, which causes the first drive roller 322 to rotate (clockwise in the side views shown) along with the first drive roller axle 326. The rotation of the first drive roller axle 326 causes the first drive roller gear 354 to rotate (clockwise), which causes first drum gear 358 to rotate (counter-clockwise) along with the drum axle 350. The rotation of the drum axle 350 causes the cutting mechanism 340 and the second drum gear 360 to rotate (both counter-clockwise), which causes the first transfer gear 376 to rotate (clockwise) along with the first non-circular gear axle 364. The rotation of the first non-circular gear axle 364 causes the first non-circular gear 362 and the third non-circular gear 370 to rotate (both clockwise). The rotation of the third non-circular gear 370 causes the fourth non-circular gear 372 to rotate (counter-clockwise) along with the fourth non-circular gear axle 374, which causes the tail spring 380 to extend downward and store energy. The rotation of the first non-circular gear 362 causes the second non-circular gear 366 to rotate (counter-clockwise) along with the second non-circular gear axle 368, which causes the second transfer gear 378 to rotate (counter-clockwise). The rotation of the second transfer gear 378 causes the second drive roller gear 356 to rotate (clockwise) along with the second drive roller axle 334, which causes the second drive roller 330 to rotate (clockwise) and advance the engaged portion of the sheet product. In this manner, initial pulling of the tail portion 308 downward by the user causes the first drive roller 322 to rotate (clockwise), which ultimately causes the second drive roller 330 to rotate (clockwise) and the tail spring 380 to extend and store energy.

As discussed above, by their nature, the first and second non-circular gears 362, 366 have a varying gear ratio, which is dependent upon the orientation of the non-circular gears 362, 366 throughout a rotation thereof. Accordingly, an output of the first and second non-circular gears 362, 366 to the second drive roller 330 (via the second non-circular gear axle 368, the second transfer gear 378, the second drive roller gear 356, and the second drive roller axle 334) varies throughout the dispense cycle, and thus the non-circular gears 362, 366 drive the second drive roller 330 at a varying rate throughout the dispense cycle. In the first state of the dispense cycle, the first and second non-circular gears 362, 366 are in an orientation in which the output to the second drive roller 330 is slow compared to the input from the initial pulling of the tail portion 308. Accordingly, as the user initially pulls the tail portion 308, the second drive roller 330 rotates at a slower rate than the tail portion 308 is pulled and the first drive roller 322 rotates.

Figure 9B:
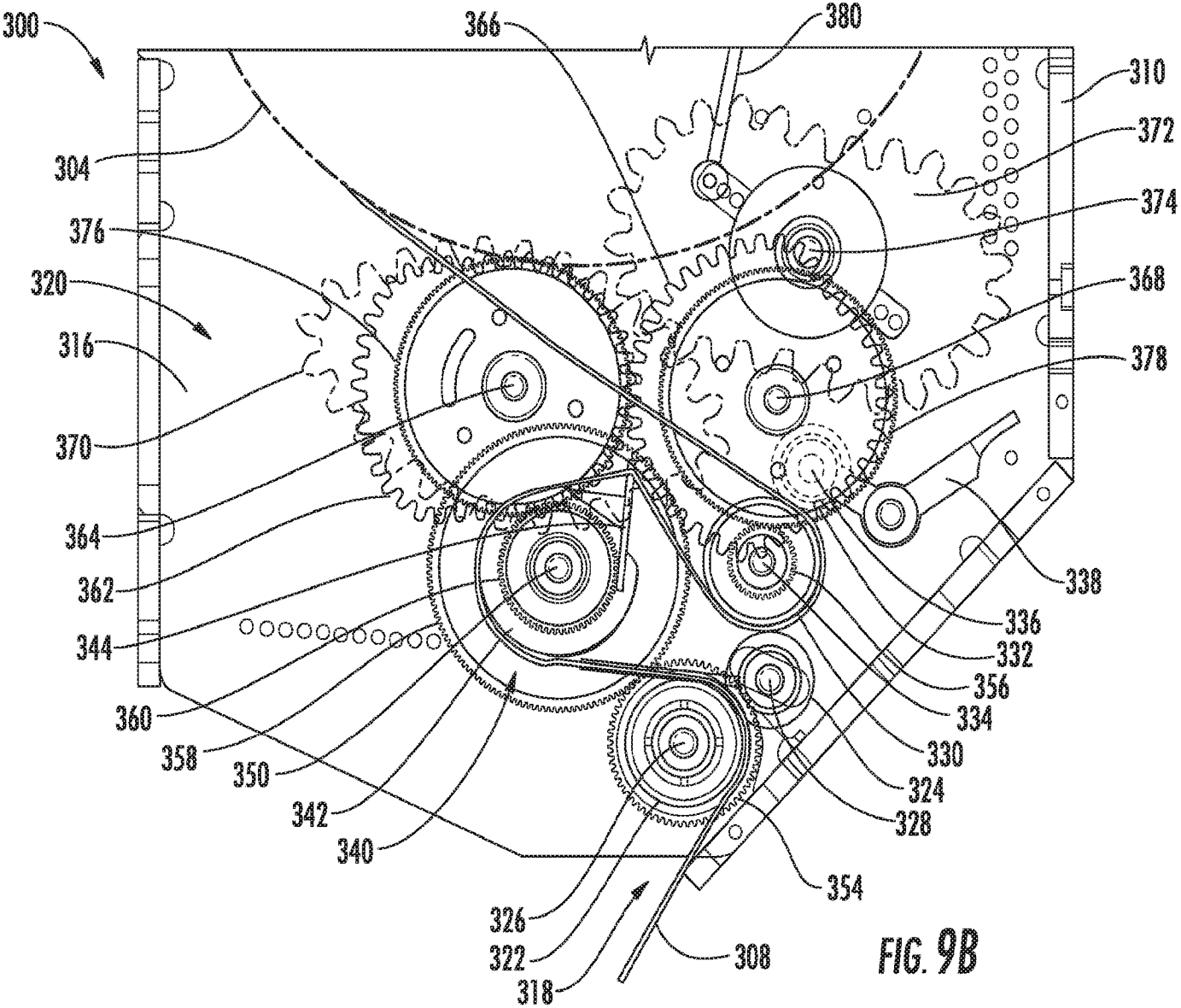
FIG. 9B is a side view of a portion of the example mechanical hands-free sheet product dispenser of FIG. 7, showing the mechanical dispensing mechanism in a second state during the dispense cycle.

FIG. 9B shows the mechanical dispensing mechanism 320 in a second state of the dispense cycle, following initial pulling of the tail portion 308. In the second state, the first drive roller 322 and the first pinch roller 324 continue to engage and grip a portion of the sheet product received therebetween, while the second drive roller 330 and the second pinch roller 332 continue to engage and grip another portion of the sheet product therebetween. As described above, the second drive roller 330 has rotated at a slower rate than the tail portion 308 has been pulled and the first drive roller 322 has rotated. In this manner, some of the slack has been removed from the portion of the sheet product disposed over the drum 342. In the second state, the cutting mechanism 340 has rotated such that the cutting knife 344 engages and begins to cut the sheet product. Further, as is shown, the fourth non-circular gear 372 has rotated and caused the tail spring 380 to extend downward and store energy. As the user continues to pull the tail portion 308, the various gears continue to rotate as described above and the tail spring 380 continues to extend and store more energy. Further, as the user continues to pull the tail portion 308, the second drive roller 330 continues to rotate at a slower rate than the tail portion 308 is pulled and the first drive roller 322 rotates, thereby causing the sheet product to be pulled more tightly over the cutting mechanism 340.

Figure 9C:
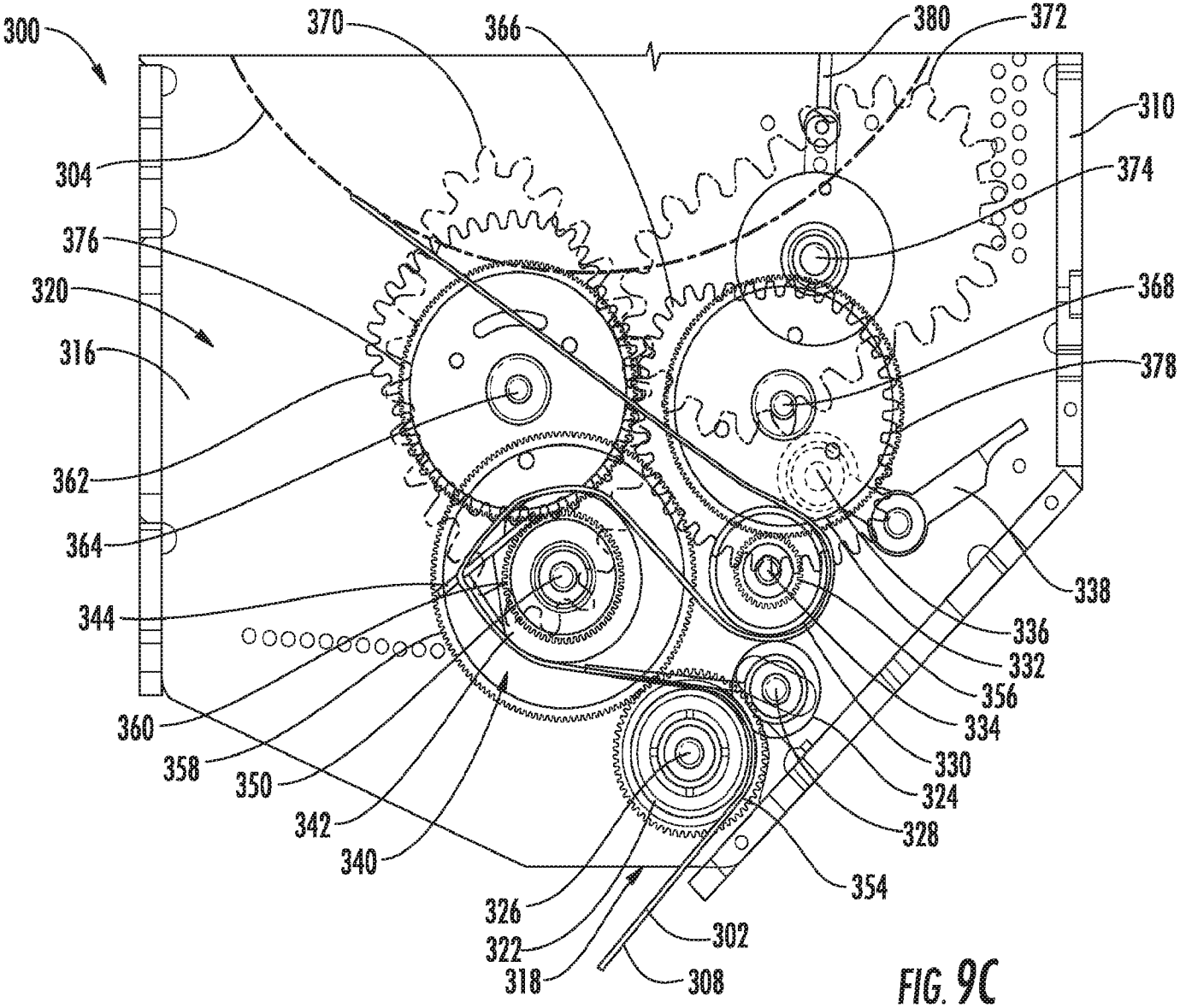
FIG. 9C is a side view of a portion of the example mechanical hands-free sheet product dispenser of FIG. 7, showing the mechanical dispensing mechanism in a third state during the dispense cycle.

FIG. 9C shows the mechanical dispensing mechanism 320 in a third state of the dispense cycle, following continued pulling of the tail portion 308. In the third state, the first drive roller 322 and the first pinch roller 324 continue to engage and grip a portion of the sheet product received therebetween, while the second drive roller 330 and the second pinch roller 332 continue to engage and grip another portion of the sheet product therebetween. In the third state, the cutting mechanism 340 has rotated such that portions of the teeth 346 of the cutting knife 344 have cut through the sheet product to partially define the individual sheet 302 to be dispensed to the user. However, the individual sheet 302 remains connected to the remainder of the roll 304, as described above. Further, as is shown, the fourth non-circular gear 372 has rotated further and caused the tail spring 380 to extend further downward and store more energy. As the user continues to pull the tail portion 308, the various gears continue to rotate as described above and the tail spring 380 continues to extend and store more energy. Further, as the user continues to pull the tail portion 308, the second drive roller 330 continues to rotate at a slower rate than the tail portion 308 is pulled and the first drive roller 322 rotates, thereby causing the sheet product to be pulled more tightly over the cutting mechanism 340.

Figure 9D:
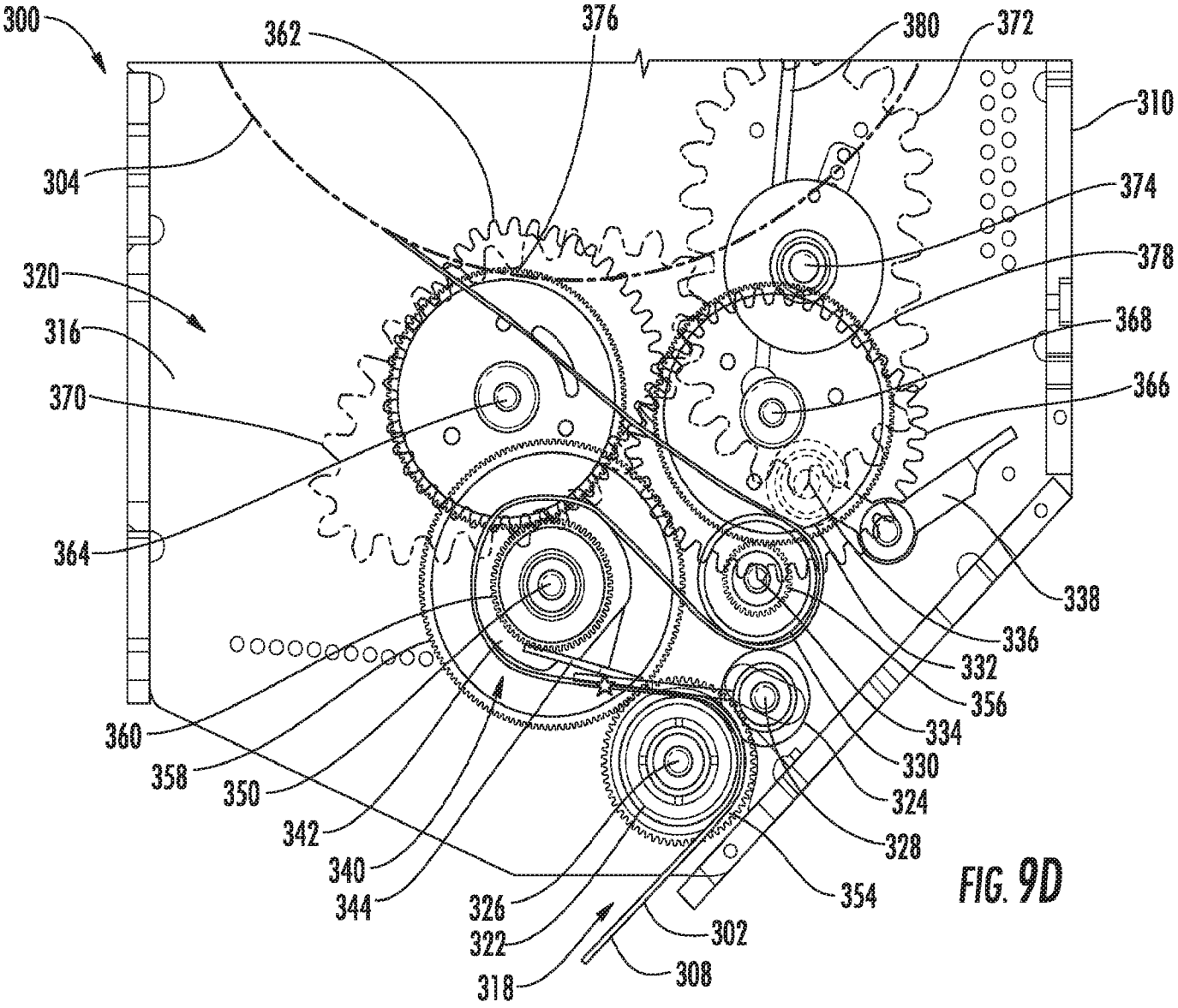
FIG. 9D is a side view of a portion of the example mechanical hands-free sheet product dispenser of FIG. 7, showing the mechanical dispensing mechanism in a fourth state during the dispense cycle.

FIG. 9D shows the mechanical dispensing mechanism 320 in a fourth state of the dispense cycle, following continued pulling of the tail portion 308. In the fourth state, the first drive roller 322 and the first pinch roller 324 continue to engage and grip a portion of the sheet product received therebetween, while the second drive roller 330 and the second pinch roller 332 continue to engage and grip another portion of the sheet product therebetween. In the fourth state, the cutting mechanism 340 has rotated such that the cutting knife 344 disengages the sheet product. As described above, the individual sheet 302 remains connected to the remainder of the roll 304 via small strips of sheet product corresponding to the notches 348 of the cutting knife 344. Further, as is shown, the fourth non-circular gear 372 has rotated further and caused the tail spring 380 to extend further downward and store more energy. In the fourth state, the tail spring 380 is almost fully extended. As the user continues to pull the tail portion 308, the various gears continue to rotate as described above and the tail spring 380 continues to extend and store more energy until reaching its longest length of the dispense cycle. At that point, the tail spring 380 begins to retract and release the stored energy, which reduces the driving force required from the user. Further, in the fourth state, the first and second non-circular gears 362, 366 are in an orientation in which the output to the second drive roller 330 is fast compared to the input from the continued pulling of the tail portion 308. Accordingly, as the user continues to pull the tail portion 308, the second drive roller 330 rotates at a faster rate than the tail portion 308 is pulled and the first drive roller 322 rotates, thereby causing the sheet product disposed over the cutting mechanism 340 to have some slack between the first drive roller 322 and the second drive roller 330.

Figure 9E:
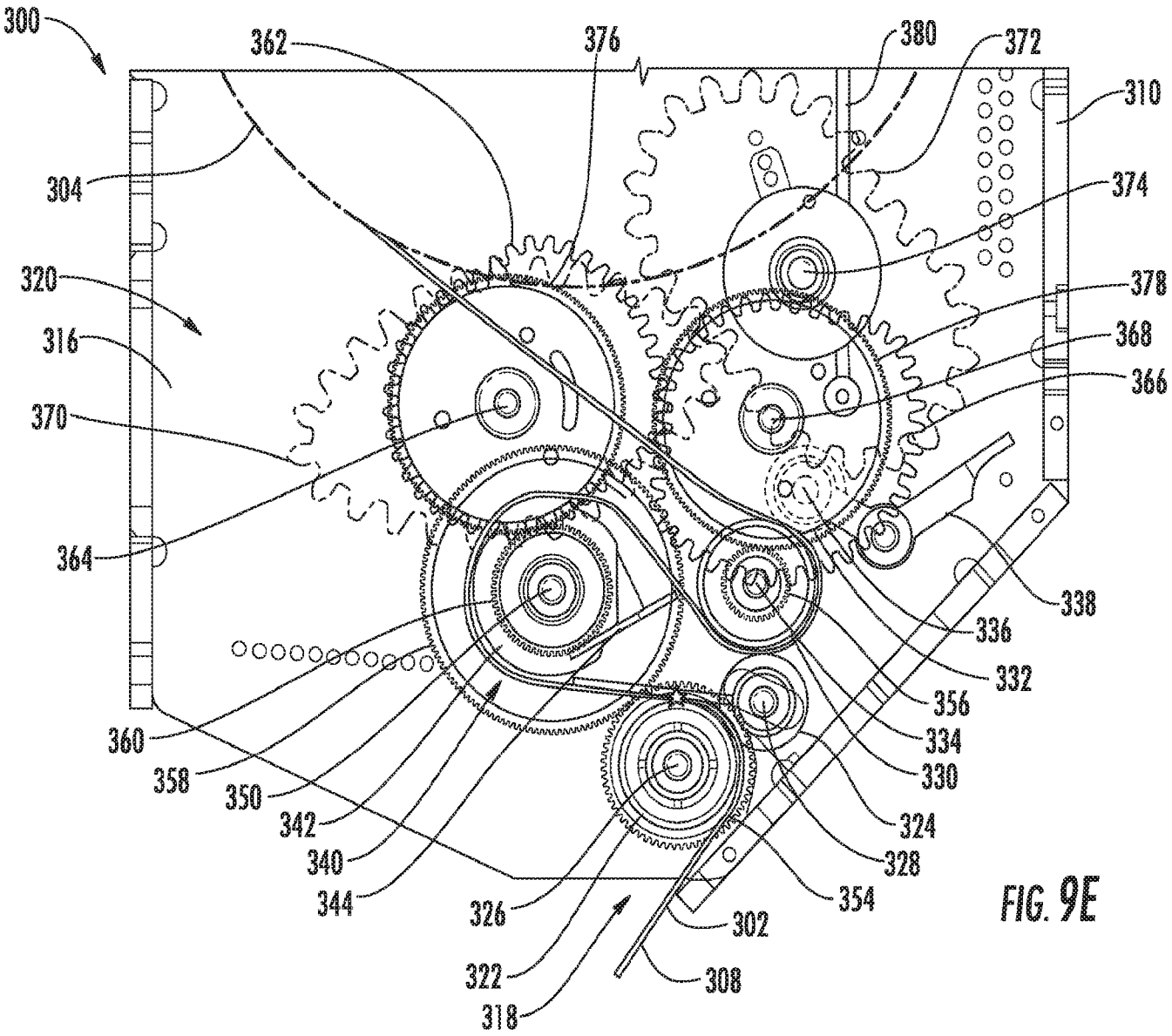
FIG. 9E is a side view of a portion of the example mechanical hands-free sheet product dispenser of FIG. 7, showing the mechanical dispensing mechanism in a fifth state during the dispense cycle.

FIG. 9E shows the mechanical dispensing mechanism 320 in a fifth state of the dispense cycle, following continued pulling of the tail portion 308. In the fifth state, the first drive roller 322 and the first pinch roller 324 continue to engage and grip a portion of the sheet product received therebetween, while the second drive roller 330 and the second pinch roller 332 continue to engage and grip another portion of the sheet product therebetween. In the fifth state, the cutting mechanism 340 has rotated such that the cutting knife 344 begins to engage the sheet product again. Further, as is shown, the fourth non-circular gear 372 has rotated further, and the tail spring 380 has retracted and released some of the stored energy, thereby reducing the driving force required from the user. In the fifth state, the lagging end of the individual sheet 302 engages the first drive roller 322, as is shown. As the user continues to pull the tail portion 308, the various gears continue to rotate as described above and the tail spring 380 continues to retract and release more energy. Further, as the user continues to pull the tail portion 308, the second drive roller 330 continues to rotate at a faster rate than the tail portion 308 is pulled and the first drive roller 322 rotates, thereby causing the sheet product disposed over the cutting mechanism 340 to have more slack.

Figure 9F:
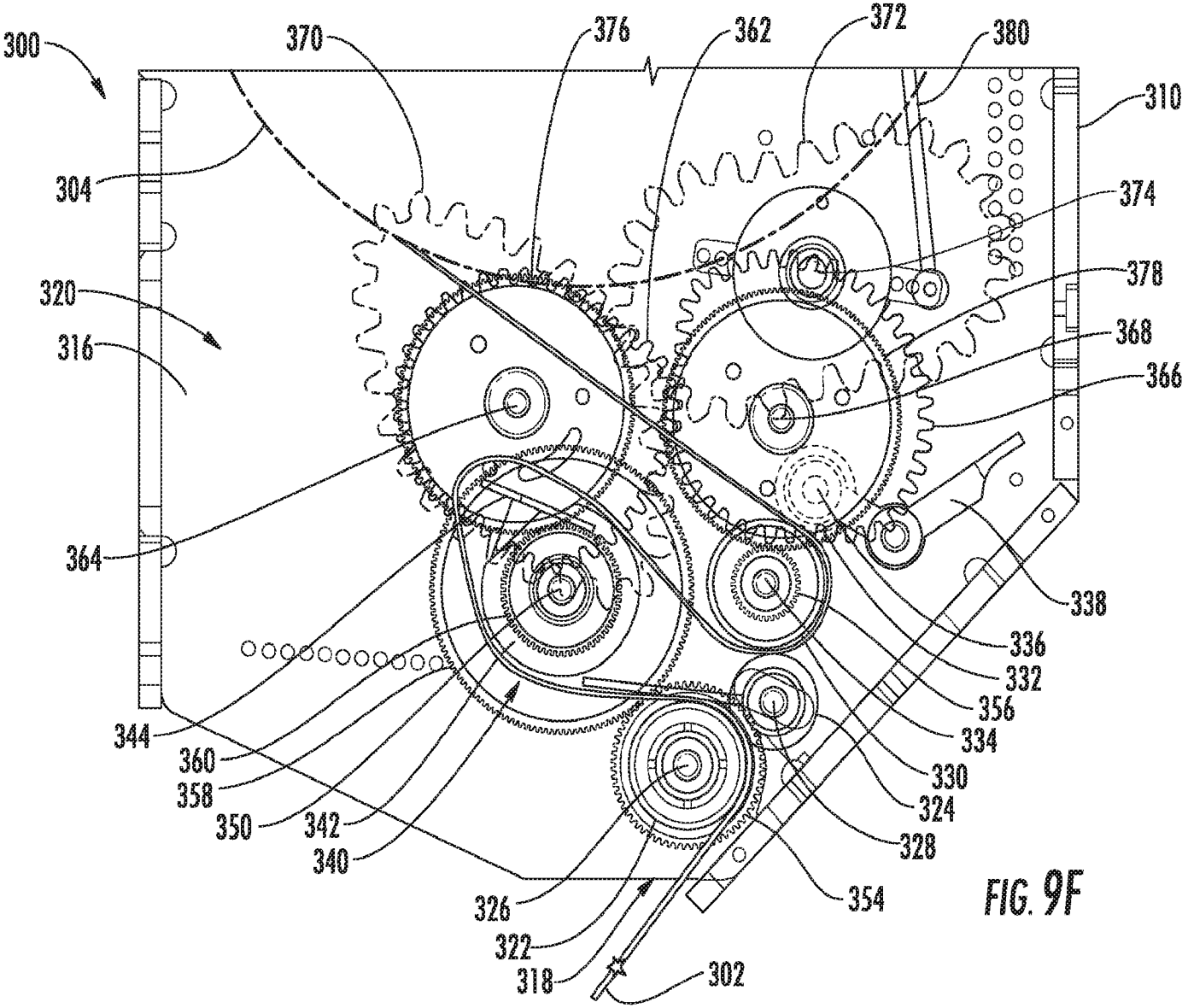
FIG. 9F is a side view of a portion of the example mechanical hands-free sheet product dispenser of FIG. 7, showing the mechanical dispensing mechanism in a sixth state during the dispense cycle.

FIG. 9F shows the mechanical dispensing mechanism 320 in a sixth state of the dispense cycle, following continued pulling of the tail portion 308. In the sixth state, the first drive roller 322 and the first pinch roller 324 continue to engage and grip a portion of the sheet product received therebetween, while the second drive roller 330 and the second pinch roller 332 continue to engage and grip another portion of the sheet product therebetween. In the sixth state, the cutting mechanism 340 has rotated such that the cutting knife 344 continues to engage the sheet product. However, due to the slack in the sheet product disposed over the cutting mechanism 340, the cutting knife 344 does not cut the sheet product. Further, as is shown, the fourth non-circular gear 372 has rotated further, and the tail spring 380 has retracted and released more of the stored energy, thereby reducing the driving force required from the user and facilitating advancement of the sheet product. In the sixth state, the lagging end of the individual sheet 302 has disengaged the first drive roller 322 and passed through the dispenser outlet 318, as is shown. As the tail spring 380 continues to retract and release more energy, the first and second drive rollers 322, 330 continue to rotate and advance the sheet product to present a new tail portion 308, as the mechanical dispensing mechanism 320 returns to the first state, as is shown in FIG. 9A, and is ready to begin a subsequent dispense cycle. Ultimately, as the user pulls against the tail spring 380 in the subsequent dispense cycle, the small strips of sheet product connecting the individual sheet 302 to the remainder of the roll 304 are exposed to enough tension to separate the individual sheet 302 from the remainder of the roll 304.

The dispenser 300 may be configured to dispense individual sheets 302 having a predetermined sheet length (i.e., the cutting mechanism 340 cuts the sheet product at a predetermined distance from the exposed end of the roll 304), which may depend on the type of sheet product dispensed. For example, the dispenser 300 may be configured to dispense individual sheets 302 of paper towels having a predetermined sheet length of 8.5 inches. Based on the configuration and operation of the mechanical dispensing mechanism 320, the sheet length may be equal to a sum of a length of the tail portion 308 (a "tail length") and a length over which a user pulls the tail portion 308 (a "pull length") during the dispense cycle. For example, the dispenser 300 may be configured to dispense individual sheets 302 having a sheet length of 8.5 inches, wherein the tail length is 4.25 inches and the pull length is 4.25 inches. It will be understood that the dimensions of the dispenser 300, particularly the mechanical dispensing mechanism 320, and the individual sheets 302 may be selected depending upon the type of sheet product to be dispensed.

The mechanical dispensing mechanism 320 of dispenser 300 may provide significant advantages over mechanical dispensing mechanisms of known hands-free sheet product dispensers. In particular, the various non-circular gears of the mechanical dispensing mechanism 320 may provide significant advantages over conventional circular gears used in known mechanical dispensing mechanisms.

As described above, the first and second non-circular gears 362, 366 may be configured to drive the second drive roller 330 at a varying speed throughout a dispense cycle. Specifically, the first and second non-circular gears 362, 366 may be configured to drive the second drive roller 330 at a lower speed than the first drive roller 322 during a first portion of the dispense cycle, and to drive the second drive roller 330 at a higher speed than the first drive roller 322 during a second portion of the dispense cycle. The portions of the first and second non-circular gears 362, 366 that mesh during the first portion of the dispense cycle may have a constant pitch radius, wherein the pitch radius of the first non-circular gear 362 is less than the pitch radius of the second non-circular gear 366, as is shown. Further, the portions of the first and second non-circular gears 362, 366 that mesh during the second portion of the dispense cycle may have a constant pitch radius, wherein the pitch radius of the first non-circular gear 362 is greater than the pitch radius of the second non-circular gear 366, as is shown. In this manner, the first and second non-circular gears 362, 366 may maintain a constant first gear ratio during the first portion of the dispense cycle and a constant second gear ratio during the second portion of the dispense cycle.

As described above, the third and fourth non-circular gears 370, 372 may be configured to cause the tail spring 380 to extend and store energy during a first portion of the dispense cycle, and to be at least partially driven by the tail spring 380 as the tail spring 380 retracts and releases the stored energy during a second portion of the dispense cycle. In this manner, a portion of the pull force required to carry out the dispense cycle is used to extend the tail spring 380 throughout the first portion of the dispense cycle. As is shown, the third and fourth non-circular gears 370, 372 may have varying radius relationships with respect to one another throughout the dispense cycle. Specifically, in the first state (FIG. 9A), the third non-circular gear 370 may have a larger pitch radius than the fourth non-circular gear 372, while the tail spring 380 is retracted and at its shortest length. Accordingly, as the user pulls the tail portion 308 and the third and fourth non-circular gears 370, 372 rotate as described above, the fourth non-circular gear 372 rotates at a higher rate than the third non-circular gear 370, which causes the tail spring 380 to quickly assume a position where it can extend and store energy. Following continued pulling of the tail portion 308 and rotation of the third non-circular gear 370 about ninety degrees (FIG. 9C), the fourth non-circular gear 372 may have a larger pitch radius than the third non-circular gear 370, which causes the tail spring 380 to slowly extend and store energy. Following continued pulling of the tail portion 308 and rotation of the third non-circular gear 370 about another ninety degrees (FIG. 9E), the third non-circular gear 370 again may have a larger pitch radius than the fourth non-circular gear 372, which allows the tail spring to quickly assume a position where it can retract and release stored energy to facilitate advancement of the sheet product. Accordingly, the third and fourth non-circular gears 370, 372 may reduce the pull force required at this point of the dispense cycle. According to different embodiments, the third and fourth non-circular gears 370, 372 may have various radius relationships that affect the peak force required to extend the tail spring 380 and the energy input required to extend the tail spring 380 (and thus also the energy output from the tail spring 380).

Ultimately, as compared to known dispensers, the dispenser 300 may allow a lower pull force (i.e., a driving force imparted by a user) required for a given sheet length and tail length. Additionally, as compared to known dispensers, the dispenser 300 may allow a lower paper strength required for a given sheet length and tail length, due to the lower pull force allowed. Moreover, as compared to known dispensers, the dispenser 300 may generate a greater amount of energy from a given pull force, which may provide greater reliability in presenting a tail portion. Further, as compared to known dispensers, the dispenser 300 may enable use of a smaller drum and thus a smaller housing, as the drum 342 of the cutting mechanism 340 completes two rotations during a dispense cycle instead of only one. Additionally, as compared to known dispensers, the dispenser 300 may enable a simpler cutting mechanism, as the cutting knife 344 is fixed relative to the drum 342.

Figure 10:
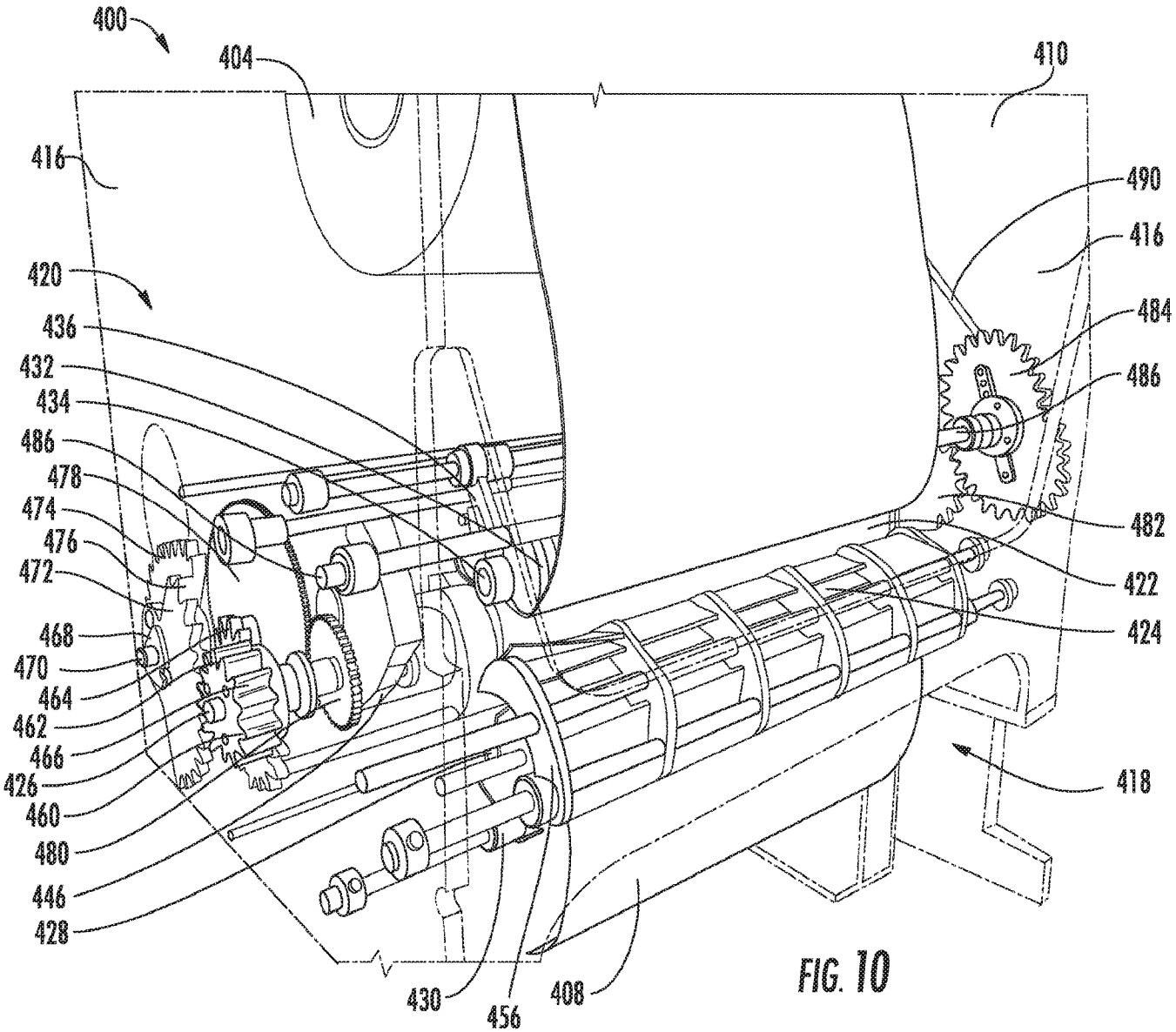
FIG. 10 is a perspective view of an example mechanical hands-free sheet product dispenser in accordance with one or more embodiments of the disclosure.
Figure 77:
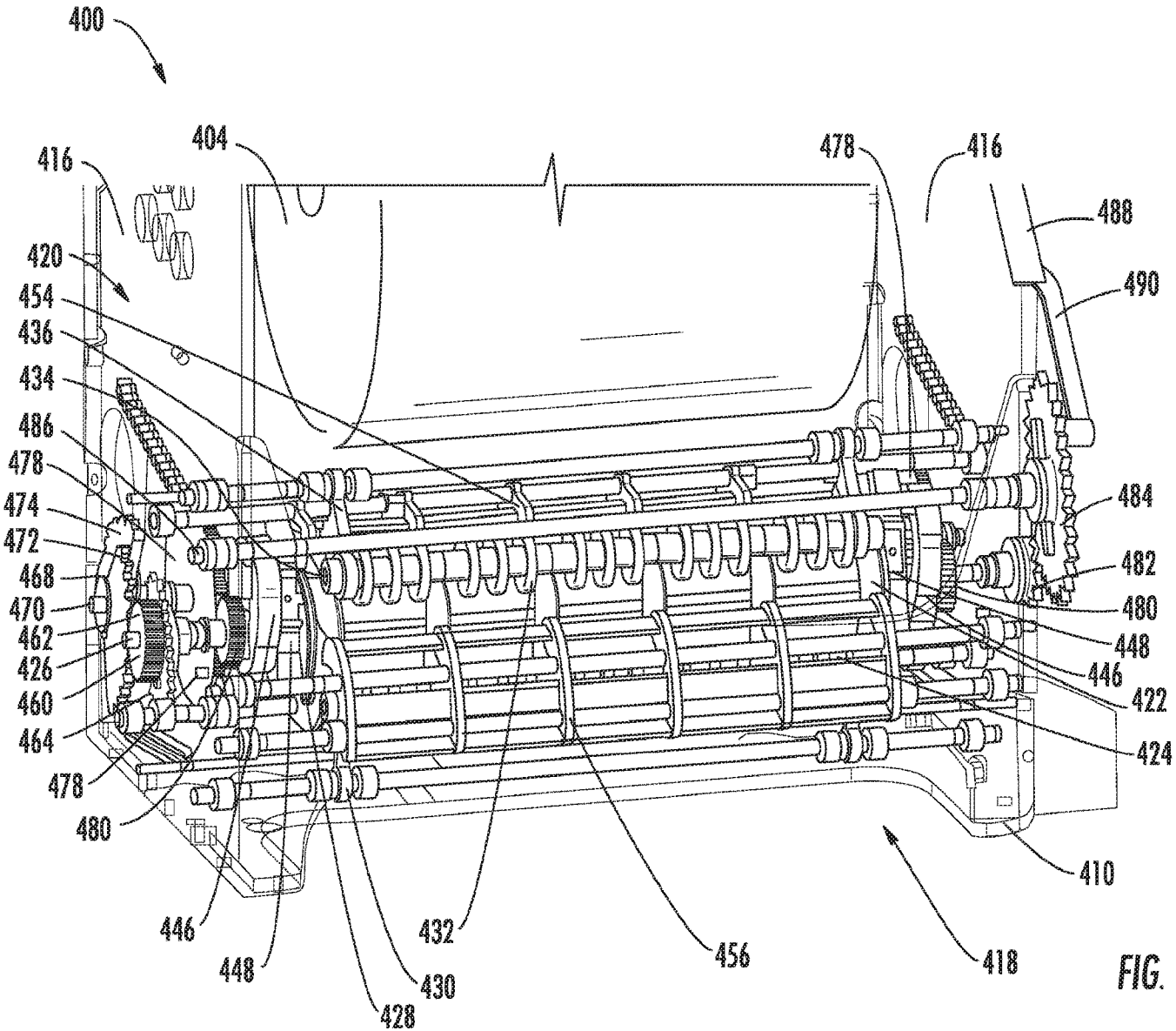
Figure 12:
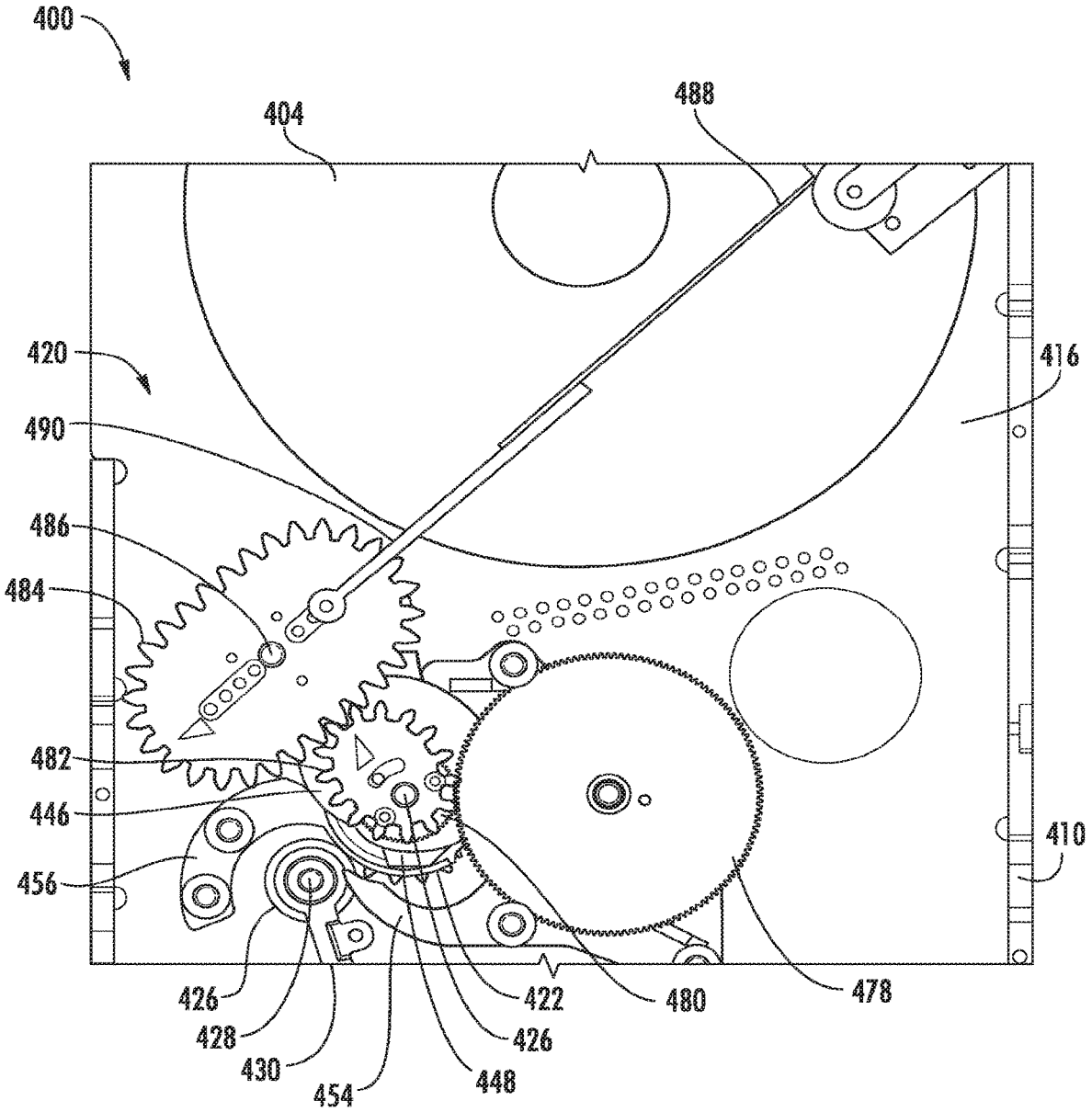
FIG. 12 is a detailed side view of a portion of the example mechanical hands-free sheet product dispenser of FIG. 10.
Figure 13:
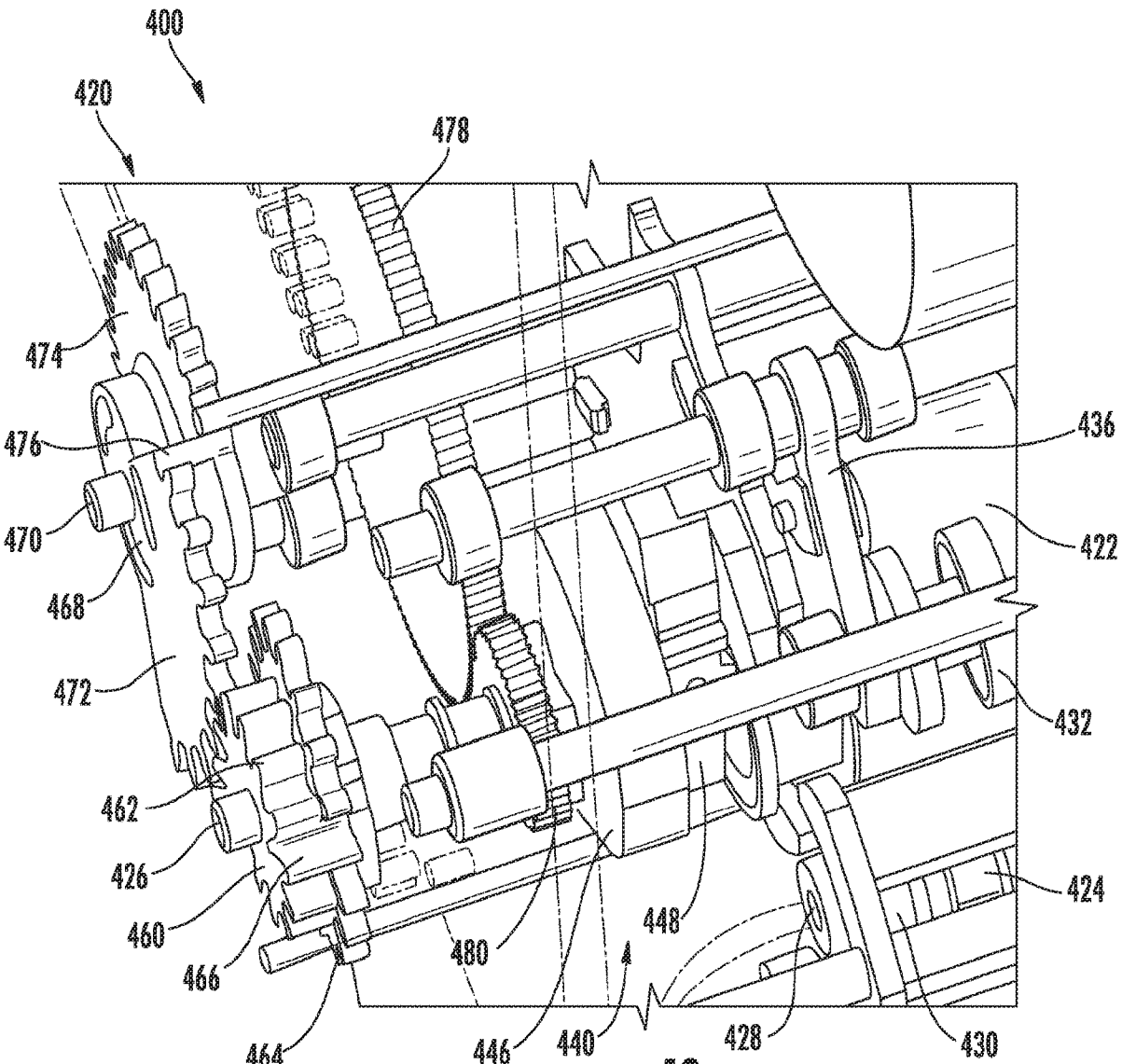
FIG. 13 is a detailed perspective view of a portion of the example mechanical hands-free sheet product dispenser of FIG. 10.
Figure 14:
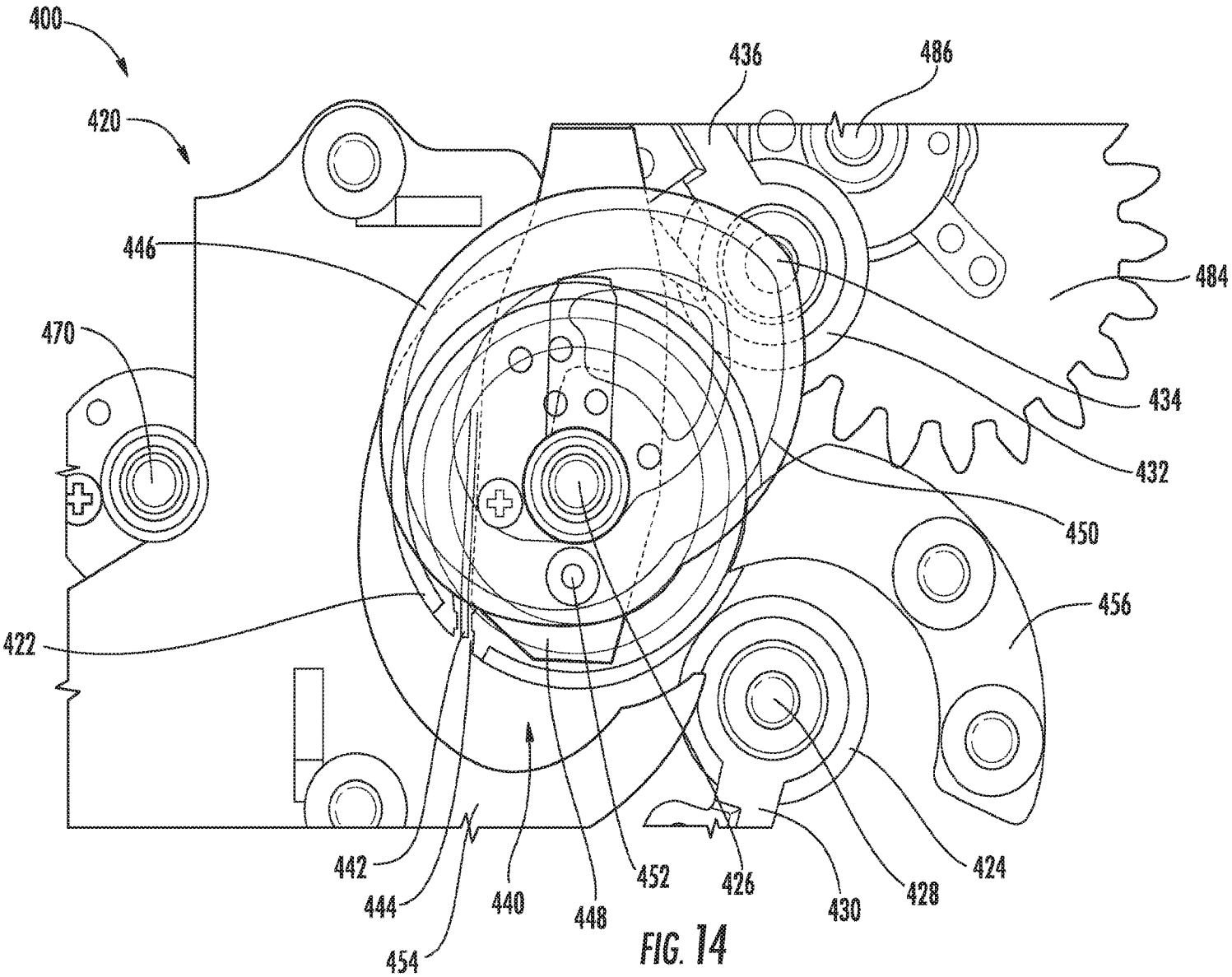
FIG. 14 is a detailed side view of a portion of the example mechanical hands-free sheet product dispenser of FIG. 10.

FIGS. 10 and 11 show perspective views of an example mechanical hands-free sheet product dispenser 400 in accordance with one or more embodiments of the disclosure. FIGS. 12-14 show detailed views of portions of the dispenser 400. FIGS. 15A-15E show side views of a portion of the dispenser 400 in different states during a dispense cycle. The dispenser 400 may be configured to dispense individual sheets 402 from a roll 404 of non-perforated sheet product. The roll 404 of non-perforated sheet product may be formed in a conventional manner. As is described in detail herein below, the dispenser 400 may be configured to present a tail portion 408 (i.e., an exposed end portion) of the roll 404 to be grasped and pulled by a user during a dispense cycle. Specifically, as is shown, the tail portion 408 may be a leading end portion of the roll 404 to be dispensed during a dispense cycle.

As is shown, the dispenser 400 may include a housing 410, and the roll 404 of non-perforated sheet product may be disposed within the housing 410 for dispensing the individual sheets 402 therefrom. The roll 404 may be rotatably supported within the housing 410 by a roll support, such as a roll shaft 414 attached to opposing side walls 416 of the housing 410. In some embodiments, the housing 410 may include a dispenser outlet 418 defined in a wall thereof, such as a front wall or a bottom wall of the housing. The dispenser 400 may be configured to present the tail portion 408 extending from the dispenser outlet 418 and out of the housing 410 to be grasped and pulled by a user.

The dispenser 400 also may include a mechanical dispensing mechanism 420 disposed within the housing 410 and configured to guide and advance the sheet product from the roll 404 during a dispense cycle. The mechanical dispensing mechanism 420 may include a number of rollers configured to guide and advance the sheet product from the roll 404 during a dispense cycle as a user grasps and pulls the tail portion 408 to impart a driving force thereto. Specifically, the number of rollers may include a drum 422 and a first pinch roller 424 attached to the housing 410 and configured to receive the sheet product therebetween. The drum 422 and the first pinch roller 424 may be configured to engage and grip the sheet product throughout the dispense cycle. As is shown, the drum 422 may be positioned about and coupled to a drum axle 426 supported by the side walls 416 of the housing 410 and allowing the drum 422 to rotate with respect to the housing 410. The first pinch roller 424 may be positioned about and coupled to a first pinch roller axle 428 supported by the housing 410 via a first pinch roller arm 430 and allowing the first pinch roller 424 to rotate with respect to the housing 410. The number of rollers also may include a second pinch roller 432 attached to the housing 410, and the drum 422 and the second pinch roller 432 may be configured to receive the sheet product therebetween. The drum 422 and the second pinch roller 432 may be configured to engage and grip the sheet product throughout the dispense cycle. As is shown, the second pinch roller 432 may be positioned about and coupled to a second pinch roller axle 434 supported by the housing 410 via a second pinch roller arm 436 and allowing the second pinch roller 432 to rotate with respect to the housing 410.

The mechanical dispensing mechanism 420 also may include a cutting mechanism 440 configured to guide and cut the sheet product during a dispense cycle to define an individual sheet 402 to be dispensed to a user. The cutting mechanism 440 may include a cutting knife 442 movably coupled to the drum 422. The cutting knife 442 may be configured to move from a retracted position, in which the cutting knife 442 is received within a slot 444 defined in the drum 422, to an extended position, in which at least a portion of the cutting knife 442 extends out of the slot 444. The cutting knife 442 may include a plurality of teeth configured to penetrate and cut the sheet product during a portion of the dispense cycle to at least partially define the individual sheet 402 to be dispensed to the user. The cutting knife 442 also may include one or more notches defined between one or more adjacent pairs of the teeth. The notches may be configured to allow the individual sheet 402 to remain partially connected to a remainder of the roll 404 of sheet product after the teeth penetrate and cut the sheet product. In other words, the cutting knife 442 may be configured to cut the sheet product to partially define the individual sheet 402, while allowing the individual sheet 402 to remain connected to the remainder of the roll 404 via small strips of sheet product corresponding to the notches.

The cutting mechanism 440 also may include a pair of cams 446 and a pair of sliders 448. The cams 446 may be positioned about and free to rotate with respect to (i.e., not coupled to) the drum axle 426 supported by the housing 410. As is shown, one of the cams 446 may be positioned near one end of the drum 422, and the other cam 446 may be positioned near the other end of the drum 422. Each of the cams 446 may include a cam track 450 defined therein and providing a profile having a varying distance from the longitudinal axis of the drum axle 426. The sliders 448 may be positioned about and free to translate with respect to (i.e., not coupled to) the drum axle 426 supported by the housing 410. As is shown, one of the sliders 448 may be positioned between the one cam 446 and the one end of the drum 422, and the other slider 448 may be positioned between the other cam 446 and the other end of the drum 422. Each of the sliders 448 may include a cam follower 452 extending into the cam track 450 of the respective cam 446. The cam follower 452 may be a protrusion configured to travel along the profile of the cam track 450 as the cam 446 rotates with respect to the drum axle 426. In this manner, as the cams 446 rotate with respect to the drum axle 426, the sliders 448 may translate with respect to the drum axle 426. The sliders 448 may be rigidly coupled to respective ends of the cutting knife 442. In this manner, as the sliders 448 translate with respect to the drum axle 426, the cutting knife 442 may move between the retracted position and the extended position.

The mechanical dispensing mechanism 420 also may include a first sheet product guide 454 extending around a top of the drum 422, a rear side of the drum 422, and a bottom of the drum 422, as is shown. In this manner, the first sheet product guide 454 may be configured to guide the sheet product over and around the drum 422 and from the drum 422 toward the first pinch roller 424. The mechanical dispensing mechanism 420 also may include a second sheet product guide 456 extending around a top of the first pinch roller 424 and a front side of the first pinch roller 424, as is shown. In this manner, the second sheet product guide 456 may be configured to guide the sheet product over and around the first pinch roller 424 and from the first pinch roller 424 toward the user.

The mechanical dispensing mechanism 420 also may include a number of gears configured to drive the cams 446 at a varying rate throughout a dispense cycle, as is described in detail below. Specifically, the number of gears may include a first non-circular gear 460 positioned about and coupled to the drum axle 426 supported by the housing 410 and allowing the first non-circular gear 460 to rotate with respect to the housing 410. As is shown, the first non-circular gear 460 may include a first step 462 and a second step 464 that are offset from one another along a longitudinal axis of the first non-circular gear 460. The first step 462 may have a generally constant pitch radius, the second step 464 may have a generally constant pitch radius, and the pitch radius of the first step 462 may be less than the pitch radius of the second step 464. The first non-circular gear 460 may include a common tooth 466 that spans both the first step 462 and the second step 464. The number of gears also may include a second non-circular gear 468 positioned about and coupled to a second non-circular gear axle 470 supported by the housing 410 and allowing the second non-circular gear 468 to rotate with respect to the housing 410. As is shown, the second non-circular gear 468 may include a first step 472 and a second step 474 that are offset from one another along a longitudinal axis of the second non-circular gear 468. The first step 472 may have a generally constant pitch radius, the second step 474 may have a generally constant pitch radius, and the pitch radius of the first step 472 may be greater than the pitch radius of the second step 474. The second non-circular gear 468 may include transition teeth 476 that span between the first step 472 and the second step 474. As is shown, the first non-circular gear 460 may engage the second non-circular gear 468 throughout the dispense cycle. Specifically, the first step 462 of the first non-circular gear 460 may engage the first step 472 of the second non-circular gear 468 during a portion of the dispense cycle, and the second step 464 of the first non-circular gear 460 may engage the second step 474 of the second non-circular gear 468 during another portion of the dispense cycle.

The number of gears also may include a pair of first transfer gears 478 positioned about and coupled to the second non-circular gear axle 470 supported by the housing 410 and allowing the first transfer gears 478 to rotate with respect to the housing 410. As is shown, one of the first transfer gears 478 may be positioned near one end of the second non-circular gear axle 470, and the other first transfer gear 478 may be positioned near the other end of the second non-circular gear axle 470. The first transfer gears 478 may be circular gears, as is shown. The number of gears also may include a pair of second transfer gears 480 positioned about and free to rotate with respect to (i.e., not coupled to) the drum axle 426 supported by the housing 410. As is shown, one of the second transfer gears 480 may be positioned near one end of the drum axle 426, and the other second transfer gear 480 may be positioned near the other end of the drum axle 426. The second transfer gears 480 may be respectively coupled to the cams 446 such that the cams 446 are configured to rotate along with the second transfer gears 480 about the drum axle 426. As is shown, the second transfer gears 480 may be circular gears that respectively engage the first transfer gears 478 throughout the dispense cycle.

The number of gears also may include a third non-circular gear 482 positioned about and coupled to the drum axle 426 supported by the housing 410 and allowing the third non-circular gear 482 to rotate with respect to the housing 410. As is shown, the third non-circular gear 482 may have a generally elliptical shape. The number of gears also may include a fourth non-circular gear 484 positioned about and coupled to a fourth non-circular gear axle 486 supported by the housing 410 and allowing the fourth non-circular gear 484 to rotate with respect to the housing 410. As is shown, the fourth non-circular gear 484 may have a generally discorectangular or stadium shape, and the fourth non-circular gear 484 may engage the third non-circular gear 482 throughout the dispense cycle.

The mechanical dispensing mechanism 420 also may include a tail spring 488, such as a constant-force spring, coupled to the fourth non-circular gear 484 and the housing 410, as is shown. The tail spring 488 may be coupled to the fourth non-circular gear 484 via a tail spring arm 490 pivotally attached to the fourth non-circular gear 484, as is shown. As is described in detail below, the tail spring 488 may be configured to extend and store energy as the fourth non-circular gear 484 rotates with respect to the housing 410 during a portion of the dispense cycle, and to retract and release the stored energy as the fourth non-circular gear 484 rotates with respect to the housing 410 during another portion of the dispense cycle.

Figure 15A:
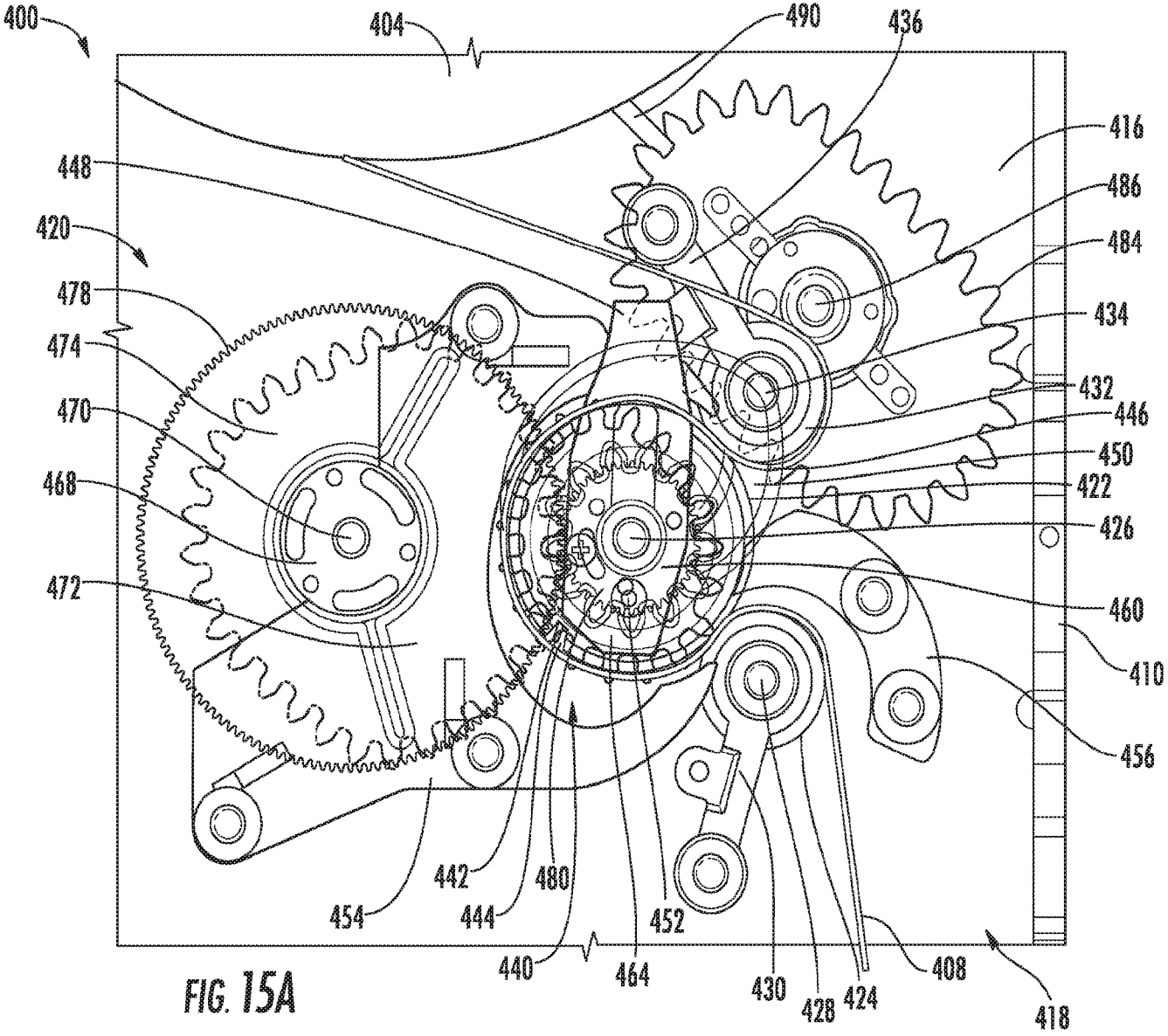
FIG. 15A is a side view of a portion of the example mechanical hands-free sheet product dispenser of FIG. 10, showing a mechanical dispensing mechanism in a first state during a dispense cycle.

FIGS. 15A-15E show side views of the mechanical dispensing mechanism 420 in a number of different states during a dispense cycle as may be carried out using the dispenser 400. FIG. 15A shows the mechanical dispensing mechanism 420 in a first state of the dispense cycle, in which the tail portion 408 (the exposed end portion of the roll 404) is presented and available to be grasped and pulled by a user. In the first state, the drum 422 and the first pinch roller 424 are engaging and gripping a portion of the sheet product received therebetween, while the drum 422 and the second pinch roller 432 are engaging and gripping another portion of the sheet product received therebetween. Meanwhile, the top, rear side, and bottom of the drum 422 are engaging yet another portion of the sheet product disposed thereover, while the cutting knife 442 is in the retracted position within the slot 444 such that the cutting knife 442 does not engage the sheet product. In the first state, the tail spring 488 is retracted at a bottom-dead-center orientation, and thus the tail spring 488 has its shortest length of the dispense cycle.

The user pulls the tail portion 408 downward to impart a driving force to the sheet product to carry out the dispense cycle. As the user initially pulls the tail portion 408 downward, the drum 422 and the first pinch roller 424 continue to grip a portion of the sheet product received therebetween, which causes the drum 422 to rotate (counter-clockwise in the side views shown) along with the drum axle 426. The rotation of the drum axle 426 causes the first non-circular gear 460 and the third non-circular gear 482 to rotate (both counter-clockwise). The rotation of the first non-circular gear 460 causes the second non-circular gear 468 to rotate (clockwise) along with the second non-circular gear axle 470, which causes the first transfer gears 478 to rotate (clockwise). The rotation of the first transfer gears 478 causes the second transfer gears 480 to rotate (counter-clockwise) along with the cams 446. The rotation of the third non-circular gear 482 causes the fourth non-circular gear 484 to rotate (clockwise), which causes the tail spring 488 to extend downward and store energy. In this manner, initial pulling of the tail portion 408 downward by the user causes the drum 422 to rotate (counter-clockwise), which ultimately causes the cams 446 to rotate (counter-clockwise) and the tail spring 488 to extend and store energy.

As discussed above, by their nature, the first and second non-circular gears 460, 468 have a varying gear ratio, which is dependent upon the orientation of the non-circular gears 460, 468 throughout a rotation thereof. Accordingly, an output of the first and second non-circular gears 460, 468 to the cams 446 (via the second non-circular gear axle 470, the first transfer gears 478, and the second transfer gears 480) varies during the dispense cycle, and thus the non-circular gears 460, 468 drive the cams 446 at a varying rate during the dispense cycle. In the first state of the dispense cycle, the first and second non-circular gears 460, 468 are in an orientation in which the first step 462 of the first non-circular gear 460 engages the first step 472 of the second non-circular gear 468. Based on the pitch radii of the first step 462 of the first non-circular gear 460 and the first step 472 of the second non-circular gear 468 (as well as the pitch radii of the first and second transfer gears 478, 480), the cams 446 rotate at substantially the same rate as the drum 422 rotates. Accordingly, as the user initially pulls the tail portion 408, the cam followers 452 remain at approximately the same position along the cam tracks 450, the sliders 448 remain at approximately the same position with respect to the drum 422, and the cutting knife 442 remains in the retracted position within the slot 444.

Figure 15B:
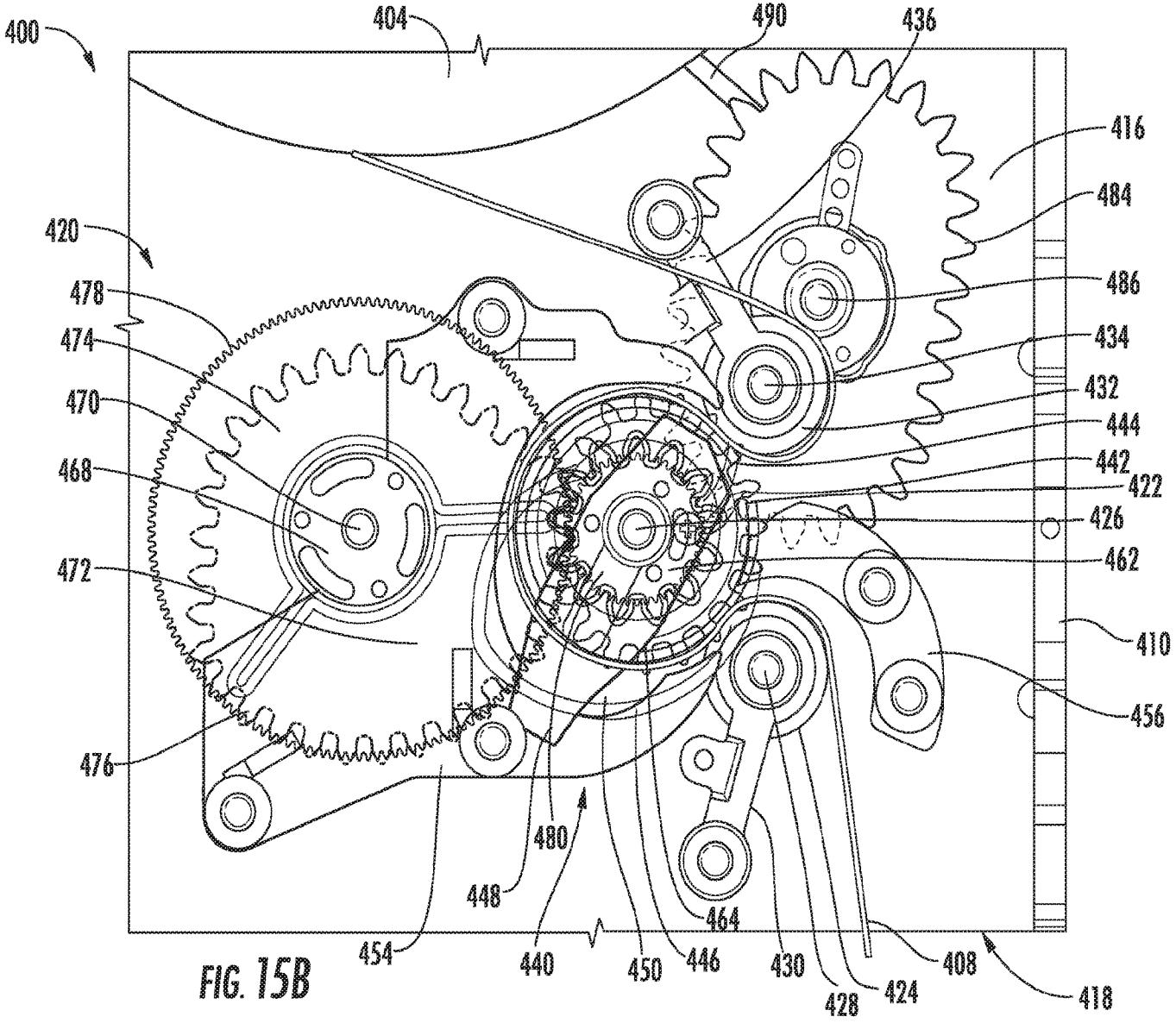
FIG. 15B is a side view of a portion of the example mechanical hands-free sheet product dispenser of FIG. 10, showing the mechanical dispensing mechanism in a second state during the dispense cycle.

FIG. 15B shows the mechanical dispensing mechanism 420 in a second state of the dispense cycle, following initial pulling of the tail portion 408. In the second state, the drum 422 and the first pinch roller 424 continue to engage and grip a portion of the sheet product received therebetween, the drum 422 and the second pinch roller 432 continue to engage and grip another portion of the sheet product received therebetween, and the top, rear side, and bottom of the drum 422 continue to engage yet another portion of the sheet product disposed thereover. As is shown, the drum 422 has rotated approximately 170 degrees. As described above, the cams 446 have rotated at substantially the same rate as the drum 422 has rotated. In this manner, the cam followers 452 remain at approximately the same position along the cam tracks 450, the sliders 448 remain at approximately the same position with respect to the drum 422, and the cutting knife 442 remains in the retracted position within the slot 444. Further, as is shown, the fourth non-circular gear 484 has rotated and caused the tail spring 488 to extend downward and store energy. In the second state, the common tooth 466 of the first non-circular gear 460 is engaging one of the transition teeth 476 of the second non-circular gear 468, as engagement of the first and second non-circular gears 460, 468 transitions from the first steps 462, 472 to the second steps 464, 474. As the user continues to pull the tail portion 408, the various gears continue to rotate as described above, and the tail spring 488 continues to extend and store more energy.

Figure 15C:
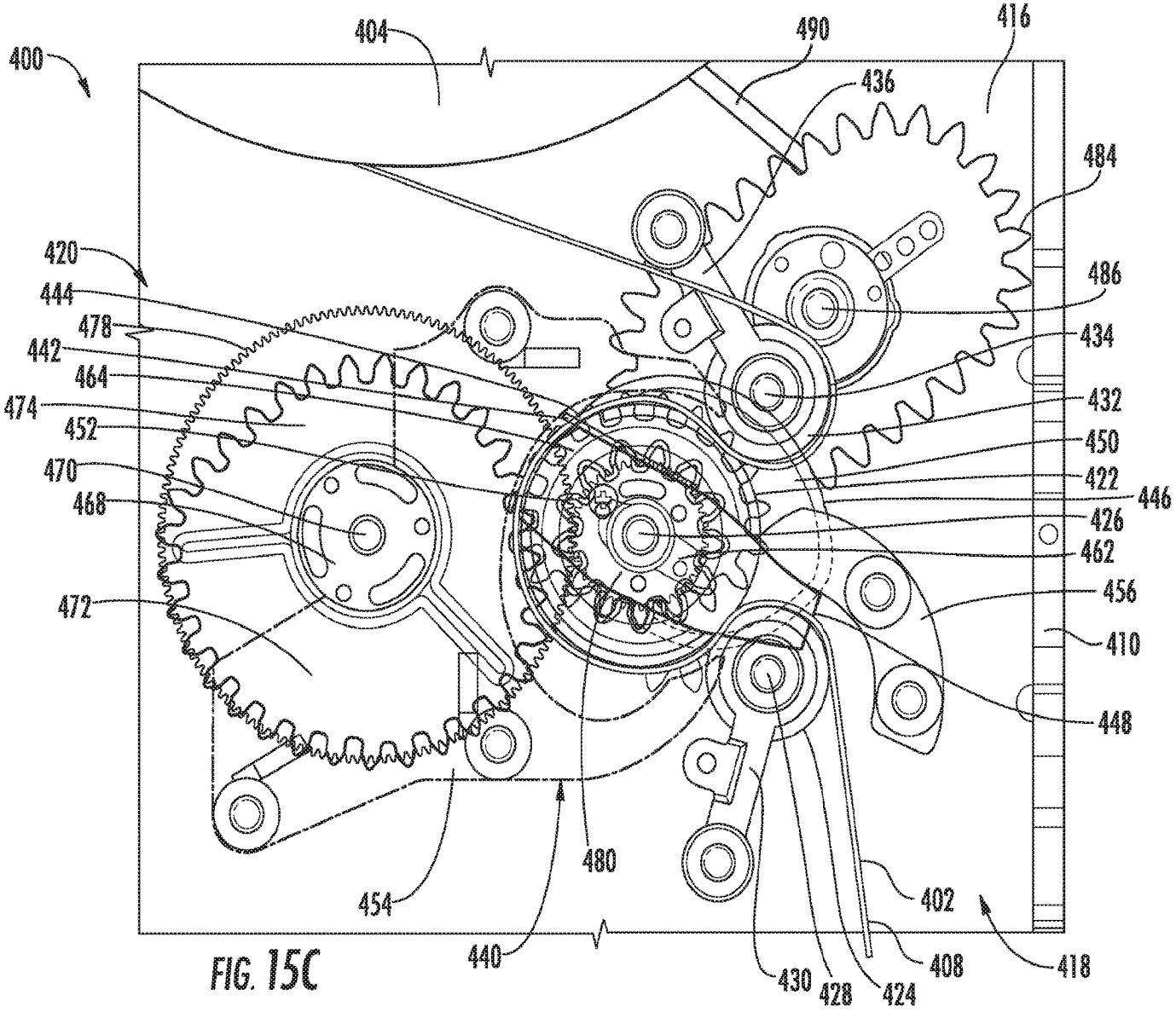
FIG. 15C is a side view of a portion of the example mechanical hands-free sheet product dispenser of FIG. 10, showing the mechanical dispensing mechanism in a third state during the dispense cycle.

FIG. 15C shows the mechanical dispensing mechanism 420 in a third state of the dispense cycle, following continued pulling of the tail portion 408. In the third state, the drum 422 and the first pinch roller 424 continue to engage and grip a portion of the sheet product received therebetween, the drum 422 and the second pinch roller 432 continue to engage and grip another portion of the sheet product received therebetween, and the top, rear side, and bottom of the drum 422 continue to engage yet another portion of the sheet product disposed thereover. As is shown, the drum 422 has further rotated approximately 90 degrees. In the third state of the dispense cycle, the first and second non-circular gears 460, 468 are in an orientation in which the second step 464 of the first non-circular gear 460 engages the second step 474 of the second non-circular gear 468. Based on the pitch radii of the second step 464 of the first non-circular gear 460 and the second step 474 of the second non-circular gear 468 (as well as the pitch radii of the first and second transfer gears 478, 480), the cams 446 rotate at a higher rate than the drum 422 rotates. Accordingly, as the user continues to pull the tail portion 408, the cam followers 452 travel along the cam tracks 450 and move away from the drum axle 426, the sliders 448 translate with respect to the drum axle 426, and the cutting knife 442 moves out of the slot 444 from the retracted position toward the extended position. In this manner, portions of the teeth of the cutting knife 442 begin to engage and cut through the sheet product to partially define the individual sheet 402 to be dispensed to the user. However, the individual sheet 402 remains connected to the remainder of the roll 404, as described above. Further, as is shown, the fourth non-circular gear 484 has rotated further and caused the tail spring 488 to extend further downward and store more energy. As the user continues to pull the tail portion 408, the various gears continue to rotate as described above and the tail spring 488 continues to extend and store more energy. Further, as the user continues to pull the tail portion 408, the cams 446 continue to rotate at a higher rate than the drum 422 rotates, thereby causing the cutting knife 442 to move further out of the slot 444 from the retracted position toward the extended position.

Figure 15D:
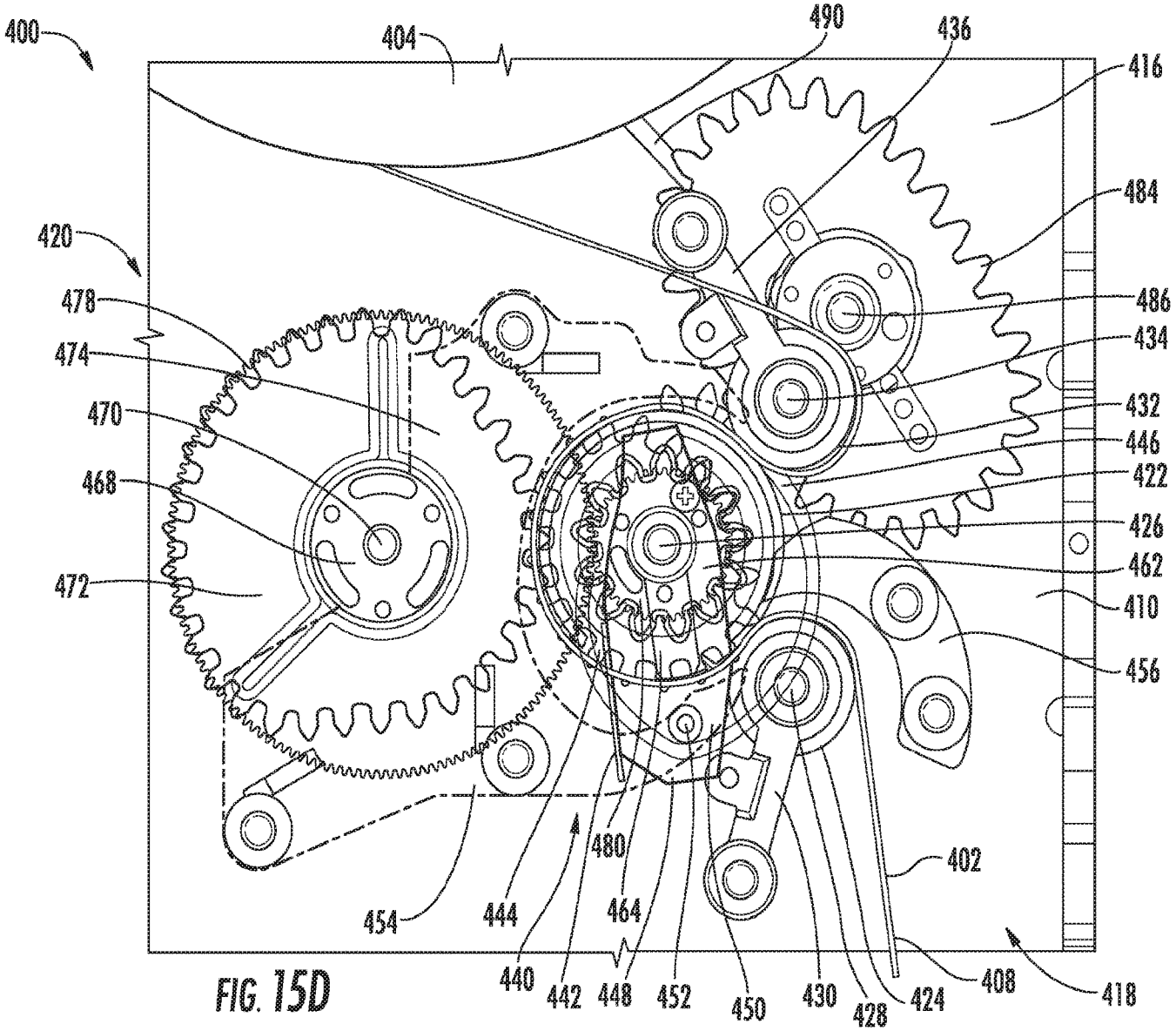
FIG. 15D is a side view of a portion of the example mechanical hands-free sheet product dispenser of FIG. 10, showing the mechanical dispensing mechanism in a fourth state during the dispense cycle.

FIG. 15D shows the mechanical dispensing mechanism 420 in a fourth state of the dispense cycle, following continued pulling of the tail portion 408. In the fourth state, the drum 422 and the first pinch roller 424 continue to engage and grip a portion of the sheet product (a portion of the individual sheet 402) received therebetween, the drum 422 and the second pinch roller 432 continue to engage and grip another portion of the sheet product (a portion of the remainder of the roll 404) received therebetween, and the top, rear side, and bottom of the drum 422 continue to engage yet another portion of the sheet product disposed thereover. As is shown, the drum 422 has further rotated approximately 110 degrees. The cam followers 452 have traveled along the cam tracks 450 and moved further away from the drum axle 426, the sliders 448 have translated further with respect to the drum axle 426, and the cutting knife 442 has moved further out of the slot 444 to the fully extended position. The teeth of the cutting knife 442 have cut through the sheet product to partially define the individual sheet 402 to be dispensed to the user, although the individual sheet 402 remains connected to the remainder of the roll 404, as described above. As the user continues to pull the tail portion 408, the cam followers 452 continue to travel along the cam tracks 450 and now move toward the drum axle 426, the sliders 448 translate with respect to the drum axle 426, and the cutting knife 442 moves into the slot 444 from the extended position toward the retracted position. As is shown, the fourth non-circular gear 484 has rotated further and caused the tail spring 488 to move beyond a top-dead-center orientation, in which the tail spring 488 has its longest length of the dispense cycle. In this manner, the tail spring 488 has begun to retract and release the stored energy, which reduces the driving force required from the user. In the fourth state of the dispense cycle, the first and second non-circular gears 460, 468 are in an orientation in which the second step 464 of the first non-circular gear 460 continues to engage the second step 474 of the second non-circular gear 468. As the user continues to pull the tail portion 408, the various gears continue to rotate as described above and the tail spring 488 continues to retract and release the stored energy. Further, as the user continues to pull the tail portion 408, the cams 446 continue to rotate at a higher rate than the drum 422 rotates, thereby causing the cutting knife 442 to move further into the slot 444 from the extended position toward the retracted position.

Figure 15E:
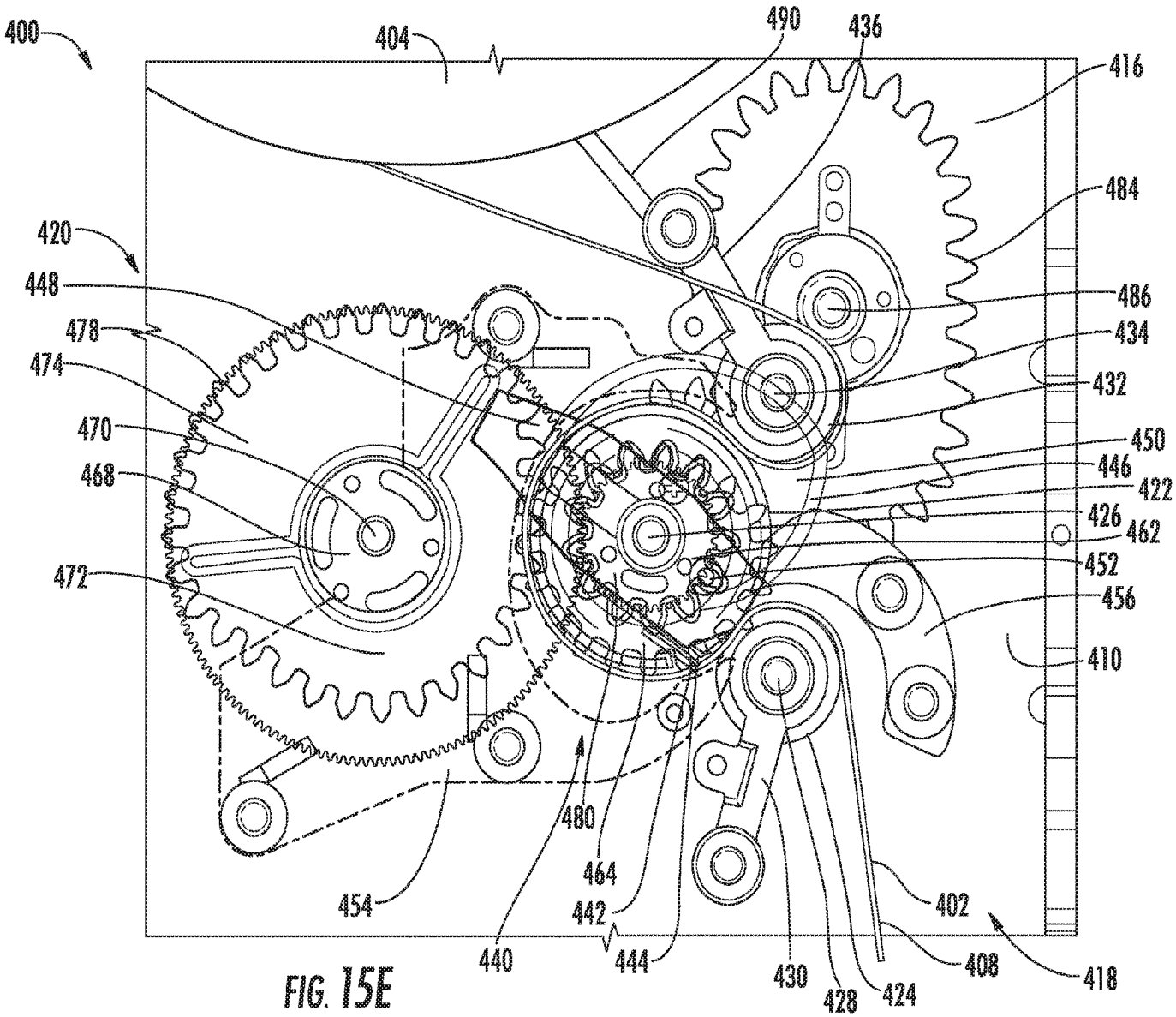
FIG. 15E is a side view of a portion of the example mechanical hands-free sheet product dispenser of FIG. 10, showing the mechanical dispensing mechanism in a fifth state during the dispense cycle.

FIG. 15E shows the mechanical dispensing mechanism 420 in a fifth state of the dispense cycle, following continued pulling of the tail portion 408. In the fifth state, the drum 422 and the first pinch roller 424 continue to engage and grip a portion of the sheet product (a portion of the individual sheet 402) received therebetween, the drum 422 and the second pinch roller 432 continue to engage and grip another portion of the sheet product (a portion of the remainder of the roll 404) received therebetween, and the top, rear side, and bottom of the drum 422 continue to engage yet another portion of the sheet product disposed thereover. As is shown, the drum 422 has further rotated approximately 60 degrees. The cam followers 452 have continued to travel along the cam tracks 450 and move toward the drum axle 426, the sliders 448 have translated further with respect to the drum axle 426, and the cutting knife 442 has moved into the slot 444 to the fully retracted position. As the user continues to pull the tail portion 408, the cam followers 452 continue to travel along the cam tracks 450 but remain at approximately the same position with respect to the drum axle 426, the sliders 448 remain at approximately the same position with respect to the drum axle 426, and the cutting knife 442 remains in the retracted position within the slot 444. In this manner, the cutting knife 442 does not interfere with or contact the first pinch roller 424 as the cutting knife 442 rotates past the first pinch roller 424. As is shown, the fourth non-circular gear 484 has rotated further, while the tail spring 488 has further retracted and released more of the stored energy, thereby reducing the driving force required from the user and facilitating advancement of the sheet product. As the tail spring 488 continues to retract and release more of the stored energy, the drum 422 continues to rotate and advance the sheet product to present a new tail portion 408, as the mechanical dispensing mechanism 420 returns to the first state, as is shown in FIG. 15A, and is ready to begin a subsequent dispense cycle. Ultimately, as the user pulls against the tail spring 488 in the subsequent dispense cycle, the small strips of sheet product connecting the individual sheet 402 to the remainder of the roll 404 are exposed to enough tension to separate the individual sheet 402 from the remainder of the roll 404.

The dispenser 400 may be configured to dispense individual sheets 402 having a predetermined sheet length (i.e., the cutting mechanism 440 cuts the sheet product at a predetermined distance from the exposed end of the roll 404), which may depend on the type of sheet product dispensed. For example, the dispenser 400 may be configured to dispense individual sheets 402 of paper towels having a predetermined sheet length of 8.5 inches. Based on the configuration and operation of the mechanical dispensing mechanism 420, the sheet length may be equal to a sum of a length of the tail portion 408 (a "tail length") and a length over which a user pulls the tail portion 408 (a "pull length") during the dispense cycle. For example, the dispenser 400 may be configured to dispense individual sheets 402 having a sheet length of 8.5 inches, wherein the tail length is 4.25 inches and the pull length is 4.25 inches. It will be understood that the dimensions of the dispenser 400, particularly the mechanical dispensing mechanism 420, and the individual sheets 402 may be selected depending upon the type of sheet product to be dispensed.

The mechanical dispensing mechanism 420 of dispenser 400 may provide significant advantages over mechanical dispensing mechanisms of known hands-free sheet product dispensers. In particular, the various non-circular gears of the mechanical dispensing mechanism 420 may provide significant advantages over conventional circular gears used in known mechanical dispensing mechanisms.

As described above, the first and second non-circular gears 460, 468 may be configured to drive the cams 446 at a varying rate during the dispense cycle. Specifically, the first and second non-circular gears 460, 468 may be configured to drive the cams 446 at substantially the same rate as the drum 422 rotates during a portion of the dispense cycle, and to drive the cams 446 at a higher rate than the drum 422 rotates during another portion of the dispense cycle. As described above, during a portion of the dispense cycle, the first and second non-circular gears 460, 468 are in an orientation in which the first step 462 of the first non-circular gear 460 engages the first step 472 of the second non-circular gear 468. Based on the pitch radii of the first step 462 of the first non-circular gear 460 and the first step 472 of the second non-circular gear 468 (as well as the pitch radii of the first and second transfer gears 478, 480), the cams 446 rotate at substantially the same rate as the drum 422 rotates. During another portion of the dispense cycle, the first and second non-circular gears 460, 468 are in an orientation in which the second step 464 of the first non-circular gear 460 engages the second step 474 of the second non-circular gear 468. Based on the pitch radii of the second step 464 of the first non-circular gear 460 and the second step 474 of the second non-circular gear 468 (as well as the pitch radii of the first and second transfer gears 478, 480), the cams 446 rotate at a higher rate than the drum 422 rotates.

As described above, the third and fourth non-circular gears 482, 484 may be configured to cause the tail spring 488 to extend and store energy during a first portion of the dispense cycle, and to be at least partially driven by the tail spring 488 as the tail spring 488 retracts and releases the stored energy during a second portion of the dispense cycle. In this manner, a portion of the pull force required to carry out the dispense cycle is used to extend the tail spring 488 throughout the first portion of the dispense cycle. As is shown, the third and fourth non-circular gears 482, 484 may have varying radius relationships with respect to one another throughout the dispense cycle. Specifically, in the first state (FIG. 15A), while the tail spring 488 is retracted and at its shortest length, the portion of the third non-circular gear 482 that engages the fourth non-circular gear 484 may have a larger pitch radius than other portions of the third non-circular gear 482. Accordingly, as the user pulls the tail portion 408 and the third and fourth non-circular gears 482, 484 rotate as described above, the fourth non-circular gear 484 rotates at a higher rate than during other states, which causes the tail spring 488 to quickly assume a position where it can extend and store energy. Following continued pulling of the tail portion 408 and rotation of the third non-circular gear 482 (FIG. 15B), the third non-circular gear 482 may have a smaller pitch radius than during the first state, which causes the tail spring 488 to slowly extend and store energy. Following continued pulling of the tail portion 408 and rotation of the third non-circular gear 482 (FIG. 15D), the third non-circular gear 482 again may have a larger pitch radius, which allows the tail spring to quickly assume a position where it can retract and release the stored energy to facilitate advancement of the sheet product. Accordingly, the third and fourth non-circular gears 482, 484 may reduce the pull force required at this point of the dispense cycle. According to different embodiments, the third and fourth non-circular gears 482, 484 may have various radius relationships that affect the peak force required to extend the tail spring 488 and the energy input required to extend the tail spring 488 (and thus also the energy output from the tail spring 488).

Ultimately, as compared to known dispensers, the dispenser 400 may allow a lower pull force (i.e., a driving force imparted by a user) required for a given sheet length and tail length. Additionally, as compared to known dispensers, the dispenser 400 may allow a lower paper strength required for a given sheet length and tail length, due to the lower pull force allowed. Moreover, as compared to known dispensers, the dispenser 400 may generate a greater amount of energy from a given pull force, which may provide greater reliability in presenting a tail portion. Further, as compared to known dispensers, the dispenser 400 may enable use of a smaller drum and thus a smaller housing, as the drum 420 of the mechanical dispensing mechanism 420 completes two rotations during a dispense cycle instead of only one.

The present disclosure thus provides improved hands-free sheet product dispensers and related methods for dispensing individual sheets from a roll of sheet product to address one or more of the potential drawbacks associated with known hands-free sheet product dispensers and methods in certain applications. For example, as compared to known dispensers, the mechanical hands-free sheet product dispensers and methods may provide certain advantages including a lower pull force required for a given sheet length and tail length, a lower paper strength required for a given sheet length and tail length, a greater amount of energy generated from a given pull force, a greater reliability in presenting a tail portion, a reduced size of a mechanical dispensing mechanism and the overall dispenser, mechanical synchronization of a dispense cycle with perforation lines of a roll of perforated sheet product, elimination of a mechanical cutting mechanism, simplification of a mechanical cutting mechanism, and lockout protection. It will be understood that, although the mechanical dispensing mechanisms provided herein are described as being incorporated into mechanical hands-free sheet product dispensers, the mechanical dispensing mechanisms provided alternatively may be incorporated into automated hands-free sheet product dispensers to provide similar advantages.

FIGS. 16A-16I illustrate an example automated hands-free flowable material dispenser 500 in accordance with one or more embodiments of the disclosure. The dispenser 500 may be configured to dispense flowable material from a replaceable container 502. As shown, the container 502 may include a reservoir 504 and a pump assembly 506 attached to the reservoir 504. The reservoir 504 may contain the flowable material therein and may be formed as a bag or a bottle. In certain embodiments, the reservoir 504 may be collapsible such that the reservoir 504 collapses over time as the flowable material is dispensed therefrom. In other embodiments, the reservoir 504 may be rigid or substantially rigid such that the reservoir 504 maintains its shape over time as the flowable material is dispensed therefrom. In various embodiments, the flowable material may be soap, sanitizer, lotion, or other types of flowable materials. The pump assembly 506 may include a pump 508 attached to and in fluid communication with the reservoir 504. The pump 508 may be configured to pump a portion of the flowable material from the reservoir 504 during a dispense cycle. As shown, the pump 508 may include a pump body 510 and a pump piston 512 configured to move relative to the pump body 510 to actuate the pump 508. The pump 508 may be moved between an extended configuration and a compressed configuration during actuation of the pump 508. In particular, the pump piston 512 may be translated relative to the pump body 510 to move the pump 508 between the extended configuration and the compressed configuration. As the pump piston 512 translates in a first direction toward the pump body 510, moving the pump 508 from the extended configuration to the compressed configuration, flowable material disposed within the pump 508 may be dispensed therefrom. As the pump 508 translates in an opposite second direction away from the pump body 510, moving the pump 508 from the compressed configuration to the extended configuration, additional flowable material may be drawn from the reservoir 504 into the pump 508. The pump 508 also may include a spring 514 configured to bias the pump 508 toward the extended configuration. In other words, the spring 514 may be configured to bias the pump piston 512 away from the pump body 510 in the second direction, such that the pump 508 assumes the extended configuration absent external forces applied thereto. In certain embodiments, as shown, the container 502 may be mounted to the dispenser 500 with the reservoir 504 positioned above the pump 508, and the pump 508 may be actuated by moving the pump piston 512 relative to the pump body 510 in a vertical direction. In other embodiments, the container 502 may be mounted to the dispenser 500 with the reservoir 504 positioned below the pump 508, and the pump 508 may be actuated by moving the pump piston 512 relative to the pump body 510 in a vertical direction. Still other orientations of the container 502 and directions of actuation of the pump 508 may be used in other embodiments.

Figure 16A:
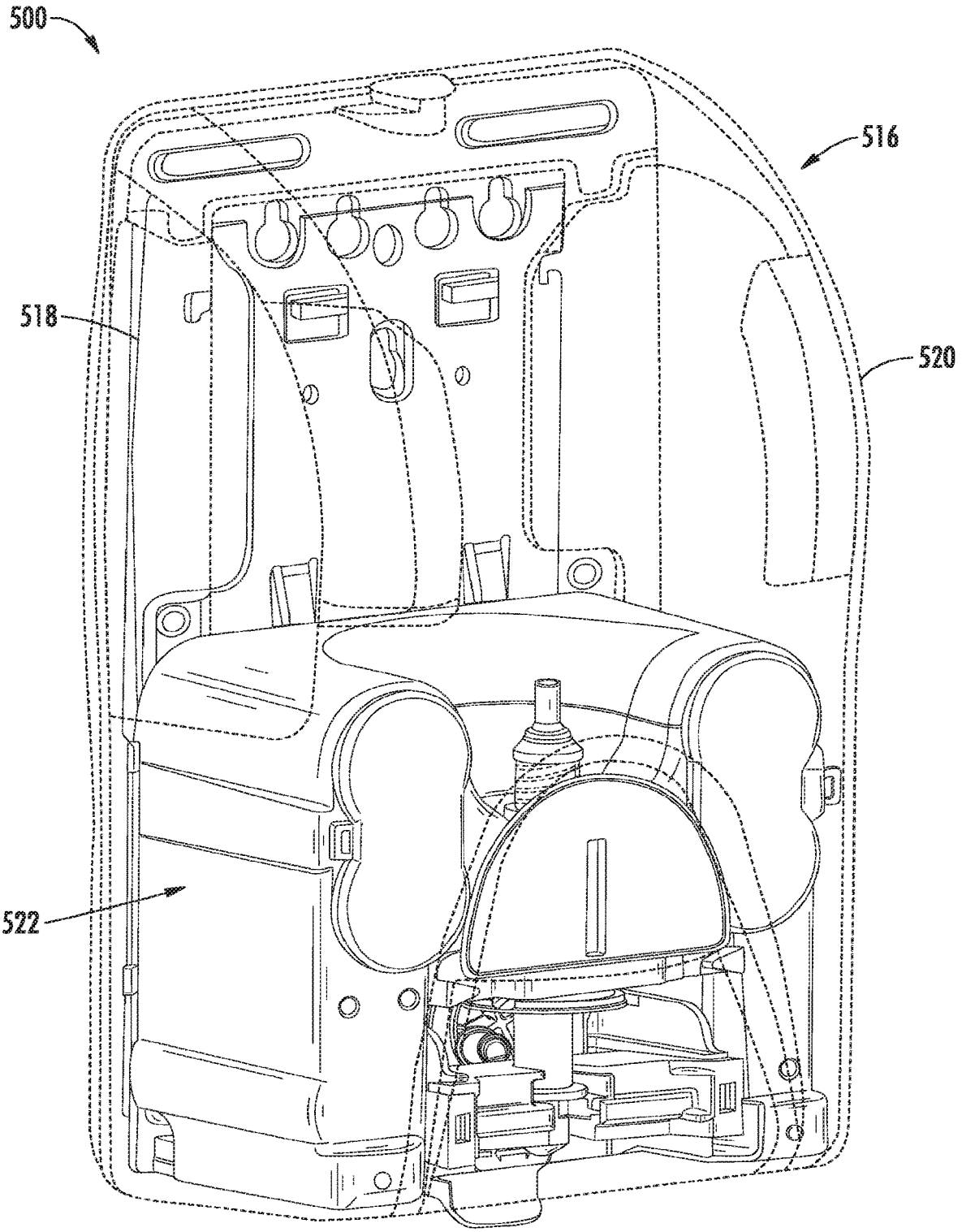
FIG. 16A is a front perspective view of an example automated hands-free flowable material dispenser in accordance with one or more embodiments of the disclosure.
Figure 16B:
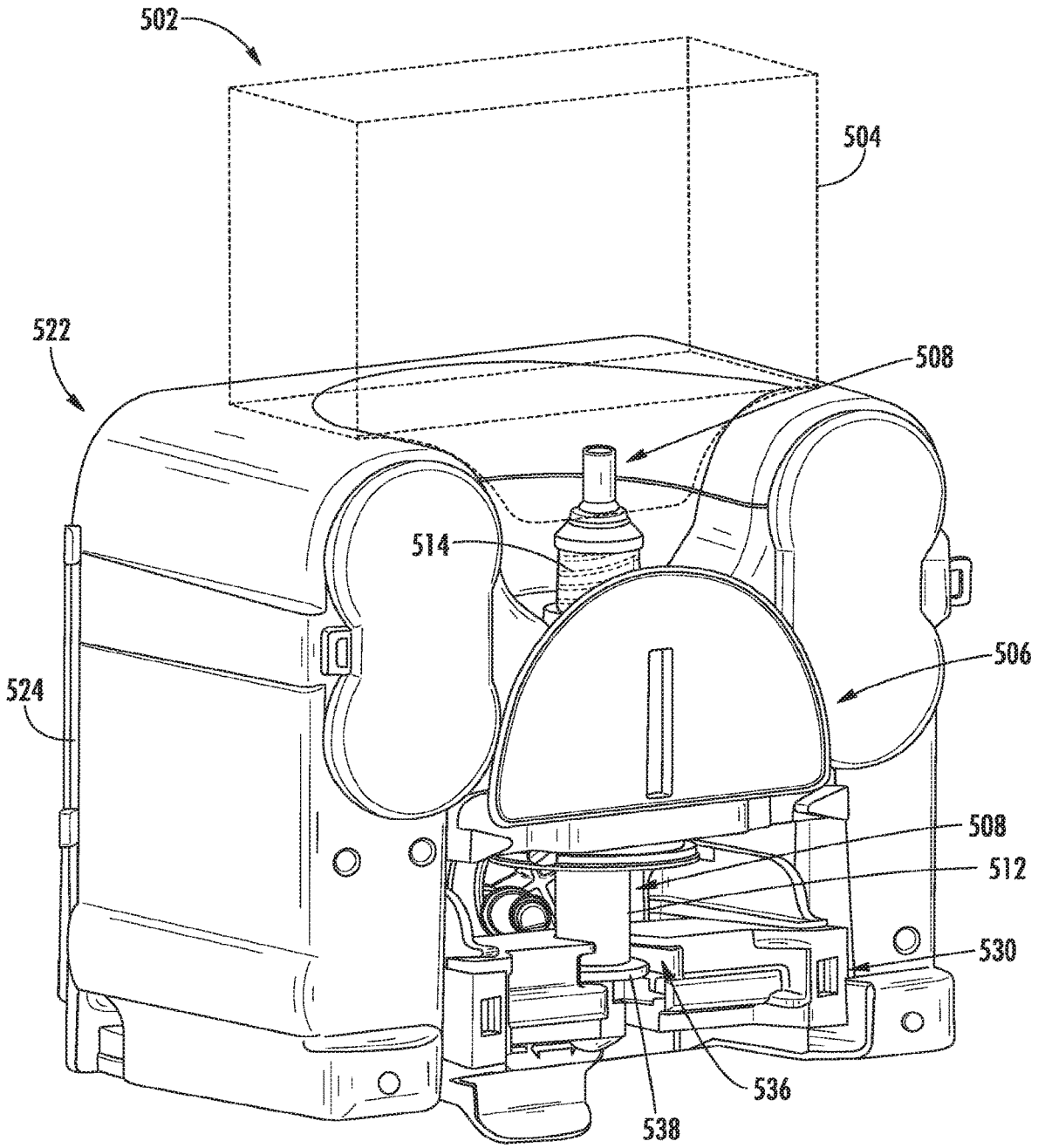
FIG. 16B is a front perspective view of a chassis assembly of the example automated hands-free flowable material dispenser of FIG. 16A, with a container attached thereto.
Figure 16C:
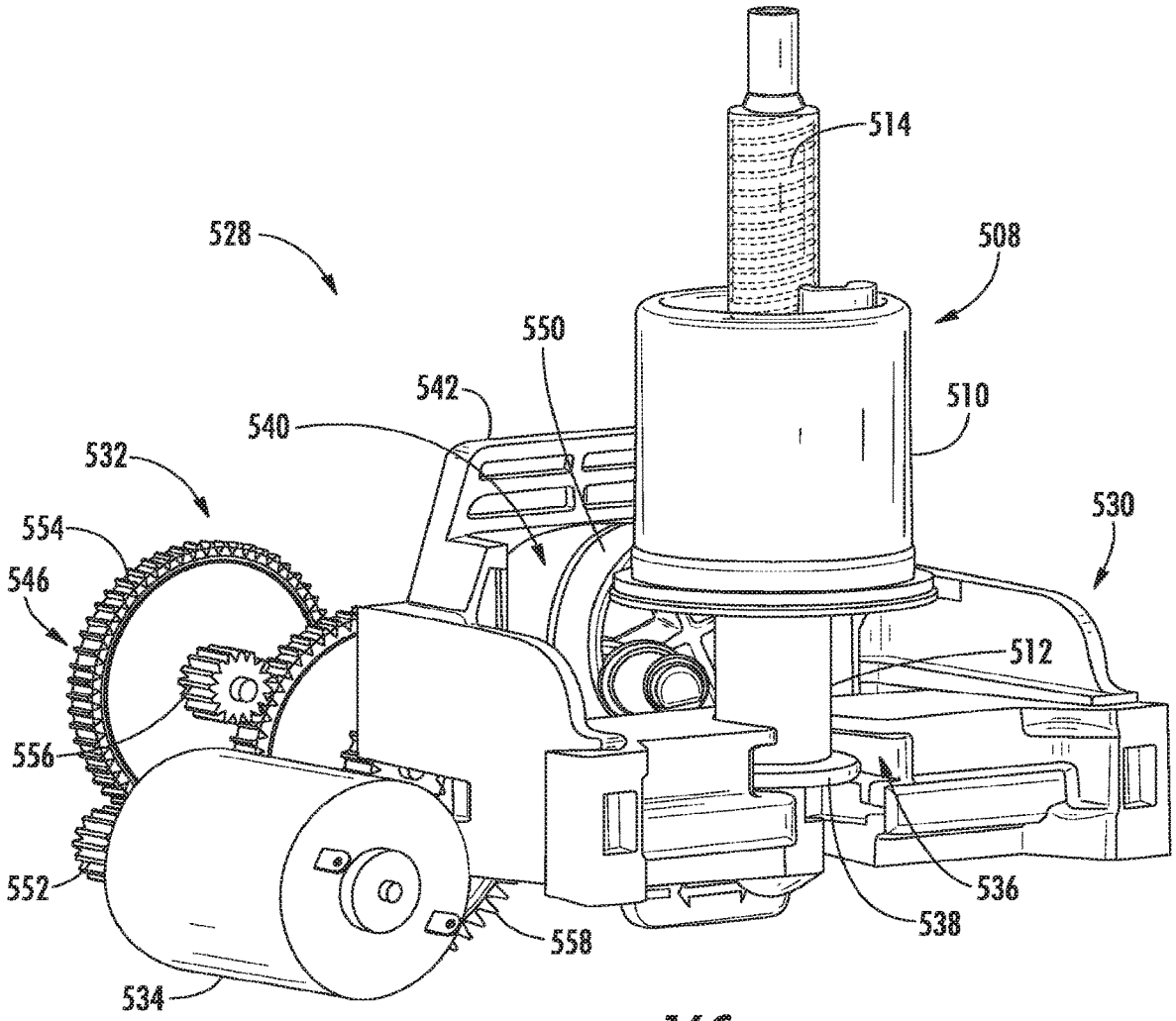
FIG. 16C is a front perspective view of a motor, a drive assembly, and an actuator of the example automated hands-free flowable material dispenser of FIG. 16A, with a pump assembly attached thereto.
Figure 16D:
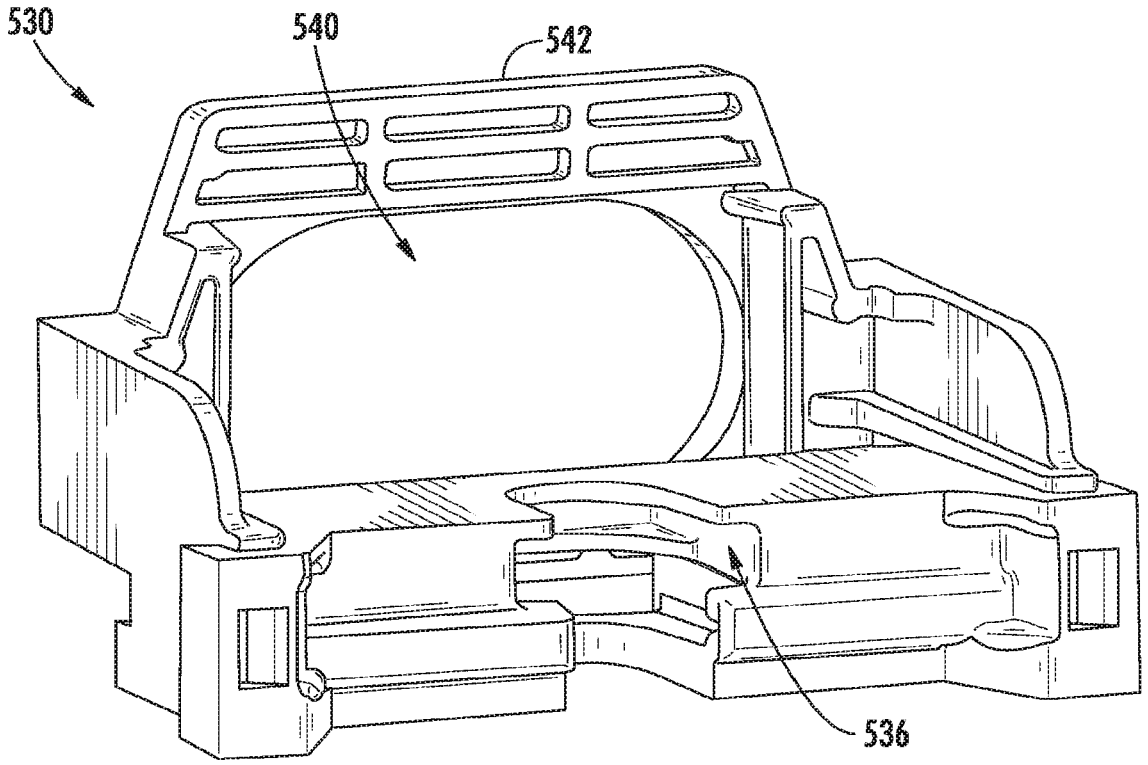
FIG. 16D is a front perspective view of the actuator of the example automated hands-free flowable material dispenser of FIG. 16A.
Figure 16E:
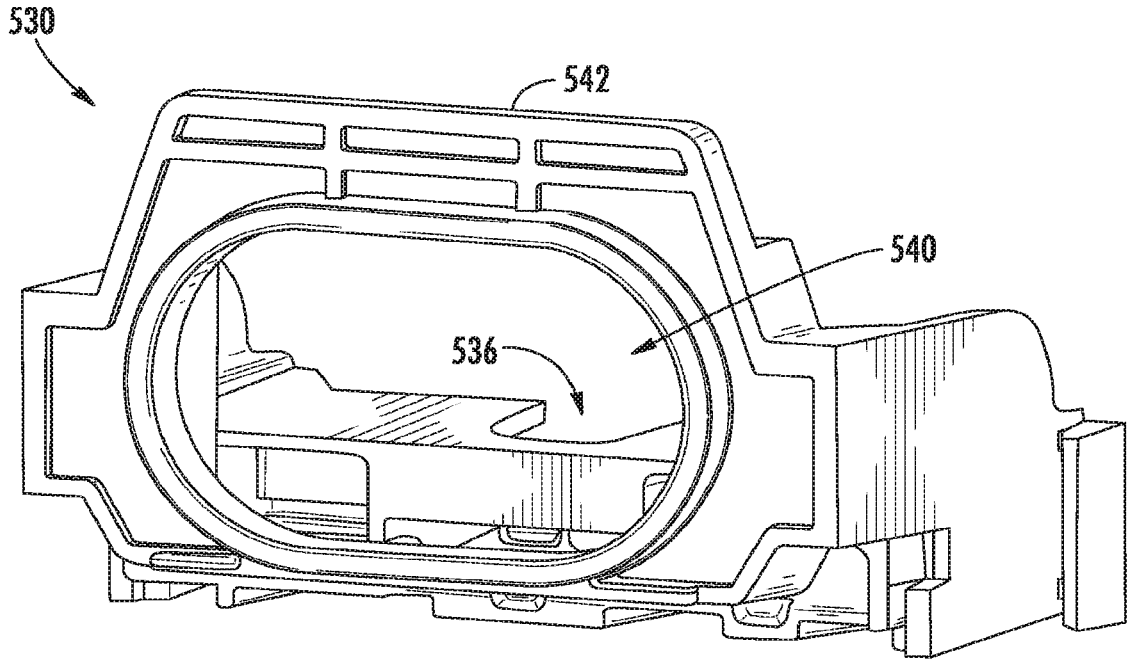
FIG. 16E is a back perspective view of the actuator of the example automated hands-free flowable material dispenser of FIG. 16A.

As shown in FIG. 16A, the dispenser 500 may include a dispenser housing 516 defining an interior space and configured to receive the container 502 therein. The dispenser housing 516 also may contain other components of the dispenser 500 therein, as described below. In certain embodiments, the dispenser housing 516 may include a base 518 and a cover 520 configured to move relative to the base 518. The base 518 may be configured to attach the dispenser 500 to a wall, a countertop, or other mounting surface, or to a stand or other support structure for supporting the dispenser 500 thereabout. The cover 520 may be configured to move relative to the base 518 between a closed position for covering the container 502 and internal components during use of the dispenser 500 and an open position for allowing access to an internal space of the housing 516, for example, to replace the container 502 or to access the internal components of the dispenser 500. In certain embodiments, as shown, the cover 520 may be configured to pivot relative to the base 518 between the closed position and the open position. Various configurations of the dispenser housing 516 may be used. In certain embodiments, the dispenser housing 516 may receive only a portion of the container 502 therein during use of the dispenser 500. In certain embodiments, as shown, the dispenser 500 may be a wall-mounted dispenser, with a portion of the dispenser housing 516 attached to a wall during use of the dispenser 500. In other embodiments, the dispenser 500 may be an in-counter dispenser, with a portion of the dispenser 500 positioned above a countertop and another portion of the dispenser 500 positioned below the countertop during use thereof. In still other embodiments, the dispenser 500 may be a stand-mounted dispenser, with a portion of the dispenser housing 516 attached to a stand or other support structure during use of the dispenser 500.

As shown, the dispenser 500 also may include a chassis portion 522 disposed within the dispenser housing 516. The chassis portion 522 may be configured to support the container 502 and other components of the dispenser 500 within the housing 516. As shown, the chassis portion 522 may include a chassis housing 524 configured to engage the container 502 supported thereby. In certain embodiments, as shown, the chassis housing 524 may engage and support the pump body 510 such that the pump body 510 remains stationary with respect to the chassis housing 524 during actuation of the pump 508. In other embodiments, the chassis housing 524 may engage and support the pump piston 512 such that the pump piston 512 remains stationary with respect to the chassis housing 524 during actuation of the pump 508. In certain embodiments, as shown, the chassis housing 524 may engage and support the reservoir 504 during use of the dispenser 500. In other embodiments, the reservoir 504 may move relative to the chassis housing 524 during use of the dispenser 500. Various configurations of the chassis housing 524 may be used, which may engage and support one or more portions of the container 502 during use of the dispenser 500.

The dispenser 500 may include an automated dispensing mechanism 528 configured to facilitate actuation of the pump 508 to dispense the flowable material therefrom during a dispense cycle. The automated dispensing mechanism 528 may include an actuator 530, a drive assembly 532, and an electric motor 534. The actuator 530 may be disposed within the dispenser housing 516 and configured to translate relative to the housing 516 between a first position and a second position during a dispense cycle. In certain embodiments, as shown, the actuator 530 may be configured to translate in a vertical direction relative to the dispenser housing 516 between the first position and the second position. In certain embodiments, the first position may be a lowermost position of the actuator 530, and the second position may be an uppermost position of the actuator 530. In other embodiments, the actuator 530 may be configured to translate in a horizontal direction relative to the dispenser housing 516 between the first position and the second position. In still other embodiments, the actuator 530 may be configured to translate relative to the dispenser housing 516 between the first position and the second position in a direction transverse to each of the vertical direction and the horizontal direction. The actuator 530 may include a pump interface 536 configured to engage the pump 508 and facilitate actuation of the pump 508. In certain embodiments, as shown, the pump interface 536 may include a recess defined in the actuator 530 and configured to receive a flange 538 of the pump piston 512 therein. The actuator 530 may be configured to move the pump 508 between the extended configuration and the compressed configuration as the actuator 530 translates between the first position and the second position during a dispense cycle. In certain embodiments, as shown, when the actuator 530 is in the first position, the pump 508 may be maintained in the extended configuration. As the actuator 530 translates from the first position to the second position, the actuator 530 may move the pump 508 from the extended configuration to the compressed configuration, and as the actuator 530 translates from the second position to the first position, the actuator 530 may move the pump 508 from the compressed configuration to the extended configuration. In particular, such movement may be achieved by the actuator 530 engaging the flange 538 and translating the pump piston 512 relative to the pump body 510. In certain embodiments, a complete dispense cycle may include the actuator 530 moving the pump 508 from the extended configuration to the compressed configuration and then moving the pump 508 from the compressed configuration to the extended configuration. In certain embodiments, movement of the pump 508 from the extended configuration to the compressed configuration may cause flowable material within the pump 508 to be dispensed from the pump 508, and movement of the pump 508 from the compressed configuration to the extended configuration may cause additional flowable material to be drawn from the reservoir 504 into the pump 508 to refill the pump 508. As shown, the actuator 530 also may include a drive slot 540 defined in a wall 542 of the actuator 530 and configured to receive a portion of the drive assembly 532 therein. In certain embodiments, the drive slot 540 may have an elongated, racetrack shape (i.e., a pair of semi-circular ends spaced apart from one another by a pair parallel sides) extending in a horizontal direction, although other shapes and orientations of the drive slot 540 may be used. As described below, the drive assembly 532 may engage the drive slot 540 to facilitate translation of the actuator 530 between the first position and the second position.

The drive assembly 532 may be coupled to the actuator 530 and the motor 534. The motor 534 may be configured to drive the drive assembly 532, and the drive assembly 532 may be configured to translate the actuator 530 between the first position and the second position. In certain embodiments, the motor 534 may be a DC motor, although other types of motors may be used. The motor 534 may be powered by one or more batteries of the dispenser 500. In certain embodiments, as shown, the motor 534 may be supported by and disposed within the chassis housing 524. The drive assembly 532 may include a drive body 544 and a gear train 546. The drive body 544 may be coupled to the actuator 530, and the gear train 546 may be coupled to the motor 534 and the drive body 544. The drive body 544 may be configured to rotate relative to the dispenser housing 516 and the chassis housing 524 about a rotational axis extending in a horizontal direction. The drive body 544 may include a plate 548 and a lobe 550 extending from the plate 548. As shown, the lobe 550 may be offset from the rotational axis of the drive body 544. In other words, a center of the lobe 550 may be offset from the rotational axis of the drive body 544, such that the center of the lobe 550 follows a circular path around the rotational axis as the drive body 544 rotates. In certain embodiments, as shown, the lobe 550 may have a circular cross-sectional shape taken perpendicular to the rotational axis of the drive body 544, although other shapes may be used. At least a portion of the lobe 550 may be movably disposed within the drive slot 540. In this manner, the drive body 544 may be coupled to the actuator 530 by the lobe 550 engaging the drive slot 540. The received portion of the lobe 550 may be able to rotate relative to the drive slot 540 and to translate relative to the drive slot 540 between the ends of the slot 540 as the drive body 544 rotates about the rotational axis. As described further below, the offset position of the lobe 550 may cause the actuator 530 to translate between the first position and the second position as the drive body 544 rotates about the rotational axis.

Figure 16F:
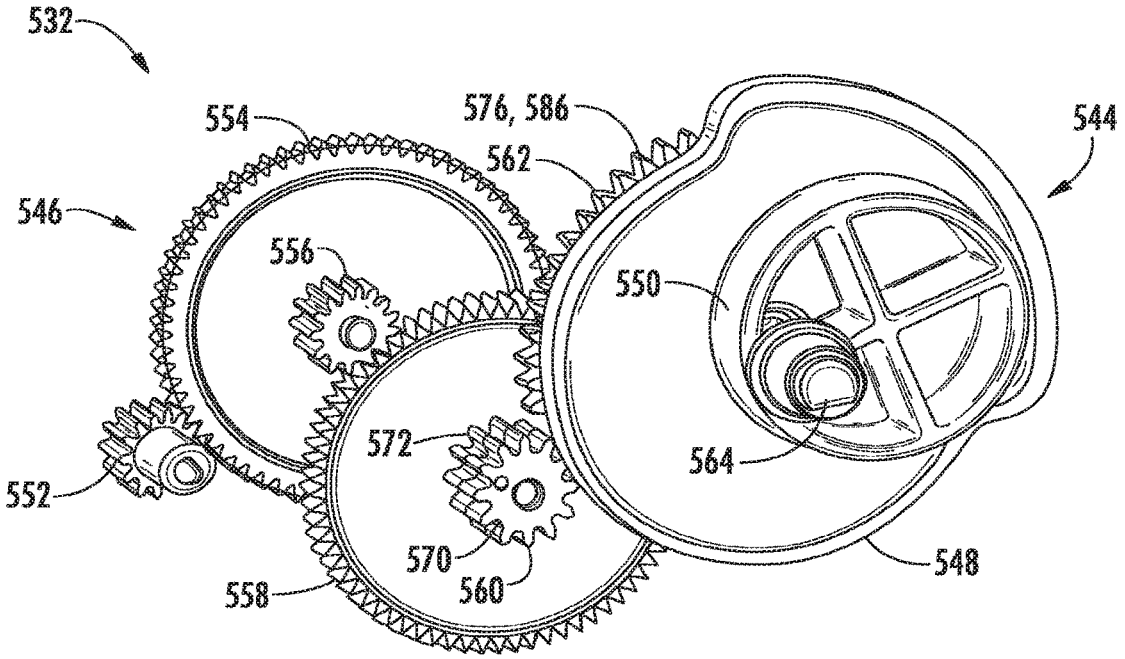
FIG. 16F is a front perspective view of a gear train and a drive body of the drive assembly of the example automated hands-free flowable material dispenser of FIG. 16A.
Figure 16G:
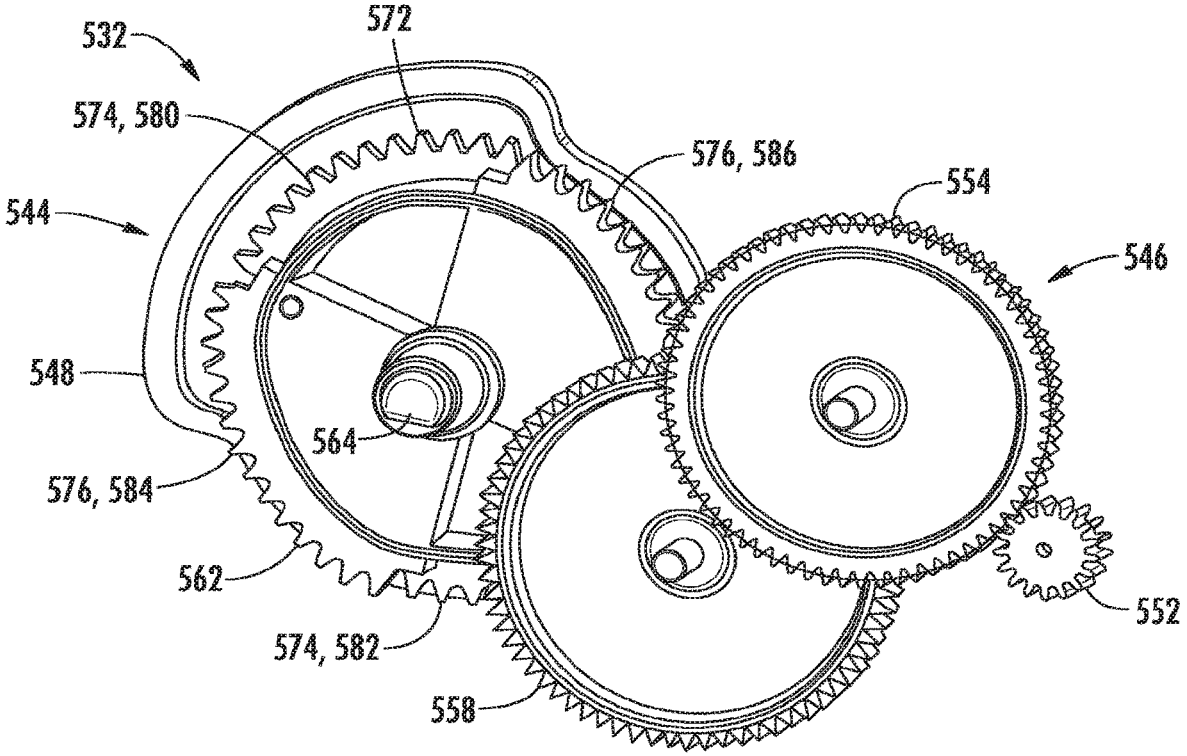
FIG. 16G is a back perspective view of the gear train and the drive body of the drive assembly of the example automated hands-free flowable material dispenser of FIG. 16A.

As shown, the gear train 546 may include a plurality of gears configured to be driven by the motor 534 and facilitate rotation of the drive body 544. In certain embodiments, the gear train 546 may include a first gear 552, a second gear 554, a third gear 556, a fourth gear 558, a fifth gear 560, and a sixth gear 562 arranged as shown in FIGS. 16F and 16G. The first gear 552, which also may be referred to as a "motor pinion gear" or an "input gear," may be a circular gear coupled to the drive shaft of the motor 534 for rotation therewith. The second gear 554, which also may be referred to as a "fast gear," may be a circular gear that engages and is rotated by the first gear 552. The third gear 556, which also may be referred to as a "fast pinion," may be a circular gear that is coupled to the second gear 554 for rotation therewith. The third gear 556 and the second gear 554, which collectively may form a "fast compound gear," may be coupled to one another directly or indirectly via the shaft supporting the gears 554, 556. The fourth gear 558, which also may be referred to as a "first slow gear," may be a circular gear that engages and is rotated by the third gear 556. The fifth gear 560, which also may be referred to as a "slow pinion" or a "non-circular pinion" may be a non-circular gear that is coupled to the fourth gear 558 for rotation therewith. The fifth gear 560 and the fourth gear 558, which collectively may form a "slow compound gear," may be coupled to one another directly or indirectly via the shaft supporting the gears 558, 560. The sixth gear 562, which also may be referred to as a "second slow gear" or a "non-circular gear," may be a non-circular gear that engages and is rotated by the fifth gear 560. The sixth gear 562 may be coupled to the drive body 544 for rotation therewith. In certain embodiments, as shown, the sixth gear 566 may be indirectly coupled to the drive body 544 via a shaft 564. The shaft 564 may have a D-shaped cross-section and may extend through mating D-shaped apertures of the sixth gear 562 and the drive body 544. In this manner, the sixth gear 562 may be coupled to the drive body 544 for rotation along with the shaft 564. In other embodiments, the sixth gear 562 may be directly coupled to the drive body 544. The respective shafts of the gear train 546 may be supported by the chassis housing 524 or other support structure such that the gears 552, 554, 556, 558, 560, 562 rotate about respective rotational axes. In certain embodiments, as shown, the respective rotational axes may be fixed relative to the chassis housing 524 and the dispenser housing 516. In other embodiments, one or more of the respective rotational axes may move relative to the chassis housing 524 and the dispenser housing 516. In certain embodiments, as shown, the gears 552, 554, 556, 558, 560, 562 may be disposed within the chassis housing 524. In certain embodiments, the fifth gear 560 and the sixth gear 562 may have an overall gear ratio that is an integer ratio (i.e., 1:1, 2:1, 3:1, 4:1, etc.). In certain embodiments, the fifth gear 560 and the sixth gear 562 may have an overall gear ratio that is greater than 1:1, thereby incorporating gear reduction. In certain embodiments, as shown, the fifth gear 560 and the sixth gear 562 may have an overall gear ratio of 4:1, although other gear ratios may be used. It will be appreciated that the illustrated configuration of the gear train 546 represents merely one embodiment, and that other configurations including a different arrangement and/or a different number of gears may be used.

In certain embodiments, as shown, the fifth gear 560 and the sixth gear 562 may include multiple levels of teeth. The multiple levels of teeth may allow the fifth gear 560 and the sixth gear 562 to have a desired overall gear ratio, such as the 4:1 overall gear ratio provided by the illustrated embodiment. For example, the fifth gear 560 may include a first level of teeth 570 and a second level of teeth 572 offset from one another in a direction of the rotational axis of the fifth gear 560. The fifth gear 560 may have a minimum radius along at least a portion of the first level of teeth 570 and a maximum radius along at least a portion of the second level of teeth 572. The sixth gear 562 may include a first level of teeth 574 and a second level of teeth 576 offset from one another in a direction of the rotational axis of the sixth gear 562. The sixth gear 562 may have a maximum radius along at least a portion of the first level of teeth 574 and a minimum radius along at least a portion of the second level of teeth 576. In certain embodiments, as shown, the levels of teeth 574, 576 of the sixth gear 562 each may include multiple sets of teeth. In particular, the first level of teeth 574 may include a first set of first-level teeth 580 and a second set of first-level teeth 582 spaced apart from one another in a circumferential direction of the sixth gear 562, and the second level of teeth 576 may include a first set of second-level teeth 584 and a second set of second-level teeth 586 spaced apart from one another in the circumferential direction of the sixth gear 562. The fifth gear 560 and the sixth gear 562 may be configured such that the first level of teeth 570 of the fifth gear 560 engages the first level of teeth 574 of the sixth gear 562 during a portion of a dispense cycle, and the second level of teeth 572 of the fifth gear 560 engages the second level of teeth 576 of the sixth gear 562 during another portion of the dispense cycle. The first level of teeth 570 of the fifth gear 560 and the first level of teeth 574 of the sixth gear 562 may have a first gear ratio curve, and the second level of teeth 572 of the fifth gear 560 and the second level of teeth 576 of the sixth gear 562 may have a second gear ratio curve that is different than the first gear ratio curve. According to the illustrated embodiment in which the fifth gear 560 and the sixth gear 562 have an overall gear ratio of 4:1, the gear ratio curve of the fifth gear 560 and the sixth gear 562 may fluctuate throughout two rotations of the fifth gear 560 without repeating itself, and the gear ratio curve may repeat itself only two times over four rotations of the fifth gear 560. According to embodiments in which the fifth gear 560 and the sixth gear 562 have an overall gear ratio of 4:1 and each have only a single level of teeth, the gear ratio curve of the fifth gear 560 and the sixth gear 562 may fluctuate throughout one rotation of the fifth gear 560, and the gear ratio curve may repeat itself four times over four rotations of the fifth gear 560. Therefore, as compared to embodiments in which the fifth gear 560 and the sixth gear 562 each have only a single level of teeth, the multiple levels of teeth of the fifth gear 560 and the sixth gear 562 may provide greater flexibility in designing a suitable gear ratio curve with less repetition during a dispense cycle of the dispenser 500.

As described further below, the automated dispensing mechanism 528 may be configured to manage torque exerted by the motor 534 during a dispense cycle of the dispenser 500. In particular, the automated dispensing mechanism 528 may be configured to minimize a peak torque required from the motor 534 during a dispense cycle of the dispenser 500. As described above, the automated dispensing mechanism 528 may actuate the pump 508 to dispense the flowable material from the pump 508 during a dispense cycle. In certain embodiments, during a dispense cycle, the automated dispensing mechanism 528 may move the pump 508 from the extended configuration to the compressed configuration and from the compressed configuration to the extended configuration. As described above, the motor 534 may drive the gear train 546, the gear train 546 may rotate the drive body 544, the drive body 544 may translate the actuator 530, and the actuator 530 may move the pump 508 between the extended configuration and the compressed configuration during a dispense cycle.

It will be appreciated that the automated dispensing mechanism 528 may be required to overcome one or more forces resisting movement of the pump 508 between the extended configuration and the compressed configuration during a dispense cycle. In certain embodiments, the automated dispensing mechanism 528 may be required to overcome one or more forces resisting movement of the pump 508 from the extended configuration to the compressed configuration, or from the compressed configuration to the extended configuration, in order to dispense flowable material from the pump 508. Such resistance forces may include a spring force generated by compression or extension of the spring 514 of the pump 508, a friction force generated by relative movement of the pump piston 512 and the pump body 510 and/or other components of the pump 508, a fluid force generated by movement of the flowable material within and/or out of the pump 508, and/or other forces generated by movement of the pump 508 between the extended configuration and the compressed configuration. It will be appreciated that such resistance forces may vary during a dispense cycle, as the pump 508 is moved between the extended configuration and the compressed configuration. For example, in certain embodiments, the resistance forces may increase as the pump 508 is moved from the extended configuration to the compressed configuration and may decrease as the pump 508 is moved from the compressed configuration to the extended configuration. Accordingly, a required force exerted by the drive body 544 against the actuator 530 in order to overcome the resistance forces and translate the actuator 530 to move the pump 508 may vary during a dispense cycle. Further, a required torque exerted by the motor 534 in order to drive the gear train 546 and rotate the drive body 544 to exert the required force may vary during a dispense cycle. In this manner, the required torque exerted by the motor 534 may increase during a portion of the dispense cycle and may decrease during another portion of the dispense cycle.

The automated dispensing mechanism 528 may be configured to minimize a peak torque required from the motor 534 during a dispense cycle of the dispenser 500. It will be appreciated that the required torque exerted by the motor 534 may be affected by a mechanical advantage provided by the drive assembly 532, a rate of rotation of the drive body 544 provided by the drive assembly 532, and a rate of translation of the actuator 530 provided by the drive assembly 532, each of which may vary during a dispense cycle. In certain embodiments, the required torque exerted by the motor 534 may vary during a dispense cycle based at least in part on a mechanical advantage provided by the drive assembly 532. In certain embodiments, the drive assembly 532 may provide a mechanical advantage that varies during a dispense cycle. The drive assembly 532 may provide a first mechanical advantage during a first portion of the dispense cycle and a second mechanical advantage during a second portion of the dispense cycle, with the second mechanical advantage being different than the first mechanical advantage. In certain embodiments, the drive assembly 532 may provide a first mechanical advantage during a first portion of the dispense cycle and a second mechanical advantage during a second portion of the dispense cycle, with the second mechanical advantage being greater than the first mechanical advantage. Resistance forces resisting movement of the pump 508 during the second portion of the dispense cycle may be greater than resistance forces resisting movement of the pump 508 during the first portion of the dispense cycle. During the second portion of the dispense cycle, the greater second mechanical advantage may allow the drive assembly 532 to overcome the greater resistance forces and translate the actuator 530 to move the pump 508, while minimizing the peak torque required from the motor 534. During the first portion of the dispense cycle, the lesser first mechanical advantage may be sufficient for the drive assembly 532 to overcome the lesser resistance forces and translate the actuator 530 to move the pump 508. The drive assembly 532 may be configured to provide the greater second mechanical advantage during a portion of the dispense cycle in which the drive assembly 532 is required to overcome a peak value of the resistance forces resisting movement of the pump 508. In other words, the greater second mechanical advantage provided by the drive assembly 532 may correspond to a portion of the dispense cycle in which the resistance forces resisting translation of the actuator 530 are at a peak value. In certain embodiments, the drive assembly 532 may be configured to provide the greater second mechanical advantage during a portion of the dispense cycle in which the actuator 530 moves the pump 508 toward the compressed configuration. In certain embodiments, the drive assembly 532 may be configured to provide the greater second mechanical advantage during a portion of the dispense cycle in which the actuator 530 moves the pump 508 toward the extended configuration. In certain embodiments, the varying mechanical advantage provided by the drive assembly 532 may be achieved by the non-circular configuration of the fifth gear 560 and the sixth gear 562 described above. For example, the greater second mechanical advantage may be provided when the minimum radius of the fifth gear 560 engages the maximum radius of the sixth gear 562, and the lesser first mechanical advantage may be provided when the maximum radius of the fifth gear 560 engages the minimum radius of the sixth gear 562.

In certain embodiments, the required torque exerted by the motor 534 may vary during a dispense cycle based at least in part on a rate of rotation of the drive body 544 about its rotational axis. In certain embodiments, the drive assembly 532 may be configured to rotate the drive body 544 at a varying rate of rotation during a dispense cycle. In particular, the drive assembly 532 may be configured to rotate the drive body 544 at a varying rate of rotation that is non-proportional to a rate of rotation of the motor 534 during a dispense cycle. The drive assembly 532 may be configured to rotate the drive body 544 at a first rate of rotation during a first portion of the dispense cycle and a second rate of rotation during a second portion of the dispense cycle, with the second rate of rotation being different than the first rate of rotation. In certain embodiments, the drive assembly 532 may be configured to rotate the drive body 544 at a first rate of rotation during a first portion of the dispense cycle and a second rate of rotation during a second portion of the dispense cycle, with the second rate of rotation being less than the first rate of rotation. Resistance forces resisting movement of the pump 508 during the second portion of the dispense cycle may be greater than resistance forces resisting movement of the pump 508 during the first portion of the dispense cycle. During the second portion of the dispense cycle, the lesser second rate of rotation may allow the drive assembly 532 to overcome the greater resistance forces and translate the actuator 530 to move the pump 508, while minimizing the peak torque required from the motor 534. During the first portion of the dispense cycle, the greater first rate of rotation may be sufficient for the drive assembly 532 to overcome the lesser resistance forces and translate the actuator 530 to move the pump 508. The drive assembly 532 may be configured to rotate the drive body 544 at the lesser second rate of rotation during a portion of the dispense cycle in which the drive assembly 532 is required to overcome a peak value of the resistance forces resisting movement of the pump 508. In other words, the lesser second rate of rotation of the drive body 544 provided by the drive assembly 532 may correspond to a portion of the dispense cycle in which the resistance forces resisting translation of the actuator 530 are at a peak value. In certain embodiments, the drive assembly 532 may be configured to rotate the drive body 544 at the lesser second rate of rotation during a portion of the dispense cycle in which the actuator 530 moves the pump 508 toward the compressed configuration. In certain embodiments, the drive assembly 532 may be configured to rotate the drive body 544 at the lesser second rate of rotation during a portion of the dispense cycle in which the actuator 530 moves the pump 508 toward the extended configuration. In certain embodiments, the varying rate of rotation of the drive body 544 provided by the drive assembly 532 may be achieved by the non-circular configuration of the fifth gear 560 and the sixth gear 562 described above. For example, the lesser second rate of rotation of the drive body 544 may be provided when the minimum radius of the fifth gear 560 engages the maximum radius of the sixth gear 562, and the greater first rate of rotation of the drive body 544 may be provided when the maximum radius of the fifth gear 560 engages the minimum radius of the sixth gear 562.

The drive assembly 532 of the automated dispensing mechanism 528 may be configured to translate the actuator 530 between the first position and the second position at a varying rate of translation during a dispense cycle. In certain embodiments, the drive assembly 532 may be configured such that the varying rate of translation varies relative to a rate of rotation of the motor 534 and follows a non-sinusoidal waveform, as described below. The drive assembly 532 may be configured to translate the actuator 530 in a first direction from the first position to the second position during a first portion of the dispense cycle, and to translate the actuator 530 in an opposite second direction from the second position to the first position during a second portion of the dispense cycle. In certain embodiments, the varying rate of translation may increase during part of the first portion of the dispense cycle and decrease during another part of the first portion of the dispense cycle, and the varying rate of translation may increase during part of the second portion of the dispense cycle and decrease during another part of the second portion of the dispense cycle. In certain embodiments, the non-sinusoidal waveform of the varying rate of translation of the actuator 530 provided by the drive assembly 532 may be achieved by the non-circular configuration of the fifth gear 560 and the sixth gear 562 described above and the resulting interaction between the drive body 544 and the actuator 530 during the dispense cycle.

FIGS. 16H-16K show front views of the fourth gear 558, the fifth gear 560, the sixth gear 562, and the drive body 544 of the drive assembly 532 in a number of different states during a dispense cycle as may be carried out using the dispenser 500. It will be appreciated that the drive body 544 is shown as being transparent in FIGS. 16H-16K for purposes of illustration. Further, it will be appreciated that the orientations and directions of movement of the various components of the automated dispensing mechanism 528 described herein and shown in FIGS. 16H-16K relate to only certain embodiments of the automated dispensing mechanism 528, and that other orientations and directions of movement of the components may be used in other embodiments. FIG. 16L illustrates a graph of rate of translation of the actuator 530 (inches per degree of rotation of the fifth gear 560) as a function of rotation of the fifth gear 560

(degrees), showing a respective curve for the drive assembly 532 during a dispense cycle. As shown in FIG. 16L and described below with respect to FIGS. 16H-16K, the varying rate of translation of the actuator 530 provided by the drive assembly 532 during the dispense cycle may follow a non-sinusoidal waveform.

Figure 16H:
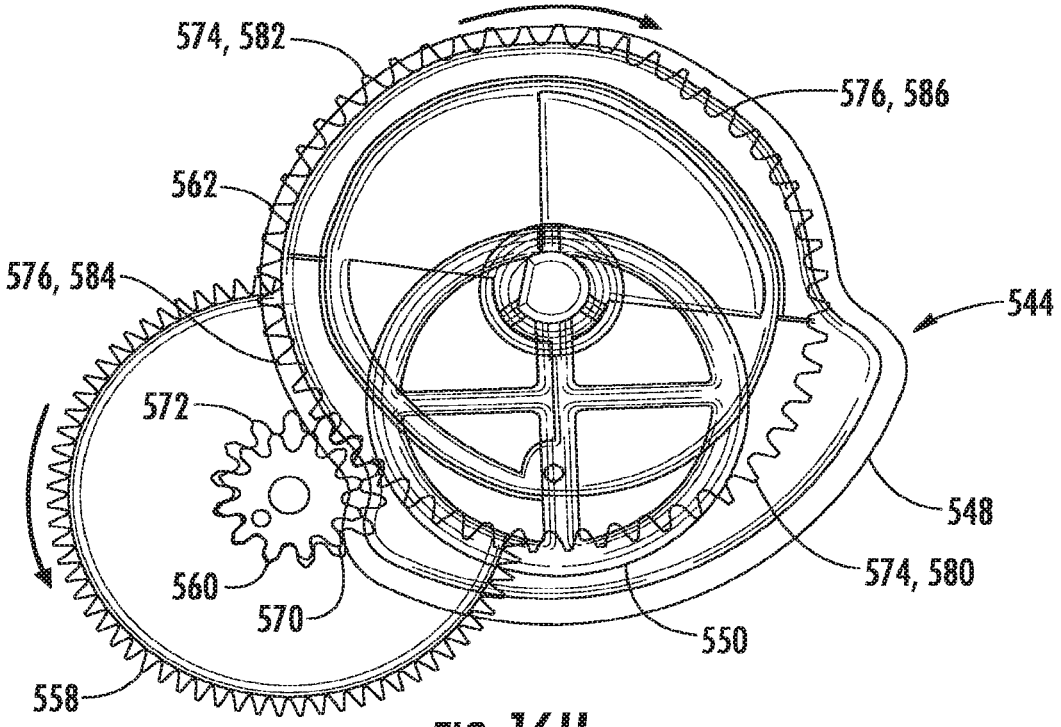
FIG. 16H is a front view of a portion of the gear train and the drive body of the drive assembly of the example automated hands-free flowable material dispenser of FIG. 16A at a first state during a dispense cycle.

FIG. 16H shows the respective portions of the drive assembly 532 in a first state, which may correspond to a home state of the drive assembly 532 in certain embodiments. In this manner, in certain embodiments, a dispense cycle may begin with the drive assembly 532 in the first state. In certain embodiments, when the drive assembly 532 is in the first state, the center of the lobe 550 may be aligned with the axis of rotation of the drive body 544 in the vertical direction and positioned below the axis of rotation. In certain embodiments, the lobe 550 may be positioned at the center of the drive slot 540 of the actuator 530 (i.e., midway between the ends of the drive slot 540), and the actuator 530 may be in the first position (i.e., the lowermost position of the actuator 530 according to the illustrated embodiment). In certain embodiments, when the drive assembly 532 is in the first state, the second level of teeth 572 of the fifth gear 560 may engage the second level of teeth 576 of the sixth gear 562. In particular, the second level of teeth 572 of the fifth gear 560 may engage the first set of second-level teeth 584 of the sixth gear 562. In certain embodiments, when the drive assembly 532 is in the first state, the maximum radius of the fifth gear 560 may engage the minimum radius of the sixth gear 562. In this manner, when the drive assembly 532 is in the first state, the drive assembly 532 may provide a first mechanical advantage, which may be a minimum mechanical advantage provided during the dispense cycle.

Upon activation of the motor 534, the motor 534 may drive the drive assembly 532 such that the gear train 546 rotates the drive body 544 (clockwise in the front views shown) about its axis of rotation. In particular, the shaft of the motor 534 may rotate the first gear 552 (counter-clockwise), the first gear 552 may rotate the second gear 554 (clockwise), the third gear 556 may rotate along with the second gear 554 (clockwise), the third gear 556 may rotate the fourth gear 558 (counter-clockwise), the fifth gear 560 may rotate along with the fourth gear 558 (counter-clockwise), the fifth gear 560 may rotate the sixth gear 562 (clockwise), and the drive body 544 may rotate along with the sixth gear 562 (clockwise) from their respective positions of the first state. In certain embodiments, the shaft of the motor 534 may rotate at a constant rate or a substantially constant rate throughout the dispense cycle, except for during initial starting of the motor 534 at the beginning of the dispense cycle and stopping of the motor 534 at the end of the dispense cycle. In this manner, the first gear 552, the second gear 554, the third gear 556, the fourth gear 558, and the fifth gear 560 each may rotate at a constant rate or a substantially constant rate throughout the dispense cycle. However, as described above, the sixth gear 562 and the drive body 544 may rotate at a varying rate of rotation during the dispense cycle, according to the non-circular configuration of the fifth gear 560 and the sixth gear 562. In certain embodiments, when the drive assembly 532 is in the first state, the maximum radius of the fifth gear 560 may engage the minimum radius of the sixth gear 562. In this manner, when the drive assembly 532 is in the first state, the drive assembly 532 may be configured to rotate the sixth gear 562 and the drive body 544 at a first rate of rotation, which may be a maximum rate of rotation during the dispense cycle. The lobe 550 may move vertically upward and horizontally to the left as the drive body 544 rotates about its rotational axis from the respective position of the first state. In this manner, the lobe 550 may move within the drive slot 540 from the center of the drive slot 540 toward the left-side end of the drive slot 540. The rotation of the drive body 544 and resulting movement of the lobe 550 within the slot 540 may cause the actuator 530 to translate vertically upward from the first position toward the second position. In this manner, the translation of the actuator 530 may move the pump 508 from the extended configuration toward the compressed configuration, thereby causing flowable material within the pump 508 to begin being dispensed therefrom. In FIG. 16L, the first state of the drive assembly 532 is indicated by data point/along the curve of the rate of translation of the actuator 530 as a function of rotation of the fifth gear 560. As shown, the rate of translation of the actuator 530 from the first position toward the second position may increase as the fifth gear 560 rotates and the drive assembly 532 moves away from the first state. Accordingly, the rate of movement of the pump 508 from the extended configuration toward the compressed configuration also may increase as the fifth gear 560 rotates and the drive assembly 532 moves away from the first state.

Figure 16I:
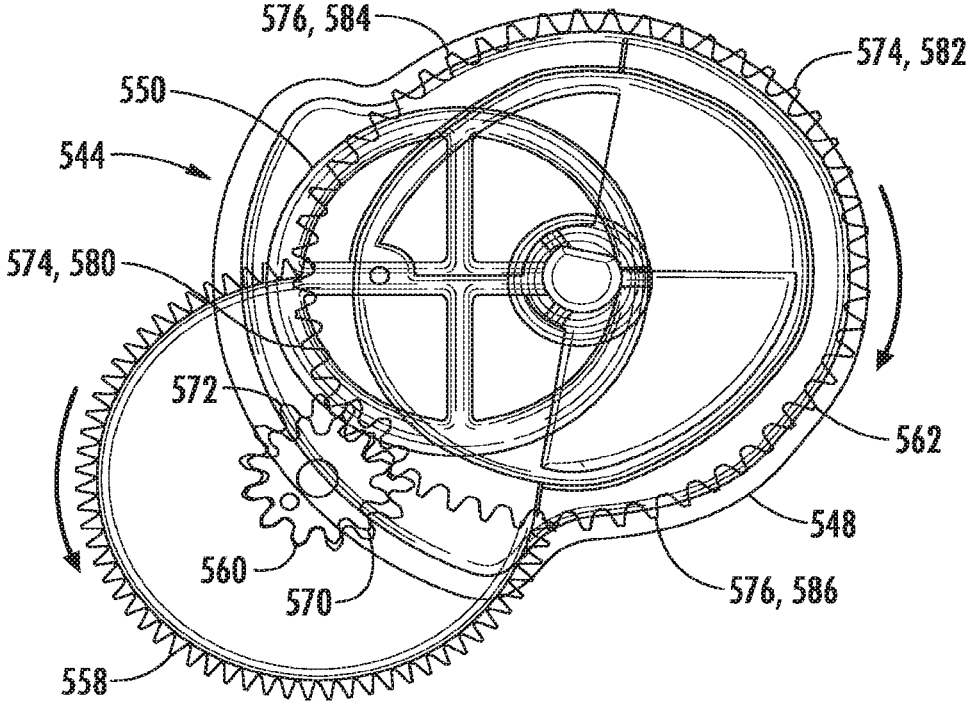
FIG. 16I is a front view of a portion of the gear train and the drive body of the drive assembly of the example automated hands-free flowable material dispenser of FIG. 16A at a second state during the dispense cycle.

FIG. 16I shows the respective portions of the drive assembly 532 in a second state, following rotation of the fifth gear 560 approximately one full rotation (approximately 360 degrees) about its axis of rotation from the position of the first state. In certain embodiments, when the drive assembly 532 is in the second state, the center of the lobe 550 may be aligned with the axis of rotation of the drive body 544 in the horizontal direction and positioned to the left of the axis of rotation. In certain embodiments, the lobe 550 may be positioned at the left-side end of the drive slot 540 of the actuator 530, and the actuator 530 may be in a position mid-way between the first position (i.e., the lowermost position of the actuator 530) and the second position (i.e., the uppermost position of the actuator 530). In certain embodiments, when the drive assembly 532 is in the second state, the first level of teeth 570 of the fifth gear 560 may engage the first level of teeth 574 of the sixth gear 562. In particular, the first level of teeth 570 of the fifth gear 560 may engage the first set of first-level teeth 580 of the sixth gear 562. In certain embodiments, when the drive assembly 532 is in the second state, the minimum radius of the fifth gear 560 may engage the maximum radius of the sixth gear 562. In this manner, when the drive assembly 532 is in the second state, the drive assembly 532 may provide a second mechanical advantage, which may be greater than the first mechanical advantage and may be a maximum mechanical advantage provided during the dispense cycle.

The motor 534 may continue to drive the drive assembly 532 such that the fifth gear 560 continues to rotate (counter-clockwise), and the sixth gear 562 and the drive body 544 continue to rotate (clockwise) from their respective positions of the second state. In particular, the fifth gear 560 may continue to rotate at the constant rate, and the sixth gear 562 and the drive body 544 may continue to rotate at the varying rate of rotation according to the non-circular configuration of the fifth gear 560 and the sixth gear 562. In certain embodiments, when the drive assembly 532 is in the second state, the minimum radius of the fifth gear 560 may engage the maximum radius of the sixth gear 562. In this manner, when the drive assembly 532 is in the second state, the drive assembly 532 may be configured to rotate the sixth gear 562 and the drive body 544 at a second rate of rotation, which may be less than the first rate of rotation and may be a minimum rate of rotation during the dispense cycle. The lobe 550 may move vertically upward and horizontally to the right as the drive body 544 continues to rotate about its rotational axis from the respective position of the second state. In this manner, the lobe 550 may move within the drive slot 540 from the left-side end toward the right-side end of the drive slot 540. The rotation of the drive body 544 and resulting movement of the lobe 550 within the slot 540 may cause the actuator 530 to continue to translate vertically upward toward the second position. In this manner, the translation of the actuator 530 may continue to move the pump 508 toward the compressed configuration, thereby causing flowable material within the pump 508 to continue to be dispensed therefrom. In FIG. 16L, the second state of the drive assembly 532 is indicated by data point 2 along the curve of the rate of translation of the actuator 530 as a function of rotation of the fifth gear 560. As shown, the rate of translation of the actuator 530 toward the second position may decrease as the fifth gear 560 continues to rotate and the drive assembly 532 moves away from the second state. Accordingly, the rate of movement of the pump 508 toward the compressed configuration also may decrease as the fifth gear 560 continues to rotate and the drive assembly 532 moves away from the second state.

Figure 16J:
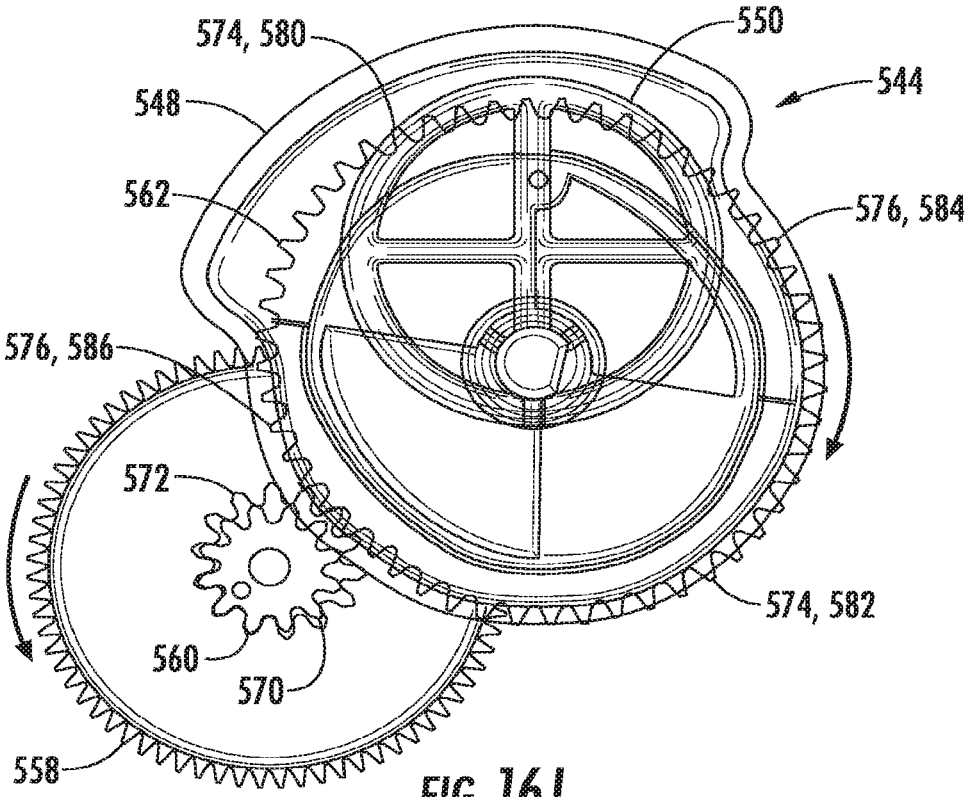
FIG. 16J is a front view of a portion of the gear train and the drive body of the drive assembly of the example automated hands-free flowable material dispenser of FIG. 16A at a third state during the dispense cycle.

FIG. 16J shows the respective portions of the drive assembly 532 in a third state, following rotation of the fifth gear 560 approximately two full rotations (approximately 720 degrees) about its axis of rotation from the position of the first state. In certain embodiments, when the drive assembly 532 is in the third state, the center of the lobe 550 may be aligned with the axis of rotation of the drive body 544 in the vertical direction and positioned above the axis of rotation. In certain embodiments, the lobe 550 may be positioned at the center of the drive slot 540 of the actuator 530, and the actuator 530 may be in the second position (i.e., the uppermost position of the actuator 530). In certain embodiments, when the drive assembly 532 is in the third state, the second level of teeth 572 of the fifth gear 560 may engage the second level of teeth 576 of the sixth gear 562. In particular, the second level of teeth 572 of the fifth gear 560 may engage the second set of second-level teeth 586 of the sixth gear 562. In certain embodiments, when the drive assembly 532 is in the third state, the maximum radius of the fifth gear 560 may engage the minimum radius of the sixth gear 562. In this manner, when the drive assembly 532 is in the third state, the drive assembly 532 may provide the first mechanical advantage, which may be the minimum mechanical advantage provided during the dispense cycle.

The motor 534 may continue to drive the drive assembly 532 such that the fifth gear 560 continues to rotate (counter-clockwise), and the sixth gear 562 and the drive body 544 continue to rotate (clockwise) from their respective positions of the third state. In particular, the fifth gear 560 may continue to rotate at the constant rate, and the sixth gear 562 and the drive body 544 may continue to rotate at the varying rate of rotation according to the non-circular configuration of the fifth gear 560 and the sixth gear 562. In certain embodiments, when the drive assembly 532 is in the third state, the maximum radius of the fifth gear 560 may engage the minimum radius of the sixth gear 562. In this manner, when the drive assembly 532 is in the third state, the drive assembly 532 may be configured to rotate the sixth gear 562 and the drive body 544 at the first rate of rotation, which may be the maximum rate of rotation during the dispense cycle. The lobe 550 may move vertically downward and horizontally to the right as the drive body 544 continues to rotate about its rotational axis from the respective position of the third state. In this manner, the lobe 550 may continue to move within the drive slot 540 toward the right-side end of the drive slot 540. The rotation of the drive body 544 and resulting movement of the lobe 550 within the slot 540 may cause the actuator 530 to translate vertically downward from the second position toward the first position. In this manner, the translation of the actuator 530 may move the pump 508 from the compressed configuration toward the extended configuration, thereby causing flowable material to be drawn from the reservoir 504 into the pump 508. In FIG. 16L, the third state of the drive assembly 532 is indicated by data point 3 along the curve of the rate of translation of the actuator 530 as a function of rotation of the fifth gear 560. As shown, the rate of translation of the actuator 530 toward the first position may increase as the fifth gear 560 continues to rotate and the drive assembly 532 moves away from the third state. Accordingly, the rate of movement of the pump 508 toward the extended configuration also may increase as the fifth gear 560 continues to rotate and the drive assembly 532 moves away from the third state.

Figure 16K:
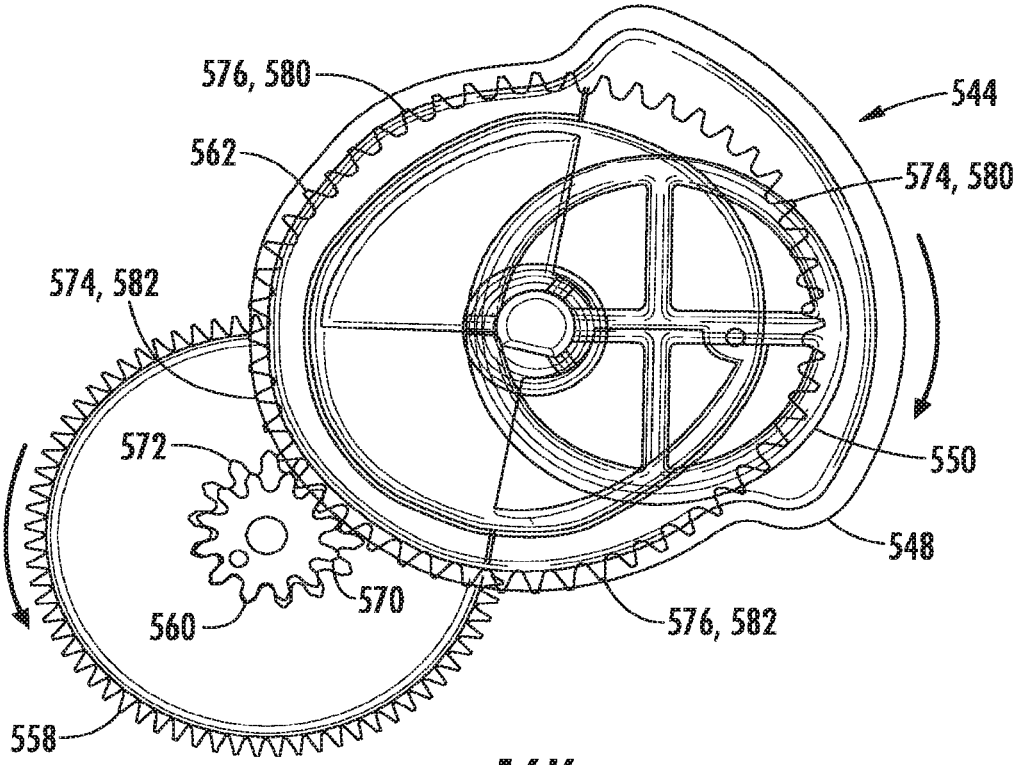
FIG. 16K is a front view of a portion of the gear train and the drive body of the drive assembly of the example automated hands-free flowable material dispenser of FIG. 16A at a fourth state during the dispense cycle.
Figure 16L:
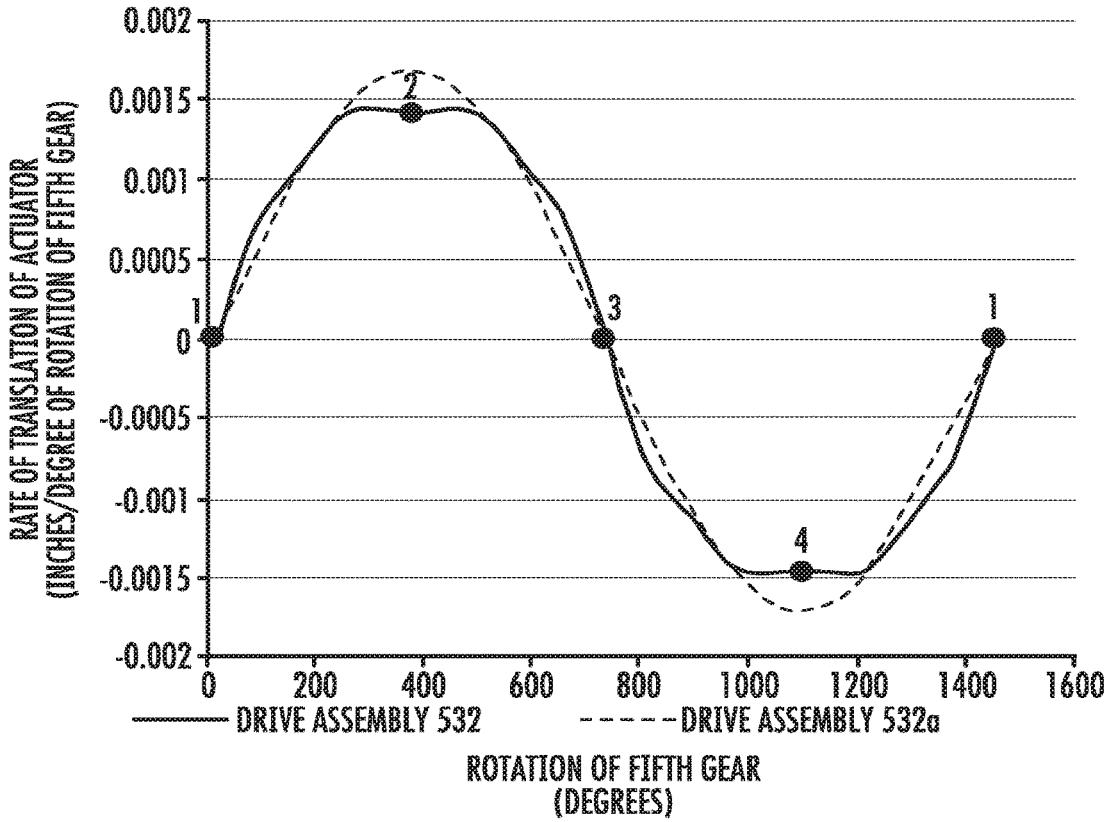
FIG. 16L is a graph of a rate of translation of the actuator of the example automated hands-free flowable material dispenser of FIG. 16A as a function of a rotational position of a gear of the drive train during the dispense cycle.

FIG. 16K shows the respective portions of the drive assembly 532 in a fourth state, following rotation of the fifth gear 560 approximately three full rotations (approximately 1080 degrees) about its axis of rotation from the position of the first state. In certain embodiments, when the drive assembly 532 is in the fourth state, the center of the lobe 550 may be aligned with the axis of rotation of the drive body 544 in the horizontal direction and positioned to the right of the axis of rotation. In certain embodiments, the lobe 550 may be positioned at the right-side end of the drive slot 540 of the actuator 530, and the actuator 530 may be in a position mid-way between the first position (i.e., the lowermost position of the actuator 530) and the second position (i.e., the uppermost position of the actuator 530). In certain embodiments, when the drive assembly 532 is in the fourth state, the first level of teeth 570 of the fifth gear 560 may engage the first level of teeth 577 of the sixth gear 562. In particular, the first level of teeth 570 of the fifth gear 560 may engage the second set of first-level teeth 582 of the sixth gear 562. In certain embodiments, when the drive assembly 532 is in the fourth state, the minimum radius of the fifth gear 560 may engage the maximum radius of the sixth gear 562. In this manner, when the drive assembly 532 is in the fourth state, the drive assembly 532 may provide the second mechanical advantage, which may be the maximum mechanical advantage provided during the dispense cycle.

The motor 534 may continue to drive the drive assembly 532 such that the fifth gear 560 continues to rotate (counter-clockwise), and the sixth gear 562 and the drive body 544 continue to rotate (clockwise) from their respective positions of the fourth state. In particular, the fifth gear 560 may continue to rotate at the constant rate, and the sixth gear 562 and the drive body 544 may continue to rotate at the varying rate of rotation according to the non-circular configuration of the fifth gear 560 and the sixth gear 562. In certain embodiments, when the drive assembly 532 is in the fourth state, the minimum radius of the fifth gear 560 may engage the maximum radius of the sixth gear 562. In this manner, when the drive assembly 532 is in the fourth state, the drive assembly 532 may be configured to rotate the sixth gear 562 and the drive body 544 at the second rate of rotation, which may be the minimum rate of rotation during the dispense cycle. The lobe 550 may move vertically downward and horizontally to the left as the drive body 544 continues to rotate about its rotational axis from the respective position of the fourth state. In this manner, the lobe 550 may move within the drive slot 540 from the right-side end toward the left-side end of the drive slot 540. The rotation of the drive body 544 and resulting movement of the lobe 550 within the slot 540 may cause the actuator 530 to continue to translate vertically downward toward the first position. In this manner, the translation of the actuator 530 may continue to move the pump 508 toward the extended configuration, thereby causing flowable material to continue to be drawn from the reservoir 504 into the pump 508. In FIG. 16L, the fourth state of the drive assembly 532 is indicated by data point 4 along the curve of the rate of translation of the actuator 530 as a function of rotation of the fifth gear 560. As shown, the rate of translation of the actuator 530 toward the first position may decrease as the fifth gear 560 continues to rotate and the drive assembly 532 moves away from the fourth state. Accordingly, the rate of movement of the pump 508 toward the extended configuration also may decrease as the fifth gear 560 continues to rotate and the drive assembly 532 moves away from the fourth state. The dispense cycle may end when the respective portions of the drive assembly 532 reach the respective positions shown in FIG. 16H (i.e., the first state). At the end of the dispense cycle, the motor 534 may be deactivated, and the drive assembly 532 may remain in the first state until a subsequent dispense cycle begins.

The automated dispensing mechanism 528 may be configured to minimize a peak torque required from the motor 534 as the pump 508 is actuated during the dispense cycle of the dispenser 500. As explained above, the automated dispensing mechanism 528 may be required to overcome one or more resistance forces resisting movement of the pump 508 between the extended configuration and the compressed configuration during the dispense cycle, and the resistance forces may vary during the dispense cycle. In particular, the resistance forces may increase as the actuator 530 is translated from the first position toward the second position and the pump 508 is moved from the extended configuration toward the compressed configuration, and the resistance forces may decrease as the actuator 530 is translated from the second position toward the first position and the pump 508 is moved from the compressed configuration toward the extended configuration. Accordingly, the required force exerted by the drive body 544 against the actuator 530 in order to overcome the resistance forces and translate the actuator 530 to move the pump 508 may vary during the dispense cycle, and the required torque exerted by the motor 534 in order to drive the gear train 546 and rotate the drive body 544 to exert the required force may vary during the dispense cycle.

In certain embodiments, the required torque exerted by the motor 534 may vary during the dispense cycle based at least in part on the varying mechanical advantage provided by the drive assembly 532. As explained above, the drive assembly 532 may provide the lesser first mechanical advantage, which may be the minimum mechanical advantage, when the resistance forces are the least, for example when the drive assembly 532 is in the first state and the third state, and the drive assembly 532 may provide the greater second mechanical advantage, which may be the maximum mechanical advantage, when the resistance forces are the greatest, for example when the drive assembly 532 is in the second state and fourth state. In certain embodiments, the varying mechanical advantage provided by the drive assembly 532 may increase as the drive assembly 532 moves from the first state to the second state and from the third state to the fourth state, and the varying mechanical advantage provided by the drive assembly 532 may decrease as the drive assembly 532 moves from the second state to the third state and from the fourth state to the first state. The lesser mechanical advantage may be sufficient for the drive assembly 532 to overcome the lesser resistance forces and translate the actuator 530 to move the pump 508 during certain portions of the dispense cycle. For example, the lesser mechanical advantage may be sufficient for moving the drive assembly 532 from the first state of the dispense cycle and for moving the drive assembly 532 through the third state of the dispense cycle. The greater mechanical advantage may allow the drive assembly 532 to overcome the greater resistance forces and translate the actuator 530 to move the pump 508 during other portions of the dispense cycle, while minimizing the peak torque required from the motor 534. For example, the greater mechanical advantage may allow the drive assembly 532 to move through the second state of the dispense cycle and to move through the fourth state of the dispense cycle in a manner that minimizes the peak torque required from the motor 534 during these portions of the dispense cycle.

In certain embodiments, the required torque exerted by the motor 534 may vary during the dispense cycle based at least in part on the varying rate of rotation of the drive body 544 provided by the drive assembly 532. As explained above, the drive assembly 532 may rotate the drive body 544 at the greater first rate of rotation, which may be the maximum rate of rotation, when the resistance forces are the least, for example when the drive assembly 532 is in the first state and the third state, and the drive assembly 532 may rotate the drive body 544 at the lesser second rate of rotation, which may be the minimum rate of rotation, when the resistance forces are the greatest, for example when the drive assembly 532 is in the second state and fourth state. In certain embodiments, the varying rate of rotation provided by the drive assembly 532 may decrease as the drive assembly 532 moves from the first state to the second state and from the third state to the fourth state, and the varying rate of rotation provided by the drive assembly 532 may increase as the drive assembly 532 moves from the second state to the third state and from the fourth state to the first state. The greater rate of rotation may be sufficient for the drive assembly 532 to overcome the lesser resistance forces and translate the actuator 530 to move the pump 508 during certain portions of the dispense cycle. For example, the greater rate of rotation may be sufficient for moving the drive assembly 532 from the first state of the dispense cycle and for moving the drive assembly 532 through the third state of the dispense cycle. The lesser rate of rotation may allow the drive assembly 532 to overcome the greater resistance forces and translate the actuator 530 to move the pump 508 during other portions of the dispense cycle, while minimizing the peak torque required from the motor 534. For example, the lesser rate of rotation may allow the drive assembly 532 to move through the second state of the dispense cycle and to move through the fourth state of the dispense cycle in a manner that minimizes the peak torque required from the motor 534 during these portions of the dispense cycle.

As described above, the drive assembly 532 of the automated dispensing mechanism 528 may be configured to translate the actuator 530 between the first position and the second position at a varying rate of translation during the dispense cycle. The varying rate of translation may vary relative to the rate of rotation of the motor 534. In certain embodiments, the varying rate of translation of the actuator 530 provided by the drive assembly 532 during the dispense cycle may follow the non-sinusoidal waveform shown in FIG. 16L. During a first portion of the dispense cycle, as the drive assembly 532 moves from the first state to the third state, the drive assembly 532 may translate the actuator 530 in the first direction from the first position to the second position. During a second portion of the dispense cycle, as the drive assembly 532 moves from the third state to the first state, the drive assembly 532 may translate the actuator 530 in the second direction from the second position to the first position. During a first part of the first portion of the dispense cycle, as the drive assembly 532 moves from the first state to the second state, the varying rate of translation of the actuator 530 in the first direction may increase, and during a second part of the first portion of the dispense cycle, as the drive assembly 532 moves from the second state to the third state, the varying rate of translation of the actuator 530 in the first direction may decrease. During a first part of the second portion of the dispense cycle, as the drive assembly 532 moves from the third state to the fourth state, the varying rate of translation of the actuator 530 in the second direction may increase, and during a second part of the second portion of the dispense cycle, as the drive assembly 532 moves from the fourth state to the first state, the varying rate of translation of the actuator 530 in the second direction may decrease. As described above, the fifth gear 560 and the sixth gear 562 may be configured such that the varying rate of translation of the actuator 530 provided by the drive assembly 532 during the dispense cycle follows the non-sinusoidal waveform shown in FIG. 16L. In particular, the non-circular configuration of the fifth gear 560 and the sixth gear 562 may be selected such that the gear ratio curve of the fifth gear 560 and the sixth gear 562 and the resulting interaction between the drive body 544 and the actuator 530 during the dispense cycle cause the varying rate of translation of the actuator 530 provided by the drive assembly 532 during the dispense cycle to follow the illustrated non-sinusoidal waveform.

Figure 16M:
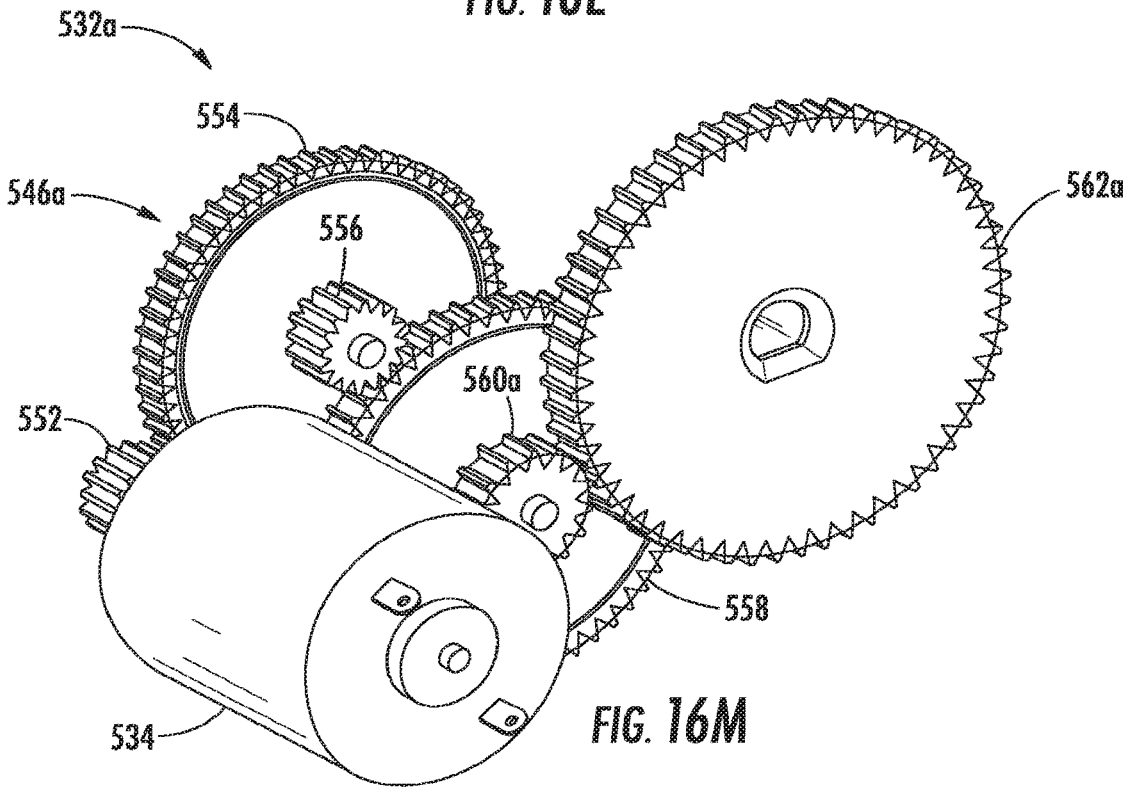
FIG. 16M is a front perspective view of a motor and an alternative gear train in accordance with one or more embodiments of the disclosure.

Certain advantages of the drive assembly 532 may be appreciated by comparison to an alternative drive assembly 532*a* shown in FIG. 16M. The drive assembly 532*a* may be used as a part of the dispenser 500 in a manner generally similar to that of the drive assembly 532 described above. The drive assembly 532*a* may include the same drive body 544 and a gear train 546*a*. The gear train 546*a* may include the first gear 552, the second gear 554, the third gear 556, the fourth gear 558, a fifth gear 560*a*, and a sixth gear 562*a*. As compared to the fifth gear 560 and the sixth gear 562 of the drive assembly 532, which are non-circular gears, the fifth gear 560*a* and the sixth gear 562*a* of the drive assembly 532*a* are circular gears. Similar to the drive assembly 532, the fifth gear 560*a* and the sixth gear 562*a* of the drive assembly 532*a* may have an overall gear ratio of 4:1. Because all of the gears 552, 554, 556, 558, 560*a*, 562*a* of the drive train 546*a* are circular gears, a mechanical advantage provided by the drive assembly 532*a* may be constant throughout a dispense cycle. Further, because all of the gears 552, 554, 556, 558, 560*a*, 562*a* of the drive train 546*a* are circular gears, the drive assembly 532*a* may be configured to rotate the drive body 544 at a constant rate of rotation throughout a dispense cycle. In particular, the drive assembly 532*a* may be configured such that a rate of rotation the drive body 544 is proportional to a rate of rotation of the motor 534.

FIG. 16L includes a respective curve for the drive assembly 532*a* during a dispense cycle similar to that described above with respect to the drive assembly 532, showing the rate of translation of the actuator 530 as a function of rotation of the fifth gear 560*a*. Similar to the drive assembly 532, the drive assembly 532*a* may be configured to translate the actuator 530 between the first position and the second position at a varying rate of translation during the dispense cycle. However, the varying rate of translation provided by the drive assembly 532*a* may follow a sinusoidal waveform, as shown, due to the circular configuration of the fifth gear 560*a* and the sixth gear 562*a* and the resulting interaction between the drive body 544 and the actuator 530 during the dispense cycle. In particular, the constant mechanical advantage and the constant rate of rotation of the drive body 544 provided by the drive assembly 532*a* may cause the varying rate of translation to follow the sinusoidal waveform. As shown, for both the drive assembly 532 and the drive assembly 532*a*, a peak torque may be required from the motor 534 when the drive assembly 532, 532*a* is in the second state of the dispense cycle. However, the peak motor torque for the drive assembly 532 may be less than the peak motor torque for the drive assembly 532*a* due to the lesser rate of translation of the actuator 530 in the second state. In one example, according to the illustrated embodiments, the minimum radius of the fifth gear 560 of the drive assembly 532, which engages the sixth gear 562 when the drive assembly 532 is in the second state, may be approximately 14% less than the radius of the fifth gear 560*a* of the drive assembly 532*a*. As a result, the peak motor torque for the drive assembly 532 may be approximately 14% less than the peak motor torque for the drive assembly 532*a*. Although it may be possible to reduce the peak motor torque of the drive assembly 532*a* by approximately 14% by changing the gear ratio of the fifth gear 560*a* and the sixth gear 562*a* while maintaining their circular configuration, such modification would increase the duration of the dispense cycle, which may adversely affect user satisfaction and battery life of the dispensing mechanism. The reduced peak motor torque for the drive assembly 532 advantageously may allow the drive assembly 532 to be driven by a smaller sized motor as compared to the drive assembly 532*a*, which may allow the overall dispenser 500 to be smaller and manufactured at a lower cost. Additionally, the reduced peak motor torque for the drive assembly 532 may reduce wear on the batteries powering the motor 534, extend battery life, and allow the batteries to be useful at lower voltages. Further, the reduced peak motor torque for the drive assembly 532 may improve reliability of the dispenser 500, reducing incidence of partial or incomplete dispense cycles.

Although the actuator 530 and the drive assembly 532 may be described above as being used in combination with the motor 534 as a part of the automated dispensing mechanism 528, it will be appreciated that the actuator 530 and the drive assembly 532 alternatively may be used without the motor 534 as a part of a mechanical (i.e., manual) dispensing mechanism to provide similar advantages. In other words, in certain embodiments, the dispenser 500 may be a mechanical (i.e., manual) dispenser that requires a user to manually impart a driving force to the dispenser 500 in order to carry out a dispense cycle. For example, the dispenser 500 may include a drive member that is coupled to and configured to drive the drive assembly 532 for carrying out a dispense cycle. In various embodiments, the drive member may include a handle, a lever, a button, a knob, or other member that may be moved by the user to drive the drive assembly 532. As described above, the actuator 530 and the drive assembly 532 may be configured to minimize a peak torque required during a dispense cycle. Accordingly, in embodiments in which the dispenser 500 is a mechanical dispenser, the actuator 530 and the drive assembly 532 may minimize a peak torque generated by the user during a dispense cycle.

FIGS. 17A-17I illustrate an example automated dispensing mechanism 628 as may be used with the dispenser 500 instead of the automated dispensing mechanism 528 described above. The automated dispensing mechanism 628 may be configured to facilitate actuation of the pump 508 to dispense the flowable material therefrom during a dispense cycle. As shown, the automated dispensing mechanism 628 may include an actuator 630, a drive assembly 632, and an electric motor 634. As described below, the drive assembly 632 may be configured to provide a mechanical advantage that varies during a dispense cycle. Further, the drive assembly 632 may be configured to translate the actuator 630 at a varying rate during a dispense cycle, and the varying rate may follow a non-sinusoidal waveform. As described below, the automated dispensing mechanism 628 may be used with the dispenser 500 to manage torque exerted by the motor 534 during a dispense cycle, and in particular to minimize a peak motor torque during the dispense cycle. In this manner, the automated dispensing mechanism 628 may provide the same advantages and benefits explained above with respect to the automated dispensing mechanism 528.

The actuator 630 may be disposed within the dispenser housing 516 and configured to translate relative to the dispenser housing 516 between a first position and a second position during a dispense cycle. In certain embodiments, as shown, the actuator 630 may be configured to translate in a vertical direction relative to the dispenser housing 516 between the first position and the second position. In certain embodiments, the first position may be a lowermost position of the actuator 630, and the second position may be an uppermost position of the actuator 630. In other embodiments, the actuator 630 may be configured to translate in a horizontal direction relative to the dispenser housing 516 between the first position and the second position. In still other embodiments, the actuator 630 may be configured to translate relative to the dispenser housing 516 between the first position and the second position in a direction transverse to each of the vertical direction and the horizontal direction. It will be appreciated that only a portion of the actuator 630 is shown in FIGS. 17A-17I for illustration purposes. In particular, a wall 640 of the actuator 630 is shown, which may correspond generally to the wall 542 of the actuator 530 described above. The actuator 630 may include a pump interface, similar to the pump interface 536, configured to engage the pump 508 and facilitate actuation of the pump 508. In certain embodiments, the pump interface may include a recess defined in the actuator 630 and configured to receive the flange 538 of the pump piston 512 therein. The actuator 630 may be configured to move the pump 508 between the extended configuration and the compressed configuration as the actuator 630 translates between the first position and the second position during a dispense cycle. In certain embodiments, as shown, when the actuator 630 is in the first position, the pump 508 may be maintained in the extended configuration. As the actuator 630 translates from the first position to the second position, the actuator 530 may move the pump 508 from the extended configuration to the compressed configuration, and as the actuator 630 translates from the second position to the first position, the actuator 630 may move the pump 508 from the compressed configuration to the extended configuration. In particular, such movement may be achieved by the actuator 630 engaging the flange 538 and translating the pump piston 512 relative to the pump body 510. In certain embodiments, a complete dispense cycle may include the actuator 630 moving the pump 508 from the extended configuration to the compressed configuration and then moving the pump 508 from the compressed configuration to the extended configuration. In certain embodiments, movement of the pump 508 from the extended configuration to the compressed configuration may cause flowable material within the pump 508 to be dispensed from the pump 508, and movement of the pump 508 from the compressed configuration to the extended configuration may cause additional flowable material to be drawn from the reservoir 504 into the pump 508 to refill the pump 508. As shown, the actuator 630 also may include a plurality of slots defined in the wall 640 of the actuator 630 and configured to receive portions of the drive assembly 632 therein. In particular, the actuator 630 may include a pair of first slots 641 and a second slot 642 defined in the wall 640 thereof. As shown, the first slots 641 may be spaced apart from one another in the vertical direction, and the second slot 642 may be positioned between the first slots 641 in the vertical direction, although other arrangements of the slots 641, 642 may be used. In certain embodiments, as shown, the first slots 641 may have a curved, contoured shape, although other shapes, such as a linear shape, may be used. In certain embodiments, as shown, the second slot 642 may have a "+" shape, although other shapes may be used. As shown, the second slot 642 may be surrounded by a ring member defining the second slot 642 having the desired shape, and the first slots 641 may be defined by the ring member and respective ribs, although other features defining the slots 641, 642 may be used. As described below, the drive assembly 632 may engage the first slots 641 and the second slot 642 to facilitate translation of the actuator 630 between the first position and the second position.

Figure 17A:
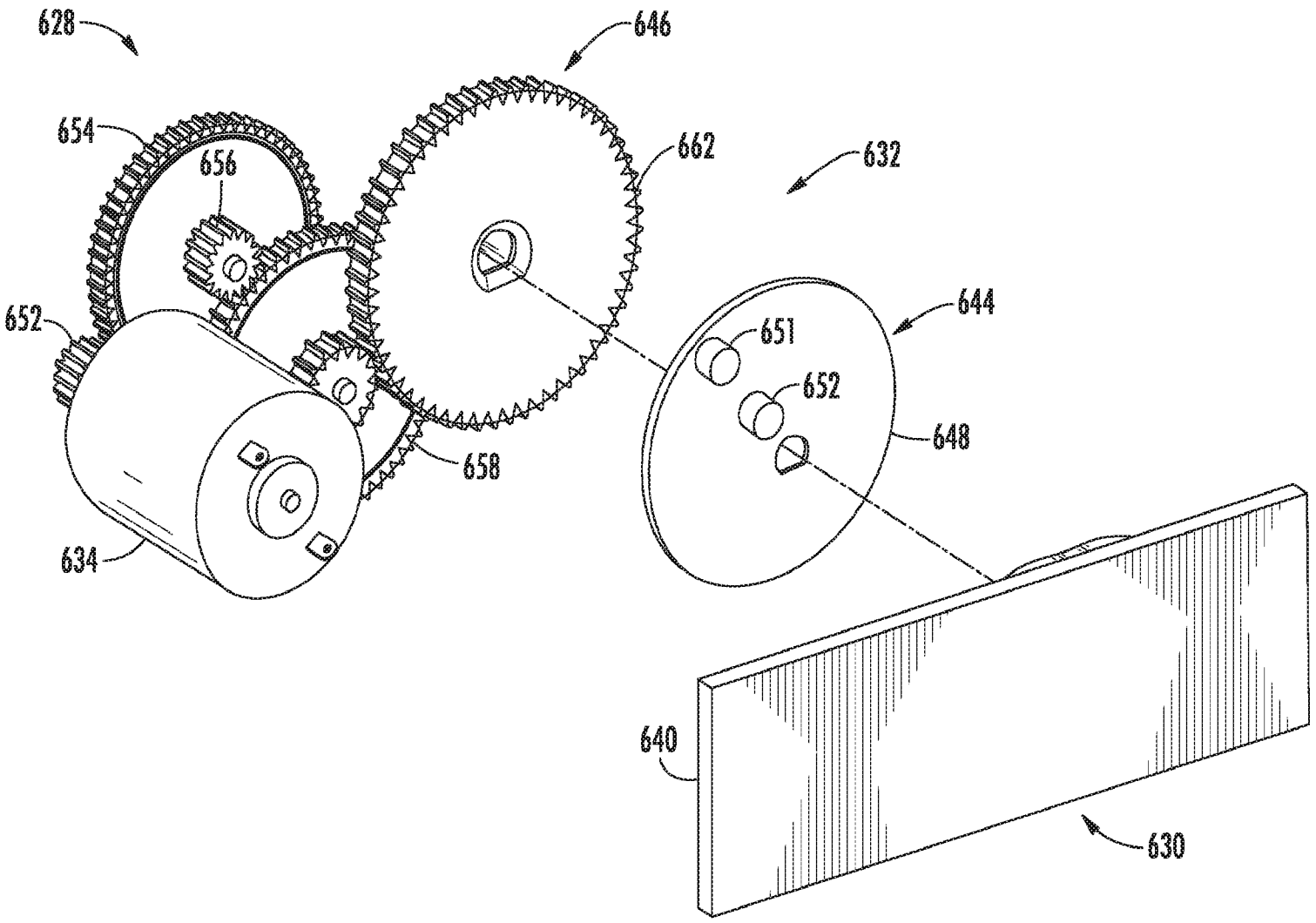
FIG. 17A is an exploded front perspective view of a motor, a drive assembly, and a portion of an actuator as may be used with the example automated hands-free flowable material dispenser of FIG. 16A in accordance with one or more embodiments of the disclosure.
Figure 17B:
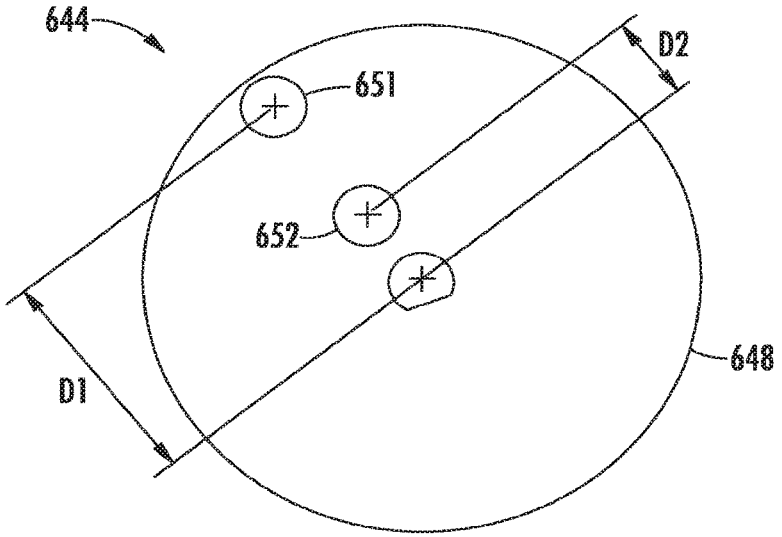
FIG. 17B is a front view of a drive body of the drive assembly of FIG. 17A.
Figure 17C:
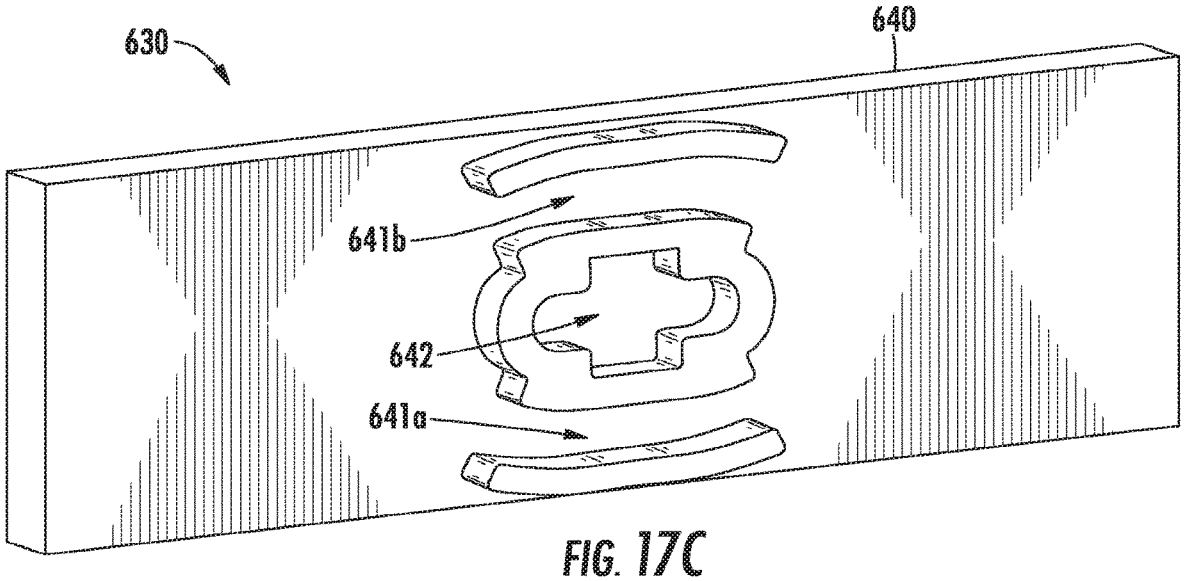
FIG. 17C is a back perspective view of the portion of the actuator of FIG. 17A.

The drive assembly 632 may be coupled to the actuator 630 and the motor 634. The motor 634 may be configured to drive the drive assembly 632, and the drive assembly 632 may be configured to translate the actuator 630 between the first position and the second position. In certain embodiments, the motor 634 may be a DC motor, although other types of motors may be used. The motor 634 may be powered by one or more batteries of the dispenser 500. In certain embodiments, the motor 634 may be supported by and disposed within the chassis housing 528. The drive assembly 632 may include a drive body 644 and a gear train 646. The drive body 644 may be coupled to the actuator 630, and the gear train 646 may be coupled to the motor 634 and the drive body 644. The drive body 644 may be configured to rotate relative to the dispenser housing 516 and the chassis housing 524 about a rotational axis extending in the horizontal direction. The drive body 644 may include a plate 648, a first lobe 651 extending from the plate 648, and a second lobe 652 extending from the plate 648. As shown, the first lobe 651 and the second lobe 652 each may be offset from the rotational axis of the drive body 644. In particular, as shown in FIG. 17B, a center of the first lobe 651 may be offset from the rotational axis by a first distance D1, and a center of the second lobe 652 may be offset from the rotational axis by a second distance D2. The first distance D1 may be greater than the second distance D2, as shown. In this manner, the centers of the lobes 651, 652 may follow respective circular paths around the rotational axis as the drive body 644 rotates. In certain embodiments, as shown, the lobes 651, 652 each may have a circular cross-sectional shape taken perpendicular to the rotational axis of the drive body 644, although other shapes may be used and the lobes 651, 652 may have different shapes and/or sizes than one another. As described below, at least a portion of the first lobe 651 may be configured to move through each of the first slots 641 during a dispense cycle. In particular, a portion of the first lobe 651 may be configured to be positioned within and pass through the first slot 641*a* during a portion of the dispense cycle, and to be positioned within and pass through the first slot 641*b* during another portion of the dispense cycle. At least a portion of the second lobe 652 may be movably disposed within the second slot 642. In particular, the received portion of the second lobe 652 may be able to rotate relative to the second slot 642 and to translate relative to the second slot 642 between the lateral ends of the slot 642 as the drive body 644 rotates about the rotational axis. As described further below, the offset positions of the first lobe 651 and the second lobe 652 may cause the actuator 630 to translate between the first position and the second position as the drive body 644 rotates about the rotational axis.

As shown, the gear train 646 may include a plurality of gears configured to be driven by the motor 634 and facilitate rotation of the drive body 644. In particular, the gear train 646 may include a first gear 652, a second gear 654, a third gear 656, a fourth gear 658, a fifth gear 660, and a sixth gear 662 arranged as shown in FIG. 17A. The first gear 652, which also may be referred to as a "motor pinion gear" or an "input gear," may be a circular gear coupled to the drive shaft of the motor 634 for rotation therewith. The second gear 654, which also may be referred to as a "fast gear," may be a circular gear that engages and is rotated by the first gear 652. The third gear 656, which also may be referred to as a "fast pinion," may be a circular gear that is coupled to the second gear 654 for rotation therewith. The third gear 656 and the second gear 654, which collectively may form a "fast compound gear," may be coupled to one another directly or indirectly via the shaft supporting the gears 654, 656. The fourth gear 658, which also may be referred to as a "first slow gear," may be a circular gear that engages and is rotated by the third gear 656. The fifth gear 660, which also may be referred to as a "slow pinion," may be a circular gear that is coupled to the fourth gear 658 for rotation therewith. The fifth gear 660 and the fourth gear 658, which collectively may form a "slow compound gear," may be coupled to one another directly or indirectly via the shaft supporting the gears 658, 660. The sixth gear 662, which also may be referred to as a "second slow gear," may be a circular gear that engages and is rotated by the fifth gear 660. The sixth gear 662 may be coupled to the drive body 644 for rotation therewith. In certain embodiments, the sixth gear 662 may be indirectly coupled to the drive body 644 via a shaft. For example, the shaft may have a D-shaped cross-section and may extend through mating D-shaped apertures of the sixth gear 662 and the drive body 644. In this manner, the sixth gear 662 may be coupled to the drive body 644 for rotation along with the shaft. In other embodiments, the sixth gear 662 may be directly coupled to the drive body 644. The respective shafts of the gear train 646 may be supported by the chassis housing 528 or other support structure such that the gears 652, 654, 656, 658, 660, 662 rotate about respective rotational axes. In certain embodiments, as shown, the respective rotational axes may be fixed relative to the chassis housing 524 and the dispenser housing 516. In other embodiments, one or more of the respective rotational axes may move relative to the chassis housing 524 and the dispenser housing 516. In certain embodiments, the gears 652, 654, 656, 658, 660, 662 may be disposed within the chassis housing 524. In certain embodiments, the fifth gear 660 and the sixth gear 662 may have an overall gear ratio that is an integer ratio (i.e., 1:1, 2:1, 3:1, 4:1, etc.). In certain embodiments, the fifth gear 660 and the sixth gear 662 may have an overall gear ratio that is greater than 1:1, thereby incorporating gear reduction. In certain embodiments, as shown, the fifth gear 660 and the sixth gear 662 may have an overall gear ratio of 4:1, although other gear ratios may be used. It will be appreciated that the illustrated configuration of the gear train 646 represents merely one embodiment, and that other configurations including a different arrangement and/or a different number of gears may be used.

As described further below, the automated dispensing mechanism 628 may be configured to manage torque exerted by the motor 634 during a dispense cycle of the dispenser 500. In particular, the automated dispensing mechanism 628 may be configured to minimize a peak torque required from the motor 634 during a dispense cycle of the dispenser 500. As described above, the automated dispensing mechanism 628 may actuate the pump 508 to dispense the flowable material from the pump 508 during a dispense cycle. In certain embodiments, during a dispense cycle, the automated dispensing mechanism 628 may move the pump 508 from the extended configuration to the compressed configuration and from the compressed configuration to the extended configuration. As described above, the motor 634 may drive the gear train 646, the gear train 646 may rotate the drive body 644, the drive body 644 may translate the actuator 630, and the actuator 630 may move the pump 508 between the extended configuration and the compressed configuration during a dispense cycle.

It will be appreciated that the automated dispensing mechanism 628 may be required to overcome one or more forces resisting movement of the pump 508 between the extended configuration and the compressed configuration during a dispense cycle. In certain embodiments, the automated dispensing mechanism 628 may be required to overcome one or more forces resisting movement of the pump 508 from the extended configuration to the compressed configuration, or from the compressed configuration to the extended configuration, in order to dispense flowable material from the pump 508. Such resistance forces may include a spring force generated by compression or extension of the spring 514 of the pump 508, a friction force generated by relative movement of the pump piston 512 and the pump body 510 and/or other components of the pump 508, a fluid force generated by movement of the flowable material within and/or out of the pump 508, and/or other forces generated by movement of the pump 508 between the extended configuration and the compressed configuration. It will be appreciated that such resistance forces may vary during a dispense cycle, as the pump 508 is moved between the extended configuration and the compressed configuration. For example, in certain embodiments, the resistance forces may increase as the pump 508 is moved from the extended configuration to the compressed configuration and may decrease as the pump 508 is moved from the compressed configuration to the extended configuration. Accordingly, a required force exerted by the drive body 644 against the actuator 630 in order to overcome the resistance forces and translate the actuator 630 to move the pump 508 may vary during a dispense cycle. Further, a required torque exerted by the motor 634 in order to drive the gear train 646 and rotate the drive body 644 to exert the required force may vary during a dispense cycle. In this manner, the required torque exerted by the motor 634 may increase during a portion of the dispense cycle and may decrease during another portion of the dispense cycle.

The automated dispensing mechanism 628 may be configured to minimize a peak torque required from the motor 634 during a dispense cycle of the dispenser 500. It will be appreciated that the required torque exerted by the motor 634 may be affected by a mechanical advantage provided by the drive assembly 632, and a rate of translation of the actuator 630 provided by the drive assembly 632, each of which may vary during a dispense cycle. In certain embodiments, the required torque exerted by the motor 634 may vary during a dispense cycle based at least in part on a mechanical advantage provided by the drive assembly 632. In certain embodiments, the drive assembly 632 may provide a mechanical advantage that varies during a dispense cycle. The drive assembly 632 may provide a first mechanical advantage during a first portion of the dispense cycle and a second mechanical advantage during a second portion of the dispense cycle, with the second mechanical advantage being different than the first mechanical advantage. In certain embodiments, the drive assembly 632 may provide a first mechanical advantage during a first portion of the dispense cycle and a second mechanical advantage during a second portion of the dispense cycle, with the second mechanical advantage being greater than the first mechanical advantage. Resistance forces resisting movement of the pump 508 during the second portion of the dispense cycle may be greater than resistance forces resisting movement of the pump 508 during the first portion of the dispense cycle. During the second portion of the dispense cycle, the greater second mechanical advantage may allow the drive assembly 632 to overcome the greater resistance forces and translate the actuator 630 to move the pump 508, while minimizing the peak torque required from the motor 634. During the first portion of the dispense cycle, the lesser first mechanical advantage may be sufficient for the drive assembly 632 to overcome the lesser resistance forces and translate the actuator 630 to move the pump 508. The drive assembly 632 may be configured to provide the greater second mechanical advantage during a portion of the dispense cycle in which the drive assembly 632 is required to overcome a peak value of the resistance forces resisting movement of the pump 508. In other words, the greater second mechanical advantage provided by the drive assembly 632 may correspond to a portion of the dispense cycle in which the resistance forces resisting translation of the actuator 630 are at a peak value. In certain embodiments, the drive assembly 632 may be configured to provide the greater second mechanical advantage during a portion of the dispense cycle in which the actuator 630 moves the pump 508 toward the compressed configuration. In certain embodiments, the drive assembly 632 may be configured to provide the greater second mechanical advantage during a portion of the dispense cycle in which the actuator 630 moves the pump 508 toward the extended configuration. In certain embodiments, the varying mechanical advantage provided by the drive assembly 632 may be achieved by the configuration of the lobes 651, 652 of the drive body 644 and the slots 641, 642 of the actuator 630 and their interaction with one another. As further described below, the first lobe 651 may contact the actuator 630 and control translation of the actuator 630 during a portion of the dispense cycle, and the second lobe 652 may contact the actuator 630 and control translation of the actuator 630 during a portion of the dispense cycle. As described above, the first lobe 651 and the second lobe 652 may be offset from the rotational axis of the drive body 644 by different distances a 1, D2. In this manner, the first lobe 651 and the second lobe 652 may be configured to engage the different slots 641, 642 of the actuator 630 as the drive body 644 rotates about its rotational axis. For example, the first lobe 651 may be configured to selectively engage the actuator 630 and move through the first slots 641 as the drive body 644 rotates about its rotational axis, and the second lobe 652 may be configured to selectively engage the actuator 630 and move within the second slot 642 as the drive body 644 rotates about its rotational axis. Each of the slots 641, 642 may be shaped, positioned, and oriented such that interaction between the respective slot 641, 642 and the respective lobe 651, 652 may result in a different mechanical advantage. For example, the interaction between the first lobe 651 and one of the first slots 641 may result in a first mechanical advantage, and the interaction between the second lobe 651 and the second slot 642 may result in a second mechanical advantage that is greater than the first mechanical advantage. Accordingly, the greater second mechanical advantage may be provided when the second lobe 652 contacts and controls translation of the actuator 630, and the lesser first mechanical advantage may be provided when the first lobe 651 contacts and controls translation of the actuator 630. Ultimately, the arrangement of the slots 641, 642 and the lobes 651, 652 may be selected such that the varying mechanical advantage provided by the drive assembly 632 optimizes the torque demand on the motor 634 during the dispense cycle.

The drive assembly 632 of the automated dispensing mechanism 628 may be configured to translate the actuator 630 between the first position and the second position at a varying rate of translation during a dispense cycle. In certain embodiments, the drive assembly 632 may be configured such that the varying rate of translation varies relative to a rate of rotation of the motor 634 and follows a non-sinusoidal waveform, as described below. The drive assembly 632 may be configured to translate the actuator 630 in a first direction from the first position to the second position during a first portion of the dispense cycle, and to translate the actuator 630 in an opposite second direction from the second position to the first position during a second portion of the dispense cycle. In certain embodiments, the varying rate of translation may increase during part of the first portion of the dispense cycle and decrease during another part of the first portion of the dispense cycle, and the varying rate of translation may increase during part of the second portion of the dispense cycle and decrease during another part of the second portion of the dispense cycle. In certain embodiments, the non-sinusoidal waveform of the varying rate of translation of the actuator 630 provided by the drive assembly 632 may be achieved by the configuration of the lobes 651, 652 of the drive body 644 and the slots 641, 642 of the actuator 630 described above and their interaction with one another during the dispense cycle.

FIGS. 17D-17I show front views of the actuator 630 and the drive body 644 of the drive assembly 632 in a number of different states during a dispense cycle as may be carried out using the drive assembly 632 with the dispenser 500. It will be appreciated that the actuator 630 is shown as being transparent in FIGS. 17D-17I for purposes of illustration. Further, it will be appreciated that the orientations and directions of movement of the various components of the automated dispensing mechanism 628 described herein and shown in FIGS. 17D-17I relate to only certain embodiments of the automated dispensing mechanism 628, and that other orientations and directions of movement of the components may be used in other embodiments. FIG. 17J illustrates a graph of rate of translation of the actuator 630 (inches per degree of rotation of the fifth gear 660) as a function of rotation of the fifth gear 660 (degrees), showing a respective curve for the drive assembly 632 during a dispense cycle. As shown in FIG. 17J and described below with respect to FIGS. 17D-17I, the varying rate of translation of the actuator 630 provided by the drive assembly 632 during the dispense cycle may follow a non-sinusoidal waveform.

Figure 17D:
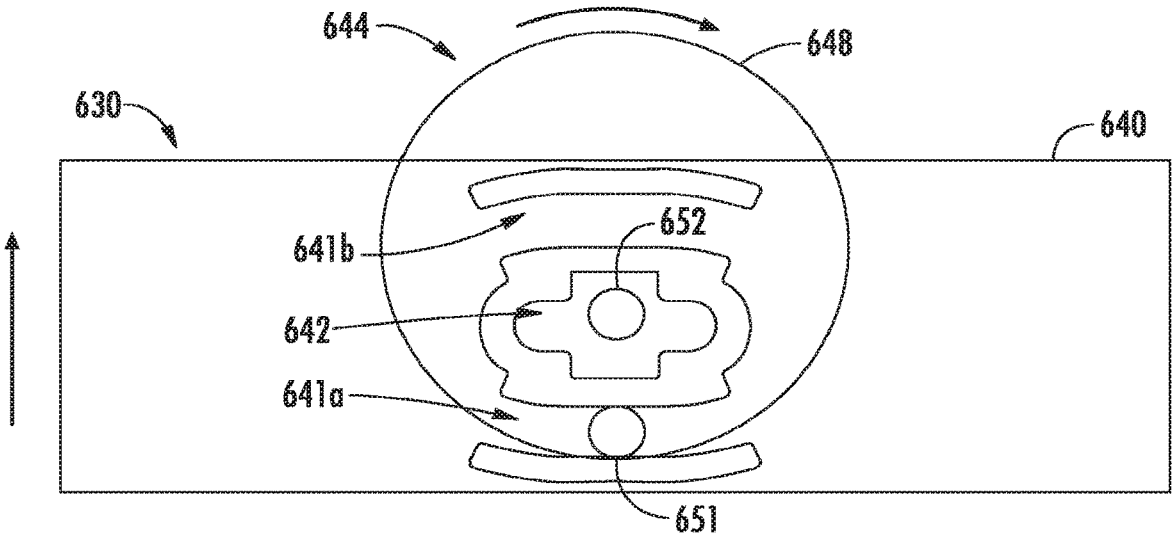
FIG. 17D is a front view of the drive body and the portion of the actuator of FIG. 17A at a first state during a dispense cycle.

FIG. 17D shows the actuator 630 and the drive body 644 when the drive assembly 632 is in a first state, which may correspond to a home state of the drive assembly 632 in certain embodiments. In this manner, in certain embodiments, a dispense cycle may begin with the drive assembly 632 in the first state. In certain embodiments, when the drive assembly 632 is in the first state, the respective centers of the first lobe 651 and the second lobe 652 may be aligned with the axis of rotation of the drive body 644 in the vertical direction and positioned below the axis of rotation, and the first lobe 651 may be positioned within the first slot 641*a*. In certain embodiments, the first lobe 651 may be positioned at a center of the first slot 641*a* in the horizontal direction, and the second lobe 652 may be positioned at a center of the second slot 642 in the horizontal direction. In certain embodiments, when the drive assembly 632 is in the first state, the first lobe 651 may contact the actuator 630 and control translation of the actuator 630. In this manner, when the drive assembly 632 is in the first state, the drive assembly 632 may provide a first mechanical advantage, which may be a minimum mechanical advantage provided during the dispense cycle. In certain embodiments, the first lobe 651 may contact the ring member to control translation of the actuator 630. In certain embodiments, when the drive assembly 632 is in the first state, the actuator 630 may be in the first position (i.e., the lowermost position of the actuator 630). In certain embodiments, when the drive assembly 632 is in the first state, the pump 508 may be in the extended configuration.

Upon activation of the motor 634, the motor 634 may drive the drive assembly 632 such that the gear train 646 rotates the drive body 544 (clockwise in the front views shown) about its axis of rotation. In particular, the shaft of the motor 634 may rotate the first gear 652 (counter-clockwise), the first gear 652 may rotate the second gear 654 (clockwise), the third gear 656 may rotate along with the second gear 654 (clockwise), the third gear 656 may rotate the fourth gear 658 (counter-clockwise), the fifth gear 660 may rotate along with the fourth gear 658 (counter-clockwise), the fifth gear 660 may rotate the sixth gear 662 (clockwise), and the drive body 644 may rotate along with the sixth gear 662 (clockwise) from their respective positions of the first state. In certain embodiments, the shaft of the motor 634 may rotate at a constant rate or a substantially constant rate throughout the dispense cycle, except for during initial starting of the motor 634 at the beginning of the dispense cycle and stopping of the motor 634 at the end of the dispense cycle. In this manner, the first gear 652, the second gear 654, the third gear 656, the fourth gear 658, the fifth gear 660, the sixth gear 662, and the drive body 644 each may rotate at a constant rate or a substantially constant rate throughout the dispense cycle. The lobes 651, 652 may move vertically upward and horizontally to the left as the drive body 644 rotates about its rotational axis from the respective position of the first state. In this manner, the first lobe 651 may move within the first slot 641*a* from the center of the first slot 641*a* toward the left-side end of the first slot 641*a*, and the second lobe 652 may move within the second slot 642 from the center of the second slot 642 toward the left-side end of the second slot 642. The rotation of the drive body 644 and the resulting movement of the first lobe 651 within the first slot 641*a* may cause the actuator 630 to translate vertically upward from the first position toward the second position. In this manner, the translation of the actuator 630 may move the pump 508 from the extended position toward the compressed position, thereby causing flowable material within the pump 508 to begin being dispensed therefrom. In FIG. 17J, the first state of the drive assembly 632 is indicated by data point/along the curve of the rate of translation of the actuator 630 as a function of rotation of the fifth gear 660. As shown, the rate of translation of the actuator 630 from the first position toward the second position may increase as the fifth gear 660 rotates and the drive assembly 632 moves away from the first state. Accordingly, the rate of movement of the pump 508 from the extended configuration toward the compressed configuration also may increase as the fifth gear 660 rotates and the drive assembly 632 moves away from the first state.

Figure 17E:
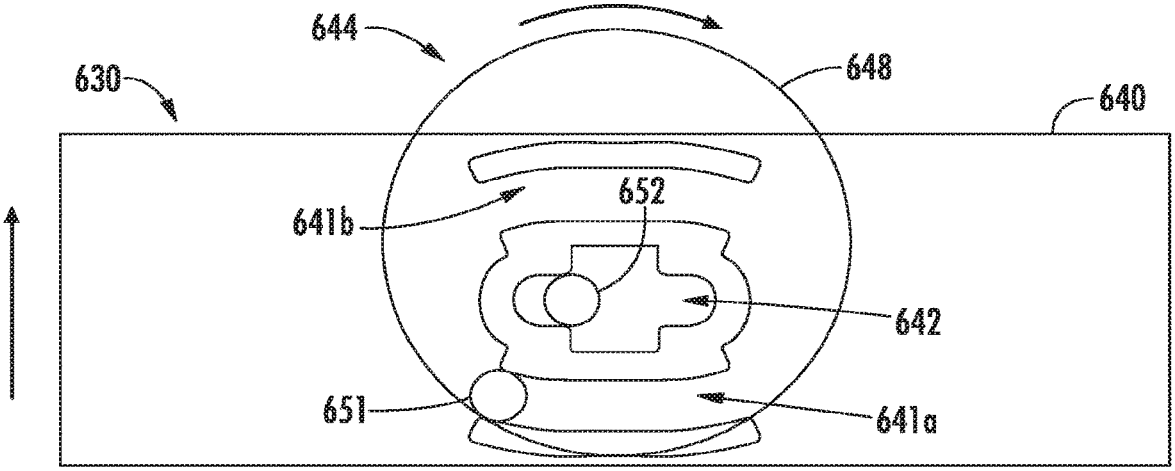
FIG. 17E is a front view of the drive body and the portion of the actuator of FIG. 17A at a second state during the dispense cycle.

FIG. 17E shows the actuator 630 and the drive body 644 when the drive assembly 632 is in a second state, following rotation of the fifth gear 660 approximately one-half rotation (approximately 180 degrees) about its axis of rotation from the position of the first state. In certain embodiments, when the drive assembly 632 is in the second state, the first lobe 651 may begin to disengage the first slot 641*a*, and the second lobe 652 may begin to engage the left-side lateral end portion of the second slot 642. In certain embodiments, when the drive assembly 632 is in the second state, the first lobe 651 may begin to release contact with the actuator 630 and release control of translation of the actuator 630, and the second lobe 652 may begin to contact the actuator 630 and gain control of translation of the actuator 630. In certain embodiments, the second lobe 652 may begin to contact the ring member to control translation of the actuator 630. In certain embodiments, when the drive assembly 632 is in the second state, the actuator 630 may be in a position between the first position (i.e., the lowermost position of the actuator 630) and the second position (i.e., the uppermost position of the actuator 630) and closer to the first position. In certain embodiments, when the drive assembly 632 is in the second state, the pump 508 may be in a configuration between the extended configuration and the compressed configuration and closer to the extended configuration.

The motor 634 may continue to drive the drive assembly 632 such that the fifth gear 660 continues to rotate (counter-clockwise), and the sixth gear 662 and the drive body 644 continue to rotate (clockwise) from their respective positions of the second state. The lobes 651, 652 may continue to move vertically upward and horizontally to the left as the drive body 644 rotates about its rotational axis from the respective position of the second state. In this manner, the first lobe 651 may move out of the first slot 641*a*, and the second lobe 652 may continue to move within the second slot 642 toward the left-side end of the second slot 642. The rotation of the drive body 644 and the resulting movement of the second lobe 652 within the second slot 642 may cause the actuator 630 to continue to translate vertically upward toward the second position. In this manner, the translation of the actuator 630 may continue to move the pump 508 toward the compressed position, thereby causing flowable material within the pump 508 to continue to be dispensed therefrom. In FIG. 17J, the second state of the drive assembly 632 is indicated by data point 2 along the curve of the rate of translation of the actuator 630 as a function of rotation of the fifth gear 660. As shown, the rate of translation of the actuator 630 toward the second position may continue to increase as the fifth gear 660 rotates and the drive assembly 632 moves away from the second state. Accordingly, the rate of movement of the pump 508 toward the compressed configuration also may continue to increase as the fifth gear 660 rotates and the drive assembly 632 moves away from the second state.

Figure 17F:
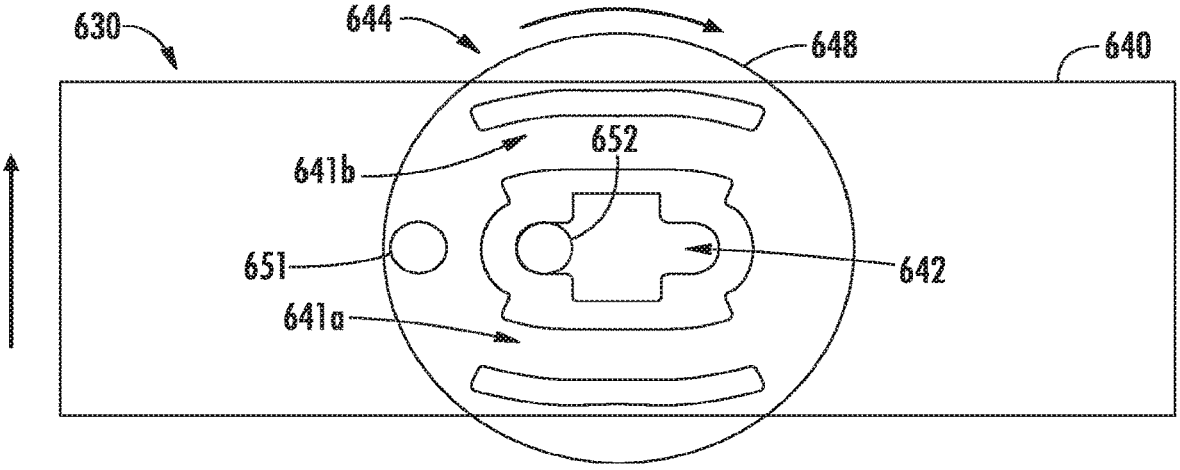
FIG. 17F is a front view of the drive body and the portion of the actuator of FIG. 17A at a third state during the dispense cycle.

FIG. 17F shows the actuator 630 and the drive body 644 when the drive assembly 632 is in a third state, following rotation of the fifth gear 660 approximately one rotation (approximately 360 degrees) about its axis of rotation from the position of the first state. In certain embodiments, when the drive assembly 632 is in the third state, the respective centers of the first lobe 651 and the second lobe 652 may be aligned with the axis of rotation of the drive body 644 in the horizontal direction and positioned to the left of the axis of rotation. In certain embodiments, when the drive assembly 632 is in the third state, the first lobe 651 may be positioned outside of the first slots 641*a*, 641*b*, and the second lobe 652 may be positioned at the left-side end of the second slot 642. In certain embodiments, when the drive assembly 632 is in the third state, the second lobe 652 may continue to contact the actuator 630 and control translation of the actuator 630. In this manner, when the drive assembly 632 is in the third state, the drive assembly 632 may provide a second mechanical advantage, which may be a maximum mechanical advantage provided during the dispense cycle. In certain embodiments, the second lobe 652 may continue to contact the ring member to control translation of the actuator 630. In certain embodiments, when the drive assembly 632 is in the third state, the actuator 630 may be in a position mid-way between the first position and the second position. In certain embodiments, when the drive assembly 632 is in the third state, the pump 508 may be in a configuration mid-way between the extended configuration and the compressed configuration.

The motor 634 may continue to drive the drive assembly 632 such that the fifth gear 660 continues to rotate (counter-clockwise), and the sixth gear 662 and the drive body 644 continue to rotate (clockwise) from their respective positions of the third state. The lobes 651, 652 may move vertically upward and horizontally to the right as the drive body 644 rotates about its rotational axis from the respective position of the third state. In this manner, the first lobe 651 may move toward the first slot 641*b*, and the second lobe 652 may move within the second slot 642 toward the right-side end of the second slot 642. The rotation of the drive body 644 and the resulting movement of the second lobe 652 within the second slot 642 may cause the actuator 630 to continue to translate vertically upward toward the second position. In this manner, the translation of the actuator 630 may continue to move the pump 508 toward the compressed position, thereby causing flowable material within the pump 508 to continue to be dispensed therefrom. In FIG. 17J, the third state of the drive assembly 632 is indicated by data point 3 along the curve of the rate of translation of the actuator 630 as a function of rotation of the fifth gear 660. As shown, the rate of translation of the actuator 630 toward the second position may decrease as the fifth gear 660 rotates and the drive assembly 632 moves away from the third state. Accordingly, the rate of movement of the pump 508 toward the compressed configuration also may decrease as the fifth gear 660 rotates and the drive assembly 632 moves away from the third state.

Figure 17G:
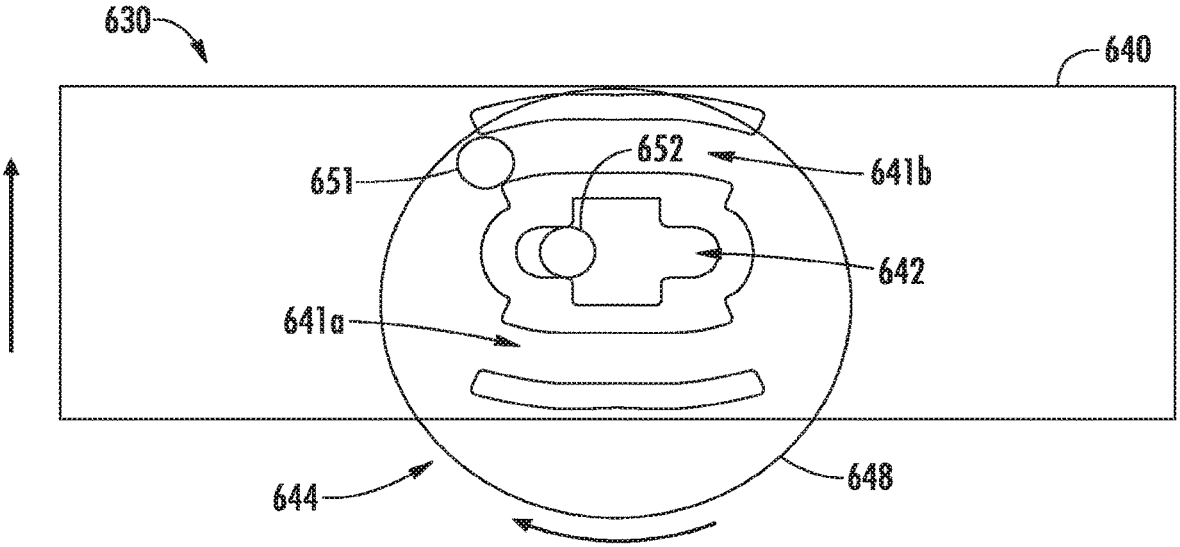
FIG. 17G is a front view of the drive body and the portion of the actuator of FIG. 17A at a fourth state during the dispense cycle.

FIG. 17G shows the actuator 630 and the drive body 644 when the drive assembly 632 is in a fourth state, following rotation of the fifth gear 660 approximately one and one-half rotations (approximately 540 degrees) about its axis of rotation from the position of the first state. In certain embodiments, when the drive assembly 632 is in the fourth state, the first lobe 651 may begin to engage the first slot 641*b*, and the second lobe 652 may begin to disengage the left-side lateral end portion of the second slot 642. In certain embodiments, when the drive assembly 632 is in the fourth state, the first lobe 651 may begin to contact the actuator 630 and regain control of translation of the actuator 630, and the second lobe 652 may begin to release contact with the actuator 630 and release control of translation of the actuator 630. In certain embodiments, the first lobe 651 may begin to contact the rib along the first slot 641*b* to control translation of the actuator 630. In certain embodiments, when the drive assembly 632 is in the fourth state, the actuator 630 may be in a position between the first position and the second position and closer to the second position. In certain embodiments, when the drive assembly 632 is in the fourth state, the pump 508 may be in a configuration between the extended configuration and the compressed configuration and closer to the compressed configuration.

The motor 634 may continue to drive the drive assembly 632 such that the fifth gear 660 continues to rotate (counter-clockwise), and the sixth gear 662 and the drive body 644 continue to rotate (clockwise) from their respective positions of the fourth state. The lobes 651, 652 may continue to move vertically upward and horizontally to the right as the drive body 644 rotates about its rotational axis from the respective position of the fourth state. In this manner, the first lobe 651 may move into the first slot 641*b*, and the second lobe 652 may move out of the left-side lateral end portion of the second slot 642 toward the right-side end of the second slot 642. The rotation of the drive body 644 and the resulting movement of the first lobe 651 within the first slot 641*b* may cause the actuator 630 to continue to translate vertically upward toward the second position. In this manner, the translation of the actuator 630 may continue to move the pump 508 toward the compressed position, thereby causing flowable material within the pump 508 to continue to be dispensed therefrom. In FIG. 17J, the fourth state of the drive assembly 632 is indicated by data point 4 along the curve of the rate of translation of the actuator 630 as a function of rotation of the fifth gear 660. As shown, the rate of translation of the actuator 630 toward the second position may continue to decrease as the fifth gear 660 rotates and the drive assembly 632 moves away from the fourth state. Accordingly, the rate of movement of the pump 508 toward the compressed configuration also may continue to decrease as the fifth gear 660 rotates and the drive assembly 632 moves away from the fourth state.

Figure 17H:
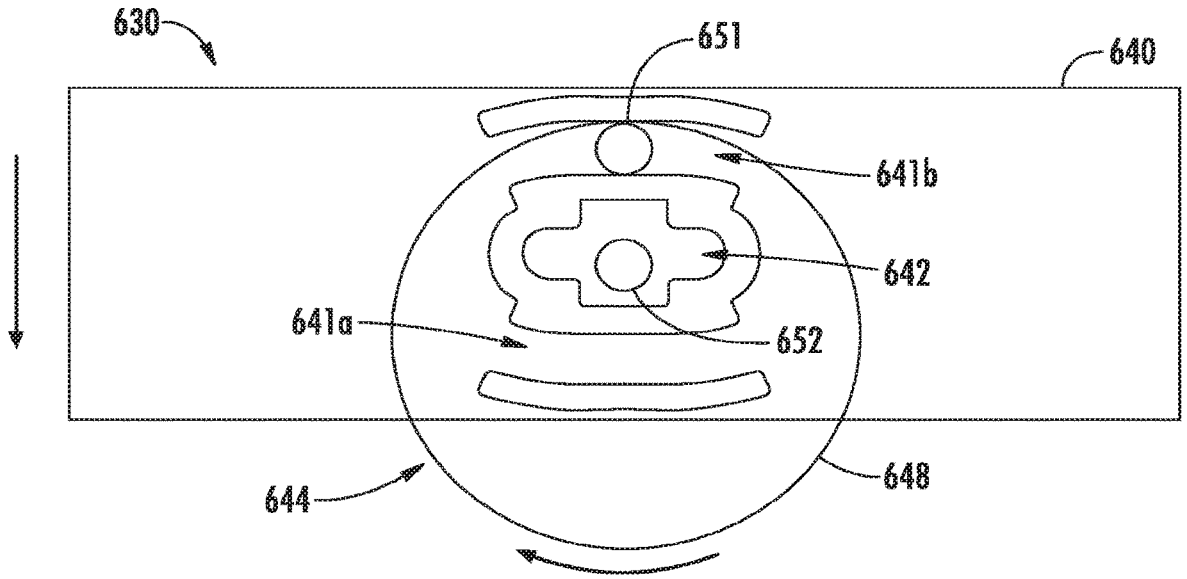
FIG. 17H is a front view of the drive body and the portion of the actuator of FIG. 17A at a fifth state during the dispense cycle.

FIG. 17H shows the actuator 630 and the drive body 644 when the drive assembly 632 is in a fifth state, following rotation of the fifth gear 660 approximately two rotations (approximately 720 degrees) about its axis of rotation from the position of the first state. In certain embodiments, when the drive assembly 632 is in the fifth state, the respective centers of the first lobe 651 and the second lobe 652 may be aligned with the axis of rotation of the drive body 644 in the vertical direction and positioned below the axis of rotation, and the first lobe 651 may be positioned within the first slot 641*b*. In certain embodiments, the first lobe 651 may be positioned at a center of the first slot 641*b* in the horizontal direction, and the second lobe 652 may be positioned at a center of the second slot 642 in the horizontal direction. In certain embodiments, when the drive assembly 632 is in the fifth state, the first lobe 651 may continue to contact the actuator 630 and control translation of the actuator 630. In this manner, when the drive assembly 632 is in the fifth state, the drive assembly 632 may provide the first mechanical advantage, which may be the minimum mechanical advantage provided during the dispense cycle. In certain embodiments, the first lobe 651 may continue to contact the rib along the first slot 641*b* to control translation of the actuator 630. In certain embodiments, when the drive assembly 632 is in the fifth state, the actuator 630 may be in the second position (i.e., the uppermost position of the actuator 630). In certain embodiments, when the drive assembly 632 is in the fifth state, the pump 508 may be in the compressed configuration.

The motor 634 may continue to drive the drive assembly 632 such that the fifth gear 660 continues to rotate (counter-clockwise), and the sixth gear 662 and the drive body 644 continue to rotate (clockwise) from their respective positions of the fifth state. The lobes 651, 652 may move vertically downward and horizontally to the right as the drive body 644 rotates about its rotational axis from the respective position of the fifth state. In this manner, the first lobe 651 may move within the first slot 641*b* from the center of the first slot 641*b* toward the right-side end of the first slot 641*b*, and the second lobe 652 may move within the second slot 642 from the center of the second slot 642 toward the right-side end of the second slot 642. The rotation of the drive body 644 and the resulting movement of the first lobe 651 within the first slot 641*b* may cause the actuator 630 to translate vertically downward from the second position toward the first position. In this manner, the translation of the actuator 630 may move the pump 508 from the compressed position toward the extended position, thereby causing flowable material to be drawn from the reservoir 504 into the pump 508. In FIG. 17J, the fifth state of the drive assembly 632 is indicated by data point 5 along the curve of the rate of translation of the actuator 630 as a function of rotation of the fifth gear 660. As shown, the rate of translation of the actuator 630 from the second position toward the first position may increase as the fifth gear 660 rotates and the drive assembly 632 moves away from the fifth state. Accordingly, the rate of movement of the pump 508 from the compressed configuration toward the extended configuration also may increase as the fifth gear 660 rotates and the drive assembly 632 moves away from the fifth state.

Figure 17I:
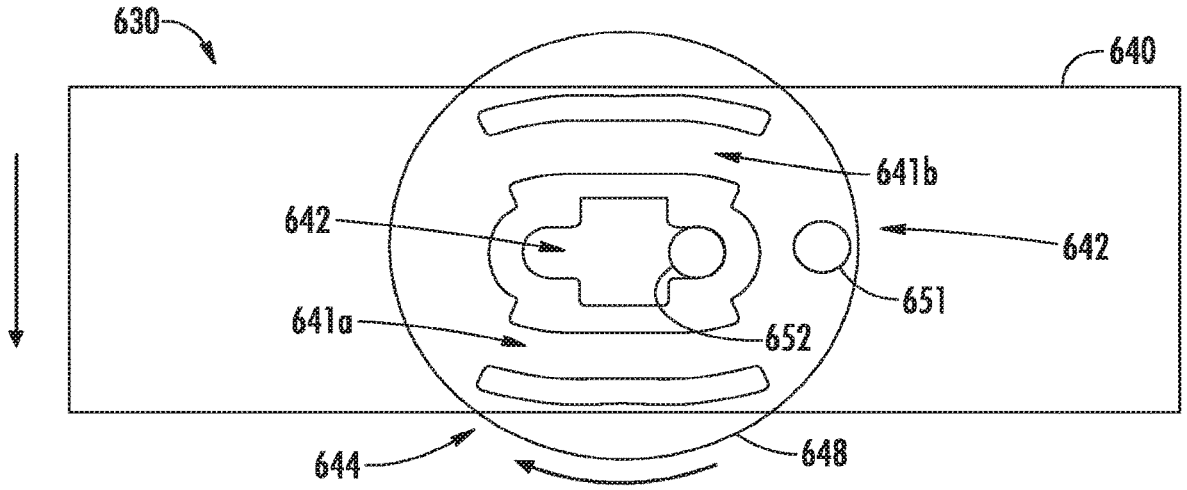
FIG. 17I is a front view of the drive body and the portion of the actuator of FIG. 17A at a sixth state during the dispense cycle.
Figure 17J:
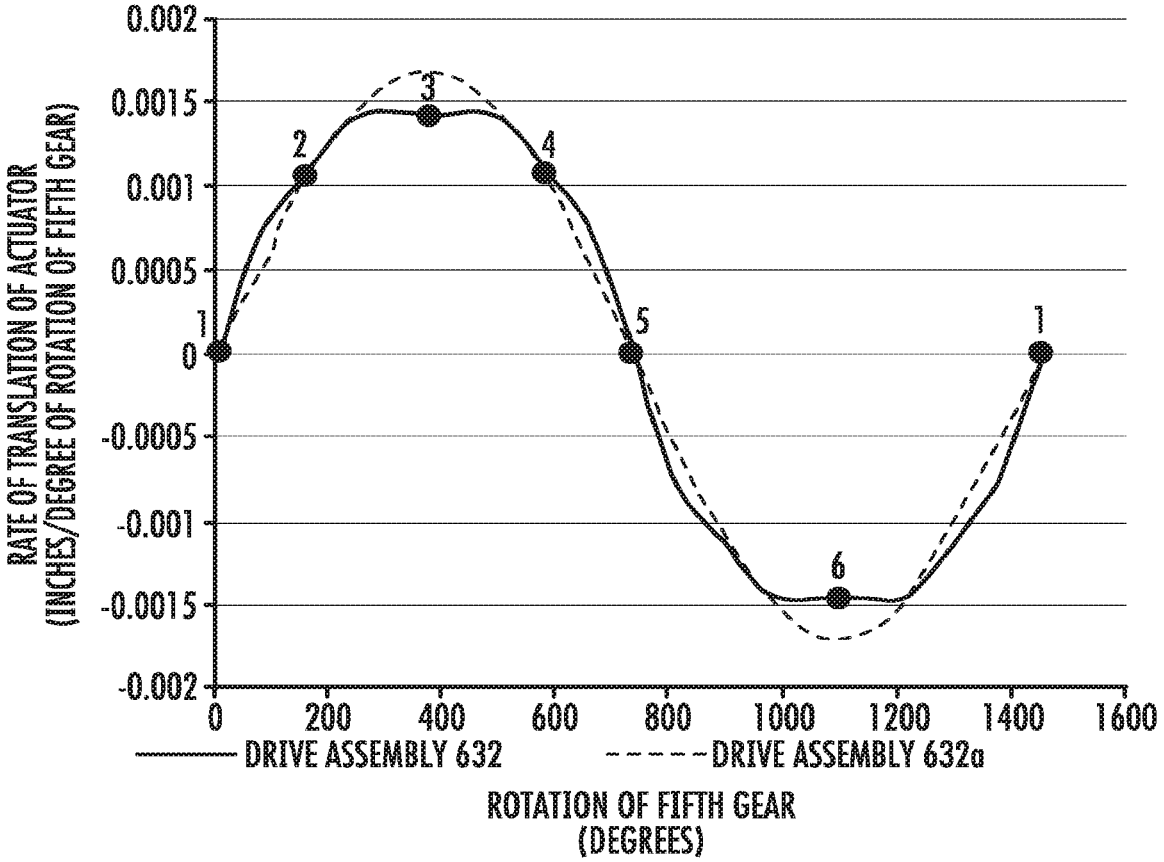
FIG. 17J is a graph of a rate of translation of the actuator of FIG. 17A as a function of a rotational position of a gear of the drive assembly during the dispense cycle.

FIG. 17I shows the actuator 630 and the drive body 644 when the drive assembly 632 is in a sixth state, following rotation of the fifth gear 660 approximately three rotations (approximately 1080 degrees) about its axis of rotation from the position of the first state. In certain embodiments, when the drive assembly 632 is in the sixth state, the respective centers of the first lobe 651 and the second lobe 652 may be aligned with the axis of rotation of the drive body 644 in the horizontal direction and positioned to the right of the axis of rotation. In certain embodiments, when the drive assembly 632 is in the sixth state, the first lobe 651 may be positioned outside of the first slots 641*a*, 641*b*, and the second lobe 652 may be positioned at the right-side end of the second slot 642. In certain embodiments, when the drive assembly 632 is in the sixth state, the second lobe 652 may contact the actuator 630 and control translation of the actuator 630. In this manner, when the drive assembly 632 is in the sixth state, the drive assembly 632 may provide the second mechanical advantage, which may be the maximum mechanical advantage provided during the dispense cycle. In certain embodiments, the second lobe 652 may contact the ring member to control translation of the actuator 630. In certain embodiments, when the drive assembly 632 is in the sixth state, the actuator 630 may be in a position mid-way between the first position and the second position. In certain embodiments, when the drive assembly 632 is in the sixth state, the pump 508 may be in a configuration mid-way between the extended configuration and the compressed configuration.

The motor 634 may continue to drive the drive assembly 632 such that the fifth gear 660 continues to rotate (counter-clockwise), and the sixth gear 662 and the drive body 644 continue to rotate (clockwise) from their respective positions of the sixth state. The lobes 651, 652 may move vertically downward and horizontally to the left as the drive body 644 rotates about its rotational axis from the respective position of the sixth state. In this manner, the first lobe 651 may move toward the first slot 641*a*, and the second lobe 652 may move within the second slot 642 toward the left-side end of the second slot 642. The rotation of the drive body 644 and the resulting movement of the second lobe 652 within the second slot 642 may cause the actuator 630 to continue to translate vertically downward toward the first position. In this manner, the translation of the actuator 630 may continue to move the pump 508 toward the extended position, thereby causing flowable material to continue to be drawn from the reservoir 504 into the pump 508. In FIG. 17J, the sixth state of the drive assembly 632 is indicated by data point 6 along the curve of the rate of translation of the actuator 630 as a function of rotation of the fifth gear 660. As shown, the rate of translation of the actuator 630 toward the first position may decrease as the fifth gear 660 rotates and the drive assembly 632 moves away from the sixth state. Accordingly, the rate of movement of the pump 508 toward the extended configuration also may decrease as the fifth gear 660 rotates and the drive assembly 632 moves away from the sixth state. The dispense cycle may end when the respective portions of the drive assembly 632 reach the respective positions shown in FIG. 17D (i.e., the first state). At the end of the dispense cycle, the motor 634 may be deactivated, and the drive assembly 632 may remain in the first state until a subsequent dispense cycle begins.

The automated dispensing mechanism 628 may be configured to minimize a peak torque required from the motor 634 as the pump 508 is actuated during the dispense cycle of the dispenser 500. As explained above, the automated dispensing mechanism 628 may be required to overcome one or more resistance forces resisting movement of the pump 508 between the extended configuration and the compressed configuration during the dispense cycle, and the resistance forces may vary during the dispense cycle. In particular, the resistance forces may increase as the actuator 630 is translated from the first position toward the second position and the pump 508 is moved from the extended configuration toward the compressed configuration, and the resistance forces may decrease as the actuator 630 is translated from the second position toward the first position and the pump 508 is moved from the compressed configuration toward the extended configuration. Accordingly, the required force exerted by the drive body 644 against the actuator 630 in order to overcome the resistance forces and translate the actuator 630 to move the pump 508 may vary during the dispense cycle, and the required torque exerted by the motor 634 in order to drive the gear train 646 and rotate the drive body 644 to exert the required force may vary during the dispense cycle.

In certain embodiments, the required torque exerted by the motor 634 may vary during the dispense cycle based at least in part on the varying mechanical advantage provided by the drive assembly 632. As explained above, the drive assembly 632 may provide the lesser first mechanical advantage, which may be the minimum mechanical advantage, when the drive assembly 632 is in the first state and the fifth state, and the drive assembly 632 may provide the greater second mechanical advantage, which may be the maximum mechanical advantage, when the drive assembly 632 is in the third state and sixth state. The lesser mechanical advantage may be sufficient for the drive assembly 632 to overcome the lesser resistance forces and translate the actuator 630 to move the pump 508 during certain portions of the dispense cycle. For example, the lesser mechanical advantage may be sufficient for moving the drive assembly 632 from the first state to the second state of the dispense cycle and for moving the drive assembly 632 from the fourth state through the fifth state of the dispense cycle. The greater mechanical advantage may allow the drive assembly 632 to overcome the greater resistance forces and translate the actuator 630 to move the pump 508 during other portions of the dispense cycle, while minimizing the peak torque required from the motor 634. For example, the greater mechanical advantage may allow the drive assembly 632 to move from the second state to the fourth state of the dispense cycle and to move through the sixth state of the dispense cycle in a manner that minimizes the peak torque required from the motor 634 during these portions of the dispense cycle. As explained above, the drive assembly 632 may provide the lesser first mechanical advantage when the first lobe 651 contacts and controls translation of the actuator 630, and the drive assembly 632 may provide the greater second mechanical advantage when the second lobe 652 contacts and controls translation of the actuator 630.

As described above, the drive assembly 632 of the automated dispensing mechanism 628 may be configured to translate the actuator 630 between the first position and the second position at a varying rate of translation during the dispense cycle. The varying rate of translation may vary relative to the rate of rotation of the motor 634. In certain embodiments, the varying rate of translation of the actuator 630 provided by the drive assembly 632 during the dispense cycle may follow the non-sinusoidal waveform shown in FIG. 17J. During a first portion of the dispense cycle, as the drive assembly 632 moves from the first state to the fifth state, the drive assembly 632 may translate the actuator 630 in the first direction from the first position to the second position. During a second portion of the dispense cycle, as the drive assembly 632 moves from the fifth state to the first state, the drive assembly 632 may translate the actuator 630 in the second direction from the second position to the first position. During a first part of the first portion of the dispense cycle, as the drive assembly 632 moves from the first state to the third state, the varying rate of translation of the actuator 630 in the first direction may increase, and during a second part of the first portion of the dispense cycle, as the drive assembly 632 moves from the third state to the fifth state, the varying rate of translation of the actuator 630 in the first direction may decrease. During a first part of the second portion of the dispense cycle, as the drive assembly 632 moves from the fifth state to the sixth state, the varying rate of translation of the actuator 630 in the second direction may increase, and during a second part of the second portion of the dispense cycle, as the drive assembly 632 moves from the sixth state to the first state, the varying rate of translation of the actuator 630 in the second direction may decrease. As described above, the lobes 651, 652 of the drive body 644 and the slots 641, 642 of the actuator 630 may be configured such that the varying rate of translation of the actuator 630 provided by the drive assembly 632 during the dispense cycle follows the non-sinusoidal waveform shown in FIG. 17J. Each of the slots 641, 642 may be shaped, positioned, and oriented such that interaction between the respective slot 641, 642 and the respective lobe 651, 652 may result in the varying rate of translation of the actuator 630 provided by the drive assembly 632 during the dispense cycle. In particular, the different offset distances D1, D2 of the first lobe 651 and the second lobe 652 from the rotational axis of the drive body 644, and the respective shapes, positions, and orientations of the first slots 641 and the second slot 642 for varying contact between the lobes 651, 652 and the actuator 630 may be selected such that the resulting interaction between the drive body 644 and the actuator 630 during the dispense cycle causes the varying rate of translation of the actuator 630 provided by the drive assembly 632 during the dispense cycle to follow the illustrated non-sinusoidal waveform.

Certain advantages of the drive assembly 632 may be appreciated by comparison to the alternative drive assembly 532*a*. FIG. 17J includes a respective curve for the drive assembly 532*a* during a dispense cycle similar to that described above with respect to the drive assembly 632, showing the rate of translation of the actuator 530 as a function of rotation of the fifth gear 560*a*. As shown, the varying rate of translation provided by the drive assembly 632 may follow a non-sinusoidal waveform, and the varying rate of translation provided by the drive assembly 532*a* may follow a sinusoidal waveform. For both the drive assembly 632 and the drive assembly 532*a*, a peak torque may be required from the motor 634, 534 when the drive assembly 632, 532*a* is in the third state of the dispense cycle. However, the peak motor torque for the drive assembly 632 may be less than the peak motor torque for the drive assembly 532*a* due to the lesser rate of translation of the actuator 630, 530 in the third state. In one example, according to the illustrated embodiments, the second lobe 652 of the drive body 644, which contacts and controls translation of the actuator 630 when the drive assembly 632 is in the third state, may be offset from the rotational axis of the drive body 644 by a distance that is approximately 15% less than a distance by which the lobe 550 of the drive body 544 is offset from the rotational axis of the drive body 544. In one embodiment, the offset distance D1 between the first lobe 651 and the rotational axis of the drive body 644 may be 0.90 inches, the offset distance D2 between the second lobe 652 and the rotational axis of the drive body 644 may be 0.33 inches, and the offset distance between the lobe 550 and the rotational axis of the drive body 544 may be 0.39 inches. As a result of the offset distance D2 between the second lobe 652 and the rotational axis of the drive body 644 being less than the offset distance between the lobe 550 and the rotational axis of the drive body 544 by approximately 15%, the peak motor torque for the drive assembly 632 may be approximately 15% less than the peak motor torque for the drive assembly 532*a*. The reduced peak motor torque for the drive assembly 632 advantageously may allow the drive assembly 632 to be driven by a smaller sized motor as compared to the drive assembly 532*a*, which may allow the overall dispenser 500 to be smaller and manufactured at a lower cost. Additionally, the reduced peak motor torque for the drive assembly 632 may reduce wear on the batteries powering the motor 634, extend battery life, and allow the batteries to be useful at lower voltages. Further, the reduced peak motor torque for the drive assembly 632 may improve reliability of the dispenser 500, reducing incidence of partial or incomplete dispense cycles.

It will be appreciated that the actuator 630 and the drive assembly 632 described above and shown in FIGS. 17A-17I relate to only certain embodiments of the automated dispensing mechanism 628 and that other embodiments may be used. In certain embodiments, the drive body 644 may include a different number of lobes configured to contact and control translation of the actuator 630 during different portions of the dispense cycle. For example, the drive body 644 may include a single lobe, three lobes, four lobes, or more than four lobes. In certain embodiments, the one or more lobes of the drive body 644 may have non-circular shapes and may have different shapes from one another. In certain embodiments, the arrangement of the lobes and the slots may be interchanged such that the lobes are a part of the actuator 630 and the slots are defined in the drive body 644 or another component of the drive assembly 632. In certain embodiments, the lobes may be able to move relative to the plate 648 of the drive body 644. For example, the lobes may include a bearing configured to rotate relative to the plate 648 of the drive body 644.

Although the actuator 630 and the drive assembly 632 may be described above as being used in combination with the motor 634 as a part of the automated dispensing mechanism 628, it will be appreciated that the actuator 630 and the drive assembly 632 alternatively may be used without the motor 634 as a part of a mechanical (i.e., manual) dispensing mechanism to provide similar advantages. In other words, in certain embodiments, the dispenser 500 may be a mechanical (i.e., manual) dispenser that requires a user to manually impart a driving force to the dispenser 500 in order to carry out a dispense cycle. For example, the dispenser 500 may include a drive member that is coupled to and configured to drive the drive assembly 632 for carrying out a dispense cycle. In various embodiments, the drive member may include a handle, a lever, a button, a knob, or other member that may be moved by the user to drive the drive assembly 632. As described above, the actuator 630 and the drive assembly 632 may be configured to minimize a peak torque required during a dispense cycle. Accordingly, in embodiments in which the dispenser 500 is a mechanical dispenser, the actuator 630 and the drive assembly 632 may minimize a peak torque generated by the user during a dispense cycle.

Figure 18A:
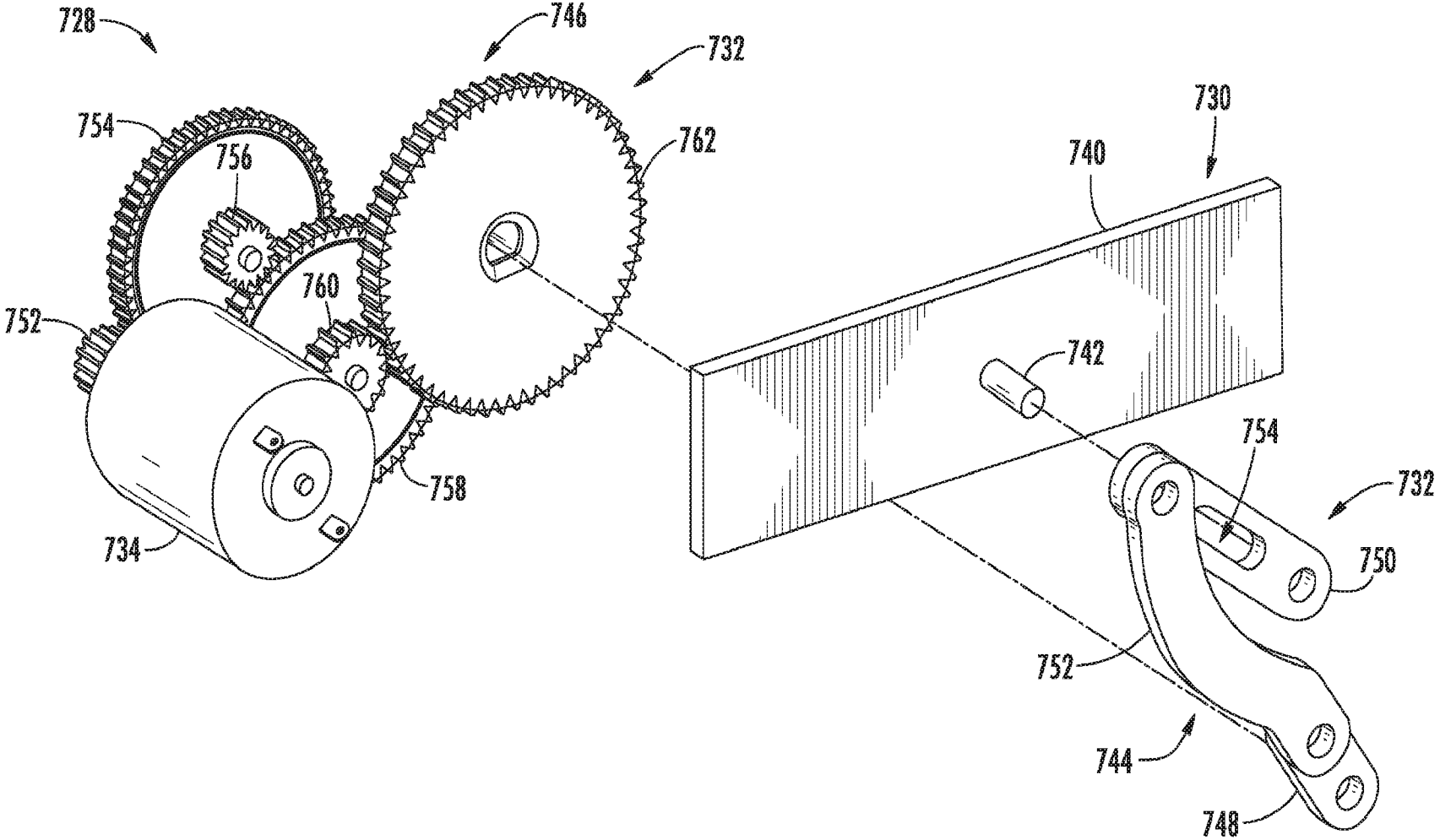
FIG. 18A is an exploded front perspective view of a motor, a drive assembly, and a portion of an actuator as may be used with the example automated hands-free flowable material dispenser of FIG. 16A in accordance with one or more embodiments of the disclosure.
Figure 18B:
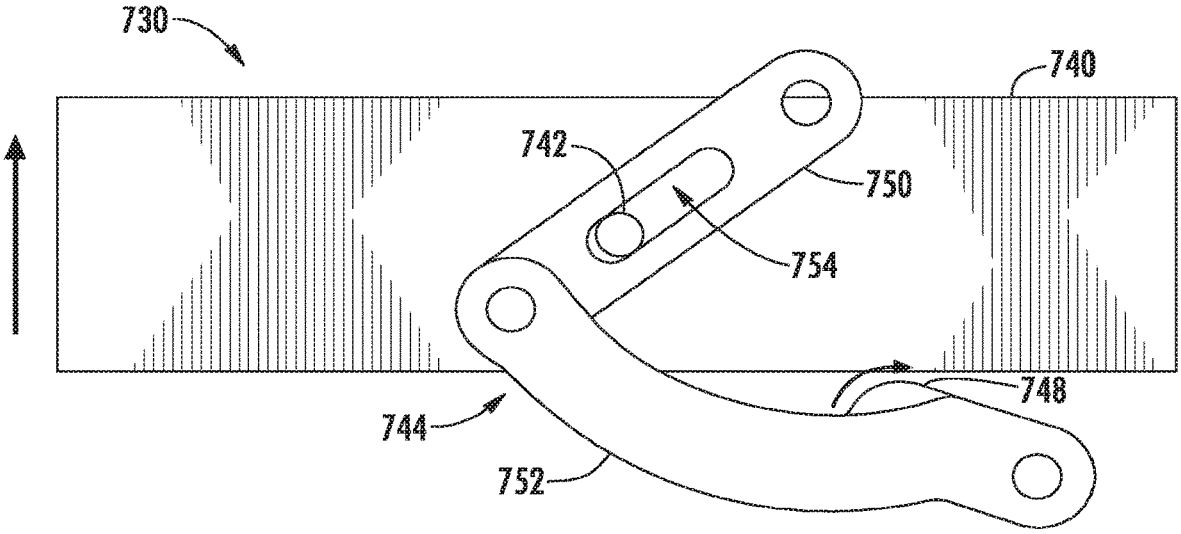
FIG. 18B is a front view of a rocker, a floating link, and a crank of the drive assembly and the portion of the actuator of FIG. 18A at a first state during a dispense cycle.
Figure 18C:
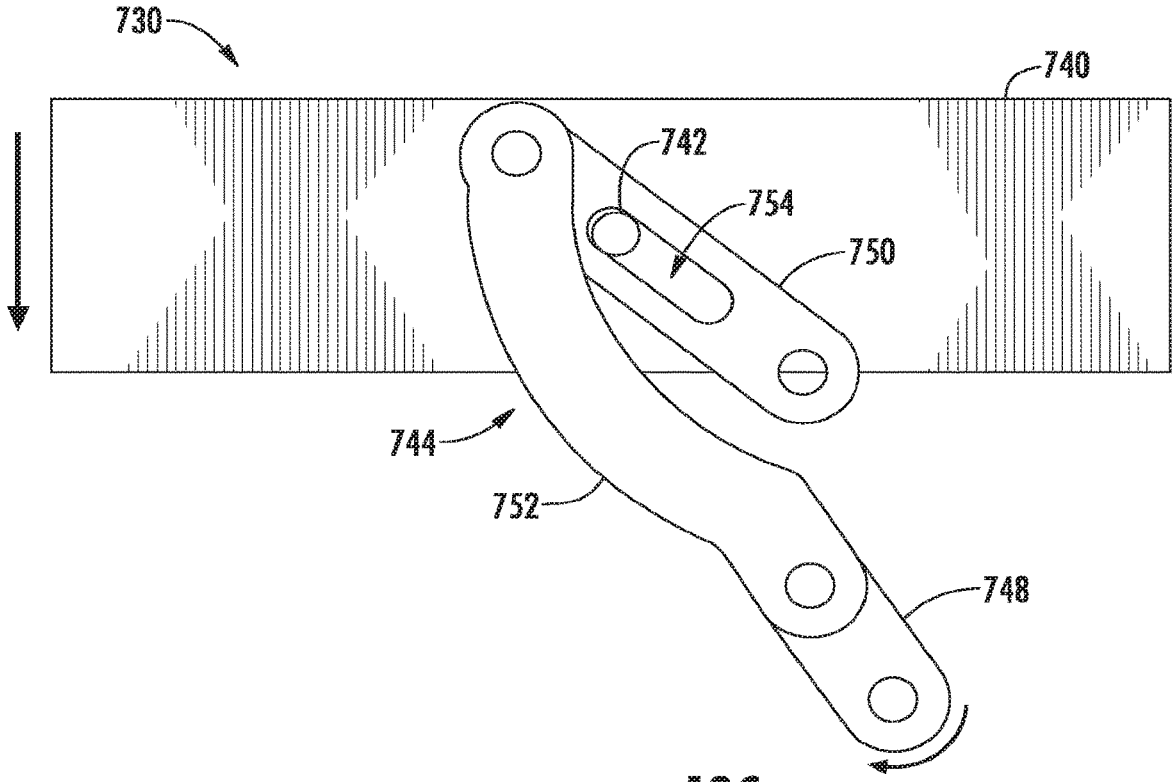
FIG. 18C is a front view of the rocker, the floating link, and the crank of the drive assembly and the portion of the actuator of FIG. 18A at a second state during the dispense cycle.

FIGS. 18A-18C illustrate an example automated dispensing mechanism 728 as may be used with the dispenser 500 instead of the automated dispensing mechanism 528 described above. The automated dispensing mechanism 728 may be configured to facilitate actuation of the pump 508 to dispense the flowable material therefrom during a dispense cycle. As shown, the automated dispensing mechanism 728 may include an actuator 730, a drive assembly 732, and an electric motor 734. As described below, the drive assembly 732 may be configured to provide a mechanical advantage that varies during a dispense cycle. Further, the drive assembly 732 may be configured to translate the actuator 730 at a varying rate during a dispense cycle, and the varying rate may follow a non-sinusoidal waveform. As described below, the automated dispensing mechanism 728 may be used with the dispenser 500 to manage torque exerted by the motor 734 during a dispense cycle, and in particular to minimize a peak motor torque during the dispense cycle. In this manner, the automated dispensing mechanism 728 may provide the same advantages and benefits explained above with respect to the automated dispensing mechanism 528.

The actuator 730 may be disposed within the dispenser housing 516 and configured to translate relative to the dispenser housing 516 between a first position and a second position during a dispense cycle. In certain embodiments, as shown, the actuator 730 may be configured to translate in a vertical direction relative to the dispenser housing 516 between the first position and the second position. In certain embodiments, the first position may be a lowermost position of the actuator 730, and the second position may be an uppermost position of the actuator 730. In other embodiments, the actuator 730 may be configured to translate in a horizontal direction relative to the dispenser housing 516 between the first position and the second position. In still other embodiments, the actuator 730 may be configured to translate relative to the dispenser housing 516 between the first position and the second position in a direction transverse to each of the vertical direction and the horizontal direction. It will be appreciated that only a portion of the actuator 730 is shown in FIGS. 18A-18C for illustration purposes. In particular, a wall 740 of the actuator 730 is shown, which may correspond generally to the wall 542 of the actuator 530 described above. The actuator 730 may include a pump interface, similar to the pump interface 536, configured to engage the pump 508 and facilitate actuation of the pump 508. In certain embodiments, the pump interface may include a recess defined in the actuator 730 and configured to receive the flange 538 of the pump piston 512 therein. The actuator 730 may be configured to move the pump 508 between the extended configuration and the compressed configuration as the actuator 730 translates between the first position and the second position during a dispense cycle. In certain embodiments, as shown, when the actuator 730 is in the first position, the pump 508 may be maintained in the extended configuration. As the actuator 730 translates from the first position to the second position, the actuator 730 may move the pump 508 from the extended configuration to the compressed configuration, and as the actuator 730 translates from the second position to the first position, the actuator 730 may move the pump 508 from the compressed configuration to the extended configuration. In particular, such movement may be achieved by the actuator 730 engaging the flange 538 and translating the pump piston 512 relative to the pump body 510. In certain embodiments, a complete dispense cycle may include the actuator 730 moving the pump 508 from the extended configuration to the compressed configuration and then moving the pump 508 from the compressed configuration to the extended configuration. In certain embodiments, movement of the pump 508 from the extended configuration to the compressed configuration may cause flowable material within the pump 508 to be dispensed from the pump 508, and movement of the pump 508 from the compressed configuration to the extended configuration may cause additional flowable material to be drawn from the reservoir 504 into the pump 508 to refill the pump 508. As shown, the actuator 730 also may include a pin 742 extending from the wall 740 and configured to engage a portion of the drive assembly 732. In certain embodiments, as shown, the pin 742 may be formed as a cylindrical protrusion extending from the wall 740 in a horizontal direction and having a circular cross-section in a direction perpendicular to a longitudinal axis of the pin 742, although other shapes and configurations of the pin 742 may be used. As described below, the drive assembly 732 may engage the pin 742 to facilitate translation of the actuator 730 between the first position and the second position.

The drive assembly 732 may be coupled to the actuator 730 and the motor 734. The motor 734 may be configured to drive the drive assembly 732, and the drive assembly 732 may be configured to translate the actuator 730 between the first position and the second position. In certain embodiments, the motor 734 may be a DC motor, although other types of motors may be used. The motor 734 may be powered by one or more batteries of the dispenser 500. In certain embodiments, the motor 734 may be supported by and disposed within the chassis housing 524. The drive assembly 732 may include a linkage 744 and a gear train 746. As shown, the linkage 744 may be coupled to the actuator 730, and the gear train 746 may be coupled to the motor 734 and the linkage 744. The linkage 744 may include a crank 748, a rocker 750, and a floating link 752 shaped and arranged as shown, although other shapes and arrangements of these components may be used. The crank 748 may be configured to rotate relative to the dispenser housing 516 and the chassis housing 524 about a rotational axis extending in the horizontal direction. The rocker 750 may be pivotally attached to the chassis housing 524 or the dispenser housing 516 and coupled to the actuator 730. In particular, the rocker 750 may be pivotally attached to one of the housings 520, 528 via a pin connection, and the rocker 750 may include an elongated slot 754 configured to movably receive the pin 742 of the actuator 730 therein. The floating link 752 may be pivotally attached to the rocker 750 at or near one end of the floating link 752 and pivotally attached to the crank 748 at or near an opposite end of the floating link 752. In particular, the floating link 752 may be pivotally attached to the rocker 750 via a first pin connection and pivotally attached to the crank 748 via a second pin connection. In this manner, the linkage 744 may be actuated by rotation of the crank 748, which may result in pivotal movement of the floating link 752 about the first pin connection and the second pin connection, and such movement of the floating link 752 may result in pivotal movement of the rocker 750 about its pin connection to the chassis housing 528 or the dispenser housing 520. Ultimately, the pivotal movement of the rocker 750 may cause the actuator 730 to translate in the vertical direction via interaction between the pin 742 of the actuator 730 and the slot 754 of the rocker 750. Although the illustrated embodiment shows the rocker 750 including the slot 754 and the actuator 730 including the pin 742, the rocker 750 may include the pin 742 and the actuator 730 may include the slot 754 in other embodiments. In certain embodiments, the floating link 752 may include the slot 754 that engages the pin 742 of the actuator 730. In certain embodiments, the floating link 752 may include the pin 742, and the actuator 730 may include the slot 754. As described further below, one full rotation (360 degrees) of the crank 748 about its rotational axis may cause the actuator 630 to translate between the first position and the second position to complete a dispense cycle.

As shown, the gear train 746 may include a plurality of gears configured to be driven by the motor 734 and facilitate rotation of the crank 748. In particular, the gear train 746 may include a first gear 752, a second gear 754, a third gear 756, a fourth gear 758, a fifth gear 760, and a sixth gear 762 arranged as shown in FIG. 17A. The first gear 752, which also may be referred to as a "motor pinion gear" or an "input gear," may be a circular gear coupled to the drive shaft of the motor 734 for rotation therewith. The second gear 754, which also may be referred to as a "fast gear," may be a circular gear that engages and is rotated by the first gear 752. The third gear 756, which also may be referred to as a "fast pinion," may be a circular gear that is coupled to the second gear 754 for rotation therewith. The third gear 756 and the second gear 754, which collectively may form a "fast compound gear," may be coupled to one another directly or indirectly via the shaft supporting the gears 754, 756. The fourth gear 758, which also may be referred to as a "first slow gear," may be a circular gear that engages and is rotated by the third gear 756. The fifth gear 760, which also may be referred to as a "slow pinion," may be a circular gear that is coupled to the fourth gear 758 for rotation therewith. The fifth gear 760 and the fourth gear 758, which collectively may form a "slow compound gear," may be coupled to one another directly or indirectly via the shaft supporting the gears 758, 760. The sixth gear 762, which also may be referred to as a "second slow gear," may be a circular gear that engages and is rotated by the fifth gear 760. The sixth gear 762 may be coupled to the crank 748 for rotation therewith. In certain embodiments, as shown, the sixth gear 762 may be indirectly coupled to the crank 748 via a shaft. For example, the shaft may have a D-shaped cross-section and may extend through mating D-shaped apertures of the sixth gear 762 and the crank 748. In this manner, the sixth gear 762 may be coupled to the crank 748 for rotation along with the shaft. In other embodiments, the sixth gear 762 may be directly coupled to the crank 748. The respective shafts of the gear train 746 may be supported by the chassis housing 524 or other support structure such that the gears 752, 754, 756, 758, 760, 762 rotate about respective rotational axes. In certain embodiments, as shown, the respective rotational axes may be fixed relative to the chassis housing 524 and the dispenser housing 516. In other embodiments, one or more of the respective rotational axes may move relative to the chassis housing 524 and the dispenser housing 516. In certain embodiments, the gears 752, 754, 756, 758, 760, 762 may be disposed within the chassis housing 524. In certain embodiments, the fifth gear 760 and the sixth gear 762 may have an overall gear ratio that is an integer ratio (i.e., 1:1, 2:1, 3:1, 4:1, etc.). In certain embodiments, the fifth gear 760 and the sixth gear 762 may have an overall gear ratio that is greater than 1:1, thereby incorporating gear reduction. In certain embodiments, as shown, the fifth gear 760 and the sixth gear 762 may have an overall gear ratio of 4:1, although other gear ratios may be used. It will be appreciated that the illustrated configuration of the gear train 746 represents merely one embodiment, and that other configurations including a different arrangement and/or a different number of gears may be used.

As described further below, the automated dispensing mechanism 728 may be configured to manage torque exerted by the motor 734 during a dispense cycle of the dispenser 700. In particular, the automated dispensing mechanism 728 may be configured to minimize a peak torque required from the motor 734 during a dispense cycle of the dispenser 500. As described above, the automated dispensing mechanism 728 may actuate the pump 508 to dispense the flowable material from the pump 508 during a dispense cycle. In certain embodiments, during a dispense cycle, the automated dispensing mechanism 728 may move the pump 508 from the extended configuration to the compressed configuration and from the compressed configuration to the extended configuration. As described above, the motor 734 may drive the gear train 746, the gear train 746 may rotate the crank 748 of the linkage 744, the linkage 744 may translate the actuator 730, and the actuator 730 may move the pump 508 between the extended configuration and the compressed configuration during a dispense cycle.

It will be appreciated that the automated dispensing mechanism 728 may be required to overcome one or more forces resisting movement of the pump 508 between the extended configuration and the compressed configuration during a dispense cycle. In certain embodiments, the automated dispensing mechanism 728 may be required to overcome one or more forces resisting movement of the pump 508 from the extended configuration to the compressed configuration, or from the compressed configuration to the extended configuration, in order to dispense flowable material from the pump 508. Such resistance forces may include a spring force generated by compression or extension of the spring 514 of the pump 508, a friction force generated by relative movement of the pump piston 512 and the pump body 510 and/or other components of the pump 508, a fluid force generated by movement of the flowable material within and/or out of the pump 508, and/or other forces generated by movement of the pump 508 between the extended configuration and the compressed configuration. It will be appreciated that such resistance forces may vary during a dispense cycle, as the pump 508 is moved between the extended configuration and the compressed configuration. For example, in certain embodiments, the resistance forces may increase as the pump 508 is moved from the extended configuration to the compressed configuration and may decrease as the pump 508 is moved from the compressed configuration to the extended configuration. Accordingly, a required force exerted by the linkage 744 against the actuator 730 in order to overcome the resistance forces and translate the actuator 730 to move the pump 508 may vary during a dispense cycle. Further, a required torque exerted by the motor 734 in order to drive the gear train 746 and rotate the crank 748 of the linkage 744 to exert the required force may vary during a dispense cycle. In this manner, the required torque exerted by the motor 734 may increase during a portion of the dispense cycle and may decrease during another portion of the dispense cycle.

The automated dispensing mechanism 728 may be configured to minimize a peak torque required from the motor 734 during a dispense cycle of the dispenser 500. It will be appreciated that the required torque exerted by the motor 734 may be affected by a mechanical advantage provided by the drive assembly 732, and a rate of translation of the actuator 730 provided by the drive assembly 732, each of which may vary during a dispense cycle. In certain embodiments, the required torque exerted by the motor 734 may vary during a dispense cycle based at least in part on a mechanical advantage provided by the drive assembly 732. In certain embodiments, the drive assembly 732 may provide a mechanical advantage that varies during a dispense cycle. The drive assembly 732 may provide a first mechanical advantage during a first portion of the dispense cycle and a second mechanical advantage during a second portion of the dispense cycle, with the second mechanical advantage being different than the first mechanical advantage. In certain embodiments, the drive assembly 732 may provide a first mechanical advantage during a first portion of the dispense cycle and a second mechanical advantage during a second portion of the dispense cycle, with the second mechanical advantage being greater than the first mechanical advantage. Resistance forces resisting movement of the pump 508 during the second portion of the dispense cycle may be greater than resistance forces resisting movement of the pump 508 during the first portion of the dispense cycle. During the second portion of the dispense cycle, the greater second mechanical advantage may allow the drive assembly 732 to overcome the greater resistance forces and translate the actuator 730 to move the pump 508, while minimizing the peak torque required from the motor 734. During the first portion of the dispense cycle, the lesser first mechanical advantage may be sufficient for the drive assembly 732 to overcome the lesser resistance forces and translate the actuator 730 to move the pump 508. The drive assembly 732 may be configured to provide the greater second mechanical advantage during a portion of the dispense cycle in which the drive assembly 732 is required to overcome a peak value of the resistance forces resisting movement of the pump 508. In other words, the greater second mechanical advantage provided by the drive assembly 732 may correspond to a portion of the dispense cycle in which the resistance forces resisting translation of the actuator 730 are at a peak value. In certain embodiments, the drive assembly 732 may be configured to provide the greater second mechanical advantage during a portion of the dispense cycle in which the actuator 730 moves the pump 508 toward the compressed configuration. In certain embodiments, the drive assembly 732 may be configured to provide the greater second mechanical advantage during a portion of the dispense cycle in which the actuator 730 moves the pump 508 toward the extended configuration. In certain embodiments, the varying mechanical advantage provided by the drive assembly 732 may be achieved by the configuration of the linkage 744, the pin 742, and the slot 754 and their interaction with one another during the dispense cycle. Multiple variables may affect the varying mechanical advantage provided by the drive assembly 732, including the locations of the pivot points of the linkage 744, the distances between the respective pivot points of the linkage 744, the shape, position, and orientation of the pin 742, and the shape, position, and orientation of the slot 754. These variables may be selected such that the mechanical advantage provided by the drive assembly 732 varies during the dispense cycle. As further described below, as the rocker 750 pivots about its pivotal axis at the pin connection to the chassis housing 528 or the dispenser housing 520, the pin 742 may move within the slot 754 between the ends of the slot 754. In certain embodiments, the drive assembly 732 may provide the lesser first mechanical advantage when the pin 742 is at one end of the slot 754, such as the end further away from the pivotal axis of the rocker 750, and the drive assembly 732 may provide the greater second mechanical advantage when the pin 742 is at the other end of the slot 754, such as the end closer to the pivotal axis of the rocker 750.

The drive assembly 732 of the automated dispensing mechanism 728 may be configured to translate the actuator 730 between the first position and the second position at a varying rate of translation during a dispense cycle. In certain embodiments, the drive assembly 732 may be configured such that the varying rate of translation varies relative to a rate of rotation of the motor 734 and follows a non-sinusoidal waveform, as described below. The drive assembly 732 may be configured to translate the actuator 730 in a first direction from the first position to the second position during a first portion of the dispense cycle, and to translate the actuator 730 in an opposite second direction from the second position to the first position during a second portion of the dispense cycle. In certain embodiments, the varying rate of translation may increase during part of the first portion of the dispense cycle and decrease during another part of the first portion of the dispense cycle, and the varying rate of translation may increase during part of the second portion of the dispense cycle and decrease during another part of the second portion of the dispense cycle. In certain embodiments, the non-sinusoidal waveform of the varying rate of translation of the actuator 730 provided by the drive assembly 732 may be achieved by the configuration of the pin 742 of the actuator 730 and the slot 754 of the rocker 750 and their interaction with one another during the dispense cycle.

Figure 18D:
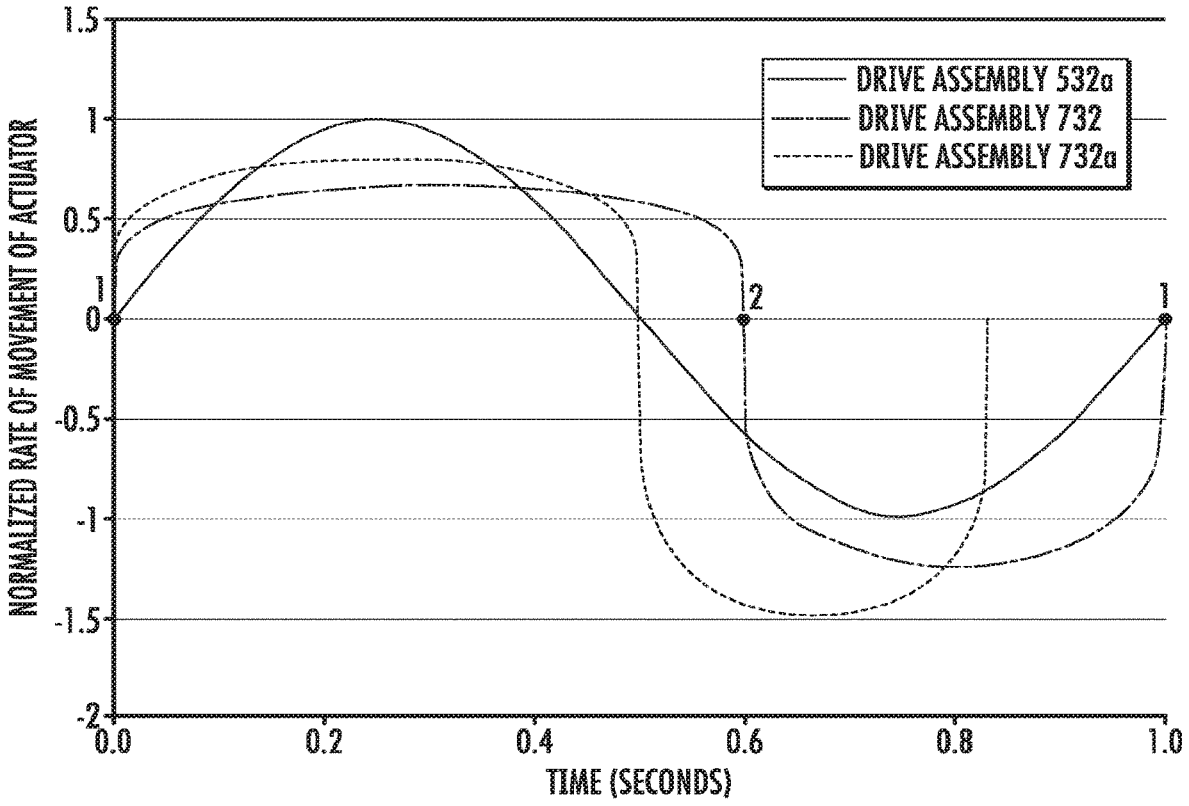
FIG. 18D is a graph of a normalized rate of movement of the actuator of FIG. 18A as a function of time during the dispense cycle.

FIGS. 18B and 18C show front views of the actuator 730 and the linkage 744 of the drive assembly 732 in a number of different states during a dispense cycle as may be carried out using the drive assembly 732 with the dispenser 500. It will be appreciated that the orientations and directions of movement of the various components of the automated dispensing mechanism 728 described herein and shown in FIGS. 18B and 18C relate to only certain embodiments of the automated dispensing mechanism 728, and that other orientations and directions of movement of the components may be used in other embodiments. FIG. 18D illustrates a graph of a normalized rate of translation of the actuator 730 as a function of time during a dispense cycle, normalized with respect to the respective curve for the drive assembly 532*a* discussed above. As shown in FIG. 18D and described below with respect to FIGS. 18B and 18C, the varying rate of translation of the actuator 730 provided by the drive assembly 732 during the dispense cycle may follow a non-sinusoidal waveform.

FIG. 18B shows the actuator 730 and the linkage 744 when the drive assembly 732 is in a first state, which may correspond to a home state of the drive assembly 732 in certain embodiments. In this manner, in certain embodiments, a dispense cycle may begin with the drive assembly 732 in the first state. In certain embodiments, when the drive assembly 732 is in the first state, the crank 748 may extend downward and to the right from its rotational axis, the rocker 750 may extend downward and to the left from its pivotal axis at the pivot connection to the chassis housing 524 or the dispenser housing 516, and the floating link 752 may extend upward and to the left from its pin connection to the crank 748 to its pin connection to the rocker 750. In certain embodiments, as shown, when the drive assembly 732 is in the first state, the crank 748 may extend at an acute angle of approximately 20 degrees relative to the horizontal direction. In certain embodiments, when the drive assembly 732 is in the first state, the pin 742 may be positioned within the slot 754 at or near the end of the slot 754 closest to the pin connection between the rocker 750 and the floating link 752 and at a position furthest away from the pivotal axis of the rocker 750. In certain embodiments, when the drive assembly 732 is in the first state, the drive assembly 732 may provide a first mechanical advantage, which may be a minimum mechanical advantage provided during the dispense cycle. In certain embodiments, when the drive assembly 732 is in the first state, the actuator 730 may be in the first position (i.e., the lowermost position of the actuator 730). In certain embodiments, when the drive assembly 732 is in the first state, the pump 508 may be in the extended configuration.

Upon activation of the motor 734, the motor 734 may drive the drive assembly 732 such that the gear train 746 rotates the crank 748 (clockwise in the front views shown) about its axis of rotation. In particular, the shaft of the motor 734 may rotate the first gear 752 (counter-clockwise), the first gear 752 may rotate the second gear 754 (clockwise), the third gear 756 may rotate along with the second gear 754 (clockwise), the third gear 756 may rotate the fourth gear 758 (counter-clockwise), the fifth gear 760 may rotate along with the fourth gear 758 (counter-clockwise), the fifth gear 760 may rotate the sixth gear 762 (clockwise), and the crank 748 may rotate along with the sixth gear 762 (clockwise) from their respective positions of the first state. In certain embodiments, the shaft of the motor 734 may rotate at a constant rate or a substantially constant rate throughout the dispense cycle, except for during initial starting of the motor 734 at the beginning of the dispense cycle and stopping of the motor 734 at the end of the dispense cycle. In this manner, the first gear 752, the second gear 754, the third gear 756, the fourth gear 758, the fifth gear 760, the sixth gear 762, and the crank 748 each may rotate at a constant rate or a substantially constant rate throughout the dispense cycle. As the crank 748 rotates, the crank 748 may urge the floating link 752 toward the rocker 750, which may cause the rocker 750 to pivot (clockwise) about its pivotal axis. The pivotal movement of the rocker 750 may cause the actuator 730 to translate from the first position toward the second position. In particular, the interaction between the pin 742 and the slot 754 may cause the rocker 750 to translate the actuator 730 vertically upward from the first position toward the second position. In this manner, the translation of the actuator 730 may move the pump 508 from the extended position toward the compressed position, thereby causing flowable material within the pump 508 to be dispensed therefrom. The pivotal movement of the rocker 750 may cause the pin 742 to translate within the slot 754 toward the pivotal axis of the rocker 750 and then away from the pivotal axis of the rocker 750. In certain embodiments, the mechanical advantage provided by the drive assembly 732 may initially increase as the drive assembly 732 moves away from the first state and then decrease as the drive assembly 732 moves toward the second state described below. In FIG. 18D, the first state of the drive assembly 732 is indicated by data point/along the curve of the normalized rate of translation of the actuator 730 as a function of time. As shown, the rate of translation of the actuator 730 from the first position toward the second position may initially increase as the drive assembly 732 moves away from the first state and then decrease as the drive assembly 732 moves toward the second state described below. Accordingly, the rate of movement of the pump 508 from the extended configuration toward the compressed configuration also may initially increase as the drive assembly 732 moves away from the first state and then decrease as the drive assembly 732 moves toward the second state.

FIG. 18C shows the actuator 730 and the linkage 744 when the drive assembly 732 is in a second state, following rotation of the crank 748 approximately 216 degrees about its axis of rotation from the position of the first state. In certain embodiments, when the drive assembly 732 is in the second state, the crank 748 may extend upward and to the left from its rotational axis, the rocker 750 may extend upward and to the left from its pivotal axis at the connection to the chassis housing 524 or the dispenser housing 516, and the floating link 754 may extend upward and to the left from its pin connection to the crank 748 to its pin connection to the rocker 750. In certain embodiments, as shown, when the drive assembly 732 is in the second state, the crank 748 may extend at an acute angle of approximately 56 degrees relative to the horizontal direction. In certain embodiments, when the drive assembly 732 is in the second state, the pin 742 may be positioned within the slot 754 at or near the end of the slot 754 closest to the pin connection between the rocker 750 and the floating link 752 and at the position furthest away from the pivotal axis of the rocker 750. In certain embodiments, when the drive assembly 732 is in the second state, the drive assembly 732 may provide the first mechanical advantage, which may be the minimum mechanical advantage provided during the dispense cycle. In certain embodiments, when the drive assembly 732 is in the second state, the actuator 730 may be in the second position (i.e., the uppermost position of the actuator 730). In certain embodiments, when the drive assembly 732 is in the second state, the pump 508 may be in the compressed configuration.

The motor 734 may continue to drive the drive assembly 732 such that the sixth gear 762 and the crank 748 continue to rotate (clockwise) from their respective positions of the second state. As the crank 748 continues to rotate, the crank 748 may urge the floating link 752 toward and then away from the rocker 750, which may cause the rocker 750 to pivot (counter-clockwise) about its pivotal axis. The pivotal movement of the rocker 750 may cause the actuator 730 to translate from the second position toward the first position. In particular, the interaction between the pin 742 and the slot 754 may cause the rocker 750 to translate the actuator 730 vertically downward from the second position toward the first position. In this manner, the translation of the actuator 730 may move the pump 508 from the compressed position toward the extended position, thereby causing flowable material to be drawn from the reservoir 504 into the pump 508. The pivotal movement of the rocker 750 may cause the pin 742 to translate within the slot 754 toward the pivotal axis of the rocker 750 and then away from the pivotal axis of the rocker 750. In certain embodiments, the mechanical advantage provided by the drive assembly 732 may initially increase as the drive assembly 732 moves away from the second state and then decrease as the drive assembly 732 moves toward the first state. In FIG. 18D, the second state of the drive assembly 732 is indicated by data point 2 along the curve of the normalized rate of translation of the actuator 730 as a function of time. As shown, the rate of translation of the actuator 730 from the second position toward the first position may initially increase as the drive assembly 732 moves away from the second state and then decrease as the drive assembly 732 moves toward the first state. Accordingly, the rate of movement of the pump 508 from the extended configuration toward the compressed configuration also may initially increase as the drive assembly 732 moves away from the second state and then decrease as the drive assembly 732 moves toward the first state. The dispense cycle may end when the respective portions of the drive assembly 732 and the actuator 730 reach the respective positions shown in FIG. 18B (i.e., the first state). At the end of the dispense cycle, the motor 734 may be deactivated, and the drive assembly 732 may remain in the first state until a subsequent dispense cycle begins.

The automated dispensing mechanism 728 may be configured to minimize a peak torque required from the motor 734 as the pump 508 is actuated during the dispense cycle of the dispenser 500. As explained above, the automated dispensing mechanism 728 may be required to overcome one or more resistance forces resisting movement of the pump 508 between the extended configuration and the compressed configuration during the dispense cycle, and the resistance forces may vary during the dispense cycle. In particular, the resistance forces may increase as the actuator 730 is translated from the first position toward the second position and the pump 508 is moved from the extended configuration toward the compressed configuration, and the resistance forces may decrease as the actuator 730 is translated from the second position toward the first position and the pump 508 is moved from the compressed configuration toward the extended configuration. Accordingly, the required force exerted by the linkage 744 against the actuator 730 in order to overcome the resistance forces and translate the actuator 730 to move the pump 508 may vary during the dispense cycle, and the required torque exerted by the motor 734 in order to drive the gear train 746 and rotate the crank 748 of the linkage 744 to exert the required force may vary during the dispense cycle.

In certain embodiments, the required torque exerted by the motor 734 may vary during the dispense cycle based at least in part on the varying mechanical advantage provided by the drive assembly 732. As explained above, the drive assembly 732 may provide the lesser first mechanical advantage, which may be the minimum mechanical advantage, when the drive assembly 732 is in the first state and the second state, and the drive assembly 732 may provide the greater second mechanical advantage, which may be the maximum mechanical advantage, when the drive assembly 732 is mid-way between the first state and the second state and when the drive assembly 732 is mid-way between the second state and the first state. The lesser mechanical advantage may be sufficient for the drive assembly 732 to overcome the lesser resistance forces and translate the actuator 730 to move the pump 508 during certain portions of the dispense cycle. For example, the lesser mechanical advantage may be sufficient for moving the drive assembly 732 from the first state to mid-way between the first state and the second state of the dispense cycle and for moving the drive assembly 732 from the second state to mid-way between the second state and the first state of the dispense cycle. The greater mechanical advantage may allow the drive assembly 732 to overcome the greater resistance forces and translate the actuator 730 to move the pump 508 during other portions of the dispense cycle, while minimizing the peak torque required from the motor 734. For example, the greater mechanical advantage may allow the drive assembly 732 to move from mid-way between the first state and the second state to the second state of the dispense cycle and to move from mid-way between the second state and the first state to the first state of the dispense cycle in a manner that minimizes the peak torque required from the motor 734 during these portions of the dispense cycle. In certain embodiments, the drive assembly 732 may provide the lesser first mechanical advantage when the pin 742 is at the position furthest away from the pivotal axis of the rocker 750, and the drive assembly 732 may provide the greater second mechanical advantage when the pin 742 is at the position closest to the pivotal axis of the rocker 750.

As described above, the drive assembly 732 of the automated dispensing mechanism 728 may be configured to translate the actuator 730 between the first position and the second position at a varying rate of translation during the dispense cycle. The varying rate of translation may vary relative to the rate of rotation of the motor 734. In certain embodiments, the varying rate of translation of the actuator 730 provided by the drive assembly 732 during the dispense cycle may follow the non-sinusoidal waveform shown in FIG. 18D. During a first portion of the dispense cycle, as the drive assembly 732 moves from the first state to the second state, the drive assembly 732 may translate the actuator 730 in the first direction from the first position to the second position. During a second portion of the dispense cycle, as the drive assembly 732 moves from the second state to the first state, the drive assembly 732 may translate the actuator 730 in the second direction from the second position to the first position. During a first part of the first portion of the dispense cycle, as the drive assembly 732 moves from the first state to mid-way between the first state and the second state, the varying rate of translation of the actuator 730 in the first direction may increase, and during a second part of the first portion of the dispense cycle, as the drive assembly 732 moves from mid-way between the first state and the second state to the second state, the varying rate of translation of the actuator 730 in the first direction may decrease. During a first part of the second portion of the dispense cycle, as the drive assembly 732 moves from the second state to mid-way between the second state and the first state, the varying rate of translation of the actuator 730 in the second direction may increase, and during a second part of the second portion of the dispense cycle, as the drive assembly 732 moves from mid-way between the second state and the first state to the first state, the varying rate of translation of the actuator 730 in the second direction may decrease. As described above, the linkage 744, the pin 742, and the slot 754 may be configured such that the varying rate of translation of the actuator 730 provided by the drive assembly 732 during the dispense cycle follows the non-sinusoidal waveform shown in FIG. 18B. In particular, the relevant variables, including the locations of the pivot points of the linkage 744, the distances between the respective pivot points of the linkage 744, the shape, position, and orientation of the pin 742, and the shape, position, and orientation of the slot 754, may be selected such that the varying rate of translation of the actuator 730 provided by the drive assembly 732 during the dispense cycle follows the illustrated non-sinusoidal waveform.

Certain advantages of the drive assembly 732 may be appreciated by comparison to the alternative drive assembly 532*a*. FIG. 18D includes a respective curve for the drive assembly 532*a* during a dispense cycle similar to that described above with respect to the drive assembly 732, showing the normalized rate of translation of the actuator 530 as a function of time. As shown, the varying rate of translation provided by the drive assembly 732 may follow a non-sinusoidal waveform, and the varying rate of translation provided by the drive assembly 532*a* may follow a sinusoidal waveform. In one example, according to the illustrated embodiments, for the drive assembly 732, a peak torque may be required from the motor 734 when the drive assembly 732 is mid-way between the first state and the second state of the dispense cycle, at 0.3 seconds into the dispense cycle, and for the drive assembly 532*a*, a peak torque may be required from the motor 534 at 0.25 seconds into the dispense cycle. As shown, the peak motor torque for the drive assembly 732 may be less than the peak motor torque for the drive assembly 532*a* due to the lesser rate of translation of the actuator 730, 530 at these respective times of the dispense cycles. As shown in FIG. 18D, the drive assembly 732 may result in a dispense cycle in which the pump 508 is compressed (i.e., the actuator 730 is moved from the first position toward the second position) for a first period of time, the pump 508 is extended (i.e., the actuator 730 is moved from the second position toward the first position) for a second period of time, with the first period of time being greater than the second period of time. In other words, the drive assembly 732 may be configured to cause the actuator 730 to move from the first position toward the second position for a majority (i.e., greater than 50%) of the dispense cycle. For example, according to the illustrated embodiment, the drive assembly 732 may result in a dispense cycle in which the pump 508 is compressed for 0.6 seconds (during 216 degrees of rotation of the crank 748), and the pump 508 is extended for 0.4 seconds (during 144 degrees of rotation of the crank 748). In this manner, the drive assembly 732 may provide an increased mechanical advantage over a longer period of time during the compression portion of the dispense cycle than the extension portion of the dispense cycle. As described above, an increased mechanical advantage may be advantageous when the pump 508 is being compressed, and a decreased mechanical advantage may be acceptable when the pump 508 is being extended. In contrast, the drive assembly 532*a* may result in a dispense cycle in which the pump 508 is compressed for a first period of time, the pump 508 is extended for a second period of time, with the first period of time being equal to the second period of time. For example, according to the illustrated embodiment, the drive assembly 532*a* may result in a dispense cycle in which the pump 508 is compressed for 0.5 seconds, and the pump 508 is extended for 0.5 seconds. In this manner, as compared to the drive assembly 532*a*, the drive assembly 732 may be configured to overcome the greater resistance forces during the compression portion of the dispense cycle over a longer period of time. In other words, the drive assembly 732 may be configured to achieve the same amount of work over a longer period of time, thereby reducing the peak torque required from the motor 734. As a result of the compression portion of the dispense cycle for the drive assembly 732 being approximately 17% longer than the compression portion of the dispense cycle for the drive assembly 532*a*, the peak motor torque for the drive assembly 732 may be approximately 17% less than the peak motor torque for the drive assembly 532*a*. The reduced peak motor torque for the drive assembly 732 advantageously may allow the drive assembly 732 to be driven by a smaller sized motor as compared to the drive assembly 532*a*, which may allow the overall dispenser 500 to be smaller and manufactured at a lower cost. Additionally, the reduced peak motor torque for the drive assembly 732 may reduce wear on the batteries powering the motor 734, extend battery life, and allow the batteries to be useful at lower voltages. Further, the reduced peak motor torque for the drive assembly 732 may improve reliability of the dispenser 500, reducing incidence of partial or incomplete dispense cycles.

FIG. 18D also shows the respective curve for a drive assembly 732*a* that is the same as the drive assembly 732 except for the gear train 746. In particular, the drive assembly 732*a* may include a gear train 746*a* having faster gears. As a result, the drive assembly 732 may result in a dispense cycle in which the pump 508 is compressed for the same amount of time as achieved using the drive assembly 532*a*, and the pump 508 is extended for a shorter amount of time as achieved using the drive assembly 532*a*. In this manner, the drive assembly 732*a* may allow a dispense cycle to be carried out in less time, without compromising reliability of flowable material dispensing provided during the compression portion of the dispense cycle.

It will be appreciated that the actuator 730 and the drive assembly 732 described above and shown in FIGS. 18A-18C relate to only certain embodiments of the automated dispensing mechanism 728 and that other embodiments may be used. In certain embodiments, the linkage 744 may include a different number of links configured to control translation of the actuator 730. For example, the linkage 744 may include four, five, six, or more than six links. In certain embodiments, the linkage 744 may include two or more links that are coupled to one another and configured to move in a non-pivotal manner. For example, the linkage 744 may include two or more links that are slidably coupled to one another. In certain embodiments, the components of the linkage 744 may have different shapes, arrangements, and/or connections to one another. In certain embodiments, the shape of the slot 754 may be non-linear. For example, the slot 754 may have a curved shape or may be contoured in an irregular manner. In certain embodiments in which the pin 742 is a part of the actuator 730, the pin 742 may be able to move relative to the actuator 730. For example, the pin 742 may include a bearing configured to rotate relative to wall of the actuator 730. In certain embodiments in which the pin 742 is a part of the rocker 750 or other component of the linkage 744, the pin 742 may be able to move relative to the body of the rocker 750 or other component. For example, the pin 742 may include a bearing configured to rotate relative to the actuator 730 body of the rocker 750 or other component. In certain embodiments, the actuator 730 may be movably coupled to the chassis housing 524 or the dispenser housing 516 by a mechanism other than the linkage 744.

Although the actuator 730 and the drive assembly 732 may be described above as being used in combination with the motor 734 as a part of the automated dispensing mechanism 728, it will be appreciated that the actuator 730 and the drive assembly 732 alternatively may be used without the motor 734 as a part of a mechanical (i.e., manual) dispensing mechanism to provide similar advantages. In other words, in certain embodiments, the dispenser 500 may be a mechanical (i.e., manual) dispenser that requires a user to manually impart a driving force to the dispenser 500 in order to carry out a dispense cycle. For example, the dispenser 500 may include a drive member that is coupled to and configured to drive the drive assembly 732 for carrying out a dispense cycle. In various embodiments, the drive member may include a handle, a lever, a button, a knob, or other member that may be moved by the user to drive the drive assembly 732. As described above, the actuator 730 and the drive assembly 732 may be configured to minimize a peak torque required during a dispense cycle. Accordingly, in embodiments in which the dispenser 500 is a mechanical dispenser, the actuator 730 and the drive assembly 732 may minimize a peak torque generated by the user during a dispense cycle.

Although the automated dispensing mechanisms 528, 628, 728 may be described above as being alternative mechanisms for actuating the pump 508 of the dispenser, in certain embodiments, aspects of two or more of the automated dispensing mechanisms 528, 628, 728 may be combined for managing and further optimizing motor torque required during a dispense cycle. For example, in certain embodiments, an automated dispensing mechanism may include non-circular gears, similar to the fifth gear 560 and the sixth gear 562, a drive body having multiple lobes, similar to the lobes 651, 652, and an actuator having multiple slots, similar to the slots 641, 642, for interacting with the lobes. In certain embodiments, an automated dispensing mechanism may include non-circular gears, similar to the fifth gear 560 and the sixth gear 562, and a linkage, similar to the linkage 744, for interacting with an actuator via a pin and slot arrangement, similar to the pin 742 and the slot 754. In certain embodiments, an automated dispensing mechanism may include a linkage, similar to the linkage 744, a drive body having multiple lobes, similar to the lobes 651, 652, and an actuator having multiple slots, similar to the slots 641, 642, for interacting with the lobes. Still other configurations of an automated dispensing mechanism may be used, which may include aspects from two or more of the automated dispensing mechanisms 528, 628, 728 described above to manage and optimize motor torque required during a dispense cycle.

Although certain embodiments of the disclosure are described herein and shown in the accompanying drawings, one of ordinary skill in the art will recognize that numerous modifications and alternative embodiments are within the scope of the disclosure. Moreover, although certain embodiments of the disclosure are described herein with respect to specific exemplary hands-free sheet product dispenser configurations, it will be appreciated that numerous other hands-free sheet product dispenser configurations are within the scope of the disclosure. Conditional language used herein, such as "can," "could," "might," or "may," unless specifically stated otherwise, or otherwise understood within the context as used, generally is intended to convey that certain embodiments could include, while other embodiments do not include, certain features, elements, or functional capabilities. Thus, such conditional language generally is not intended to imply that certain features, elements, or functional capabilities are in any way required for one or more embodiments.

I claim:

1. A flowable material dispenser for dispensing flowable material from a container having a reservoir and a pump, the dispenser comprising:

a housing configured to receive the container therein;

an actuator disposed within the housing and configured to translate relative to the housing between a first position and a second position during a dispense cycle, wherein the actuator is configured to move the pump to dispense the flowable material as the actuator translates between the first position and the second position during the dispense cycle;

a motor disposed within the housing; and a drive assembly coupled to the actuator and the motor, wherein the drive assembly is configured to translate the actuator between the first position and the second position at a varying rate of translation during the dispense cycle, and wherein the varying rate of translation varies relative to a rate of rotation of the motor and follows a non-sinusoidal waveform.

2. The flowable material dispenser of claim 1, wherein the actuator is configured to translate in a vertical direction relative to the housing.

3. The flowable material dispenser of claim 1, wherein the drive assembly is configured to translate the actuator in a first direction from the first position to the second position during a first portion of the dispense cycle, and wherein the drive assembly is configured to translate the actuator in an opposite second direction from the second position to the first position during a second portion of the dispense cycle.

4. The flowable material dispenser of claim 3, wherein the varying rate of translation increases during part of the first portion of the dispense cycle and decreases during part of the first portion of the dispense cycle, and wherein the varying rate of translation increases during part of the second portion of the dispense cycle and decreases during part of the second portion of the dispense cycle.

5. The flowable material dispenser of claim 1, wherein:

the actuator comprises:

a pump interface configured to engage a portion of the pump; and a slot defined therein; and the drive assembly comprises:

a drive body configured to rotate relative to the housing about a rotational axis, wherein the drive body comprises a lobe offset from the rotational axis and movably disposed within the slot; and a gear train coupled to the motor and the drive body, wherein the gear train is configured to rotate the drive body about the rotational axis.

6. The flowable material dispenser of claim 5, wherein the gear train comprises:

a non-circular gear coupled to the drive body and configured to rotate therewith about the rotational axis; and a non-circular pinion engaging the non-circular gear and configured to rotate the non-circular gear about the rotational axis;

wherein a minimum radius of the non-circular pinion engages a maximum radius of the non-circular gear during a first portion of the dispense cycle in which the actuator moves the pump between an extended configuration and a compressed configuration; and wherein a maximum radius of the non-circular pinion engages a minimum radius of the non-circular gear during a second portion of the dispense cycle in which the pump is in the compressed configuration or the extended configuration.

7. The flowable material dispenser of claim 6, wherein:

the non-circular gear comprises:

a first level of gear teeth having the maximum radius of the non-circular gear along a portion thereof, wherein the first level of gear teeth comprises a first set of first-level gear teeth and a second set of first-level gear teeth circumferentially spaced apart from one another; and a second level of gear teeth having the minimum radius of the non-circular gear along a portion thereof, wherein the second level of gear teeth comprises a first set of second-level gear teeth and a second set of second-level gear teeth circumferentially spaced apart from one another; and the non-circular pinion comprises:

a first level of pinion teeth having the minimum radius of the non-circular pinion along a portion thereof; and a second level of pinion teeth having the maximum radius of the non-circular pinion along a portion thereof.

8. The flowable material dispenser of claim 1, wherein:

the actuator comprises:

a pump interface configured to engage a portion of the pump;

a first slot defined therein; and a second slot defined therein; and the drive assembly comprises:

a drive body configured to rotate relative to the housing about a rotational axis, wherein the drive body comprises:

a first lobe offset from the rotational axis and configured to move through the first slot; and a second lobe offset from the rotational axis and movably disposed within the second slot; and a gear train coupled to the motor and the drive body, wherein the gear train is configured to rotate the drive body about the rotational axis.

9. The flowable material dispenser of claim 8, wherein:

the first lobe is offset from the rotational axis by a first distance;

the second lobe is offset from the rotational axis by a second distance; and the first distance is greater than the second distance.

10. The flowable material dispenser of claim 8, wherein the first lobe is configured to engage the first slot and control translation of the actuator between the first position and the second position during a first portion of the dispense cycle, and wherein the second lobe is configured to engage the second slot and control translation of the actuator between the first position and the second position during a second portion of the dispense cycle.

11. The flowable material dispenser of claim 1, wherein:

the actuator comprises a pump interface configured to engage a portion of the pump; and the drive assembly comprises:

a rocker pivotally attached to the housing and coupled to the actuator by a pin and a slot;

a floater link pivotally attached to the rocker;

a crank pivotally attached to the floater link and configured to rotate relative to the housing about a rotational axis; and a gear train coupled to the motor and the crank, wherein the gear train is configured to rotate the crank about the rotational axis.

12. The flowable material dispenser of claim 11, wherein the drive assembly is configured to translate the actuator from the first position to the second position during a first portion of the dispense cycle in which the actuator moves the pump from an extended configuration to a compressed configuration, wherein the drive assembly is configured to translate the actuator from the second position to the first position during a second portion of the dispense cycle in which the actuator moves the pump from the compressed configuration to the extended configuration, and wherein a duration of the first portion of the dispense cycle is greater than a duration of the second portion of the dispense cycle.

13. A method of dispensing flowable material from a container using a flowable material dispenser, the method comprising:

providing the flowable material dispenser comprising:

a housing;

an actuator disposed within the housing and configured to translate relative to the housing between a first position and a second position;

a motor disposed within the housing; and a drive assembly coupled to the actuator and the motor;

receiving the container within the housing, the container comprising:

a reservoir containing the flowable material therein; and a pump attached to the reservoir and configured to move between a first configuration and a second configuration; and translating the actuator between the first position and the second position during a dispense cycle such that the actuator moves the pump between the first configuration and the second configuration to dispense the flowable material, wherein the drive assembly translates the actuator between the first position and the second position at a varying rate of translation during the dispense cycle, and wherein the varying rate of translation varies relative to a rate of rotation of the motor and follows a non-sinusoidal waveform.

14. The method of claim 13, wherein translating the actuator between the first position and the second position comprises:

translating the actuator in a first direction from the first position to the second position during a first portion of the dispense cycle such that the actuator moves the pump from the first configuration to the second configuration; and translating the actuator in an opposite second direction from the second position to the first position during a second portion of the dispense cycle such that the actuator moves the pump from the second configuration to the first configuration.

15. The method of claim 14, wherein translating the actuator between the first position and the second position comprises:

increasing the varying rate of translation during part of the first portion of the dispense cycle;

decreasing the varying rate of translation during part of the first portion of the dispense cycle;

increasing the varying rate of translation during part of the second portion of the dispense cycle; and decreasing the varying rate of translation during part of the second portion of the dispense cycle.

16. The method of claim 13, wherein translating the actuator between the first position and the second position comprises:

providing, via the drive assembly, a first mechanical advantage during a first portion of the dispense cycle; and providing, via the drive assembly, a second mechanical advantage during a second portion of the dispense cycle, wherein the second mechanical advantage is greater than the first mechanical advantage.

17. A flowable material dispensing system for dispensing flowable material, the system comprising:

a container comprising:

a reservoir containing the flowable material therein; and a pump attached to the reservoir and configured to move between a first configuration and a second configuration; and a flowable material dispenser comprising:

a housing receiving the container therein;

an actuator disposed within the housing and configured to translate relative to the housing between a first position and a second position during a dispense cycle, wherein the actuator is configured to move the pump between the first configuration and the second configuration to dispense the flowable material as the actuator translates between the first position and the second position during the dispense cycle;

a motor disposed within the housing; and a drive assembly coupled to the actuator and the motor, wherein the drive assembly is configured to translate the actuator between the first position and the second position at a varying rate of translation during the dispense cycle, and wherein the varying rate of translation varies relative to a rate of rotation of the motor and follows a non-sinusoidal waveform.

18. The flowable material dispensing system of claim 17, wherein the drive assembly is configured to translate the actuator in a first direction from the first position to the second position during a first portion of the dispense cycle such that the actuator moves the pump from the first configuration to the second configuration, and wherein the drive assembly is configured to translate the actuator in an opposite second direction from the second position to the first position during a second portion of the dispense cycle such that the actuator moves the pump from the second configuration to the first configuration.

19. The flowable material dispensing system of claim 18, wherein the varying rate of translation increases during part of the first portion of the dispense cycle and decreases during part of the first portion of the dispense cycle, and wherein the varying rate of translation increases during part of the second portion of the dispense cycle and decreases during part of the second portion of the dispense cycle.

20. The flowable material dispensing system of claim 17, wherein the drive assembly is configured to provide a first mechanical advantage during a first portion of the dispense cycle, wherein the drive assembly is configured to provide a second mechanical advantage during a second portion of the dispense cycle, and wherein the second mechanical advantage is greater than the first mechanical advantage.

21. The flowable material dispensing system of claim 17, wherein the first configuration is an extended configuration and the second configuration is a compressed configuration.

* * * * *